US007997355B2

(12) United States Patent
Vuyk, Jr. et al.

(10) Patent No.: US 7,997,355 B2
(45) Date of Patent: Aug. 16, 2011

(54) APPARATUS FOR INJECTING IMPACTORS INTO A FLUID STREAM USING A SCREW EXTRUDER

(75) Inventors: Adrian Vuyk, Jr., Houston, TX (US); Jim B. Terry, Houston, TX (US); Gordon Allen Tibbitts, Murray, UT (US); Nathan J. Harder, Magnolia, TX (US); Gregory G. Galloway, Conroe, TX (US)

(73) Assignee: PDTI Holdings, LLC, Houston, TX (US)

( * ) Notice: Subject to any disclaimer, the term of this patent is extended or adjusted under 35 U.S.C. 154(b) by 487 days.

(21) Appl. No.: 11/773,355

(22) Filed: Jul. 3, 2007

(65) Prior Publication Data

US 2009/0200084 A1 Aug. 13, 2009

Related U.S. Application Data

(63) Continuation-in-part of application No. 10/897,196, filed on Jul. 22, 2004, now Pat. No. 7,503,407.

(60) Provisional application No. 60/818,480, filed on Jul. 3, 2006, provisional application No. 60/899,135, filed on Feb. 2, 2007.

(51) Int. Cl.
*E21B 21/01* (2006.01)

(52) U.S. Cl. ..... 175/206; 175/207; 175/54; 166/75.15; 222/412

(58) Field of Classification Search ..... 175/206, 175/207, 54; 166/75.15; 222/412, 413; 141/DIG. 1
See application file for complete search history.

(56) References Cited

U.S. PATENT DOCUMENTS

| | | | |
|---|---|---|---|
| 2,626,779 | A | 1/1953 | Armentrout |
| 2,724,574 | A | 11/1955 | Ledgerwood, Jr. |
| 2,727,727 | A | 12/1955 | Williams |
| 2,728,557 | A | 12/1955 | McNatt |
| 2,761,651 | A | 9/1956 | Ledgerwood, Jr. |
| 2,771,141 | A | 11/1956 | Lewis |
| 2,779,571 | A | 1/1957 | Ortloff |
| 2,807,442 | A | 9/1957 | Ledgerwood, Jr. |
| 2,809,013 | A | 10/1957 | Ledgerwood, Jr. et al. |
| 2,815,931 | A | 12/1957 | Williams |

(Continued)

FOREIGN PATENT DOCUMENTS

CA 2522568 A1 11/2004

(Continued)

OTHER PUBLICATIONS

U.S. Appl. No. 11/801,268, filed May 9, 2007, Tibbitts, co-pending application.

(Continued)

*Primary Examiner* — William P Neuder
*Assistant Examiner* — Nicole A Coy
(74) *Attorney, Agent, or Firm* — Vedder Price P.C.

(57) ABSTRACT

An injection system and method is described. In several exemplary embodiments, the injection system and method may be a part of, and/or used with, a system and method for excavating a subterranean formation. In at least one example, an apparatus is provided that includes a source of impactors comprising at least some ferritic material capable of influence by magnetic fields. An injector is coupled to the source and includes a screw extruder, a screw positioned within a barrel, and at least one magnetic circuit is positioned outside of the barrel.

1 Claim, 45 Drawing Sheets

U.S. PATENT DOCUMENTS 2,841,365 A 7/1958 Ramsey et al.
2,868,509 A 1/1959 Williams
2,954,122 A 9/1960 Colburn
3,001,652 A 9/1961 Schroder et al.
3,055,442 A 9/1962 Prince
3,084,752 A 4/1963 Tirapolsky
3,093,420 A 6/1963 Levene at al.
3,112,800 A 12/1963 Bobo
3,123,159 A 3/1964 Buck
3,132,852 A 5/1964 Dolbear
3,322,214 A 5/1967 Buck
3,374,341 A 3/1968 Klotz
3,380,475 A 4/1968 Armstrong
3,385,386 A 5/1968 Goodwin et al.
3,389,759 A 6/1968 Mori et al.
3,416,614 A 12/1968 Goodwin et al.
3,424,255 A 1/1969 Mori et al.
3,469,642 A 9/1969 Goodwin et al.
3,542,142 A 11/1970 Hasiba et al.
3,548,959 A 12/1970 Hasiba et al.
3,576,221 A 4/1971 Hasiba
3,645,346 A 2/1972 Miller et al.
3,667,557 A 6/1972 Todd et al.
3,688,852 A 9/1972 Gaylord et al.
3,688,859 A 9/1972 Maurer
3,704,966 A 12/1972 Beck, Jr.
3,831,753 A 8/1974 Gaylord et al.
3,838,742 A 10/1974 Juvkam-Wold
3,852,200 A 12/1974 Meyer
3,865,202 A 2/1975 Takahashi et al.
3,924,698 A 12/1975 Juvkam-Wold
4,042,048 A 8/1977 Schwabe
4,067,617 A 1/1978 Bunnelle
4,141,592 A 2/1979 Lavon
4,266,621 A 5/1981 Brock
4,304,609 A 12/1981 Morris
4,361,193 A 11/1982 Gravley
4,391,339 A 7/1983 Johnson, Jr. et al.
4,444,277 A 4/1984 Lewis
4,476,027 A 10/1984 Fox
4,490,078 A 12/1984 Armstrong
4,492,276 A 1/1985 Kamp
4,497,598 A 2/1985 Blanton
4,498,987 A * 2/1985 Inaba ..... 210/222
4,534,427 A 8/1985 Wang et al.
4,624,327 A 11/1986 Reichman
4,627,502 A 12/1986 Dismukes
4,681,264 A 7/1987 Johnson
4,699,548 A 10/1987 Bergstrom
4,768,709 A 9/1988 Yie
4,809,791 A 3/1989 Hayatdavoudi
4,825,963 A 5/1989 Ruhle
4,840,292 A * 6/1989 Harvey ..... 222/1
4,852,668 A 8/1989 Dickinson, III et al.
4,944,347 A * 7/1990 Richard et al. ..... 166/278
5,199,512 A 4/1993 Curlett
5,291,957 A 3/1994 Curlett
5,355,967 A 10/1994 Mueller et al.
5,421,420 A 6/1995 Malone et al.
5,542,486 A 8/1996 Curlett
5,718,298 A 2/1998 Rusnak
5,862,871 A 1/1999 Curlett
5,881,830 A 3/1999 Cooley
5,897,062 A 4/1999 Enomoto et al.
5,944,123 A 8/1999 Johnson
6,003,623 A 12/1999 Miess
6,142,248 A 11/2000 Thigpen et al.
6,152,356 A 11/2000 Minden
6,345,672 B1 2/2002 Dietzen
6,347,675 B1 2/2002 Kolle
6,386,300 B1 5/2002 Curlett et al.
6,474,418 B2 11/2002 Miramon
6,506,310 B2 1/2003 Kulbeth
6,530,437 B2 3/2003 Maurer et al.
6,533,946 B2 3/2003 Pullman
6,571,700 B2 6/2003 Nakamura et al.
6,581,700 B2 6/2003 Curlett et al.
6,601,650 B2 8/2003 Sunararajan
6,651,822 B2 11/2003 Alanis
6,904,982 B2 6/2005 Judge et al.
6,920,945 B1 7/2005 Belew et al.
7,090,017 B2 8/2006 Justus et al.
7,172,038 B2 2/2007 Terry et al.
7,258,176 B2 8/2007 Tibbitts et al.
7,343,987 B2 3/2008 Tibbitts
7,383,896 B2 6/2008 Tibbitts
7,398,838 B2 7/2008 Harder
7,398,839 B2 7/2008 Harder et al.
7,503,407 B2 3/2009 Tibbitts
2002/0011338 A1 1/2002 Maurer et al.
2002/0134550 A1 9/2002 Leeson et al.
2006/0016622 A1 1/2006 Tibbitts
2006/0016624 A1 1/2006 Tibbitts
2006/0021798 A1 2/2006 Tibbitts
2006/0027398 A1 2/2006 Tibbitts et al.
2006/0124304 A1 6/2006 Leeson et al.
2006/0191718 A1 7/2006 Tibbitts
2006/0011386 A1 8/2006 Harder et al.
2006/0180350 A1 8/2006 Harder
2006/0191717 A1 8/2006 Harder et al.
2008/0017417 A1 1/2008 Tibbits
2008/0156545 A1 7/2008 Tibbitts
2008/0210472 A1 9/2008 Tibbitts
2008/0230275 A1 9/2008 Harder
2009/0038856 A1 2/2009 Vuyk
2009/0200080 A1 8/2009 Tibbitts
2009/0200084 A1 8/2009 Vuyk
2009/0205871 A1 8/2009 Tibbitts
2009/0223718 A1 9/2009 Tibbitts

FOREIGN PATENT DOCUMENTS

CA 2588170 A1 5/2007
EP 0192016 A1 8/1986
GB 2385346 A 8/2003
GB 2385346 B 9/2004
IQ 20055376 11/2005
WO 0225053 A1 3/2002
WO WO 02/25053 A1 3/2002
WO 0234653 A 5/2002
WO 0292956 A 11/2002
WO WO 2004/094734 A2 11/2004
WO WO 2004/106693 12/2004
WO 2006019977 2/2006
WO 2009009792 1/2009
WO 2009049076 A1 4/2009
WO 2009065107 A1 5/2009
WO 2009099945 A2 8/2009

OTHER PUBLICATIONS

U.S. Appl. No. 11/344,805, filed Feb. 1, 2006, Tibbitts, co-pending application.
U.S. Appl. No. 12/388,289, filed Feb. 19, 2009, Tibbitts, co-pending application.
U.S. Appl. No. 12/271,514, filed Nov. 14, 2008, Tibbitts, co-pending application.
U.S. Appl. No. 12/363,022, filed Jan. 20, 2008, Tibbitts, co-pending application.
U.S. Appl. No. 12/248,649, filed Oct. 9, 2008, Vuyk, Jr., co-pending application.
U.S. Appl. No. 12/363,119, filed Jan. 30, 2009, Tibbitts, co-pending application.
U.S. Appl. No. 12/120,763, filed May 15, 2008, Tibbitts, co-pending application.
U.S. Appl. No. 12/122,374, filed May 16, 2008, Harder, co-pending application.
U.S. Appl. No. 12/033,829, filed Feb. 19, 2008, Tibbitts, co-pending application.
U.S. Appl. No. 12/172,760, filed Jul. 14, 2008, Vuyk, Jr., co-pending application.
Behavior of Suspensions and Emulsion in Drilling Fluids, Nordic Rheology Society, Jun. 14-15, 2007.
Colby, RH., Viscoelasticity of Structured Fluids, Corporate Research Laboratories, Eastman Kodak Company, Rochester, New York.
Rheo-Plex Product Information Seet, Scomi, Oiltools, 2 pages.

Gelplex Product Information Sheet, Miswaco, 2 pages.
Drillplex Product Information Sheet, Miswaco, 2 pages.
Drillplex System Sucessfully Mills Casing Windows Offshore Egypt Performance Report, Miswaco, 2 pages.
Drillplex the Versatile Water-Base System With Exceptional Rheological Properties Designed to Lower Costs in a Wide Range of Wells Product Information Sheet, Miswaco, 6 pages.
International Search Report PCT/US05/25092; Dated Mar. 6, 2006.
Written Opinion PCT/US05/25092; Dated Mar. 6, 2006.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Jan. 12, 2010 on PCT/US08/69972, 5 pages.
International Preliminary Report on Patentability dated Nov. 19, 2009 on PCT/US08/05955, 5 pages.
Co-pending U.S. Appl. No. 10/558,181, filed Nov. 22, 2005, Titled "System for Cutting Earthen Formations".
Co-pending U.S. Appl. No. 10/825,338, filed Apr. 15, 2004, Titled "Drill Bit".
Co-pending U.S. Appl. No. 10/897,196, filed Jul. 22, 2004, Titled "Impact Excavation System and Method".
Co-pending U.S. Appl. No. 11/204,436, filed Aug. 16, 2005, Titled "Internal Subs with Flow Control of Shot".
Co-pending U.S. Appl. No. 11/204,442, filed Aug. 16, 2005, Titled "Impact Excavation System and Method with Particle Trap".
Co-pending U.S. Appl. No. 11/204,722, filed Aug. 16, 2005, Titled "Shot Trap".
Co-pending U.S. Appl. No. 11/204,862, filed Aug. 16, 2005, Titled "PID Nozzles".
Co-pending U.S. Appl. No. 11/204,981, filed Aug. 16, 2005, Titled "Injector Systems".
Co-pending U.S. Appl. No. 11/205,006, filed Aug. 16, 2005, "Secondary Types of Educators".
Anderson, Arthur, "Global E&P Trends," Jul. 1999.
Cohen et al., "High-Pressure Jet Kerf Drilling Shows Significant Potential to Increase ROP," SPE 96557, Oct. 2005, 1-8.
Maurer et al., Deep Drilling Basic Research Final Report, Jun. 1990.
Eckel et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling," Journal of Petroleum Technology, Aug. 1981, 1379-1388.
Galecki et al., "Steel Shot Entrained Ultra High Pressure Waterjet for Cutting and Drilling in Hard Rocks," 371-388.
Killalea, Mike, "High Pressure Drilling System Triples ROPS, Stymies Bit Wear," Drilling, Mar./Apr. 1989, 10-12.
Kolle et al., "Laboratory and Field Testing of an Ultra-High Pressure, Jet-Assisted Drilling System," SPE/IADC 22000, 1991, 847-856.
Ledgerwood, L., "Efforts to Develop Improved Oilwell Drilling Methods," Petroleum Transactions, Aime, 1960, 61-74, vol. 219.
Maurer, William, "Advanced Drilling Techniques," Chapter 5, 19-27, Petroleum Publishing Co., Tulsa, OK., 1980.
Maurer, William, "Impact Crater Formation in Rock," Journal of Applied Physics, Jul. 1960, 1247-1252, vol. 31, No. 7.
Peterson et al., "A New Look at Bit-Flushing or the Importance of the Crushed Zone in Rock Drilling and Cutting"; undated.
Review of Mechanical Bit/Rock Interactions, vol. 3, 3-1-3-68.
Ripkin et al., "A Study of the Fragmentation of Rock by Impingement with Water and Solid Impactors," University of Minnesota St. Anthony Falls Hydraulic Laboratory, Feb. 1972.
Security DBS, 1995.
Singh, Madan "Rock Breakage by Pellet Impact," IIT Research Institute, Dec. 24, 1969.
Summers et al., "A Further Investigation of DIAjet Cutting," Jet Cutting Technology-Proceedings of the 10$^{th}$ International Conference, 1991, pp. 181-192; Elsevier Science Publishers Ltd, USA.
Summers, David, "Waterjetting Technology," Abrasive Waterjet Drilling, 557-598.
Veenhuizen, et al. "Ultra-High Pressure Jet Assist of Mechanical Drilling," SPE/IADC 37579, 79-90, 1997.
Curlett Family Limited Partnership, Ltd., Plaintiff V. Particle Drilling Technologies, Inc., a Delaware Corporation; and Particle Drilling Technologies, Inc., a Nevada Corporation Defendant; Civil Action No. 4:06-CV-01012; Affidavit of Harry (Hal) B. Curlett, May 3, 2006.
Geddes et al., "Leveraging a New Energy Source to Enhance Heavy-Oil and Oil-Sands Production," Society of Petroleum Engineers, SPE/PS-CIM/CHOA 97781, 2005.
www.particledrilling.com, May 4, 2006.
Examination Report dated May 8, 2007 on GCC Patent No. GCC/P/2004/3505.
International Search Report PCT/US04/11578; Dated Dec. 28, 2004.
International Preliminary Report of Patentability PCT/US04/11578; Dated Oct. 21, 2005.
Written Opinion PCT/US04/11578; Dated Dec. 28, 2004.

* cited by examiner

| OPERATION OF INJECTOR VESSELS | | | |
|---|---|---|---|
| TIME PERIOD | INJECTOR VESSEL 324 | INJECTOR VESSEL 350 | INJECTOR VESSEL 374 |
| TIME 1 | CHARGING | | |
| TIME 2 | PRESSURIZING | CHARGING | |
| TIME 3 | INJECTING | PRESSURIZING | CHARGING |
| TIME 4 | CHARGING | INJECTING | PRESSURIZING |
| TIME 5 | PRESSURIZING | CHARGING | INJECTING |
| TIME 6 | INJECTING | PRESSURIZING | CHARGING |
| TIME 7 | CHARGING | INJECTING | PRESSURIZING |
| TIME 8 | PRESSURIZING | CHARGING | INJECTING |
| | ⋮ | ⋮ | ⋮ |

*Fig. 22*

| SAMPLE NUMBER | LENGTH, cm | DIAMETER, cm | PERMEABILITY TO OIL, millidarcys |
|---|---|---|---|
| 1A | 5.39 | 3.94 | 31800.00 |
| 1B | 5.19 | 3.95 | 31300.00 |
| 1C | 4.49 | 3.97 | 19600.00 |

APPARATUS FOR INJECTING IMPACTORS INTO A FLUID STREAM USING A SCREW EXTRUDER

CROSS-REFERENCE TO RELATED APPLICATIONS

This application claims the benefit of U.S. provisional patent application No. 60/899,135, filed on Feb. 2, 2007; U.S. provisional patent application Ser. No. 60/818,480, filed on Jul. 3, 2006; and pending application Ser. No. 10/897,196, filed on Jul. 22, 2004.

This application is related to U.S. provisional patent application Ser. No. 60/463,903, filed on Apr. 16, 2003; U.S. Pat. No. 6,386,300, issued on May 14, 2002, which was filed as application Ser. No. 09/665,586 on Sep. 19, 2000; U.S. Pat. No. 6,581,700, issued on Jun. 24, 2003, which was filed as application Ser. No. 10/097,038 on Mar. 12, 2002; pending application Ser. No. 11/204,981, filed on Aug. 16, 2005; pending application Ser. No. 11/204,436, filed on Aug. 16, 2005; pending application Ser. No. 11/204,862, filed on Aug. 16, 2005; pending application no. 11/205,006, filed on Aug. 16, 2005; pending application Ser. No. 11/204,772, filed on Aug. 16, 2005; pending application Ser. No. 11/204,442, filed on Aug. 16, 2005; pending application Ser. No. 10/825,338, filed on Apr. 15, 2004; pending application Ser. No. 10/558,181, filed on May 14, 2004; pending application Ser. No. 11/344,805, filed on Feb. 1, 2006; pending application No. 60/746,855, filed on May 9, 2006; the disclosures of which are incorporated herein by reference.

BACKGROUND

This disclosure generally relates to a system and method for injecting particles into a flow region in connection with, for example, excavating a formation. The formation may be excavated in order to, for example, form a wellbore for the purpose of oil and gas recovery, construct a tunnel, or form other excavations in which the formation is cut, milled, pulverized, scraped, sheared, indented, and/or fractured, hereinafter referred to collectively as cutting.

BRIEF DESCRIPTION OF THE DRAWINGS

FIG. 22 is a diagrammatic view depicting the operational steps of one possible mode of operation of the injection system of FIG. 21.

DETAILED DESCRIPTION OF THE ILLUSTRATIVE EMBODIMENTS

Figure 1:
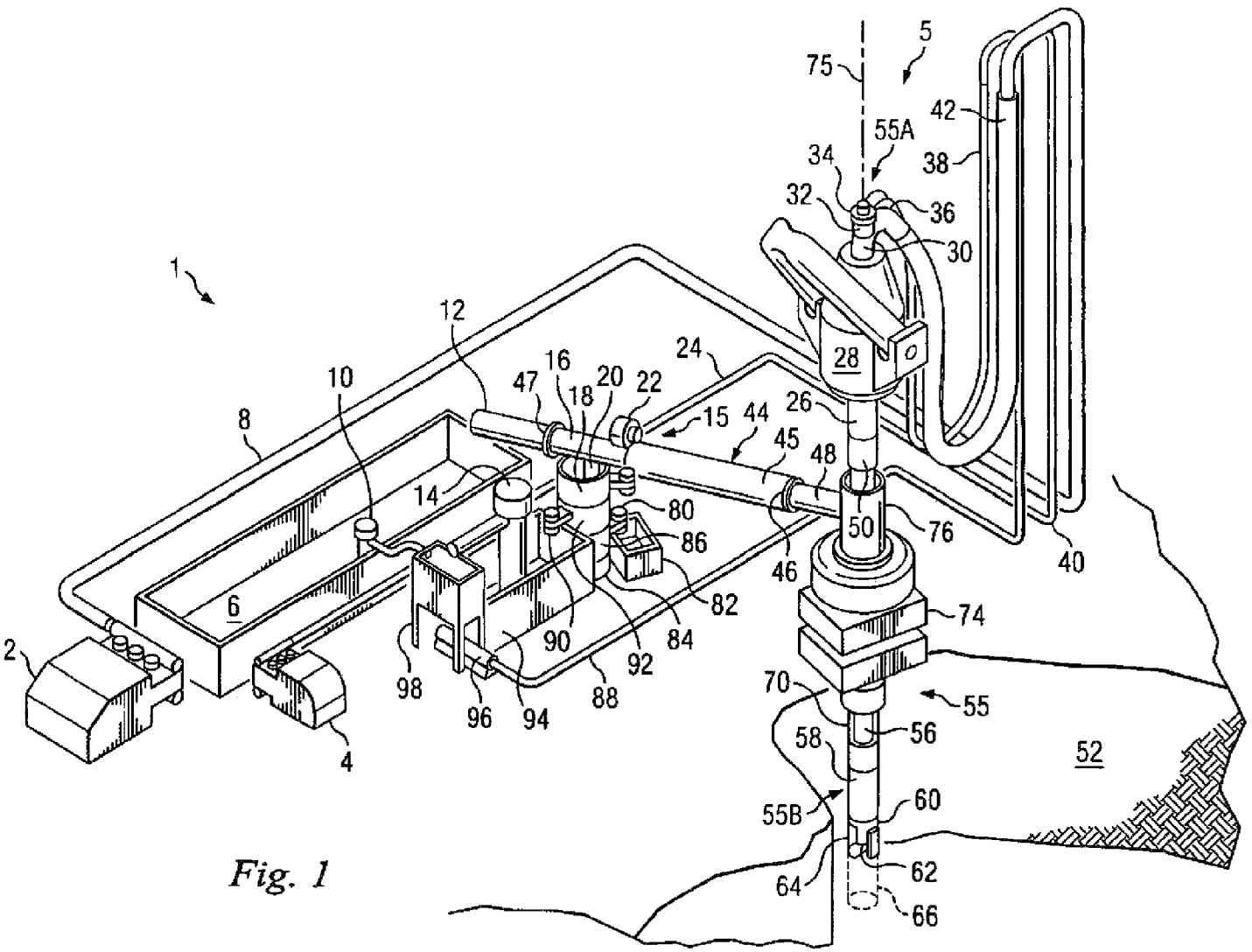
FIG. 1 is an isometric view of an excavation system according to an embodiment.

In the drawings and description that follows, like parts are marked throughout the specification and drawings with the same reference numerals, respectively. The drawings are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Figure 2:
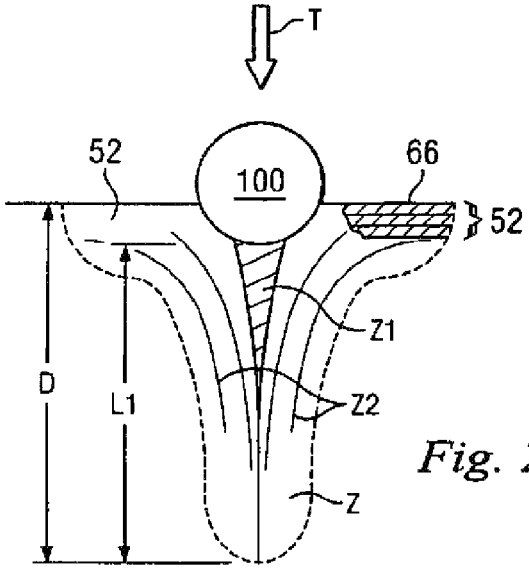
FIG. 2 illustrates an impactor impacted with a formation.

FIGS. 1 and 2 illustrate an embodiment of an excavation system 1 comprising the use of solid material particles, or impactors, 100 to engage and excavate a subterranean formation 52 to create a wellbore 70. The excavation system 1 may comprise a pipe string 55 comprised of collars 58, pipe 56, and a kelly 50. An upper end of the kelly 50 may interconnect with a lower end of a swivel quill 26. An upper end of the swivel quill 26 may be rotatably interconnected with a swivel 28. The swivel 28 may include a top drive assembly (not shown) to rotate the pipe string 55. Alternatively, the excavation system 1 may further comprise a body member such as, for example, a drill bit 60 to cut the formation 52 in cooperation with the solid material impactors 100. The drill bit 60 may be attached to the lower end 55B of the pipe string 55 and may engage a bottom surface 66 of the wellbore 70. The drill bit 60 may be a roller cone bit, a fixed cutter bit, an impact bit, a spade bit, a mill, an impregnated bit, a natural diamond bit, or other suitable implement for cutting rock or earthen formation. Referring to FIG. 1, the pipe string 55 may include a feed, or upper, end 55A located substantially near the excavation rig 5 and a lower end 55B including a nozzle 64 supported thereon. The lower end 55B of the string 55 may include the drill bit 60 supported thereon. The excavation system 1 is not limited to excavating a wellbore 70. The excavation system and method may also be applicable to excavating a tunnel, a pipe chase, a mining operation, or other excavation operation wherein earthen material or formation may be removed.

In another exemplary embodiment, the present system may be used to inject any solid particulate material into a wellbore. Exemplary particles may be magnetic or non-magnetic solid particles. Exemplary uses of the of the present system include, but are not limited to, casing exits, preventing seepage loss, and fracturing a formation.

To excavate the wellbore 70, the swivel 28, the swivel quill 26, the kelly 50, the pipe string 55, and a portion of the drill bit 60, if used, may each include an interior passage that allows circulation fluid to circulate through each of the aforementioned components. The circulation fluid may be withdrawn from a tank 6, pumped by a pump 2, through a through medium pressure capacity line 8, through a medium pressure capacity flexible hose 42, through a gooseneck 36, through the swivel 28, through the swivel quill 26, through the kelly 50, through the pipe string 55, and through the bit 60.

The excavation system 1 further comprises at least one nozzle 64 on the lower 55B of the pipe string 55 for accelerating at least one solid material impactor 100 as they exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. If a drill bit 60 is used, the nozzle or nozzles 64 may be located in the drill bit 60.

The nozzle 64 may alternatively be a conventional dual-discharge nozzle. Such dual discharge nozzles may generate: (1) a radially outer circulation fluid jet substantially encircling a jet axis, and/or (2) an axial circulation fluid jet substantially aligned with and coaxial with the jet axis, with the dual discharge nozzle directing a majority by weight of the plurality of solid material impactors into the axial circulation fluid jet. A dual discharge nozzle 64 may separate a first portion of the circulation fluid flowing through the nozzle 64 into a first circulation fluid stream having a first circulation fluid exit nozzle velocity, and a second portion of the circulation fluid flowing through the nozzle 64 into a second circulation fluid stream having a second circulation fluid exit nozzle velocity lower than the first circulation fluid exit nozzle velocity. The plurality of solid material impactors 100 may be directed into the first circulation fluid stream such that a velocity of the plurality of solid material impactors 100 while exiting the nozzle 64 is substantially greater than a velocity of the circulation fluid while passing through a nominal diameter flow path in the lower end 55B of the pipe string 55, to accelerate the solid material impactors 100.

Each of the individual impactors 100 is structurally independent from the other impactors. For brevity, the plurality of solid material impactors 100 may be interchangeably referred to as simply the impactors 100. The plurality of solid material impactors 100 may be substantially rounded and have either a substantially non-uniform outer diameter or a substantially uniform outer diameter. The solid material impactors 100 may be substantially spherically shaped, non-hollow, formed of rigid metallic material, and having high compressive strength and crush resistance, such as steel shot, ceramics, depleted uranium, and multiple component materials. Although the solid material impactors 100 may be substantially a non-hollow sphere, alternative embodiments may provide for other types of solid material impactors, which may include impactors 100 with a hollow interior. The impactors may be magnetic or non-magnetic. The impactors may be substantially rigid and may possess relatively high compressive strength and resistance to crushing or deformation as compared to physical properties or rock properties of a particular formation or group of formations being penetrated by the wellbore 70.

The impactors may be of a substantially uniform mass, grading, or size. The solid material impactors 100 may have any suitable density for use in the excavation system 1. For example, the solid material impactors 100 may have an average density of at least 470 pounds per cubic foot.

Alternatively, the solid material impactors 100 may include other metallic materials, including tungsten carbide, copper, iron, or various combinations or alloys of these and other metallic compounds. The impactors 100 may also be composed of non-metallic materials, such as ceramics, or other man-made or substantially naturally occurring non-metallic materials. Also, the impactors 100 may be crystalline shaped, angular shaped, sub-angular shaped, selectively shaped, such as like a torpedo, dart, rectangular, or otherwise generally non-spherically shaped.

The impactors 100 may be selectively introduced into a fluid circulation system, such as illustrated in FIG. 1, near an excavation rig 5, circulated with the circulation fluid (or "mud"), and accelerated through at least one nozzle 64. "At the excavation rig" or "near an excavation rig" may also include substantially remote separation, such as a separation process that may be at least partially carried out on the sea floor.

Introducing the impactors 100 into the circulation fluid may be accomplished by any of several known techniques. For example, the impactors 100 may be provided in an impactor storage tank 94 near the rig 5 or in a storage bin 82. A screw elevator 14 may then transfer a portion of the impactors at a selected rate from the storage tank 94, into a slurrification tank 98. A pump 10, such as a progressive cavity pump may transfer a selected portion of the circulation fluid from a mud tank 6, into the slurrification tank 98 to be mixed with the impactors 100 in the tank 98 to form an impactor concentrated slurry. An impactor introducer 96 may be included to pump or introduce a plurality of solid material impactors 100 into the circulation fluid before circulating a plurality of impactors 100 and the circulation fluid to the nozzle 64. The impactor introducer 96 may be a progressive cavity pump capable of pumping the impactor concentrated slurry at a selected rate and pressure through a slurry line 88, through a slurry hose 38, through an impactor slurry injector head 34, and through an injector port 30 located on the gooseneck 36, which may be located atop the swivel 28. The swivel 36, including the through bore for conducting circulation fluid therein, may be substantially supported on the feed, or upper, end of the pipe string 55 for conducting circulation fluid from the gooseneck 36 into the latter end 55*a*. The upper end 55A of the pipe string 55 may also include the kelly 50 to connect the pipe 56 with the swivel quill 26 and/or the swivel 28. The circulation fluid may also be provided with rheological properties sufficient to adequately transport and/or suspend the plurality of solid material impactors 100 within the circulation fluid.

The solid material impactors 100 may also be introduced into the circulation fluid by withdrawing the plurality of solid material impactors 100 from a low pressure impactor source 98 into a high velocity stream of circulation fluid, such as by venturi effect. For example, when introducing impactors 100 into the circulation fluid, the rate of circulation fluid pumped by the mud pump 2 may be reduced to a rate lower than the mud pump 2 is capable of efficiently pumping. In such event, a lower volume mud pump 4 may pump the circulation fluid through a medium pressure capacity line 24 and through the medium pressure capacity flexible hose 40.

The circulation fluid may be circulated from the fluid pump 2 and/or 4, such as a positive displacement type fluid pump, through one or more fluid conduits 8, 24, 40, 42, into the pipe string 55. The circulation fluid may then be circulated through the pipe string 55 and through the nozzle 64. The circulation fluid may be pumped at a selected circulation rate and/or a selected pump pressure to achieve a desired impactor and/or fluid energy at the nozzle 64.

The pump 4 may also serve as a supply pump to drive the introduction of the impactors 100 entrained within an impactor slurry, into the high pressure circulation fluid stream pumped by mud pumps 2 and 4. Pump 4 may pump a percentage of the total rate of fluid being pumped by both pumps 2 and 4, such that the circulation fluid pumped by pump 4 may create a venturi effect and/or vortex within the injector head 34 that inducts the impactor slurry being conducted through the line 42, through the injector head 34, and then into the high pressure circulation fluid stream.

From the swivel 28, the slurry of circulation fluid and impactors may circulate through the interior passage in the pipe string 55 and through the nozzle 64. As described above, the nozzle 64 may alternatively be at least partially located in the drill bit 60. Each nozzle 64 may include a reduced inner diameter as compared to an inner diameter of the interior passage in the pipe string 55 immediately above the nozzle 64. Thereby, each nozzle 64 may accelerate the velocity of the slurry as the slurry passes through the nozzle 64. The nozzle 64 may also direct the slurry into engagement with a selected portion of the bottom surface 66 of wellbore 70. The nozzle 64 may also be rotated relative to the formation 52 depending on the excavation parameters. To rotate the nozzle 64, the entire pipe string 55 may be rotated or only the nozzle 64 on the end of the pipe string 55 may be rotated while the pipe string 55 is not rotated. Rotating the nozzle 64 may also include oscillating the nozzle 64 rotationally back and forth as well as vertically, and may further include rotating the nozzle 64 in discrete increments. The nozzle 64 may also be maintained rotationally substantially stationary.

The circulation fluid may be substantially continuously circulated during excavation operations to circulate at least some of the plurality of solid material impactors 100 and the formation cuttings away from the nozzle 64. The impactors 100 and fluid circulated away from the nozzle 64 may be circulated substantially back to the excavation rig 5, or circulated to a substantially intermediate position between the excavation rig 5 and the nozzle 64.

If the drill bit 60 is used, the drill bit 60 may be rotated relative to the formation 52 and engaged therewith by an axial force (WOB) acting at least partially along the wellbore axis 75 near the drill bit 60. The bit 60 may also comprise a plurality of bit cones 62, which also may rotate relative to the bit 60 to cause bit teeth secured to a respective cone to engage the formation 52, which may generate formation cuttings substantially by crushing, cutting, or pulverizing a portion of the formation 52. The bit 60 may also be comprised of a fixed cutting structure that may be substantially continuously engaged with the formation 52 and create cuttings primarily by shearing and/or axial force concentration to fail the formation, or create cuttings from the formation 52. To rotate the bit 60, the entire pipe string 55 may be rotated or only the bit 60 on the end of the pipe string 55 may be rotated while the pipe string 55 is not rotated. Rotating the drill bit 60 may also include oscillating the drill bit 60 rotationally back and forth as well as vertically, and may further include rotating the drill bit 60 in discrete increments.

Also alternatively, the excavation system 1 may comprise a pump, such as a centrifugal pump, having a resilient lining that is compatible for pumping a solid-material laden slurry. The pump may pressurize the slurry to a pressure greater than the selected mud pump pressure to pump the plurality of solid material impactors 100 into the circulation fluid. The impactors 100 may be introduced through an impactor injection port, such as port 30. Other alternative embodiments for the system 1 may include an impactor injector for introducing the plurality of solid material impactors 100 into the circulation fluid.

As the slurry is pumped through the pipe string 55 and out the nozzles 64, the impactors 100 may engage the formation with sufficient energy to enhance the rate of formation removal or penetration (ROP). The removed portions of the formation may be circulated from within the wellbore 70 near the nozzle 64, and carried suspended in the fluid with at least a portion of the impactors 100, through a wellbore annulus between the OD of the pipe string 55 and the ID of the wellbore 70.

At the excavation rig 5, the returning slurry of circulation fluid, formation fluids (if any), cuttings, and impactors 100 may be diverted at a nipple 76, which may be positioned on a BOP stack 74. The returning slurry may flow from the nipple 76, into a return flow line 15, which maybe comprised of tubes 48, 45, 16, 12 and flanges 46, 47. The return line 15 may include an impactor reclamation tube assembly 44, as illustrated in FIG. 1, which may preliminarily separate a majority of the returning impactors 100 from the remaining components of the returning slurry to salvage the circulation fluid for recirculation into the present wellbore 70 or another wellbore. At least a portion of the impactors 100 may be separated from a portion of the cuttings by a series of screening devices, such as the vibrating classifiers 84, to salvage a reusable portion of the impactors 100 for reuse to re-engage the formation 52. A majority of the cuttings and a majority of non-reusable impactors 100 may also be discarded.

The reclamation tube assembly 44 may operate by rotating tube 45 relative to tube 16. An electric motor assembly 22 may rotate tube 44. The reclamation tube assembly 44 comprises an enlarged tubular 45 section to reduce the return flow slurry velocity and allow the slurry to drop below a terminal velocity of the impactors 100, such that the impactors 100 can no longer be suspended in the circulation fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication with the flow line discharge port 20 to conduct the separated impactors 100 selectively into the vibrating separator 84 or elsewhere in the circulation fluid circulation system.

In an exemplary embodiment, the return flow line 15, which as noted previously may include tubes 48, 45, 16, 12 and flanges 46 and 47, may also include a vibrational source, such as for example, a variable amplitude, variable frequency vibrator. Exemplary vibrational devices include those produced by Eriez Magnetics, such as for example, a variable amplitude, variable frequency vibrator, although similar devices produced by other manufactures may also be used. Employing such a vibrational device may help to prevent solid material impactors, drill cuttings and other particulate materials from forming "beaches" in the return flow line wherein solid masses of particulate material can form stagnate agglomerations. Additionally, the use of vibrational devices may also assist with the process of the return flow line carrying shot and drill cuttings from the annulus of the wellbore to the process equipment. In some exemplary embodiments, a plurality of vibrational devices may be employed in the return flow line(s) to prevent the accumulation of particles.

In another exemplary embodiment, movement of particles in the return flow line may be assisted by the addition of a lubricant. The lubricant can be water, oil, a polymer solution, or any other liquid lubricant, and can be dispersed from a source directly into the slurry flow of drilling fluids and solid material particles and/or particulate material. In an exemplary embodiment, the lubricant may be supplied to the slurry flow through a circumferential passage located, for example, at a flange connection, as described for example in U.S. Pat. No. 5,479,957, the disclosure of which is incorporated by reference in its entirety. An exemplary embodiment includes the Pipeline Lubrication System manufactured by Schwing Bioset, Inc. of Somerset, Wis. Injection of the lubricant can be done upstream of the wellbore, during the addition of the solid material impactors, or downstream of the wellbore, such as for example, in the return flow line. In certain embodiments, the lubricant may be directly added to the drilling fluids. In certain embodiments, the lubricant may be removed from the drilling fluids prior to the drilling fluids being recycled.

The vibrating classifier 84 may comprise a three-screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the circulation fluid. The removed finest grade material may be selectively directed by outlet 80 to storage bin 82, or pumped back into the flow line 15 at a point downstream of discharge port 20. Circulation fluid collected in a lower portion of the classified 84 may be returned to a mud tank 6 for re-use.

The circulation fluid may be recovered for recirculation in a wellbore or the circulation fluid may be a fluid that is substantially not recovered. The circulation fluid may be a liquid, gas, foam, mist, or other substantially continuous or multiphase fluid. For recovery, the circulation fluid and other components entrained within the circulation fluid may be directed across a shale shaker (not shown) or into a mud tank 6, whereby the circulation fluid may be further processed by techniques known in the art for re-circulation into a wellbore.

The excavation system 1 creates a mass-velocity relationship in a plurality of the solid material impactors 100, such that an impactor 100 may have sufficient energy to structurally alter the formation 52 in a zone of a point of impact. The mass-velocity relationship may be satisfied as sufficient when a substantial portion by weight of the solid material impactors 100 may by virtue of their mass and velocity at the exit of the nozzle 64, create a structural alteration as claimed or disclosed herein. Impactor velocity to achieve a desired effect upon a given formation may vary as a function of formation compressive strength, hardness, or other rock properties, and as a function of impactor size and circulation fluid rheological properties. A substantial portion means at least five percent by weight of the plurality of solid material impactors that are introduced into the circulation fluid.

The impactors 100 for a given velocity and mass of a substantial portion by weight of the impactors 100 are subject to the following mass-velocity relationship. The resulting kinetic energy of at least one impactor 100 exiting a nozzle 64 is at least 0.075 Ft.Lbs or has a minimum momentum of 0.0003 Lbf.Sec.

Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger.

The velocity of a substantial portion by weight of the plurality of solid material impactors 100 immediately exiting a nozzle 64 may be as slow as 100 feet per second and as fast as 1000 feet per second, immediately upon exiting the nozzle 64.

The velocity of a majority by weight of the impactors 100 may be substantially the same, or only slightly reduced, at the point of impact of an impactor 100 at the formation surface 66 as compared to when leaving the nozzle 64. Thus, it may be appreciated by those skilled in the art that due to the close proximity of a nozzle 64 to the formation being impacted, the velocity of a majority of impactors 100 exiting a nozzle 64 may be substantially the same as a velocity of an impactor 100 at a point of impact with the formation 52. Therefore, in many practical applications, the above velocity values may be determined or measured at substantially any point along the path between near an exit end of a nozzle 64 and the point of impact, without material deviation from the scope of this disclosure.

In addition to the impactors 100 satisfying the mass-velocity relationship described above, a substantial portion by weight of the solid material impactors 100 have an average mean diameter of between approximately 0.050 to 0.500 of an inch.

To excavate a formation 52, the excavation implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut, or plastically deform a portion of formation 52, force exerted on that portion of the formation 52 typically should exceed the minimum, in-situ stress threshold of the formation 52. When an impactor 100 first initiates contact with a formation, the unit stress exerted upon the initial contact point may be much higher than 10,000 pounds per square inch, and may be well in excess of one million pounds per square inch. The stress applied to the formation 52 during contact is governed by the force the impactor 100 contacts the formation with and the area of contact of the impactor with the formation. The stress is the force divided by the area of contact. The force is governed by Impulse Momentum theory whereby the time at which the contact occurs determines the magnitude of the force applied to the area of contact. In cases where the particle is contacting a relatively hard surface at an elevated velocity, the force of the particle when in contact with the surface is not constant, but is better described as a spike. However, the force need not be limited to any specific amplitude or duration. The magnitude of the spike load can be very large and occur in just a small fraction of the total impact time. If the area of contact is small the unit stress can reach values many times in excess of the in situ failure stress of the rock, thus guaranteeing fracture initiation and propagation and structurally altering the formation 52.

A substantial portion by weight of the solid material impactors 100 may apply at least 5000 pounds per square inch of unit stress to a formation 52 to create the structurally altered zone Z in the formation. The structurally altered zone Z is not limited to any specific shape or size, including depth or width. Further, a substantial portion by weight of the impactors 100 may apply in excess of 20,000 pounds per square inch of unit stress to the formation 52 to create the structurally altered zone Z in the formation. The mass-velocity relationship of a substantial portion by weight of the plurality of solid material impactors 100 may also provide at least 30,000 pounds per square inch of unit stress.

A substantial portion by weight of the solid material impactors 100 may have any appropriate velocity to satisfy the mass-velocity relationship. For example, a substantial portion by weight of the solid material impactors may have a velocity of at least 100 feet per second when exiting the nozzle 64. A substantial portion by weight of the solid material impactors 100 may also have a velocity of at least 100 feet per second and as great as 1200 feet per second when exiting the nozzle 64. A substantial portion by weight of the solid material impactors 100 may also have a velocity of at least 100 feet per second and as great as 750 feet per second when exiting the nozzle 64. A substantial portion by weight of the solid material impactors 100 may also have a velocity of at least 350 feet per second and as great as 500 feet per second when exiting the nozzle 64.

Impactors 100 may be selected based upon physical factors such as size, projected velocity, impactor strength, formation 52 properties and desired impactor concentration in the circulation fluid. Such factors may also include; (a) an expenditure of a selected range of hydraulic horsepower across the one or more nozzles, (b) a selected range of circulation fluid velocities exiting the one or more nozzles or impacting the formation, and (c) a selected range of solid material impactor velocities exiting the one or more nozzles or impacting the formation, (d) one or more rock properties of the formation being excavated, or (e), any combination thereof.

If an impactor 100 is of a specific shape such as that of a dart, a tapered conic, a rhombic, an octahedral, or similar oblong shape, a reduced impact area to impactor mass ratio may be achieved. The shape of a substantial portion by weight of the impactors 100 may be altered, so long as the mass-velocity relationship remains sufficient to create a claimed structural alteration in the formation and an impactor 100 does not have any one length or diameter dimension greater than approximately 0.100 inches. Thereby, a velocity required to achieve a specific structural alteration may be reduced as compared to achieving a similar structural alteration by impactor shapes having a higher impact area to mass ratio. Shaped impactors 100 may be formed to substantially align themselves along a flow path, which may reduce variations in the angle of incidence between the impactor 100 and the formation 52. Such impactor shapes may also reduce impactor contact with the flow structures such those in the pipe string 55 and the excavation rig 5 and may thereby minimize abrasive erosion of flow conduits.

Referring to FIGS. 1-4, a substantial portion by weight of the impactors 100 may engage the formation 52 with sufficient energy to enhance creation of a wellbore 70 through the formation 52 by any or a combination of different impact mechanisms. First, an impactor 100 may directly remove a larger portion of the formation 52 than may be removed by abrasive-type particles. In another mechanism, an impactor 100 may penetrate into the formation 52 without removing formation material from the formation 52. A plurality of such formation penetrations, such as near and along an outer perimeter of the wellbore 70 may relieve a portion of the stresses on a portion of formation being excavated, which may thereby enhance the excavation action of other impactors 100 or the drill bit 60. Third, an impactor 100 may alter one or more physical properties of the formation 52. Such physical alterations may include creation of micro-fractures and increased brittleness in a portion of the formation 52, which may thereby enhance effectiveness the impactors 100 in excavating the formation 52. The constant scouring of the bottom of the borehole also prevents the build up of dynamic filter-cake, which can significantly increase the apparent toughness of the formation 52.

FIG. 2 illustrates an impactor 100 that has been impaled into a formation 52, such as a lower surface 66 in a wellbore 70. For illustration purposes, the surface 66 is illustrated as substantially planar and transverse to the direction of impactor travel 100*a*. The impactors 100 circulated through a nozzle 64 may engage the formation 52 with sufficient energy to effect one or more properties of the formation 52.

A portion of the formation 52 ahead of the impactor 100 substantially in the direction of impactor travel T may be altered such as by micro-fracturing and/or thermal alteration due to the impact energy. In such occurrence, the structurally altered zone Z may include an altered zone depth D. An example of a structurally altered zone Z is a compressive zone Z1, which may be a zone in the formation 52 compressed by the impactor 100. The compressive zone Z1 may have a length L1, but is not limited to any specific shape or size. The compressive zone Z1 may be thermally altered due to impact energy.

An additional example of a structurally altered zone 102 near a point of impaction may be a zone of micro-fractures Z2. The structurally altered zone Z may be broken or otherwise altered due to the impactor 100 and/or a drill bit 60, such as by crushing, fracturing, or micro-fracturing.

FIG. 2 also illustrates an impactor 100 implanted into a formation 52 and having created an excavation E wherein material has been ejected from or crushed beneath the impactor 100. Thereby the excavation E may be created, which as illustrated in FIG. 3 may generally conform to the shape of the impactor 100.

Figure 3:
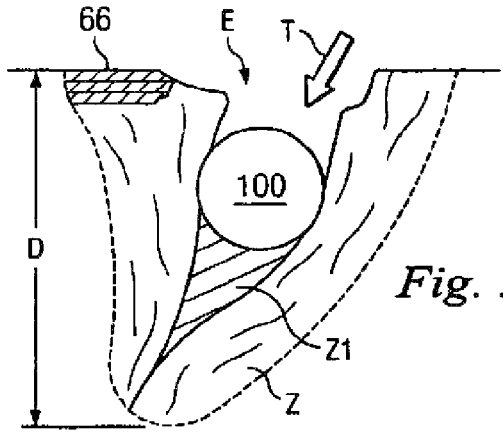
FIG. 3 illustrates an impactor embedded into the formation at an angle to a normalized surface plane of the target formation.
Figure 4:
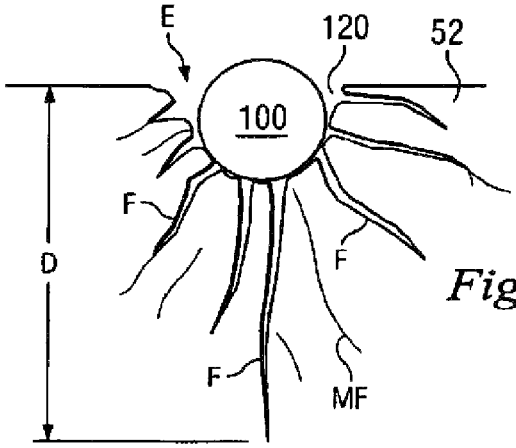
FIG. 4 illustrates an impactor impacting a formation with a plurality of fractures induced by the impact.

FIGS. 3 and 4 illustrate excavations E where the size of the excavation may be larger than the size of the impactor 100. In FIG. 2, the impactor 100 is shown as impacted into the formation 52 yielding an excavation depth D.

An additional theory for impaction mechanics in cutting a formation 52 may postulate that certain formations 52 may be highly fractured or broken up by impactor energy. FIG. 4 illustrates an interaction between an impactor 100 and a formation 52. A plurality of fractures F and micro-fractures MF may be created in the formation 52 by impact energy.

An impactor 100 may penetrate a small distance into the formation 52 and cause the displaced or structurally altered formation 52 to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for fatigue failure of a portion of the formation by "impactor contact," as the plurality of solid material impactors 100 may displace formation material back and forth.

Each nozzle 64 may be selected to provide a desired circulation fluid circulation rate, hydraulic horsepower substantially at the nozzle 64, and/or impactor energy or velocity when exiting the nozzle 64. Each nozzle 64 may be selected as a function of at least one of (a) an expenditure of a selected range of hydraulic horsepower across the one or more nozzles 64, (b) a selected range of circulation fluid velocities exiting the one or more nozzles 64, and (c) a selected range of solid material impactor 100 velocities exiting the one or more nozzles 64.

To optimize rate of penetration (ROP), it may be desirable to determine, such as by monitoring, observing, calculating, knowing, or assuming one or more excavation parameters such that adjustments may be made in one or more controllable variables as a function of the determined or monitored excavation parameter. The one or more excavation parameters may be selected from a group comprising: (a) a rate of penetration into the formation 52, (b) a depth of penetration into the formation 52, (c) a formation excavation factor, and (d) the number of solid material impactors 100 introduced into the circulation fluid per unit of time. Monitoring or observing may include monitoring or observing one or more excavation parameters of a group of excavation parameters comprising: (a) rate of nozzle rotation, (b) rate of penetration into the formation 52, (c) depth of penetration into the formation 52, (d) formation excavation factor, (e) axial force applied to the drill bit 60, (f) rotational force applied to the bit 60, (g) the selected circulation rate, (h) the selected pump pressure, and/or (i) wellbore fluid dynamics, including pore pressure.

One or more controllable variables or parameters may be altered, including at least one of: (a) rate of impactor 100 introduction into the circulation fluid, (b) impactor 100 size, (c) impactor 100 velocity, (d) drill bit nozzle 64 selection, (e) the selected circulation rate of the circulation fluid, (f) the selected pump pressure, and (g) any of the monitored excavation parameters.

To alter the rate of impactors 100 engaging the formation 52, the rate of impactor 100 introduction into the circulation fluid may be altered. The circulation fluid circulation rate may also be altered independent from the rate of impactor 100 introduction. Thereby, the concentration of impactors 100 in the circulation fluid may be adjusted separate from the fluid circulation rate. Introducing a plurality of solid material impactors 100 into the circulation fluid may be a function of impactor 100 size, circulation fluid rate, nozzle rotational speed, wellbore 70 size, and a selected impactor 100 engagement rate with the formation 52. The impactors 100 may also be introduced into the circulation fluid intermittently during the excavation operation. The rate of impactor 100 introduction relative to the rate of circulation fluid circulation may also be adjusted or interrupted as desired.

The plurality of solid material impactors 100 may be introduced into the circulation fluid at a selected introduction rate and/or concentration to circulate the plurality of solid material impactors 100 with the circulation fluid through the nozzle 64. The selected circulation rate and/or pump pressure, and nozzle selection may be sufficient to expend a desired portion of energy or hydraulic horsepower in each of the circulation fluid and the impactors 100.

An example of an operative excavation system 1 may comprise a bit 60 with an 8½ inch bit diameter. The solid material impactors 100 may be introduced into the circulation fluid at a rate of 12 gallons per minute. The circulation fluid containing the solid material impactors may be circulated through the bit 60 at a rate of 462 gallons per minute. A substantial portion by weight of the solid material impactors may have an average mean diameter of 0.100". The following parameters will result in approximately a 27 feet per hour penetration rate into Sierra White Granite. In this example, the excavation system may produce 1413 solid material impactors 100 per cubic inch with approximately 3.9 million impacts per minute against the formation 52. On average, 0.00007822 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 1.14 Ft Lbs., thus satisfying the mass-velocity relationship described above.

Another example of an operative excavation system 1 may comprise a bit 60 with an 8½" bit diameter. The solid material impactors 100 may be introduced into the circulation fluid at a rate of 12 gallons per minute. The circulation fluid containing the solid material impactors may be circulated through the nozzle 64 at a rate of 462 gallons per minute. A substantial portion by weight of the solid material impactors may have an average mean diameter of 0.075". The following parameters will result in approximately a 35 feet per hour penetration rate into Sierra White Granite. In this example, the excavation system 1 may produce 3350 solid material impactors 100 per cubic inch with approximately 9.3 million impacts per minute against the formation 52. On average, 0.0000428 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 0.240 Ft Lbs., thus satisfying the mass-velocity relationship described above.

In addition to impacting the formation with the impactors 100, the bit 60 may be rotated while circulating the circulation fluid and engaging the plurality of solid material impactors 100 substantially continuously or selectively intermittently. The nozzle 64 may also be oriented to cause the solid material impactors 100 to engage the formation 52 with a radially outer portion of the bottom hole surface 66. Thereby, as the drill bit 60 is rotated, the impactors 100, in the bottom hole surface 66 ahead of the bit 60, may create one or more circumferential kerfs. The drill bit 60 may thereby generate formation cuttings more efficiently due to reduced stress in the surface 66 being excavated, due to the one or more substantially circumferential kerfs in the surface 66.

The excavation system 1 may also include inputting pulses of energy in the fluid system sufficient to impart a portion of the input energy in an impactor 100. The impactor 100 may thereby engage the formation 52 with sufficient energy to achieve a structurally altered zone Z. Pulsing of the pressure of the circulation fluid in the pipe string 55, near the nozzle 64 also may enhance the ability of the circulation fluid to generate cuttings subsequent to impactor 100 engagement with the formation 52.

Each combination of formation type, bore hole size, bore hole depth, available weight on bit, bit rotational speed, pump rate, hydrostatic balance, circulation fluid rheology, bit type, and tooth/cutter dimensions may create many combinations of optimum impactor presence or concentration, and impactor energy requirements. The methods and systems of this disclosure facilitate adjusting impactor size, mass, introduction rate, circulation fluid rate and/or pump pressure, and other adjustable or controllable variables to determine and maintain an optimum combination of variables. The methods and systems of this disclosure also may be coupled with select bit nozzles, downhole tools, and fluid circulating and processing equipment to effect many variations in which to optimize rate of penetration.

Figure 5:
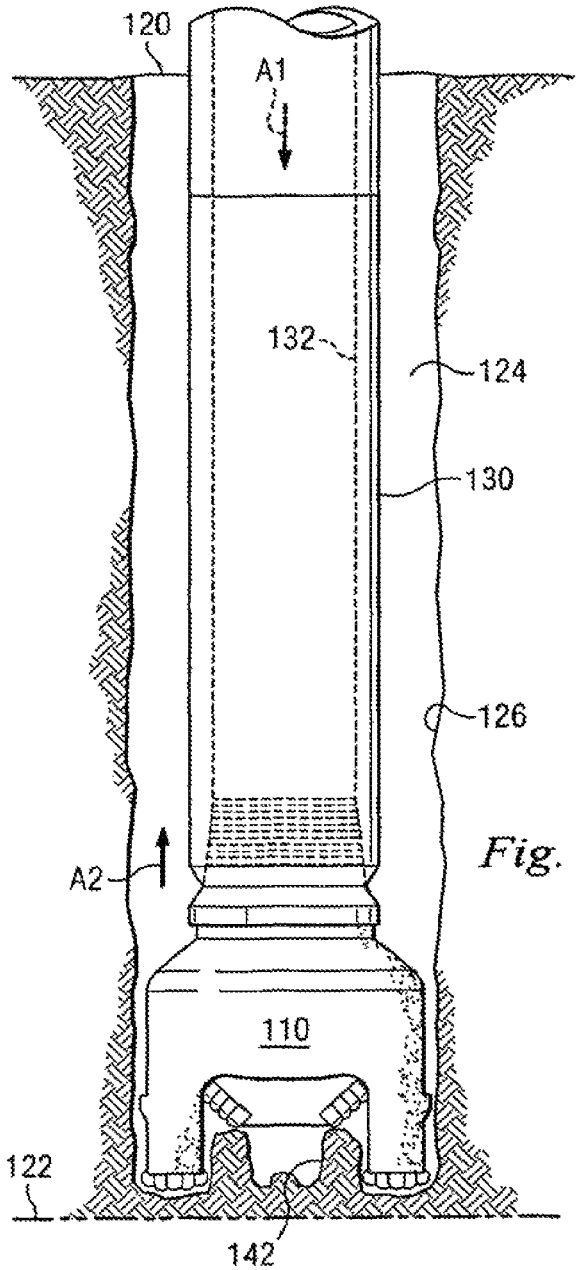
FIG. 5 is an elevational view of a drilling system utilizing a first embodiment of a drill bit.

FIG. 5 shows an alternate embodiment of the drill bit 60 (FIG. 1) and is referred to, in general, by the reference numeral 110 and which is located at the bottom of a well bore 120 and attached to a drill string 130. The drill bit 110 acts upon a bottom surface 122 of the well bore 120. The drill string 130 has a central passage 132 that supplies drilling fluids to the drill bit 110 as shown by the arrow A1. The drill bit 110 uses the drilling fluids and solid material impactors 100 when acting upon the bottom surface 122 of the well bore 120. The drilling fluids then exit the well bore 120 through a well bore annulus 124 between the drill string 130 and the inner wall 126 of the well bore 120. Particles of the bottom surface 122 removed by the drill bit 110 exit the well bore 120 with the drilling fluid through the well bore annulus 124 as shown by the arrow A2. The drill bit 110 creates a rock ring 142 at the bottom surface 122 of the well bore 120.

Figure 6:
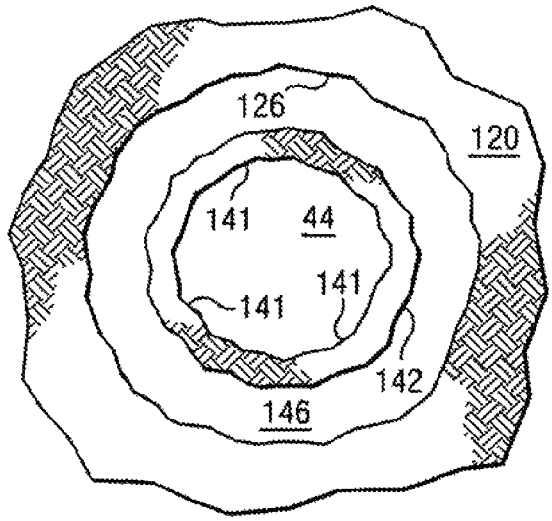
FIG. 6 is a top plan view of the bottom surface of a well bore formed by the drill bit of FIG. 5.

Referring now to FIG. 6, a top view of the rock ring 124 formed by the drill bit 110 is illustrated. An excavated interior cavity 144 is worn away by an interior portion of the drill bit 110 and the exterior cavity 146 and inner wall 126 of the well bore 120 are worn away by an exterior portion of the drill bit 110. The rock ring 142 possesses hoop strength, which holds the rock ring 142 together and resists breakage. The hoop strength of the rock ring 142 is typically much less than the strength of the bottom surface 122 or the inner wall 126 of the well bore 120, thereby making the drilling of the bottom surface 122 less demanding on the drill bit 110. By applying a compressive load and a side load, shown with arrows 141, on the rock ring 142, the drill bit 110 causes the rock ring 142 to fracture. The drilling fluid 140 then washes the residual pieces of the rock ring 142 back up to the surface through the well bore annulus 124.

The mechanical cutters, utilized on many of the surfaces of the drill bit 110, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 7:
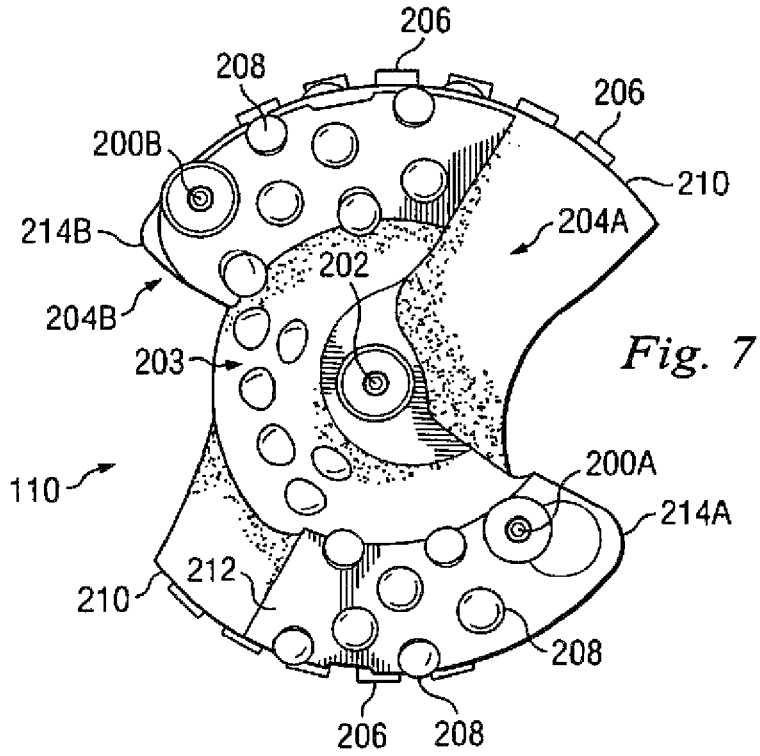
FIG. 7 is an end elevational view of the drill bit of FIG. 5.

Referring now to FIG. 7, an end elevational view of the drill bit 110 of FIG. 5 is illustrated. The drill bit 110 comprises two side nozzles 200A, 200B and a center nozzle 202. The side and center nozzles 200A, 200B, 202 discharge drilling fluid and solid material impactors (not shown) into the rock formation or other surface being excavated. The solid material impactors may comprise steel shot ranging in diameter from about 0.010 to about 0.500 of an inch. However, various diameters and materials such as ceramics, etc. may be utilized in combination with the drill bit 120. The solid material impactors contact the bottom surface 122 of the well bore 120 and are circulated through the annulus 124 to the surface. The solid material impactors may also make up any suitable percentage of the drilling fluid for drilling through a particular formation.

Still referring to FIG. 7 the center nozzle 202 is located in a center portion 203 of the drill bit 110. The center nozzle 202 may be angled to the longitudinal axis of the drill bit 110 to create an excavated interior cavity 244 and also cause the rebounding solid material impactors to flow into the major junk slot, or passage, 204A. The side nozzle 200A located on a side arm 214A of the drill bit 110 may also be oriented to allow the solid material impactors to contact the bottom surface 122 of the well bore 120 and then rebound into the major junk slot, or passage, 204A. The second side nozzle 200B is located on a second side arm 214B. The second side nozzle 200B may be oriented to allow the solid material impactors to contact the bottom surface 122 of the well bore 120 and then rebound into a minor junk slot, or passage, 204B. The orientation of the side nozzles 200A, 200B may be used to facilitate the drilling of the large exterior cavity 46. The side nozzles 200A, 200B may be oriented to cut different portions of the bottom surface 122. For example, the side nozzle 2006 may be angled to cut the outer portion of the excavated exterior cavity 146 and the side nozzle 200A may be angled to cut the inner portion of the excavated exterior cavity 146. The major and minor junk slots, or passages, 204A, 2046 allow the solid material impactors, cuttings, and drilling fluid 240 to flow up through the well bore annulus 124 back to the surface. The major and minor junk slots, or passages, 204A, 204B are oriented to allow the solid material impactors and cuttings to freely flow from the bottom surface 122 to the annulus 124.

As described earlier, the drill bit 110 may also comprise mechanical cutters and gauge cutters. Various mechanical cutters are shown along the surface of the drill bit 110. Hemispherical PDC cutters are interspersed along the bottom face and the side walls of the drill bit 110. These hemispherical cutters along the bottom face break down the large portions of the rock ring 142 and also abrade the bottom surface 122 of the well bore 120. Another type of mechanical cutter along the side arms 214A, 214B are gauge cutters 230. The gauge cutters 230 form the final diameter of the well bore 120. The gauge cutters 230 trim a small portion of the well bore 120 not removed by other means. Gauge bearing surfaces 206 are interspersed throughout the side walls of the drill bit 110. The gauge bearing surfaces 206 ride in the well bore 120 already trimmed by the gauge cutters 230. The gauge bearing surfaces 206 may also stabilize the drill bit 110 within the well bore 120 and aid in preventing vibration.

Still referring to FIG. 7 the center portion 203 comprises a breaker surface, located near the center nozzle 202, comprising mechanical cutters 208 for loading the rock ring 142. The mechanical cutters 208 abrade and deliver load to the lower stress rock ring 142. The mechanical cutters 208 may comprise PDC cutters, or any other suitable mechanical cutters. The breaker surface is a conical surface that creates the compressive and side loads for fracturing the rock ring 142. The breaker surface and the mechanical cutters 208 apply force against the inner boundary of the rock ring 142 and fracture the rock ring 142. Once fractured, the pieces of the rock ring 142 are circulated to the surface through the major and minor junk slots, or passages, 204A, 204B.

Figure 8:
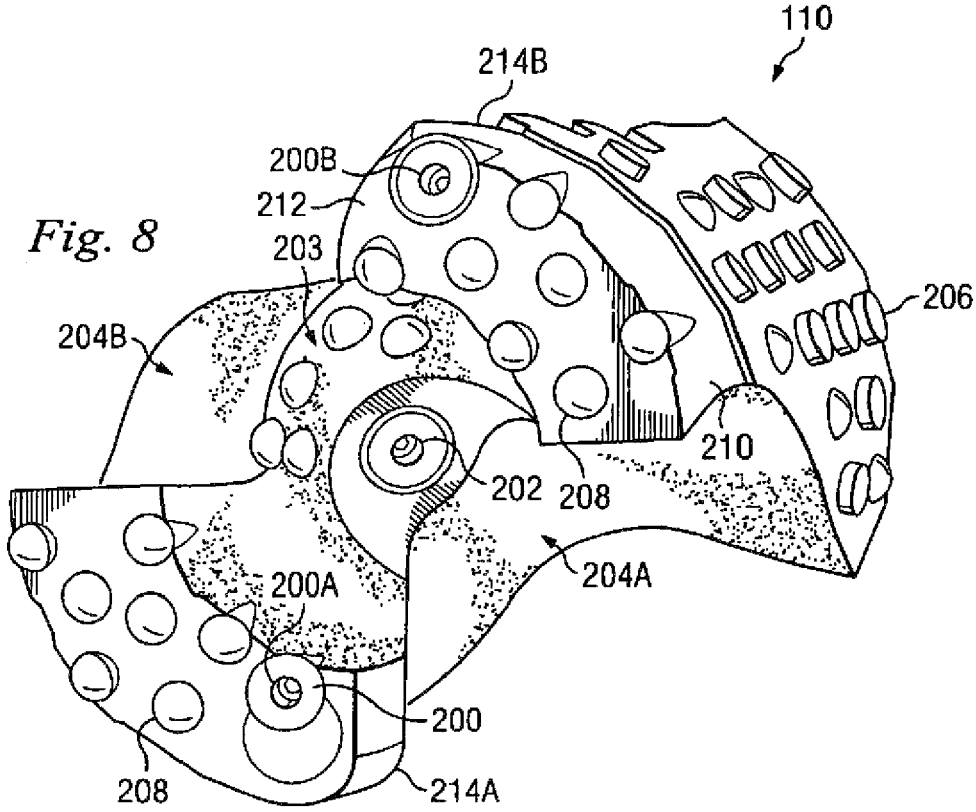
FIG. 8 is an enlarged end elevational view of the drill bit of FIG. 5.

Referring now to FIG. 8, an enlarged end elevational view of the drill bit 110 is shown. As shown more clearly in FIG. 8, the gauge bearing surfaces 206 and mechanical cutters 208 are interspersed on the outer side walls of the drill bit 110. The mechanical cutters 208 along the side walls may also aid in the process of creating drill bit 110 stability and also may perform the function of the gauge bearing surfaces 206 if they fail. The mechanical cutters 208 are oriented in various directions to reduce the wear of the gauge bearing surface 206 and also maintain the correct well bore 120 diameter. As noted with the mechanical cutters 208 of the breaker surface, the solid material impactors fracture the bottom surface 122 of the well bore 120 and, as such, the mechanical cutters 208 remove remaining ridges of rock and assist in the cutting of the bottom hole. However, the drill bit 110 need not necessarily comprise the mechanical cutters 208 on the side wall of the drill bit 110.

Figure 9:
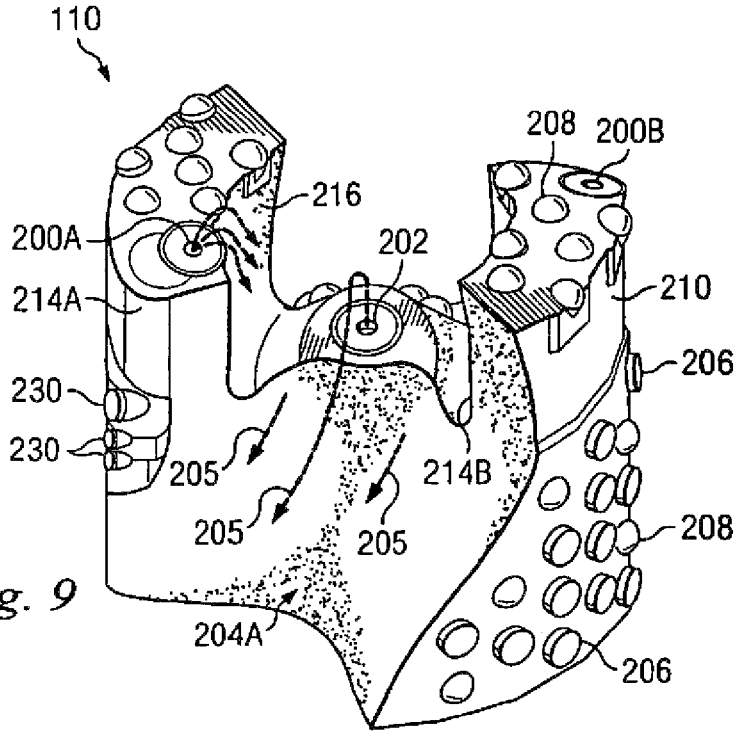
FIG. 9 is a perspective view of the drill bit of FIG. 5.

Referring now to FIG. 9, a side elevational view of the drill bit 110 is illustrated. FIG. 9 shows the gauge cutters 230 included along the side arms 214A, 214B of the drill bit 110. The gauge cutters 230 are oriented so that a cutting face of the gauge cutter 230 contacts the inner wall 126 of the well bore 120. The gauge cutters 230 may contact the inner wall 126 of the well bore at any suitable backrake, for example a backrake of 15° to 45°. Typically, the outer edge of the cutting face scrapes along the inner wall 126 to refine the diameter of the well bore 120.

Still referring to FIG. 9 one side nozzle 200A is disposed on an interior portion of the side arm 214A and the second side nozzle 200B is disposed on an exterior portion of the opposite side arm 214B. Although the side nozzles 200A, 200B are shown located on separate side arms 214A, 214B of the drill bit 110, the side nozzles 200A, 200B may also be disposed on the same side arm 214A or 214B. Also, there may only be one side nozzle, 200A or 200B. Also, there may only be one side arm, 214A or 214B.

Each side arm 214A, 214B fits in the excavated exterior cavity 146 formed by the side nozzles 200A, 200B and the mechanical cutters 208 on the face 212 of each side arm 214A, 214B. The solid material impactors from one side nozzle 200A rebound from the rock formation and combine with the drilling fluid and cuttings flow to the major junk slot 204A and up to the annulus 124. The flow of the solid material impactors, shown by arrows 205, from the center nozzle 202 also rebound from the rock formation up through the major junk slot 204A.

Figure 10:
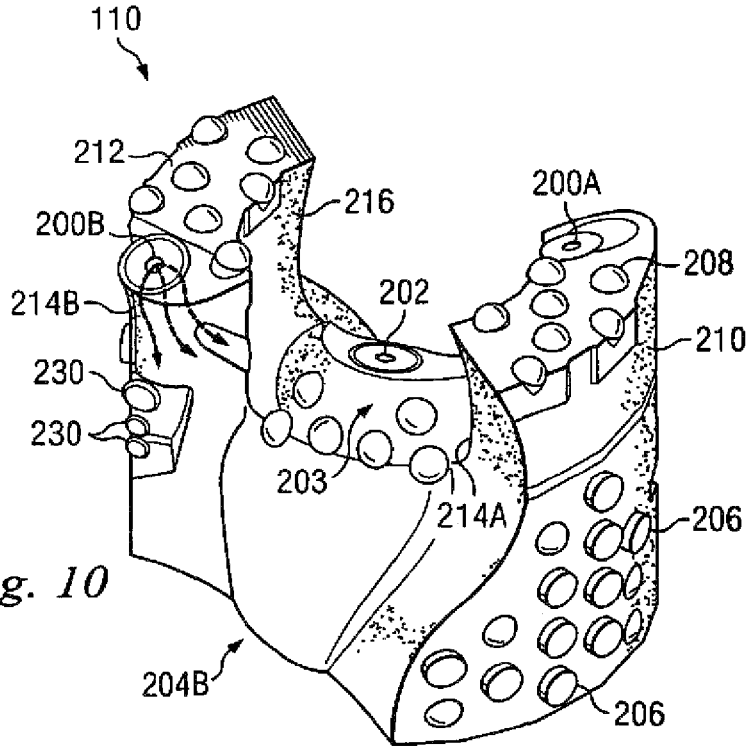
FIG. 10 is a perspective view of the drill bit of FIG. 5 illustrating a breaker and junk slot of a drill bit.
Figure 11:
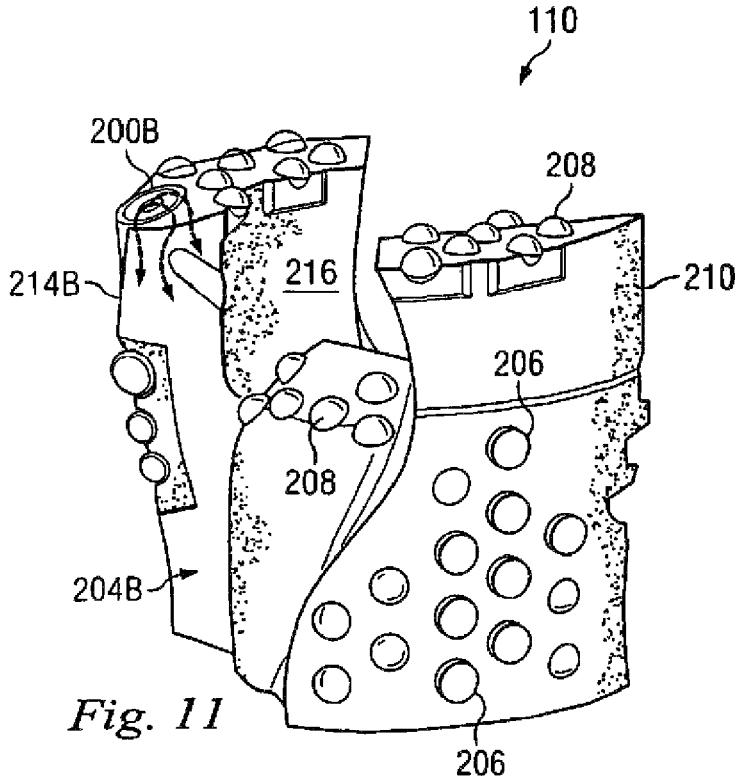
FIG. 11 is a side elevational view of the drill bit of FIG. 5 illustrating a flow of solid material impactors.

Referring now to FIGS. 10 and 11, the minor junk slot 204B, breaker surface, and the second side nozzle 200B are shown in greater detail. The breaker surface is conically shaped, tapering to the center nozzle 202. The second side nozzle 2006 is oriented at an angle to allow the outer portion of the excavated exterior cavity 146 to be contacted with solid material impactors. The solid material impactors then rebound up through the minor junk slot 204B, shown by arrows 205, along with any cuttings and drilling fluid 240 associated therewith.

Figure 12:
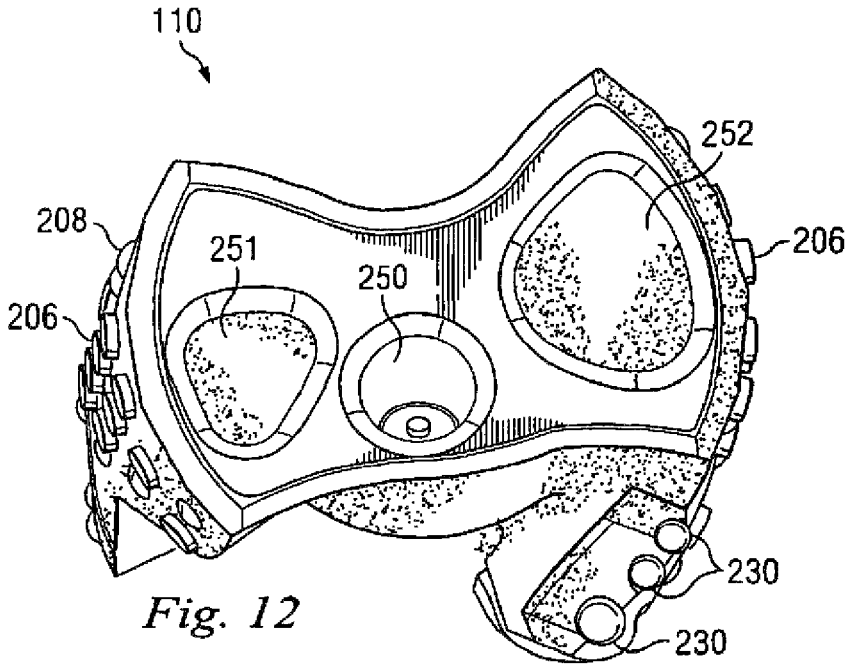
FIG. 12 is a top elevational view of the drill bit of FIG. 5 illustrating side and center cavities.
Figure 13:
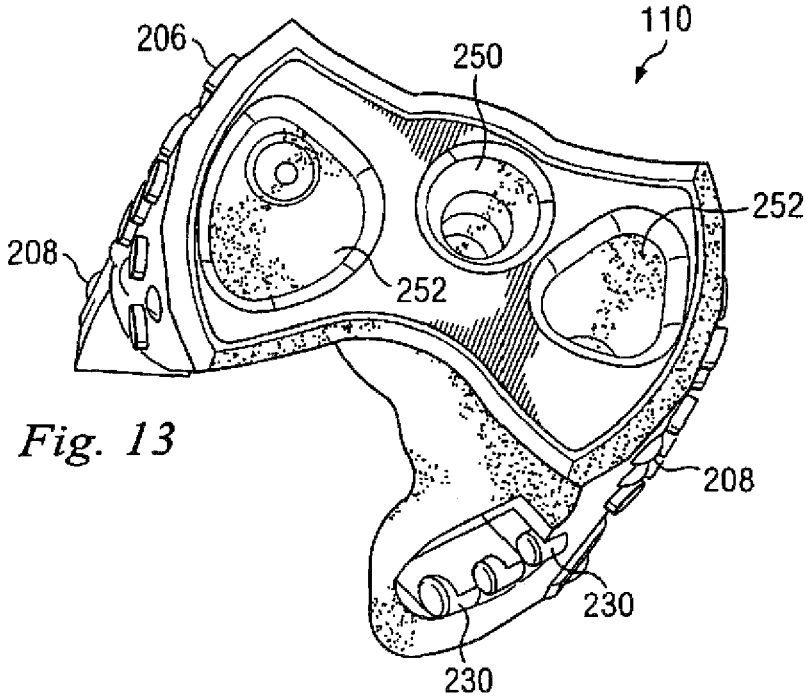
FIG. 13 is a canted top elevational view of the drill bit of FIG. 5.

Referring now to FIGS. 12 and 13, top elevational views of the drill bit 110 are shown. Each nozzle 200A, 200B, 202 receives drilling fluid 240 and solid material impactors from a common plenum feeding separate cavities 250, 251, and 252. Since the common plenum has a diameter, or cross section, greater than the diameter of each cavity 250, 251, and 252, the mixture, or suspension of drilling fluid and impactors is accelerated as it passes from the plenum to each cavity. The center cavity 250 feeds a suspension of drilling fluid 240 and solid material impactors to the center nozzle 202 for contact with the rock formation. The side cavities 251, 252 are formed in the interior of the side arms 214A, 214B of the drill bit 110, respectively. The side cavities 251, 252 provide drilling fluid 240 and solid material impactors to the side nozzles 200A, 200B for contact with the rock formation. By utilizing separate cavities 250, 251, 252 for each nozzle 202, 200A, 200B, the percentages of solid material impactors in the drilling fluid 240 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202 by changing the diameters of the nozzles. However, in alternate embodiments, other arrangements of the cavities 250, 251, 252, or the utilization of a single cavity, are possible.

Figure 14:
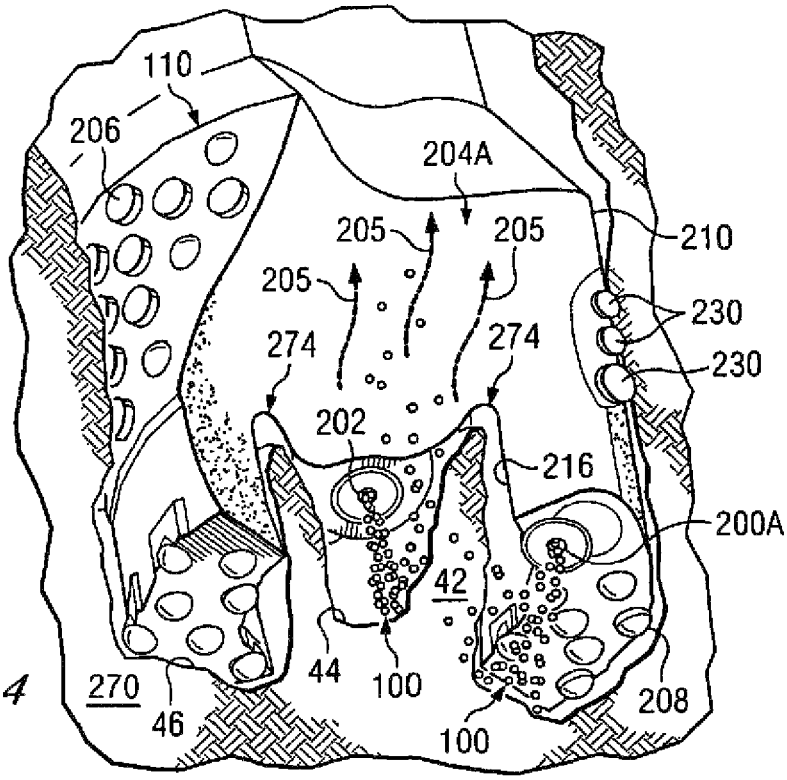
FIG. 14 is a cutaway view of the drill bit of FIG. 5 engaged in a well bore.

Referring now to FIG. 14, the drill bit 110 in engagement with the rock formation 270 is shown. As previously discussed, the solid material impactors 272 flow from the nozzles 200A, 200B, 202 and make contact with the rock formation 270 to create the rock ring 142 between the side arms 214A, 214B of the drill bit 110 and the center nozle 202 of the drill bit 110. The solid material impactors 272 from the center nozzle 202 create the excavated interior cavity 244 while the side nozzles 200A, 200B create the excavated exterior cavity 146 to form the outer boundary of the rock ring 142. The gauge cutters 230 refine the more crude well bore 120 cut by the solid material impactors 272 into a well bore 120 with a smoother inner wall 126 of the correct diameter.

Still referring to FIG. 14 the solid material impactors 272 flow from the first side nozzle 200A between the outer surface of the rock ring 142 and the interior wall 216 in order to move up through the major junk slot 204A to the surface. The second side nozzle 200B (not shown) emits solid material impactors 272 that rebound toward the outer surface of the rock ring 142 and to the minor junk slot 204B (not shown). The solid material impactors 272 from the side nozzles 200A, 200B may contact the outer surface of the rock ring 142 causing abrasion to further weaken the stability of the rock ring 142. Recesses 274 around the breaker surface of the drill bit 110 may provide a void to allow the broken portions of the rock ring 142 to flow from the bottom surface 122 of the well bore 120 to the major or minor junk slot 204A, 204B.

Figure 15:
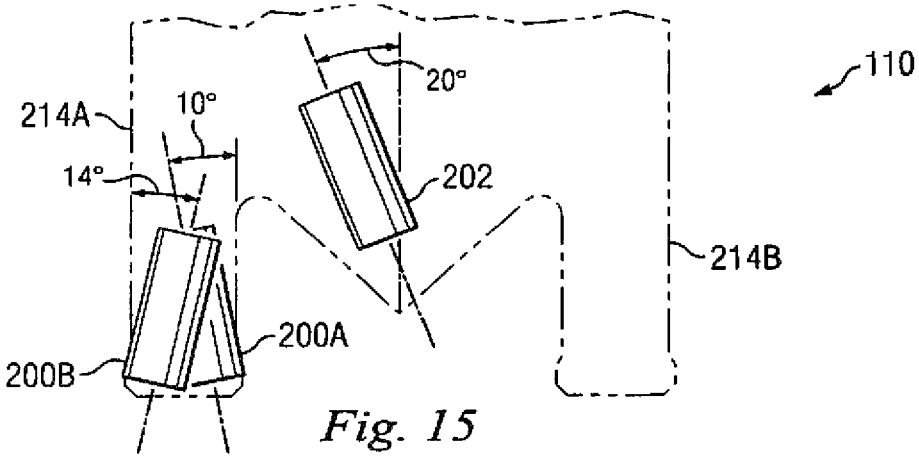
FIG. 15 is a schematic diagram of the orientation of the nozzles of a second embodiment of a drill bit.

Referring now to FIG. 15, an example orientation of the nozzles 200A, 200B, 202 are illustrated. The center nozzle 202 is disposed left of the center line of the drill bit 110 and angled on the order of around 20' left of vertical. Alternatively, both of the side nozzles 200A, 200B may be disposed on the same side arm 214 of the drill bit 110 as shown in FIG. 15. In this embodiment, the first side nozzle 200A, oriented to cut the inner portion of the excavated exterior cavity 146, is angled on the order of around 10 left of vertical. The second side nozzle 200B is oriented at an angle on the order of around 14° right of vertical. This particular orientation of the nozzles allows for a large interior excavated cavity 244 to be created by the center nozzle 202. The side nozzles 200A, 200B create a large enough excavated exterior cavity 146 in order to allow the side arms 214A, 214B to fit in the excavated exterior cavity 146 without incurring a substantial amount of resistance from uncut portions of the rock formation 270. By varying the orientation of the center nozzle 202, the excavated interior cavity 244 may be substantially larger or smaller than the excavated interior cavity 244 illustrated in FIG. 14. The side nozzles 200A, 200B may be varied in orientation in order to create a larger excavated exterior cavity 146, thereby decreasing the size of the rock ring 142 and increasing the amount of mechanical cutting required to drill through the bottom surface 122 of the well bore 120. Alternatively, the side nozzles 200A, 200B may be oriented to decrease the amount of the inner wall 126 contacted by the solid material impactors 272. By orienting the side nozzles 200A, 200B at, for example, a vertical orientation, only a center portion of the excavated exterior cavity 146 would be cut by the solid material impactors and the mechanical cutters would then be required to cut a large portion of the inner wall 126 of the well bore 120.

Figure 16:
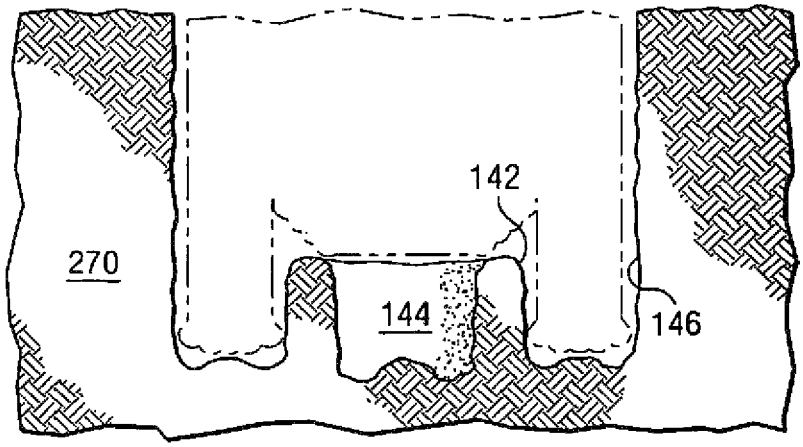
FIG. 16 is a side cross-sectional view of the rock formation created by the drill bit of FIG. 5 represented by the schematic of the drill bit of FIG. 5 inserted therein.
Figure 17:
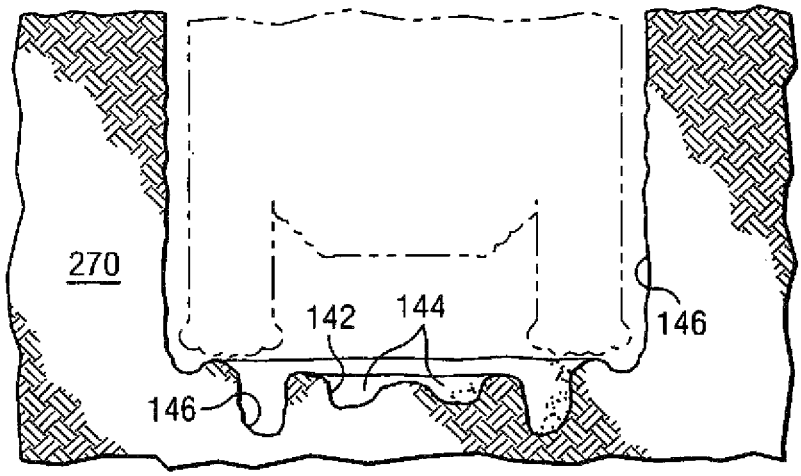
FIG. 17 is a side cross-sectional view of the rock formation created by the drill bit of FIG. 5 represented by the schematic of the drill bit of FIG. 5 inserted therein.

Referring now to FIGS. 16 and 17, side cross-sectional views of the bottom surface 122 of the well bore 120 drilled by the drill bit 110 are shown. With the center nozzle angled on the order of around 20° left of vertical and the side nozzles 200A, 200B angled on the order of around 10° left of vertical and around 14° right of vertical, respectively, the rock ring 142 is formed. By increasing the angle of the side nozzle 200A, 200B orientation, an alternate rock ring 142 shape and bottom surface 122 is cut as shown in FIG. 17. The excavated interior cavity 244 and rock ring 142 are much more shallow as compared with the rock ring 142 in FIG. 16. It is understood that various different bottom hole patterns can be generated by different nozzle configurations.

Although the drill bit 110 is described comprising orientations of nozzles and mechanical cutters, any orientation of either nozzles, mechanical cutters, or both may be utilized. The drill bit 110 need not comprise a center portion 203. The drill bit 110 also need not even create the rock ring 142. For example, the drill bit may only comprise a single nozzle and a single junk slot. Furthermore, although the description of the drill bit 110 describes types and orientations of mechanical cutters, the mechanical cutters may be formed of a variety of substances, and formed in a variety of shapes.

Figure 18:
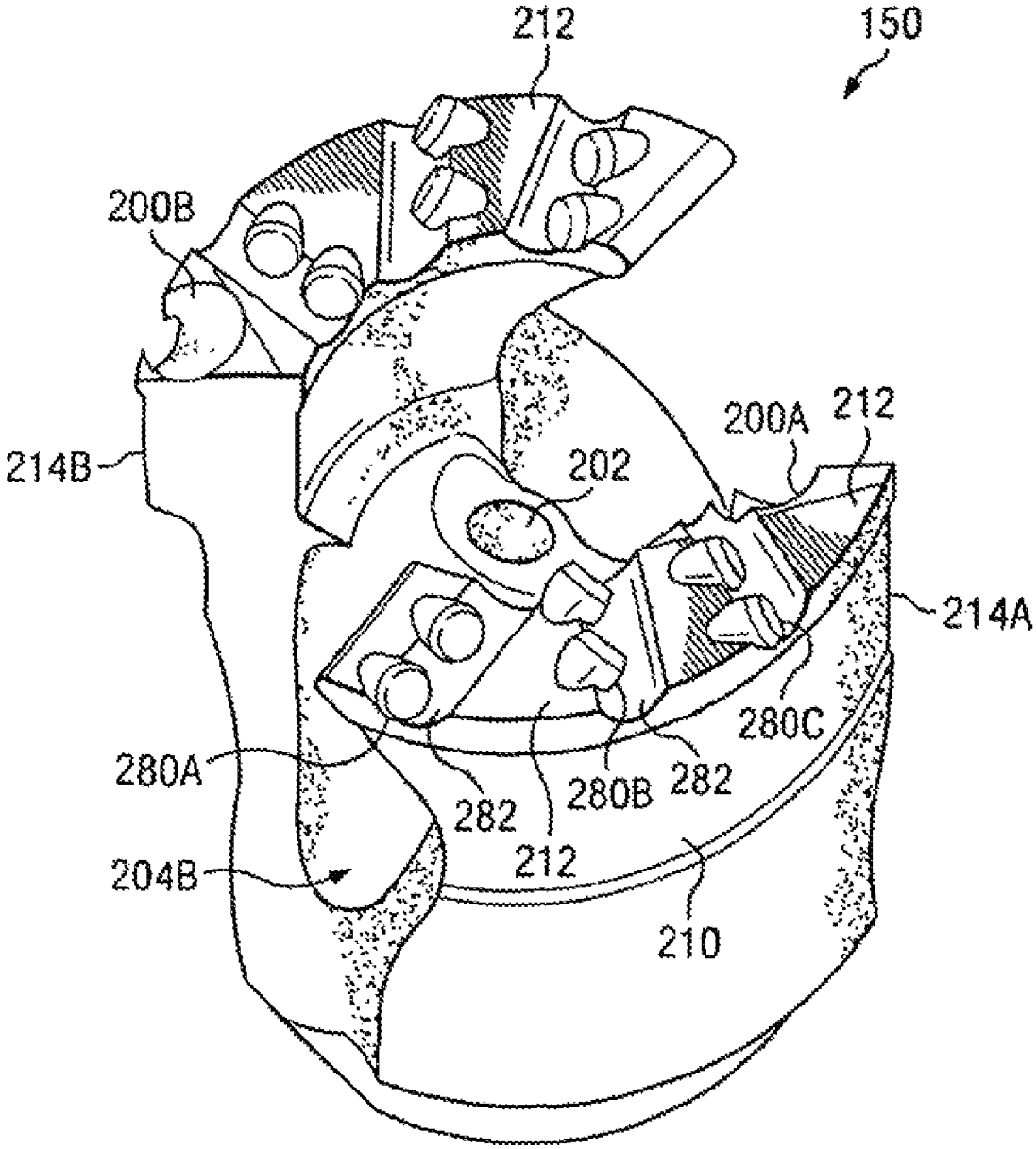
FIG. 18 is a perspective view of an alternate embodiment of a drill bit.
Figure 19:
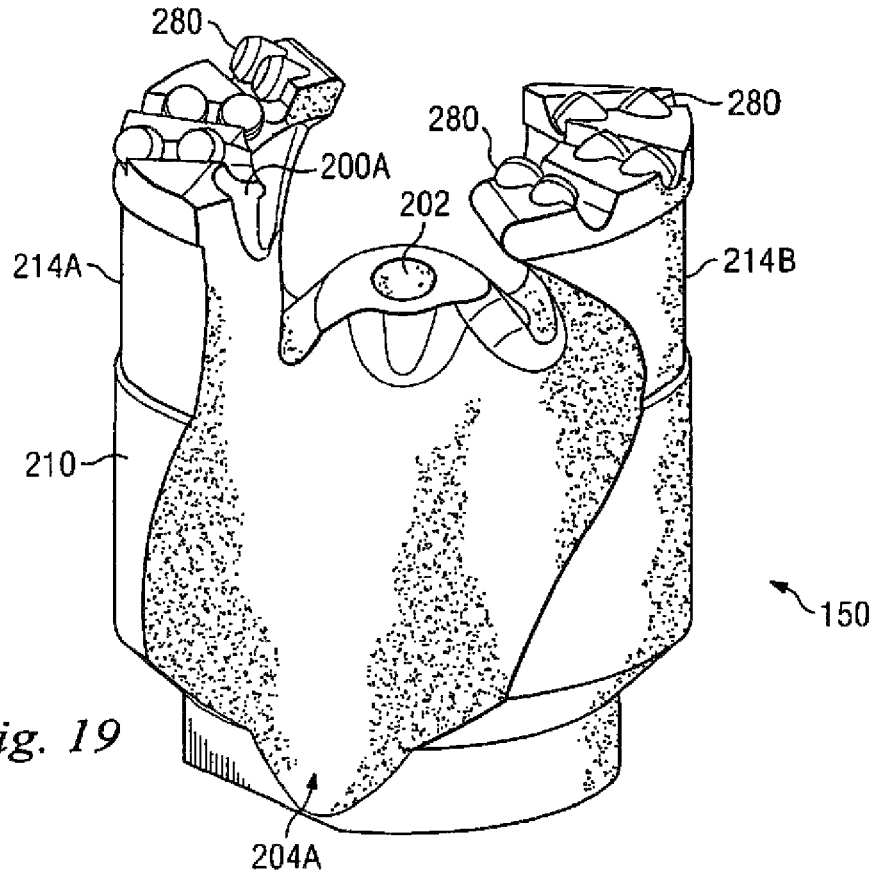
FIG. 19 is a perspective view of the drill bit of FIG. 18.

Referring now to FIGS. 18-19, a drill bit 150 in accordance with a second embodiment is illustrated. As previously noted, the mechanical cutters, such as the gauge cutters 230, mechanical cutters 208, and gauge bearing surfaces 206 may not be necessary in conjunction with the nozzles 200A, 200B, 202 in order to drill the required well bore 120. The side wall of the drill bit 150 may or may not be interspersed with mechanical cutters. The side nozzles 200A, 200B and the center nozzle 202 are oriented in the same manner as in the drill bit 150, however, the face 212 of the side arms 214A, 214B comprises angled (PDCs) 280 as the mechanical cutters.

Figure 20:
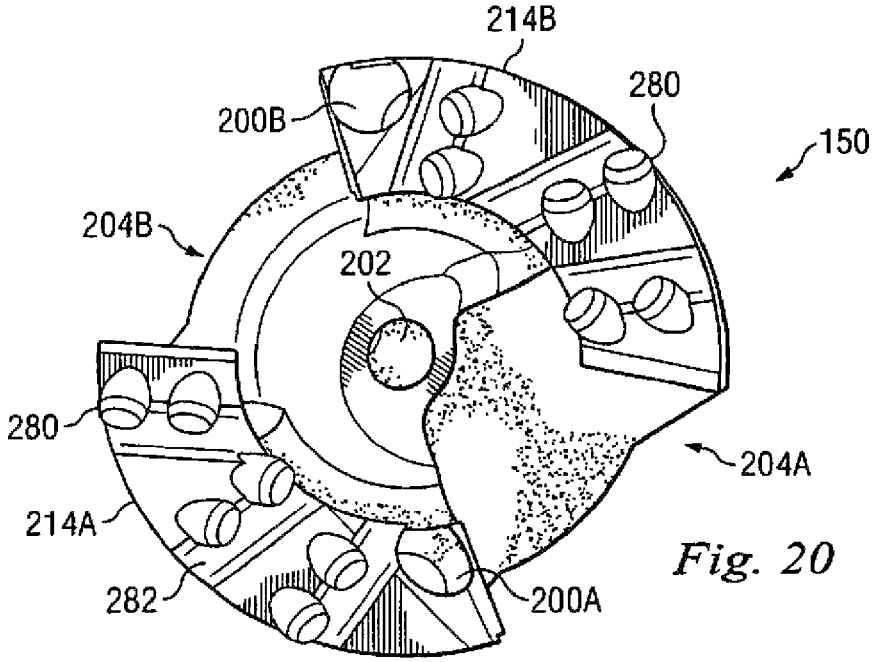
FIG. 20 illustrates an end elevational view of the drill bit of FIG. 18.

Still referring to FIGS. 18-20 each row of PDCs 280 is angled to cut a specific area of the bottom surface 122 of the well bore 120. A first row of PDCs 280A is oriented to cut the bottom surface 122 and also cut the inner wall 126 of the well bore 120 to the proper diameter. A groove 282 is disposed between the cutting faces of the PDCs 280 and the face 212 of the drill bit 150. The grooves 282 receive cuttings, drilling fluid 240, and solid material impactors and direct them toward the center nozzle 202 to flow through the major and minor junk slots, or passages, 204A, 204B toward the surface. The grooves 282 may also direct some cuttings, drilling fluid 240, and solid material impactors toward the inner wall 126 to be received by the annulus 124 and also flow to the surface. Each subsequent row of PDCs 280B, 280C may be oriented in the same or different position than the first row of PDCs 280A. For example, the subsequent rows of PDCs 280B, 280C may be oriented to cut the exterior face of the rock ring 142 as opposed to the inner wall 126 of the well bore 120. The grooves 282 on one side arm 214A may also be oriented to direct the cuttings and drilling fluid 240 toward the center nozzle 202 and to the annulus 124 via the major junk slot 204A. The second side arm 214B may have grooves 282 oriented to direct the cuttings and drilling fluid 240 to the inner wall 126 of the well bore 120 and to the annulus 124 via the minor junk slot 204B.

The PDCs 280 located on the face 212 of each side arm 214A, 214B are sufficient to cut the inner wall 126 to the correct size. However, mechanical cutters may be placed throughout the side wall of the drill bit 150 to further enhance the stabilization and cutting ability of the drill bit 150.

Figure 21:
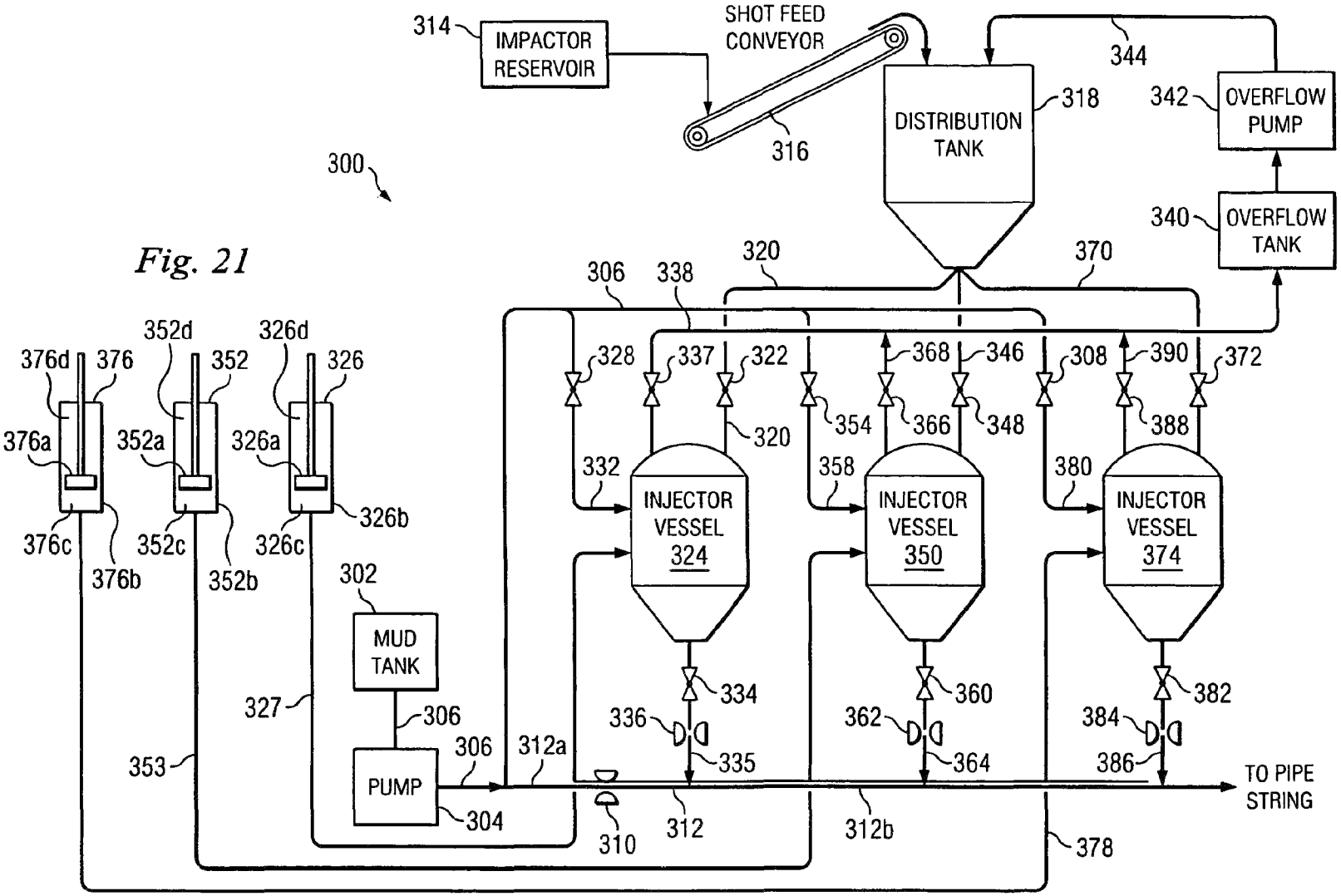
FIG. 21 is a schematic view of an injection system according to an embodiment.

Referring to FIG. 21, an injection system is generally referred to by the reference numeral 300 and includes a drilling fluid tank or mud tank 302 that is fluidicly coupled to a pump 304 via a hydraulic supply line 306 that also extends from the pump to a valve 308. An orifice 310 is fluidicly coupled to the hydraulic supply line 306 via a hydraulic supply line 312 that also extends to and/or is fluidicly coupled to a pipe string such as, for example, the pipe string 55 described above in connection with the excavation system 1 of the embodiment of FIG. 1. In an exemplary embodiment, it is understood that the hydraulic supply line 312 may be fluidicly coupled to the pipe string 55 via one or more components of the excavation system 1 of the embodiment of FIG. 1, including the impactor slurry injector head 34, the injector port 30, the fluid-conducting through-bore of the swivel 28, and/or the feed end 55*a* of the pipe string. Line portions 312*a* and 312*b* of the line 312 are defined and separated by the location of the orifice 310.

A solid-material-impactor bin or reservoir 314 is operably coupled to a solid-impactor transport device such as a shot-feed conveyor 316 which, in turn, is operably coupled to a distribution tank 318. A conduit 320 connects the tank 318 to a valve 322, and the conduit further extends and is connected to an injector vessel 324.

A hydraulic-actuated cylinder 326 is fluidicly coupled to the vessel 324 via a hydraulic flow line 327. The cylinder 326 includes a piston 326*a* that reciprocates in a cylinder housing 326*b* in a conventional manner. The housing 326*b* defines a variable-volume chamber 326*c* in fluid communication with the line 327, and further defines a variable-volume chamber 326*d* into which hydraulic cylinder fluid is introduced, and from which the hydraulic fluid is discharged, under conditions to be described.

A valve 328 is fluidicly coupled to the line 306 via a hydraulic line 332, and the line 332 also extends to the vessel 324, thereby fluidicly coupling the valve to the vessel. A valve 334 is fluidicly coupled to the vessel 324. A hydraulic line 335 fluidicly couples an orifice 336 to the valve 334, and the line also extends to the line portion 312*b* of the line 312. A valve 337 is fluidicly coupled to the vessel 324 via a hydraulic line 338 that also extends to a reservoir or tank 340. A pump 342 is fluidicly coupled to the tank 340 via a hydraulic line 344 that also extends to the tank 318.

A conduit 346 connects the tank 318 to a valve 348, and the conduit further extends and is connected to an injector vessel 350. A hydraulic-actuated cylinder 352 is fluidicly coupled to the vessel 350 via a hydraulic flow line 353. The cylinder 352 includes a piston 352*a* that reciprocates in a cylinder housing 352*b* in a conventional manner. The housing 352*b* defines a variable-volume chamber 352*c* in fluid communication with the line 353, and further defines a variable-volume chamber 352*d* into which hydraulic cylinder fluid is introduced, and from which the hydraulic fluid is discharged, under conditions to be described.

A valve 354 is fluidicly coupled to the line 306 via a hydraulic line 358, and the line 358 also extends to the vessel 350, thereby fluidicly coupling the valve to the vessel. A valve 360 is fluidicly coupled to the vessel 350, and an orifice 362 is fluidicly coupled to the valve via a hydraulic line 364 that also extends to the line portion 312*b* of the line 312. A valve 366 is fluidicly coupled to the vessel 350 via a hydraulic line 368 that also extends to the line 338.

A conduit 370 connects the tank 318 to a valve 372, and the conduit further extends and is connected to an injector vessel 374. A hydraulic-actuated cylinder 376 is fluidicly coupled to the vessel 374 via a hydraulic line 378, and the cylinder includes a piston 376*a* that reciprocates in a cylinder housing 376*b* in a conventional manner. The housing 376*b* defines a variable-volume chamber 376*c* in fluid communication with the line 378, and further defines a variable-volume chamber 376*d* into which hydraulic cylinder fluid is introduced, and from which the hydraulic fluid is discharged, under conditions to be described.

A hydraulic line 380 fluidicly couples the valve 308 to the vessel 374. A valve 382 is fluidicly coupled to the vessel 374, and an orifice 384 is fluidicly coupled to the valve via a hydraulic line 386 that also extends to the line portion 312*b* of the line 312. A valve 388 is fluidicly coupled to the vessel 374 via a hydraulic line 390 that also extends to the line 338. In an exemplary embodiment, it is understood that all of the above-described lines and line portions define flow regions through which fluid may flow over a range of fluid pressures.

Prior to the general operation of the injection system 300, all of the valves in the injection system may be closed, including the valves 322, 348, 372, 328, 337, 354, 366, 308, 388, 334, 360 and 382. Moreover, the pump 304 may cause liquid such as drilling fluid to flow from the mud tank 302, through the line 306, the line portion 312*a*, the orifice 310 and the line portion 312*b*, and to the pipe string 55. It is understood that the pressure in the line 306 and the line portion 312*a* is substantially equal to the supply pressure of the pump 304, and that the pressure in the line portion 312*b* is less than the pressure in the line 306 and the line portion 312*a* due to the pressure drop caused by the orifice 310. It is further understood that the portion of the line 306 extending to the valve 308, and the lines 327, 353, 378, 332, 358, 380, 338, 368 and 390 may be full of drilling fluid. Moreover, it is understood that the injector vessels 324, 350 and 374 may also be full of drilling fluid. The reservoir 314 is filled with material such as, for example, the solid material impactors 100 discussed above in connection with FIGS. 1-20. The tank 318 may also be filled with the solid material impactors 100, and/or may also be filled with drilling fluid.

For clarity purposes, the individual operation of the injector vessel 324 will be described. Initially, the injector vessel 324 is full of drilling fluid and the valve 337 is open, while the valves 322, 348, 372, 328, 354, 366, 308, 388, 334, 360 and 382 remain closed. As a result of the valve 337 being open, the pressure in the injector vessel 324 is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 324, the valve 322 is opened and the conveyor 316 transports solid material impactors 100 from the reservoir 314 to the tank 318. Solid material impactors 100 are also transported from the tank 318 and into the injector vessel 324 via the conduit 320 and the valve 322, thereby charging the injector vessel with the solid material impactors. In an exemplary embodiment, the solid material impactors 100 may be fed into the injector vessel 324 with drilling fluid, in a solution or slurry form, and/or be may be gravity fed into the injector vessel 324 via the conduit 320 and the valve 322. The solid material impactors 100 and the drilling fluid present in the injector vessel 324 mix to form a suspension of liquid in the form of drilling fluid and the solid material impactors 100, that is, to form an impactor slurry.

As a result of the introduction of the solid material impactors 100 into the injector vessel 324, drilling fluid present in the injector vessel is displaced and the volume of the displaced drilling fluid flows to the tank 340 via the line 338 and the valve 337. It is understood that the pump 342 may be operated to cause at least a portion of the displaced drilling fluid in the tank 340 to flow into the tank 318 via the line 344.

After the injector vessel 324 has been charged, that is, after the desired and relatively high volume of the solid material impactors 100 has been introduced into the injector vessel, the valve 322 is closed to prevent further introduction of solid material impactors 100 into the injector vessel, and the valve 337 is closed to prevent any further flow of drilling fluid to the tank 340. The cylinder 326 is then operated so that hydraulic cylinder fluid is introduced into the chamber 326*d* and, in response, the piston 326*a* applies pressure to the drilling fluid in the line 327, thereby pressurizing the line 327 and the injector vessel 324. The cylinder 326 pressurizes the line 327 and the injector vessel 324 until the pressure in the line 327 and the injector vessel 324 is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 328 is opened and, in response, a portion of the drilling fluid in the line 332 may flow through the valve 328 so that the respective pressures in the line portion 312*a*, the line 306, the line 332 and the injector vessel 324 further equalize to a pressure that still remains greater than the pressure in the line portion 312*b*.

The valve 334 is opened, thereby permitting the impactor slurry to flow through the line 335 and the orifice 336, and to the line portion 312*b*. It is understood that the pressure in the line 335 may be less than the pressure in the line 306 due to several factors such as, for example, the pressure drop associated with the flow of the impactor slurry through one or more components such as, for example, the valve 334 and the orifice 336. Notwithstanding this pressure drop, the pump 304 continues to maintain a pressurized flow of drilling fluid into the injector vessel 324 via the line 306, the valve 328 and the line 332. Due to the pressurized flow of drilling fluid, and the pressure drop across the orifice 310, the pressure in the line 335 is still greater than the pressure in the line portion 312*b* of the line 312. As a result, the impactor slurry having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the slurry from the injector vessel 324 to the line portion 312*b* via the line 335 and the orifice 336. In an exemplary embodiment, it is understood that the flow of impactor slurry delivered to the pipe string 55 via the line portion 312*b* of the line 312 may be accelerated and discharged to remove a portion of the formation 52 (FIG. 1) in a manner similar to that described above.

After the impactor slurry has been completely discharged from the injector vessel 324, the valves 328 and 334 are closed, thereby preventing any flow of drilling fluid from the tank 302, through the pump 304, the line 306, the line 332, the injector vessel 324, the valve 334, the orifice 336 and the line 335, and to the line portion 312*b* of the line 312. The cylinder 326 is then operated so that the hydraulic cylinder fluid in the chamber 326*d* is discharged therefrom. During this discharge, the pressurized drilling fluid still present in the line 327 and the injector vessel 324 applies pressure against the piston 326*a*. As a result, the pressure in the line 327 and the injector vessel 324 is reduced, and may be reduced to atmospheric pressure. The valve 337 may be opened, thereby permitting a volume of the pressurized drilling fluid that may still be present in the injector vessel 324 to be displaced, thereby causing additional drilling fluid to flow from the line 338 to the tank 340. As a result, the pressure in the injector vessel 324 may be vented, thereby facilitating its return to atmospheric pressure.

At this point, the injector vessel 324 is again in its initial condition, with the injector vessel full of drilling fluid and the valve 337 open, and the valves 322, 348, 372, 328, 354, 366, 308, 388, 334, 360 and 382 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 324 may be repeated by again opening the valve 322 to again charge the injector vessel 324, that is, to again permit introduction of the solid material impactors 100 into the injector vessel 324, as discussed above.

The individual operation of the injector vessel 350 will be described. In an exemplary embodiment, the individual operation of the injector vessel 350 is substantially similar to the operation of the injector vessel 324, with the conduit 346, the valve 348, the injector vessel 350, the cylinder 352, the piston 352*a*, the housing 352*b*, the chamber 352*c*, the chamber 352*d*, the valve 354, the line 353, the line 358, the valve 360, the orifice 362, the line 364 and the valve 366 operating in a manner substantially similar to the above-described operation of the conduit 320, the valve 322, the injector vessel 324, the cylinder 326, the piston 326*a*, the housing 326*b*, the chamber 326*c*, the chamber 326*d*, the valve 328, the line 327, the line 332, the valve 334, the orifice 336, the line 335 and the valve 337, respectively. The line 368 operates in a manner similar to the line 338, except that both the line 368 and the line 338 are used to vent the injector vessel 350 during its operation.

More particularly, the injector vessel 350 is initially full of drilling fluid and the valve 366 is open, while the valves 322, 348, 372, 328, 354, 337, 308, 388, 334, 360 and 382 remain closed. As a result of the valve 366 being open, the pressure in the injector vessel 350 is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 350, the valve 348 is opened and the conveyor 316 transports solid material impactors 100 from the reservoir 314 to the tank 318. Solid material impactors 100 are also transported from the tank 318 and into the injector vessel 350 via the conduit 346 and the valve 348, thereby charging the injector vessel with the solid material impactors. In an exemplary embodiment, the solid material impactors 100 may be fed into the injector vessel 350 with drilling fluid, in a solution or slurry form, and/or may be gravity fed into the injector vessel 350 via the conduit 346 and the valve 348. The solid material impactors 100 and the drilling fluid present in the injector vessel 350 mix to form a suspension of liquid in the form of drilling fluid and the solid material impactors 100, that is, to form an impactor slurry.

As a result of the introduction of the solid material impactors 100 into the injector vessel 350, drilling fluid present in the injector vessel is displaced and the volume of the displaced drilling fluid flows to the tank 340 via the lines 368 and 338 and the valve 366. It is understood that the pump 342 may be operated to cause at least a portion of the displaced drilling fluid in the tank 340 to flow into the tank 318 via the line 344.

After the injector vessel 350 has been charged, that is, after the desired and relatively high volume of the solid material impactors 100 has been introduced into the injector vessel, the valve 346 is closed to prevent further introduction of solid material impactors 100 into the injector vessel, and the valve 366 is closed to prevent any further flow of drilling fluid to the tank 340. The cylinder 352 is then operated so that hydraulic cylinder fluid is introduced into the chamber 352*d* and, in response, the piston 352*a* applies pressure to the drilling fluid in the line 353, thereby pressurizing the line 353 and the injector vessel 350. The cylinder 352 pressurizes the line 353 and the injector vessel 350 until the pressure in the line 353 and the injector vessel 350 is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 354 is opened and, in response, a portion of the drilling fluid in the line portion 358 may flow through the valve 354 so that the respective pressures in the line portion 312*a*, the line 306, the line 358 and the injector vessel 350 further equalize to a pressure that still remains greater than the pressure in the line portion 312*b*.

The valve 360 is opened, thereby permitting the impactor slurry to flow through the line 364 and the orifice 362, and to the line portion 312*b*. It is understood that the pressure in the line 364 may be less than the pressure in the line 306 due to several factors such as, for example, the pressure drop associated with the flow of the impactor slurry through one or more components such as, for example, the valve 360 and the orifice 362. Notwithstanding this pressure drop, the pump 304 continues to maintain a pressurized flow of drilling fluid into the injector vessel 350 via the line 306, the valve 354 and the line 358. Due to the pressurized flow of drilling fluid, and the pressure drop across the orifice 310, the pressure in the line 364 is still greater than the pressure in the line portion 312*b* of the line 312. As a result, the impactor slurry having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the slurry from the injector vessel 350 to the line portion 312*b* via the line 364 and the orifice 362. In an exemplary embodiment, it is understood that the flow of impactor slurry delivered to the pipe string 55 via the line portion 312*b* of the line 312 may be accelerated and discharged to remove a portion of the formation 52 (FIG. 1) in order to excavate the formation, in a manner similar to that described above.

After the impactor slurry has been completely discharged from the injector vessel 350, the valves 354 and 360 are closed, thereby preventing any flow of drilling fluid from the tank 302, through the pump 304, the line 306, the line 358, the injector vessel 350, the valve 360, the orifice 362 and the line 364, and to the line portion 312*b* of the line 312. The cylinder 352 is then operated so that the hydraulic cylinder fluid in the chamber 352*d* is discharged therefrom. During this discharge, the pressurized drilling fluid still present in the line 353 and the injector vessel 350 applies pressure against the piston 352*a*. As a result, the pressure in the line 353 and the injector vessel 350 is reduced, and may be reduced to atmospheric pressure. The valve 366 may be opened, thereby permitting a volume of the pressurized drilling fluid that may still be present in the injector vessel 350 to be displaced via the line 368, thereby causing additional drilling fluid to flow from the line 338 to the tank 340. As a result, the pressure in the injector vessel 350 may be vented, thereby facilitating its return to atmospheric pressure.

At this point, the injector vessel 350 is again in its initial condition, with the injector vessel full of drilling fluid and the valve 366 open, and the valves 322, 348, 372, 328, 354, 337, 308, 388, 334, 360 and 382 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 350 may be repeated by again opening the valve 348 to again charge the injector vessel 350, that is, to again permit introduction of the solid material impactors 100 into the injector vessel 350, as discussed above.

The individual operation of the injector vessel 374 will be described. In an exemplary embodiment, the individual operation of the injector vessel 374 is substantially similar to the operation of the injector vessel 324, with the conduit 370, the valve 372, the injector vessel 374, the cylinder 376, the piston 376*a*, the housing 376*b*, the chamber 376*c*, the chamber 376*d*, the valve 308, the line 378, the line 380, the valve 382, the orifice 384, the line 386 and the valve 388 operating in a manner substantially similar to the above-described operation of the conduit 320, the valve 322, the injector vessel 324, the cylinder 326, the piston 326*a*, the housing 326*b*, the chamber 326*c*, the chamber 326*d*, the valve 328, the line 327, the line 332, the valve 334, the orifice 336, the line 335 and the valve 337, respectively. The line 390 operates in a manner similar to the line 338, except that both the line 390 and the line 338 are used to vent the injector vessel 374 during its operation.

More particularly, the injector vessel 374 is initially full of drilling fluid and the valve 388 is open, while the valves 322, 348, 372, 328, 354, 366, 308, 337, 334, 360 and 382 remain closed. As a result of the valve 388 being open, the pressure in the injector vessel 374 is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 374, the valve 372 is opened and the conveyor 316 transports solid material impactors 100 from the reservoir 314 to the tank 318. Solid material impactors 100 are also transported from the tank 318 and into the injector vessel 374 via the conduit 370 and the valve 372, thereby charging the injector vessel with the solid material impactors. In an exemplary embodiment, the solid material impactors 100 may be fed into the injector vessel 374 with drilling fluid, in a solution or slurry form, and/or may be gravity fed into the injector vessel 374 via the conduit 370 and the valve 372. In an exemplary embodiment, the solid material impactors 100 may be gravity fed into the injector vessel 374 via the conduit 370 and the valve 372. The solid material impactors 100 and the drilling fluid present in the injector vessel 374 mix to form a suspension of liquid in the form of drilling fluid and the solid material impactors 100, that is, to form an impactor slurry.

As a result of the introduction of the solid material impactors 100 into the injector vessel 374, drilling fluid present in the injector vessel is displaced and the volume of the displaced drilling fluid flows to the tank 340 via the lines 390 and 338 and the valve 337. It is understood that the pump 342 may be operated to cause at least a portion of the displaced drilling fluid in the tank 340 to flow into the tank 318 via the line 344.

After the injector vessel 374 has been charged, that is, after the desired and relatively high volume of the solid material impactors 100 has been introduced into the injector vessel, the valve 372 is closed to prevent further introduction of solid material impactors 100 into the injector vessel, and the valve 388 is closed to prevent any further flow of drilling fluid to the tank 340. The cylinder 376 is then operated so that hydraulic cylinder fluid is introduced into the chamber 376*d* and, in response, the piston 376*a* applies pressure to the drilling fluid in the line 378, thereby pressurizing the line 378, the line 380 and the injector vessel 374. The cylinder 376 pressurizes the line 378 and the injector vessel 374 until the pressure in the line 378 and the injector vessel 374 is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 308 is opened and, in response, a portion of the drilling fluid in the line portion 306 may flow through the valve 308 so that the respective pressures in the line portion 312*a*, the line 306, the line 380 and the injector vessel 374 further equalize to a pressure that still remains greater than the pressure in the line portion 312*b*.

The valve 382 is opened, thereby permitting the impactor slurry to flow through the line 386 and the orifice 384, and to the line portion 312*b*. It is understood that the pressure in the line 386 may be less than the pressure in the line 306 due to several factors such as, for example, the pressure drop associated with the flow of the impactor slurry through one or more components such as, for example, the valve 382 and the orifice 384. Notwithstanding this pressure drop, the pump 304 continues to maintain a pressurized flow of drilling fluid into the injector vessel 374 via the line 306, the valve 308 and the line 380. Due to the pressurized flow of drilling fluid, and the pressure drop across the orifice 310, the pressure in the line 386 is still greater than the pressure in the line portion 312*b* of the line 312. As a result, the impactor slurry having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the slurry from the injector vessel 374 to the line portion 312*b* via the line 386 and the orifice 384. In an exemplary embodiment, it is understood that the flow of impactor slurry delivered to the pipe string 55 via the line portion 312*b* of the line 312 may be accelerated and discharged to remove a portion of the formation 52 (FIG. 1) in order to excavate the formation, in a manner similar to that described above.

After the impactor slurry has been completely discharged from the injector vessel 374, the valves 308 and 382 are closed, thereby preventing any flow of drilling fluid from the tank 302, through the pump 304, the line 306, the line 380, the injector vessel 374, the valve 382, the orifice 384 and the line 386, and to the line portion 312*b* of the line 312. The cylinder 376 is then operated so that the hydraulic cylinder fluid in the chamber 376*d* is discharged therefrom. During this discharge, the pressurized drilling fluid still present in the line 378 and the injector vessel 374 applies pressure against the piston 376*a*. As a result, the pressure in the line 378 and the injector vessel 374 is reduced, and may be reduced to atmospheric pressure. The valve 388 is opened, thereby permitting a volume of the pressurized drilling fluid that may still be present in the injector vessel 374 to be displaced via the line 390, thereby causing additional drilling fluid to flow from the line 338 to the tank 340. As a result, the pressure in the injector vessel 374 may be vented, thereby facilitating its return to atmospheric pressure.

At this point, the injector vessel 374 is again in its initial condition, with the injector vessel full of drilling fluid and the valve 388 open, and the valves 322, 348, 372, 328, 354, 366, 308, 337, 334, 360 and 382 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 374 may be repeated by again opening the valve 372 to again charge the injector vessel 374, that is, to again permit introduction of the solid material impactors 100 into the injector vessel 374, as discussed above.

Referring to the table in FIG. 22 with continuing reference to FIG. 21, although the individual operation of the injector vessel 350 is substantially similar to the operation of the injector vessel 324, the initiation of the operation of the injector vessel 350, in an exemplary embodiment, is staggered in time from the initiation of the operation of the injector vessel 324. Similarly, although the individual operation of the injector vessel 374 is substantially similar to the operation of each of the injector vessels 324 and 350, the initiation of the operation of the injector vessel 374, in an exemplary embodiment, is staggered in time from the initiations of operation of both of the injector vessels 324 and 350. As a result, each of the injector vessels 324, 350 and 374 undergoes a different operational step at one or more times during the operation of the system 300.

For example and with reference to the row of operational steps corresponding to the time period labeled "Time 3" in the table shown in FIG. 22, during the above-described injection of impactor slurry into the line portion 312*b* and to the pipe string 55 by the injector vessel 324, the injector vessel 350 may be pressurized using the cylinder 352 until the pressure in the injector vessel is greater than the pressure in the line portion 312*b*, and is less than, substantially or nearly equal to, or greater than, the pressure in the line 306 which, as noted above, is substantially equal to the supply pressure of the pump 304. During the pressurization of the injector vessel 350 using the cylinder 352, the pistons 326*a* and 376*a* do not apply pressure against the drilling fluid in the lines 327 and 378, respectively, so that only the injector vessel 350 is pressurized.

Moreover, and again during the injection of impactor slurry into the line portion 312*b* and to the pipe string 55 by the injector vessel 324, the injector vessel 376 may be charged with the desired volume of solid material impactors 100 by opening the valve 372 and permitting the solid material impactors 100 to be transported from the tank 318 to the injector vessel 376 via the valve and the conduit 370. During the charging of the injector vessel 376 with the solid material impactors 100, the valves 322 and 348 are closed to prevent any charging of the injector vessels 324 and 350, respectively, so that only the injector vessel 374 is charged with the solid material impactors.

With reference to the row of operational blocks corresponding to the time period labeled "Time 4" in the table shown in FIG. 22, which corresponds to another time period after the injection of the impactor slurry by the injector vessel 324, pressurization of the injector vessel 350, and charging of the injector vessel 374, the injector vessel 324 may be again charged with the desired volume of solid material impactors 100.

During the charging of the injector vessel 324, the injector vessel 350 may inject impactor slurry into the line portion 312*b* of the line 312, and to the pipe string 55, through the open valve 360, the orifice 362 and the line 364. During the injection by the injector vessel 350, the valves 334 and 382 are closed to prevent any injection into the line portion 312*b* by the injector vessels 324 and 376, respectively.

Moreover, and again during the charging of the injector vessel 324, the injector vessel 374 may be pressurized using the cylinder 376 until the pressure in the injector vessel is greater than the pressure in the line portion 312*b*, and is less than, substantially or nearly equal to, or greater than, the pressure in the line 306 which, as noted above, is substantially equal to the supply pressure of the pump 304. During the pressurization of the injector vessel 374 by the cylinder 376, the pistons 326*a* and 352*a* do not apply pressure against the drilling fluid in the lines 327 and 353, respectively, so that only the injector vessel 374 is pressurized.

With reference to the row of operational blocks corresponding to the time period labeled "Time 5" in the table shown in FIG. 22, which corresponds to another time period after the charging of the injector vessel 324, injection of impactor slurry by the injector vessel 350, and pressurization of the injector vessel 374, the injector vessel 324 may be again pressurized using the cylinder 326 until the pressure in the injector vessel 324 is greater than the pressure in the line portion 312*b*, and is less than, substantially equal to, or greater than, the pressure in the line 306 which, as noted above, is substantially equal to the supply pressure of the pump 304.

During the pressurization of the injector vessel 324, the injector vessel 350 may be charged with the desired volume of solid material impactors 100 by opening the valve 348 and permitting the solid material impactors 100 to be transported from the tank 318 to the injector vessel 350 via the valve and the conduit 346. During the charging of the injector vessel 350 with the solid material impactors 100, the valves 322 and 372 are closed to prevent any charging of the injector vessels 324 and 374, respectively, so that only the injector vessel 350 is charged with the solid material impactors.

Moreover, and again during the pressurization of the injector vessel 324, the injector vessel 374 may inject impactor slurry into the line portion 312*b* of the line 312, and to the pipe string 55, through the open valve 382, the orifice 384 and the line 386. During the injection by the injector vessel 374, the valves 334 and 360 are closed to prevent any injection into the line portion 312*b* by the injector vessels 324 and 350, respectively.

In view of the foregoing, it is understood that, during at least portions of one or more time periods during the operation of the system 300, one of the injector vessels 324, 350 and 374 will be undergoing charging, that is, receiving a desired volume of solid material impactors 100, while another of the injector vessels will be undergoing pressurization to a pressure substantially or nearly equal to the supply pressure of the pump 304, and while yet another of the injector vessels will be injecting impactor slurry into the line portion 312*b* and to the pipe string 55. As a result, a constant, generally uniformly distributed and relatively-high-pressure injection of impactor slurry will be injected into and flow through a flow region defined by the line portion 312*b* of the line 312 and to the pipe string 55 during the operation of the system 300, with the impactor slurry having a relatively high volume of solid material impactors 100. It is understood that, during a particular time period during the operation of the system 300, the charging of one of the injector vessels 324, 350 and 374 may occur before, during and/or after the pressurization of another of the injector vessels 324, 350 and 374 which, in turn, may occur before, during and/or after the injection of impactor slurry by yet another of the injector vessels 324, 350 and 374. It is understood that, during a particular time period of operation of the system 300, the charging of one of the injector vessels 324, 350 and 374 may occur simultaneously with, at least partially simultaneously with, or not simultaneously with the pressurization of another of the injector vessels 324, 350 and 374 which, in turn, may occur simultaneously with, at least partially simultaneously with, or not simultaneously with the injection of impactor slurry by yet another of the injector vessels 324, 350 and 374.

It is understood that the sequence of operation of each of the injector vessels 324, 350 and 374 is substantially the same, but that the initiation of the operational sequence of each injector vessel is controlled relative to the initiation of the operational sequences of the other injector vessels. The sequential injection of impactor slurry by the injector vessels 324, 350 and 374 may be controlled to achieve the desired or required mass flow rate of impactor slurry in the line portion 312*b*.

It is further understood that a wide variety of time-staggering configurations between the initiations of operation of the injector vessels 324, 350 and 374 may be employed during the operation of the system 300. Also, it is understood that the order of operation depicted in FIG. 22 is arbitrary and may be modified. For example, the order of initial operation, that is, the time-staggering order, between the injector vessels 324, 350 and 374 may be modified. In an exemplary embodiment, it is understood that each of the time steps or time periods needed to charge one of the injector vessels 324, 350 and 374, pressurize one of the injector vessels 324, 350 and 374, and/or permit one of the injectors 324, 350 and 374 to inject impactor slurry may not be constant and may vary among each other. Moreover, in an exemplary embodiment, the time period or time step required to charge and/or pressurize one or more of the injector vessels 324, 350 and 374, and/or the time step or time period required to permit one or more of the injector vessels 324, 350 and 374 to inject impactor slurry, may vary as time passes.

Moreover, it is understood that the above-described initial conditions of the system 300, and/or one or more of the injector vessels 324, 350 and 374 may be arbitrary and that additional operational steps may be necessary to carry out the above-described operation of the system. For example, if the injector vessel 324 is not initially full of drilling fluid, it is understood that the injector vessel 324 may be filled with drilling fluid.

It is understood that the quantity of injector vessels in the system 300 may be decreased to two injector vessels or one injector vessel, or may be increased to an unlimited number. In an exemplary embodiment, the quantity of injector vessels in the system 300 may be increased to an unlimited number for one or more reasons such as, for example, redundancy and/or maintenance reasons. It is further understood that the quantity of injector vessels may be dictated by many factors, including the desired or required mass flow rates of the solid material impactors 100 and/or the impactor slurry containing drilling fluid and the solid material impactors 100, the desire or requirement to smooth the injection of impactor slurry, and/or the desire or requirement to more evenly distribute the solid material impactors 100 within the flowing impactor slurry.

Further, it is understood that the valves 322, 348, 372, 328, 354, 366, 308, 388, 334, 360 and 382 may be controlled in any conventional manner, including the opening and closing thereof. Also, it is understood that each of the valves 322, 348, 372, 328, 354, 366, 308, 388, 334, 360 and 382 may be controlled to fully open, fully close, partially open and/or partially close, in order to achieve operational goals and/or requirements such as, for example, the desired or required mass flow rate of impactor slurry and/or the solid material impactors 100.

Figure 23:
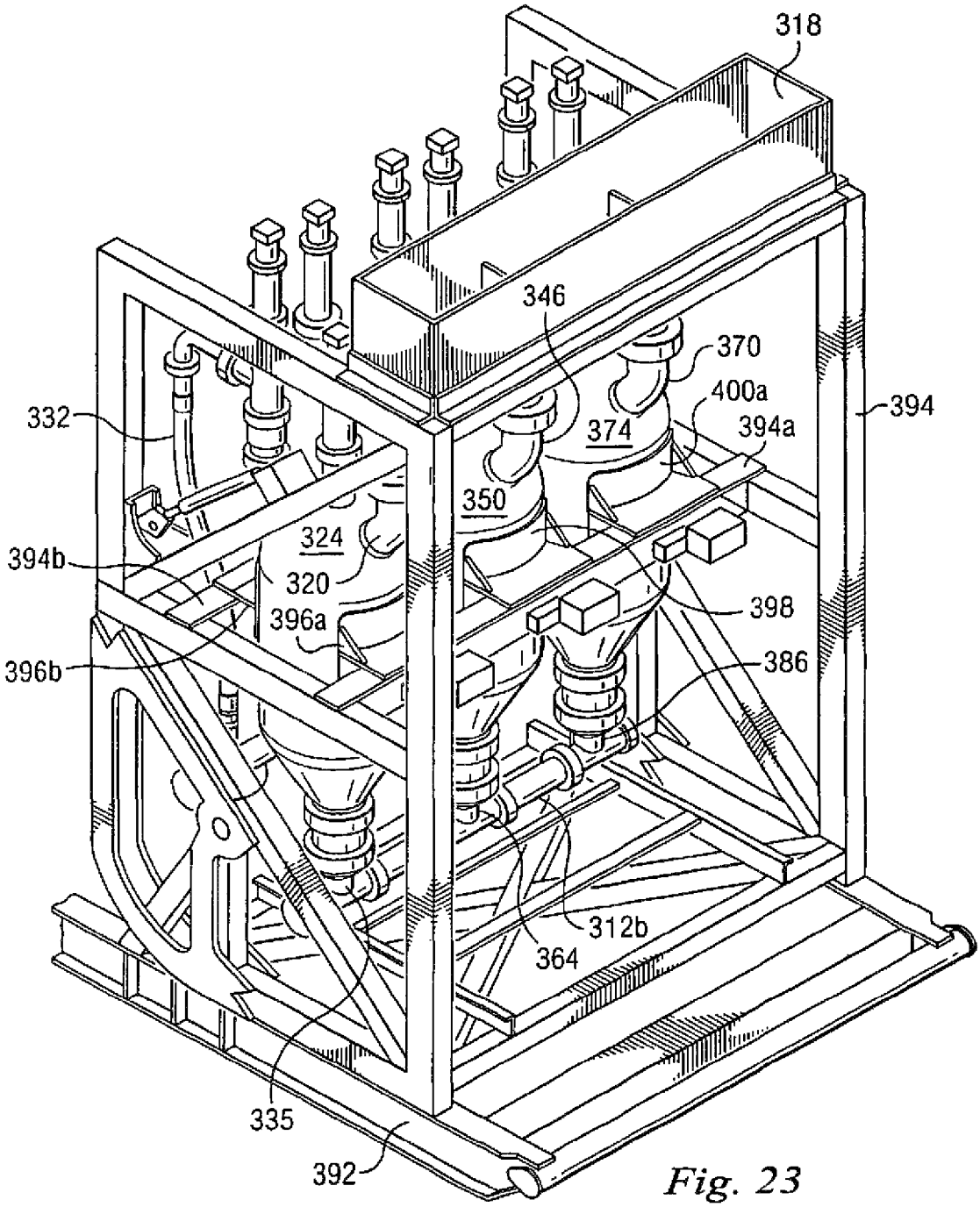
FIG. 23 is a perspective view of a portion of the injection system of FIG. 21 according to an embodiment, the portion including a plurality of injector vessels.
Figure 24:
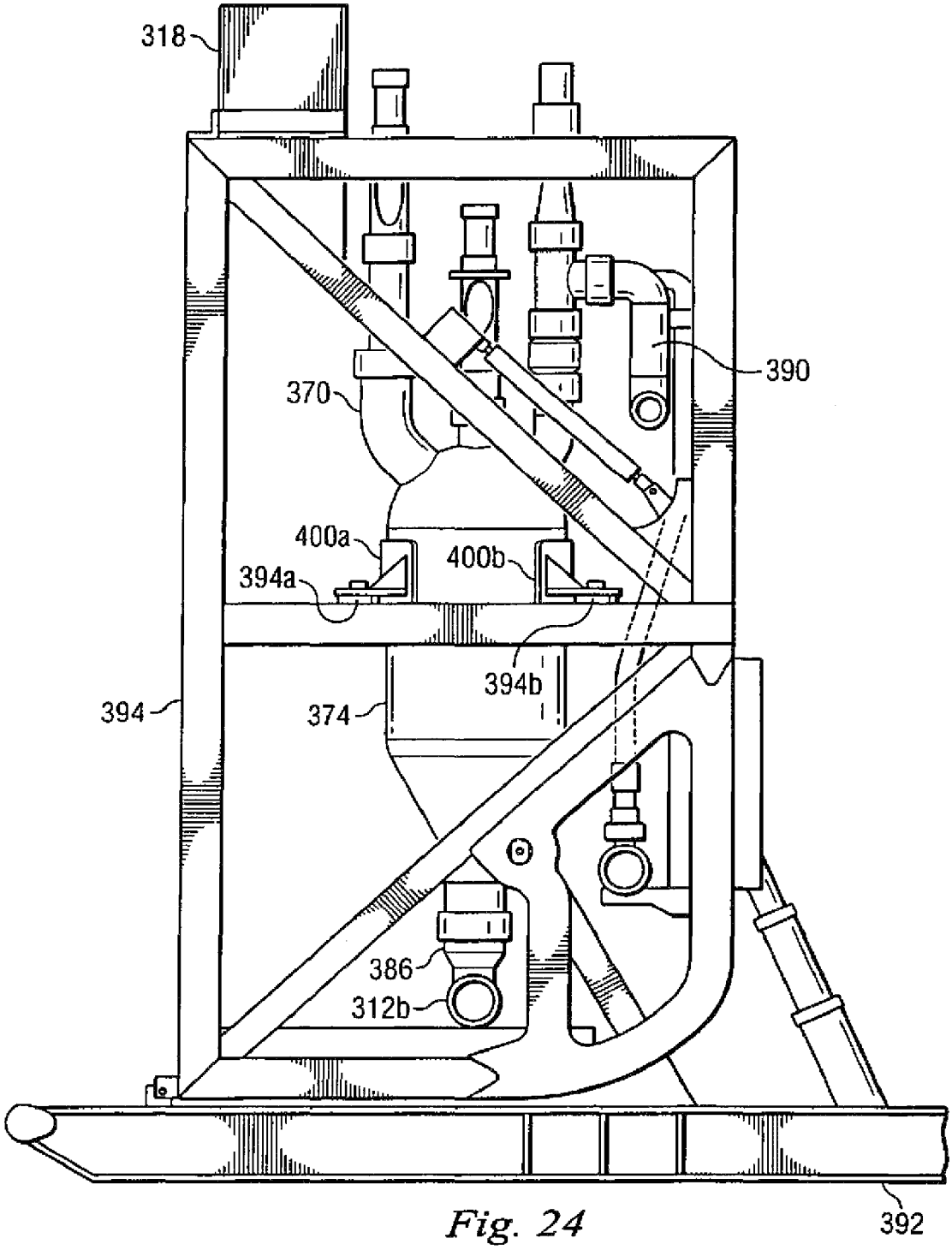
FIG. 24 is an elevational view of the portion of the injection system of FIG. 23.

In an exemplary embodiment, as illustrated in FIGS. 23-24 with continuing reference to FIGS. 21-22, the injector vessels 324, 350 and 374 of the injection system 300 are mounted on a skid 392 and are supported by a frame structure 394 extending from the skid. Symmetric support brackets 396*a* and 396*b* connect the injector vessel 324 to horizontally-extending members 394*a* and 394*b*, respectively, of the frame structure 394. Similarly, a support bracket 398 connects the injector vessel 350 to the member 394*a* and another support bracket, symmetric to the support bracket 398 and not shown, connects the injector vessel 350 to the member 394*b*. Symmetric support brackets 400*a* and 400*b* connect the injector vessel 374 to the members 394*a* and 394*b*, respectively. Several additional components of the injection system 300 are shown in FIGS. 23 and/or 24, including the tank 318; the conduits 320, 346 and 370; the line portion 312*b* of the line 312; the lines 335, 364 and 386; the line 338; the line 390; and the line 380. It is understood that one or more additional components of the system 300 may be mounted on the skid and/or supported by the frame structure 394, such as, for example, the pumps 304 and/or 342, the cylinders 326, 352 and/or 376, and/or the tanks 302 and/or 340.

Figure 25:
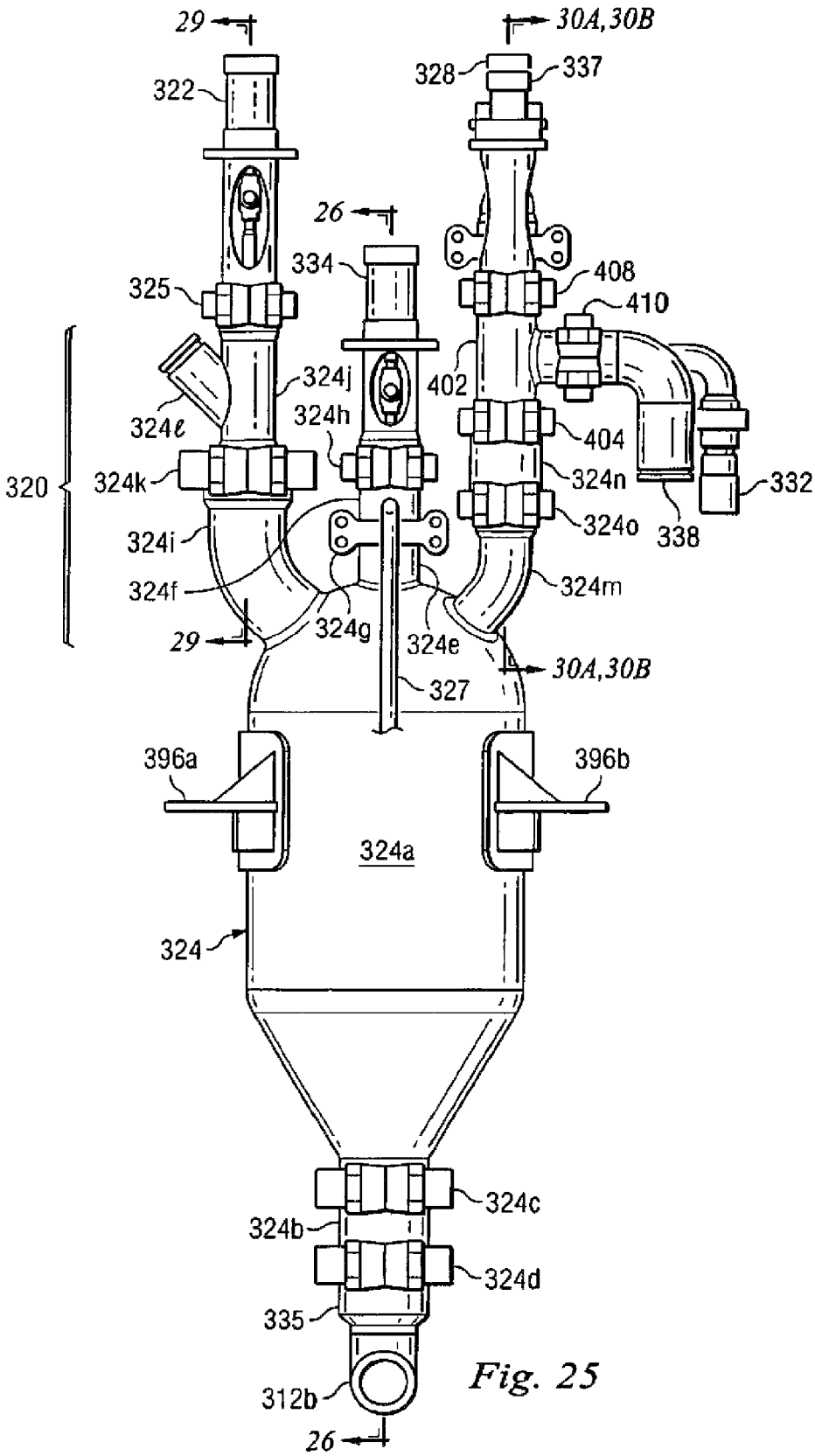
FIG. 25 is an elevational view of an injector vessel of the portion of the injection system of FIG. 23.

In an exemplary embodiment, as illustrated in FIG. 25, the injector vessel 324 includes a body 324*a* and a tubular spool 324*b* connected to the body via a clamping ring 324*c*. The line 335 is connected to the tubular spool 324*b* via a clamping ring 324*d*. A tubular portion 324*e* extends upwards from the body 324*a* and is connected to a tubular portion 324*f* via a clamping ring 324*g*. The line 327 is connected to the tubular portion 324*f*, and the tubular portion is connected to the valve 334 via a clamping ring 324*h*. The valve 334 will be described in greater detail below.

A tubular portion 324*i* extends from the body 324*a* and is connected to a tubular portion 324*j* via a clamping ring 324*k*, and a tubular portion 324*l* extends from the tubular portion 324*j*. The valve 322 is connected to the tubular portion 324*j* via a clamping ring 325. The valve 322 will be described in greater detail below. It is understood that the tubular portions 324*i*, 324*j* and 324*l* collectively define the conduit 320 that connects the tank 318 to the body 324*a* of the injector vessel 324. It is further understood that one or more additional intervening parts may extend between the tubular portion 324*l* and the tank 318, and that these one or more additional intervening parts may collectively define the conduit 320 that connects the tank 18 to the body 324*a* of the injector 324, along with the tubular portions 324*i*, 324*j* and 324*l*.

A tubular portion 324*m* extends from the body 324*a* and is connected to a tubular portion 324*n* via a clamping ring 324*o*. A tee 402 is connected to the tubular portion 324*n* via a clamping ring 404. The valve 337 is connected to the tee 402 via a clamping ring 408. The valve 328 is connected to the body 324*a* of the injector vessel 324 via intervening parts not shown and in a manner to be described below.

The line 338 is connected to the tee 402 via a clamping ring 410. The line 332 is connected to the body 324*a* of the injector vessel 324 via intervening parts not shown and in a manner to be described below. It is understood that only portions of the lines 327, 332 and 338 are shown in FIG. 25.

Figure 26:
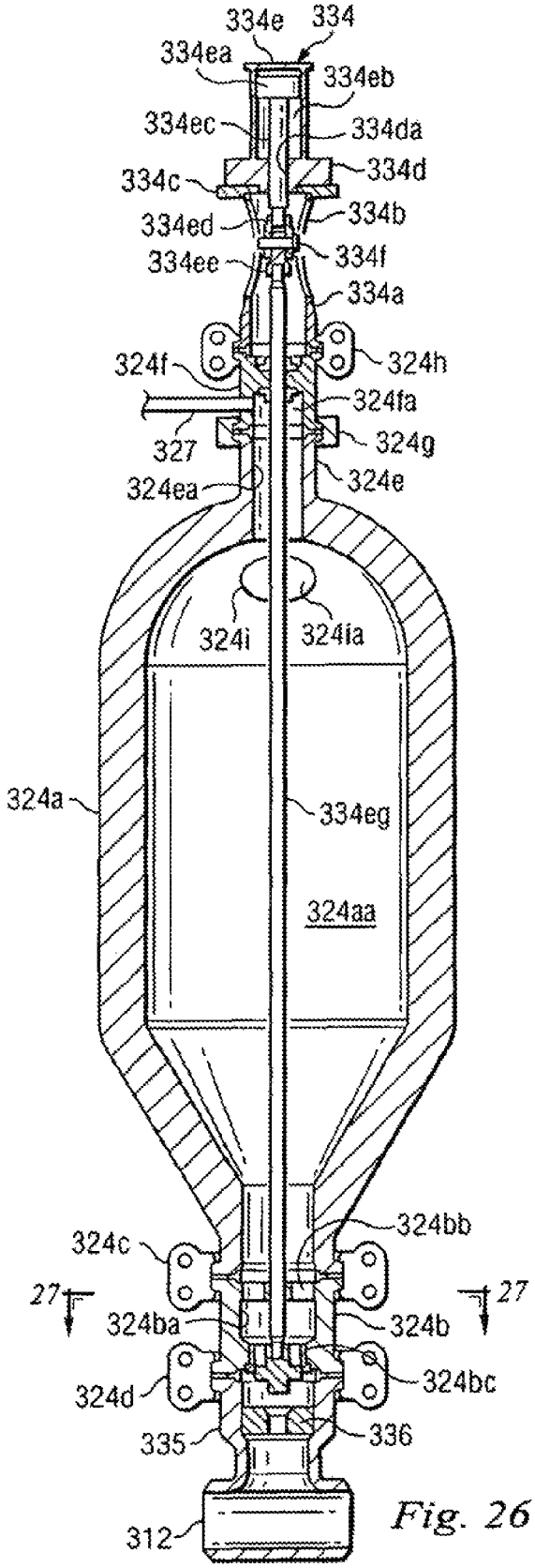
FIG. 26 is a sectional view of the injector vessel of FIG. 25 taken along line 26-26.
Figure 27:
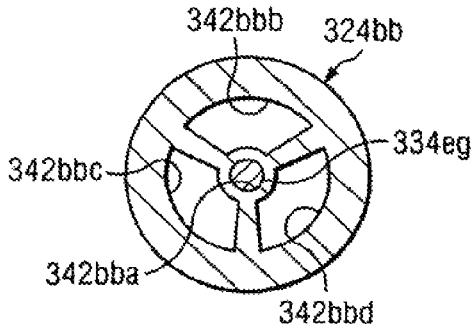
FIG. 27 is a sectional view of the injector vessel of FIG. 26 taken along line 27-27.
Figure 28:
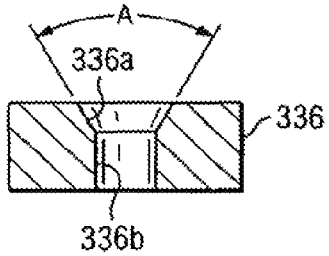
FIG. 28 is an enlarged view of a portion of the injector vessel of FIG. 26.

In an exemplary embodiment, as illustrated in FIGS. 26-28, the body 324*a* of the injector vessel 324 defines a variable-diameter chamber 324*aa*, and the tubular portion 324*i* defines a passage 324*ia*. The tubular spool 324*b* defines a passage 324*ba* and includes a radially-extending disc 324*bb* disposed within the passage in the vicinity of the clamping ring 324*c*. The disc 324*bb* includes an axially-extending through-bore 324*bba* and three circumferentially-spaced through-openings 324*bbb*, 324*bbc* and 324*bbd*. A plug seat 324*bc* is connected to the interior surface of the tubular spool 324*b* and extends within the passage 324*ba*.

The orifice 336 is connected to the interior surface of and radially extends within the line 335, and includes a countersunk opening 336*a* and a through-bore 336*b* extending therefrom. In an exemplary embodiment, the countersunk opening 336*a* defines an angle A. In an exemplary embodiment, the angle A may be 30 degrees, resulting in the orifice 336 defining a 30-degree-metering throat that is adapted to meter fluid flow through the orifice 336. It is understood that the angle A may vary widely.

The tubular portions 324*e* and 324*f* define passages 324*ea* and 324*fa*, respectively. The valve 334 includes a generally hour-glass-shaped support member 334*a*, through which a window 334*b* extends, and an end of which is connected to the tubular portion 324*f* via the clamping ring 324*h*. A support collar 334*c* is coupled to the other end of the support member 334*a*, and a housing base 334*d* is coupled to and extends through the collar 334*c*, and defines a bore 334*da*. A hydraulic-actuated and/or pneumatic-actuated cylinder 334*e* is connected to the housing base 334*d*, and includes a piston 334*ea* that reciprocates in a housing 334*eb* in response to cylinder fluid being introduced into, and discharged from, the housing, in a conventional manner.

An end of a rod 334*ec* is connected to and extends downward from the piston 334*ea*, extending through the bore 334*da* and into the support member 334*a*. The other end of the rod 334*ec* is connected to a coupling 334*ed* which in turn, is connected to a coupling 334*ee* via a pin 334*ef*. An end of a shaft 334*eg* is connected to the coupling 334*ee*, and the shaft extends downwards through the support member 334*a*, through the passages 324*fa* and 324*ea* of the tubular portions 324*f* and 324*e*, respectively, through the chamber 324*aa*, the bore 324*bba* of the disc 324*bb* of the tubular spool 324*b*, and the passage 324*ba* of the tubular spool, and at least partially within the plug seat 324*bc*. The disc 324*bb* is adapted to support and/or stabilize the shaft 334*eg*. A plug element 334*eh* is connected to the other end of the shaft 334*eg*, and at least partially extends within the line 335 at an axial position above the orifice 336. The plug element is 334*eh* is adapted to move up and down in response to the reciprocating motion of the piston 334*ea*, and thus engage and disengage, respectively, the plug seat 324*bc* to close and open, respectively, the valve 334.

Figure 29:
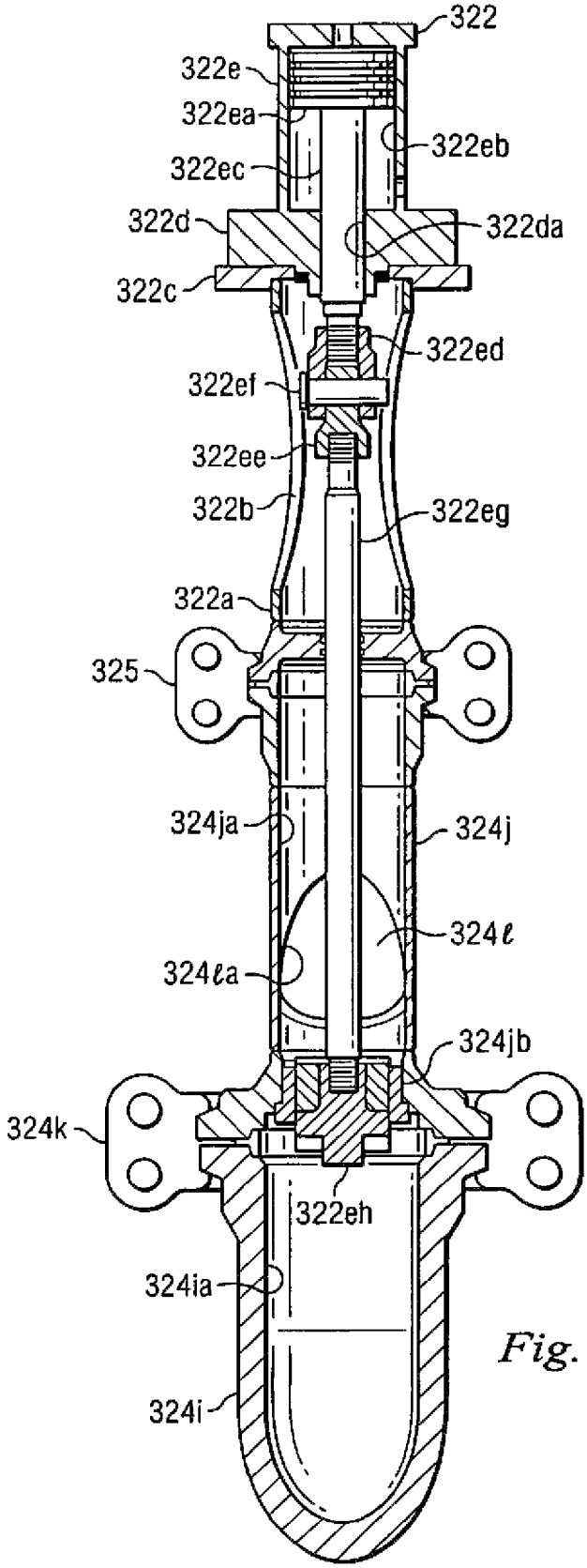
FIG. 29 is a sectional view of the injector vessel of FIG. 25 taken along line 29-29.

In an exemplary embodiment, as illustrated in FIG. 29, the tubular portion 324*i* of the injection vessel 324 defines the passage 324*ia*, as noted above. The tubular portions 324*j* and 324*l* define passages 324*ja* and 324*la*, respectively. A plug seat 324*jb* is connected to the interior surface of the tubular portion 324*j* and extends within the passage 324*ja*.

The valve 322 includes a generally hour-glass-shaped support member 322*a*, through which a window 322*b* extends, and an end of which is connected to the tubular portion 324*j* via the clamping ring 325. A support collar 322*c* is coupled to the other end of the support member 322*a*, and a housing base 322*d* is coupled to and extends through the collar 322*c*, and defines a bore 322*da*. A hydraulic-actuated and/or pneumatic-actuated cylinder 322*e* is connected to the housing base 322*d*, and includes a piston 322*ea* that reciprocates in a housing 322*eb* in response to cylinder fluid being introduced into, and discharged from, the housing, in a conventional manner.

An end of a rod 322*ec* is connected to and extends downward from the piston 322*ea*, extending through the bore 322*da* and into the support member 322*a*. The other end of the rod 322*ec* is connected to a coupling 322*ed* which, in turn, is connected to a coupling 322*ee* via a pin 322*ef*. An end of a shaft 322*eg* is connected to the coupling 322*ee*, and the shaft extends downwards through the support member 322*a*, through the passage 324*ja* of the tubular portion 324*j*, and at least partially within the plug seat 324*jb*. A plug element 322*eh* is connected to the other end of the shaft 322*eg*, and at least partially extends within the passage 324*ia*. The plug element 322*eh* is adapted to move up and down in response to the reciprocating motion of the piston 322*ea*, and thus engage and disengage, respectively, the plug seat 324*jb* to close and open, respectively, the valve 322.

Figure 30B:
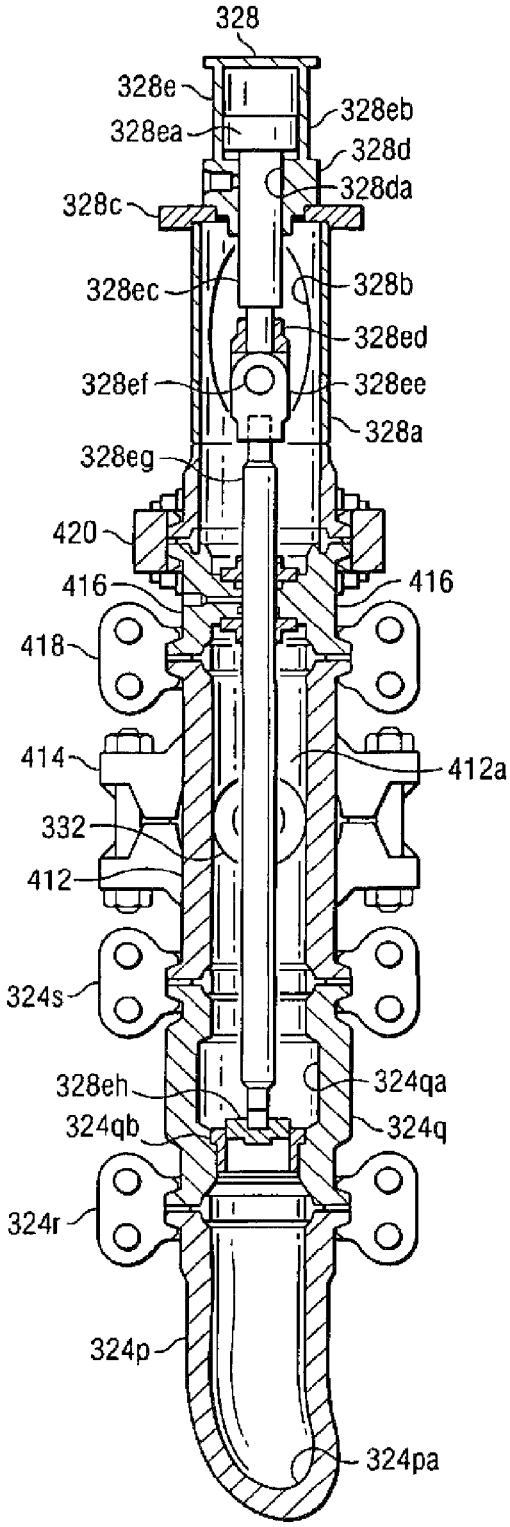
FIGS. 30A-30B are co-planar sectional views of the injector vessel of FIG. 25 taken along line 30A, 30B-30A, 30B.
Figure 30A:
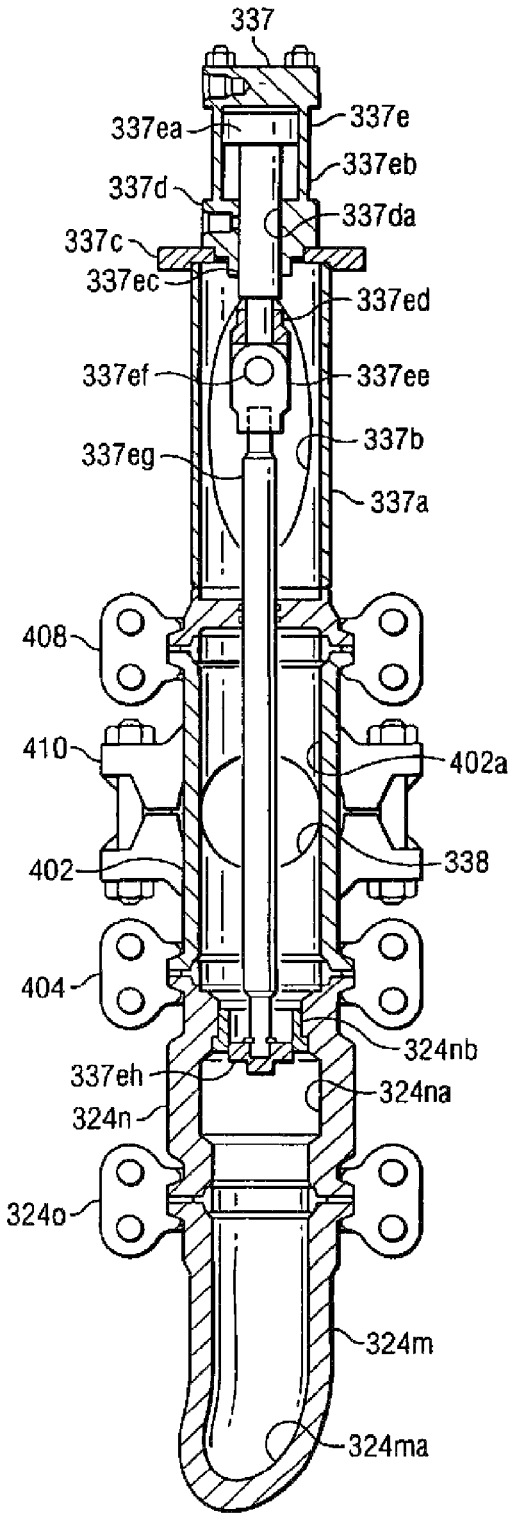

In an exemplary embodiment, as illustrated in FIG. 30A, the tubular portions 324*m* and 324*n* define passages 324*ma* and 324*na*, respectively, and the tee 402 defines a passage 402*a*. A plug seat 324*nb* is connected to the interior surface of the tubular portion 324*n* and extends within the passage 324*na*.

The valve 337 includes a generally hour-glass-shaped support member 337*a*, through which a window 337*b* extends, and an end of which is connected to the tee 402 via the clamping ring 408. A support collar 337*c* is coupled to the other end of the support member 337*a*, and a housing base 337*d* is coupled to and extends through the collar 337*c*, and defines a bore 337*da*. A hydraulic-actuated and/or pneumatic-actuated cylinder 337*e* is connected to the housing base 337*d*, and includes a piston 337*ea* that reciprocates in a housing 337*eb* in response to cylinder fluid being introduced into, and discharged from, the housing, in a conventional manner.

An end of a rod 337*ec* is connected to and extends downward from the piston 337*ea*, extending through the bore 337*da* and into the support member 337*a*. The other end of the rod 337*ec* is connected to a coupling 337*ed* which, in turn, is connected to a coupling 337*ee* via a pin 337*ef*. An end of a shaft 337*eg* is connected to the coupling 337*ee*, and the shaft extends downwards through the support member 337*a*, through the passage 402*a* of the tee 402, and at least partially within the plug seat 324*nb*. A plug element 337*eh* is connected to the other end of the shaft 337*eg*, and at least partially extends within the passage 324*na* of the tubular portion 324*n*. The plug element is 337*eh* is adapted to move up and down in response to the reciprocating motion of the piston 337*ea*, and thus engage and disengage, respectively, the plug seat 324*nb* to close and open, respectively, the valve 337.

In an exemplary embodiment, as illustrated in FIG. 30B and noted above, the valve 328 is connected to the body 324*a* of the injector vessel 324 via intervening parts, which include a tubular portion 324*p* extending from the body 324*a* that defines a passage 324*pa*, and a tubular portion 324*q* connected to the tubular portion 324*p*, via a clamping ring 324*r*, and that defines a passage 324*qa*. A plug seat 324*qb* is connected to the interior surface of the tubular portion 324*q* and extends within the passage 324*qa*. A clamping ring 324*s* connects the tubular portion 324*q* to a tee 412 which, in turn, is connected to the line 338 via a clamping ring 414. The tee 412 defines a passage 412*a*. A coupling member 416 is connected to the tee 412 via a clamping ring 418.

The valve 328 is connected to the coupling member 416 via a clamping ring 420. The valve 328 includes a generally hour-glass-shaped support member 328*a*, through which a window 328*b* extends, and an end of which is connected to the coupling member 416 via the clamping ring 420. A support collar 328*c* is coupled to the other end of the support member 328*a*, and a housing base 328*d* is coupled to and extends through the collar 328*c*, and defines a bore 328*da*. A hydraulic-actuated and/or pneumatic-actuated cylinder 328*e* is connected to the housing base 328*d*, and includes a piston 328*ea* that reciprocates in a housing 328*eb* in response to cylinder fluid being introduced into, and discharged from, the housing, in a conventional manner.

An end of a rod 328*ec* is connected to and extends downward from the piston 328*ea*, extending through the bore 328*da* and into the support member 328*a*. The other end of the rod 328*ec* is connected to a coupling 328*ed* which, in turn, is connected to a coupling 328*ee* via a pin 328*ef*. An end of a shaft 328*eg* is connected to the coupling 328*ee*, and the shaft extends downwards through the support member 328*a*, through the coupling member 416, through the passage 412*a* of the tee 412, and at least partially within the passage 324*qa* of the tubular portion 324*q*. A plug element 328*eh* is connected to the other end of the shaft 328*eg*, and at least partially extends within the passage 324*qa* of the tubular portion 324*q*. The plug element 328*eh* is adapted to move up and down in response to the reciprocating motion of the piston 328*ea*, and thus disengage and engage, respectively, the plug seat 324*qb* to open and close, respectively, the valve 328.

Figure 31:
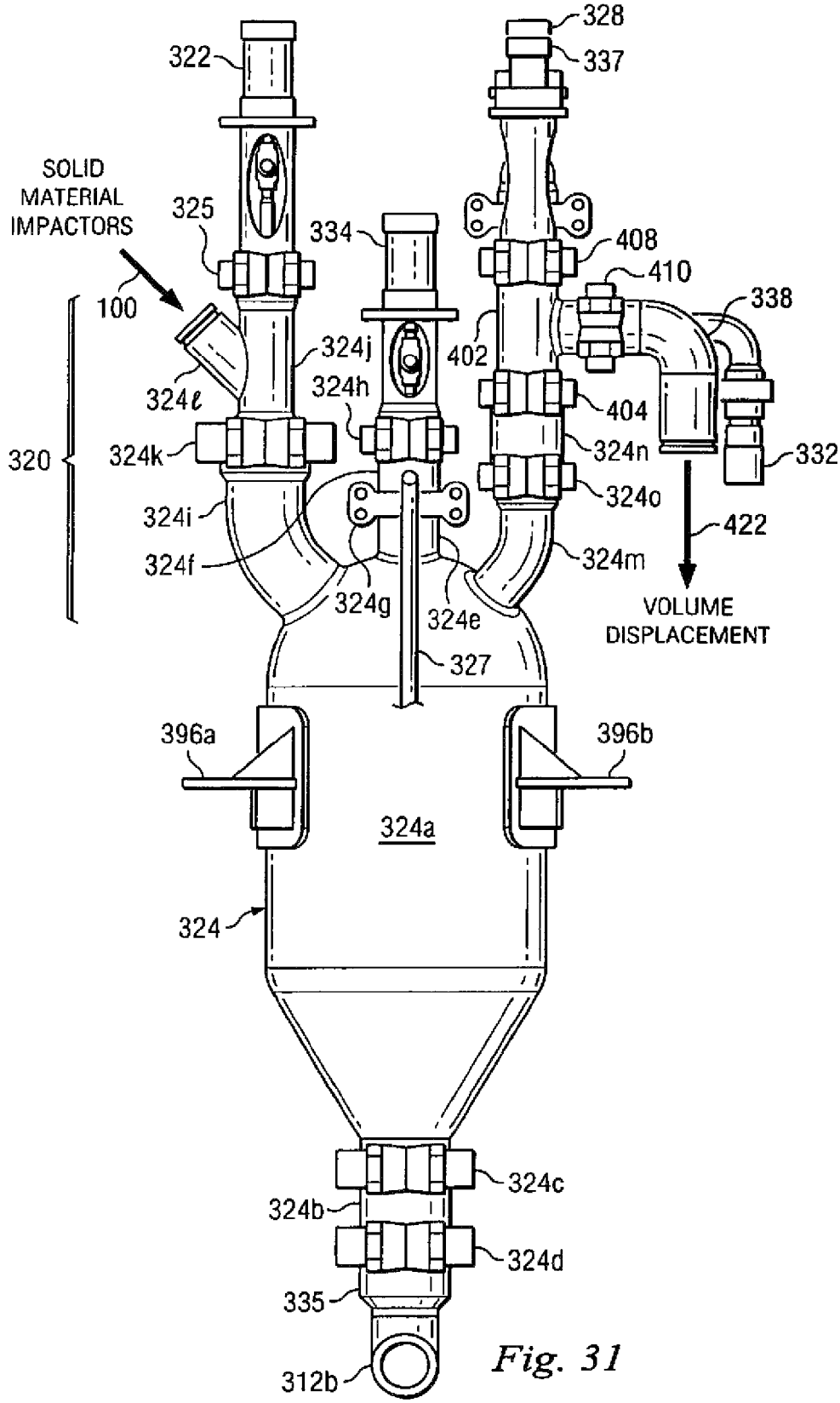
FIGS. 31-34 are views similar to that of FIG. 25 but depicting different operational modes of the injector vessel.

In an exemplary embodiment, as illustrated in FIG. 31 with continuing reference to FIGS. 21-30, the individual operation of the injector vessel 324, when mounted on the skid 392 and supported by the frame 394, will be described. It is understood that the operation of the injector vessel 324, when mounted on the skid 392 and supported by the frame 394, substantially corresponds to the operation of the injector vessel 324 described above in connection with FIG. 21.

Initially, the chamber 324*aa* of the body 324*a* of the injector vessel 324 is full of drilling fluid and the valve 337 is open, that is, the plug element 337*eh* is disengaged from the plug seat 324*nb*, while the valves 322, 348, 372, 328, 354, 366, 308, 388, 334, 360 and 382 remain closed. As a result of the valve 337 being open, the pressure within the chamber 324*aa* is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 324, the valve 322 is opened by moving the piston 322*ea* downward so that, as a result, the rod 322*ec*, the coupling 322*ed*, the pin 322*ef*, the coupling 322*ee*, the shaft 322*eg* and the plug element 322*eh* move downward and the plug element disengages from the plug seat 324*jb*. In an exemplary embodiment, it is understood that the piston 322*ea*, and therefore the valve 322, may be controlled in any conventional manner. The conveyor 316 transports solid material impactors 100 from the reservoir 314 to the tank 318. Solid material impactors 100 flow from the tank 318 and into the chamber 324*aa* of the body 324*a* of the injector vessel 324 via the conduit 320, that is, via at least the passages 324*la*, 324*ja* and 324*ia*, and via the valve 322, that is, via between the gap between the plug element 322*eh* and the plug seat 324*jb*, thereby charging the injector vessel with the solid material impactors. In an exemplary embodiment, the solid material impactors 100 may be fed into the injector vessel 324 with drilling fluid, in a solution or slurry form, and/or may be may be gravity fed into the injector vessel 324 via the conduit 320 and the valve 322. The solid material impactors 100 and the drilling fluid present in the chamber 324*aa* of the body 324*a* of the injector vessel 324 mix to form a suspension of liquid in the form of drilling fluid and the solid material impactors 100.

As a result of the introduction of the solid material impactors 100 into the chamber 324*aa*, drilling fluid present in the chamber is displaced and the volume of the displaced drilling fluid flows to the tank 340 via a volume displacement 422 in the chamber, the passage 324*ma*, the gap between the plug seat 324*nb* and the plug element 337*eh* of the open valve 337, the passage 402*a* and the line 338. It is understood that the pump 342 may be operated to cause at least a portion of the displaced drilling fluid in the tank 340 to flow into the tank 318 via the line 344.

After the injector vessel 324 has been charged, that is, after the desired and relatively high volume of the solid material impactors 100 has been introduced into the chamber 324*aa*, the valve 322 is closed to prevent further introduction of solid material impactors 100 into the injector vessel, that is, the piston 322*ea* is moved upward so that, as a result, the coupling 322*ed*, the pin 322*ef*, the coupling 322*ee*, the shaft 322*eg* and the plug element 322*eh* move upward and the plug element engages the plug seat 324*jb*. The valve 337 is closed to prevent any further flow of drilling fluid to the tank 340, that is, the piston 337*ea* is moved upward so that, as a result, the rod 337*ec*, the coupling 337*ed*, the pin 337*ef*, the coupling 337*ee*, the shaft 337*eg* and the plug element 337*eh* move upward and the plug element engages the plug seat 324*nb*. In an exemplary embodiment, it is understood that the piston 337*ea*, and therefore the valve 337, may be controlled in any conventional manner.

Figure 32:
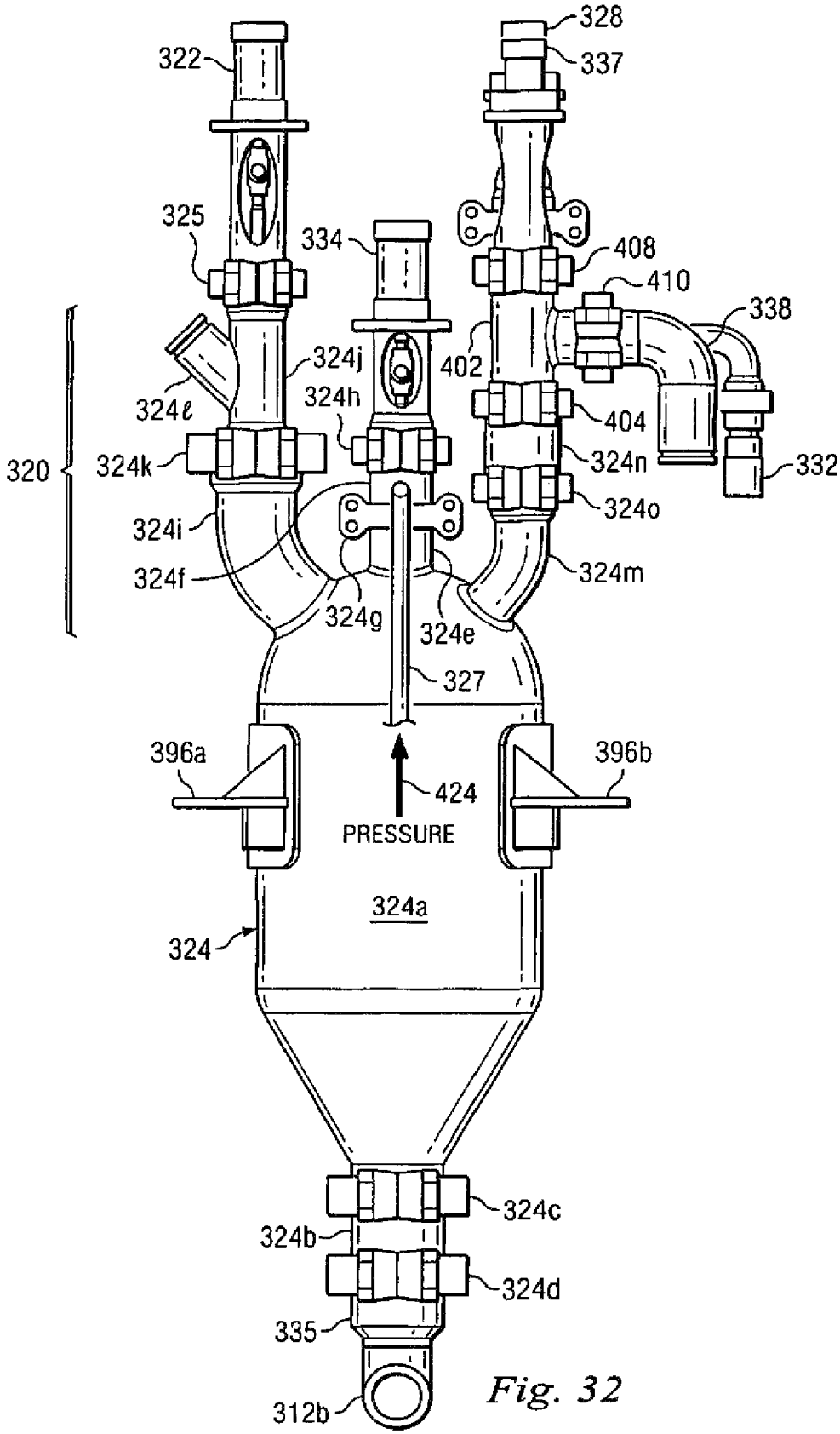

In an exemplary embodiment, as illustrated in FIG. 32 with continuing reference to FIGS. 21-31, the cylinder 326 is operated so that hydraulic cylinder fluid is introduced into the chamber 326*d* and, in response, the piston 326*a* applies pressure to the drilling fluid in the line 327, thereby applying a pressure 424 in the line 327, the passage 324*fa*, the passage 324*ea* and the chamber 324*aa*. The cylinder 326 applies the pressure 424 in the line 327, the passage 324*fa*, the passage 324*ea* and the chamber 324*aa* until the pressure in the line 327, the passage 324*fa*, the passage 324*ea* and the chamber 324*aa* is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 328 is opened by moving the piston 328*ea* upward so that, as a result, the rod 328*ec*, the coupling 328*ed*, the pin 328*ef*, the coupling 328*ee*, the shaft 328*eg* and the plug element 328*eh* move upward and the plug element disengages from the plug seat 324*qb*. In an exemplary embodiment, it is understood that the piston 328*ea*, and therefore the valve 328, may be controlled in any conventional manner. In response, a portion of the drilling fluid in the line 332, the passage 412*a*, the passage 324*qa* and/or the passage 324*pa*, may flow through the valve 328 so that the respective pressures in the line portion 312*a*, the line 306, the line 332, the passage 412*a*, the passage 324*qa*, the passage 324*pa* and the chamber 324*aa* further equalize to a pressure that still remains greater than the pressure in the line portion 312*b*.

Figure 33:
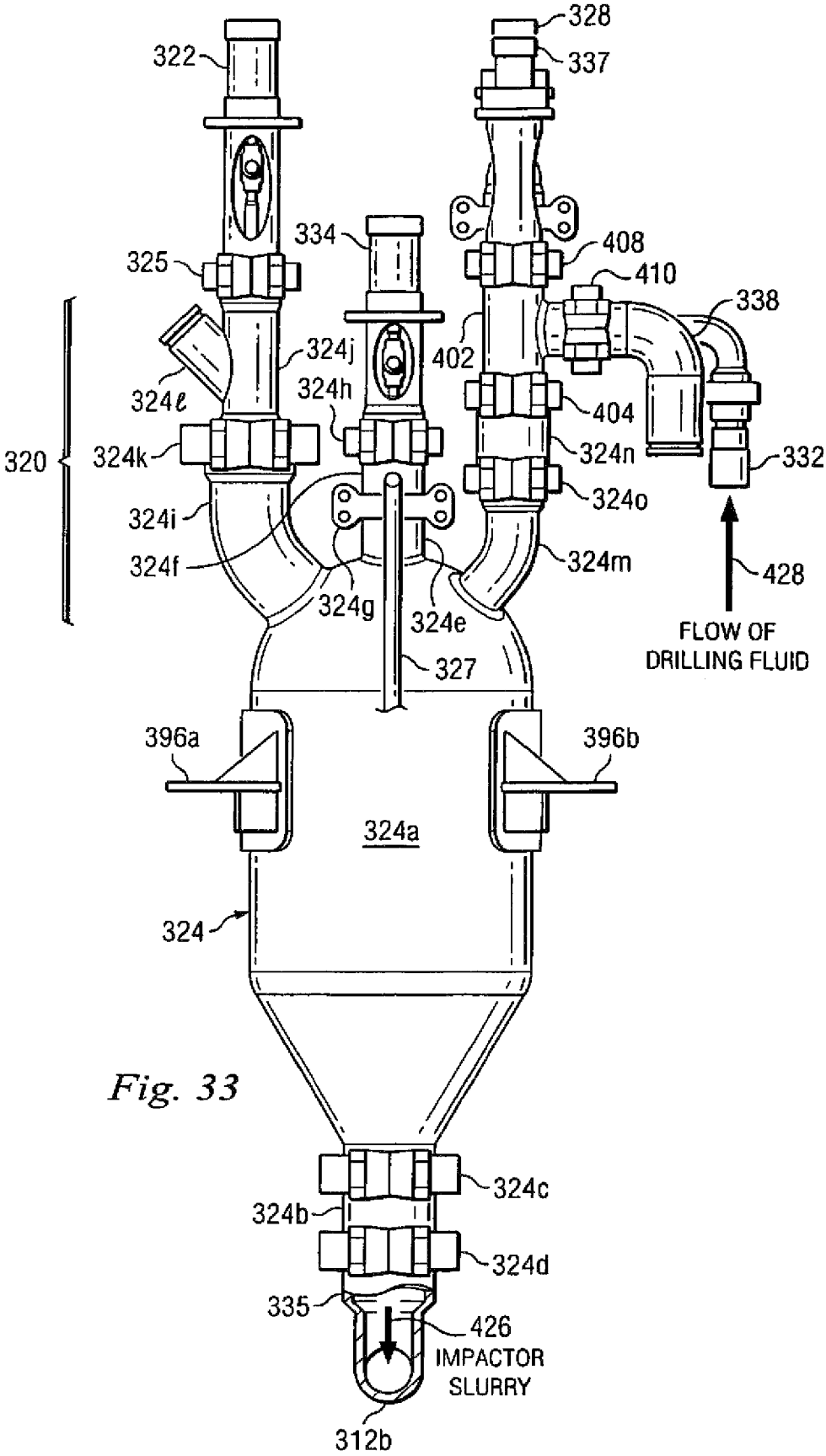

In an exemplary embodiment, as illustrated in FIG. 33 with continuing reference to FIGS. 21-32, the valve 334 is opened by moving the piston 334*ea* downward so that, as a result, the rod 334*ec*, the coupling 334*ed*, the pin 334*ef*, the coupling 334*ee*, the shaft 334*eg* and the plug element 334*eh* move downward and the plug element disengages from the plug seat 324*bc*. In an exemplary embodiment, it is understood that the movement of the piston 334*ea*, and therefore the valve 334, may be controlled in any conventional manner.

As a result of the opening of the valve 334, an impactor slurry 426, that is, the suspension of liquid in the form of drilling fluid and the solid material impactors 100, flows through the chamber 324*aa*, the openings 342*bba*, 342*bbb* and 342*bbc*, the passage 324*ba* of the spool 324*b*, the line 335, and the countersunk opening 336*a* and the through-bore 336*b* of the orifice 336.

As a result of the flow of the impactor slurry 426, the impactor slurry is permitted to be injected into the line portion 312*b*. It is understood that the pressure in the line 335 may be less than the pressure in the line 306 due to several factors such as, for example, the pressure drop associated with the flow of the impactor slurry 426 through one or more components such as, for example, the valve 334 and the orifice 336. Notwithstanding this pressure drop, the pump 304 continues to maintain a pressurized flow of drilling fluid 428 into the chamber 324*aa* via the line 306, the line 332, the passage 412*a*, the passage 324*qa*, the gap between the plug seat 324*qb* and the plug element 328*eh* of the valve 328 and the passage 324*pa*. Due to the pressurized flow of drilling fluid 428, and the pressure drop across the orifice 310, the pressure in the line 335 is still greater than the pressure in the line portion 312*b* of the line 312. As a result, the impactor slurry 426 having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the impactor slurry 426 from the injector vessel 324 to the line portion 312*b* via the line 335 and the orifice 336. In an exemplary embodiment, it is understood that the flow of impactor slurry delivered to the pipe string 55 via the line portion 312*b* of the line 312 may be accelerated and discharged to remove a portion of the formation 52 (FIG. 1), in a manner similar to that described above.

Figure 34:
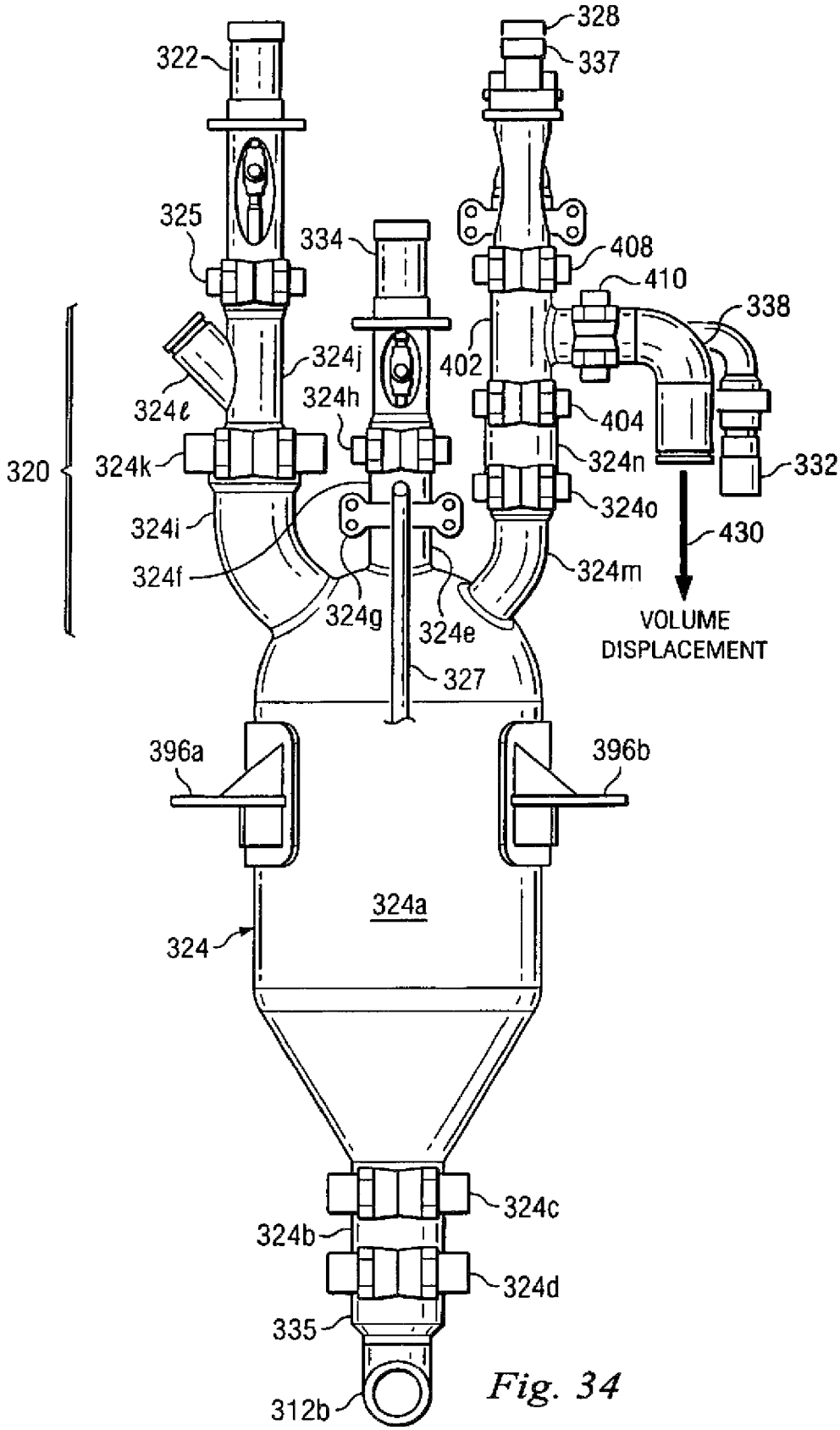

In an exemplary embodiment, as illustrated in FIG. 34 with continuing reference to FIGS. 21-33, after the impactor slurry has been completely discharged from the injector vessel 324, the valves 328 and 334 are closed, thereby preventing any flow of drilling fluid from the tank 302, through the pump 304, the line 306, the line 332, the injector vessel 324, the valve 334, the orifice 336 and the line 335, and to the line portion 312*b* of the line 312.

In an exemplary embodiment, in response to the closing of the valve 334 and thus the engagement of the plug element 334*eh* and the plug seat 324*bc*, the contact line defined by the engagement between the plug element of the valve and the plug seat may be 15 degrees from the longitudinal axis of the tubular spool 324*b*. In an exemplary embodiment, the contact lines defined by the engagement between the plug element 334*eh* of the valve 334 and the plug seat 324*bc* of the tubular spool 324*b*, corresponding to two 180-degree-circumferentially-spaced locations on the plug element, may define a 30-degree angle therebetween.

The cylinder 326 is then operated so that the hydraulic cylinder fluid in the chamber 326*d* is discharged therefrom. During this discharge, the pressurized drilling fluid still present in the line 327 and the injector vessel 324 applies pressure against the piston 326*a*. As a result, the pressure in the line 327, the passage 324*fa*, the passage 324*ea* and the chamber 324*aa* of the injector vessel 324 is reduced, and may be reduced to atmospheric pressure. The valve 337 is opened, that is the plug element 337*eh* disengages from the plug seat 324*nb*, thereby permitting a volume of the pressurized drilling fluid that may still be present in the chamber 324*aa* to be displaced so that the volume of the displaced drilling fluid flows to the tank 340 via a volume displacement 430 in the chamber, the passage 324*ma*, the passage 324*na*, the gap between the plug seat 324*nb* and the plug element 337*eh* of the open valve 337, the passage 402*a* and the line 338. As a result, the pressure in the injector vessel 324 may be vented, thereby facilitating its return to atmospheric pressure.

At this point, the injector vessel 324 is again in its initial condition, with the injector vessel full of drilling fluid and the valve 337 open, and the valves 322, 348, 372, 328, 354, 366, 308, 388, 334, 360, 382 and 406 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 324 may be repeated by again opening the valve 322 to again charge the injector vessel 324, that is, to again permit introduction of the solid material impactors 100 into the injector vessel 324, as discussed above.

In an exemplary embodiment, it is understood that the embodiments of the injector vessels 350 and 374 depicted in FIGS. 23 and/or 24 are substantially similar to the injector vessel 324 described above in connection with FIGS. 25-30 and therefore will not be described in detail. Moreover, it is understood that, in a manner that is substantially similar to the manner in which the operation of the embodiment of the injector vessel 324 depicted in FIGS. 23 and 25-30 substantially corresponds to the operation of the injector vessel 324 described above in connection with FIG. 21, the operation of each of the embodiments of the injector vessels 350 and 374 depicted in FIGS. 23 and/or 24 substantially corresponds to the operation of each of the injector vessels 350 and 374, respectively, described above in connection with FIG. 21.

In an exemplary embodiment, it is understood that the embodiments of the injector vessels 324, 350 and 374 depicted in FIGS. 23-30 may be operated in a manner substantially similar to the operation of the injector vessels 324, 350 and 374 of the injection system 300 described above in connection with FIG. 22.

Figure 35:
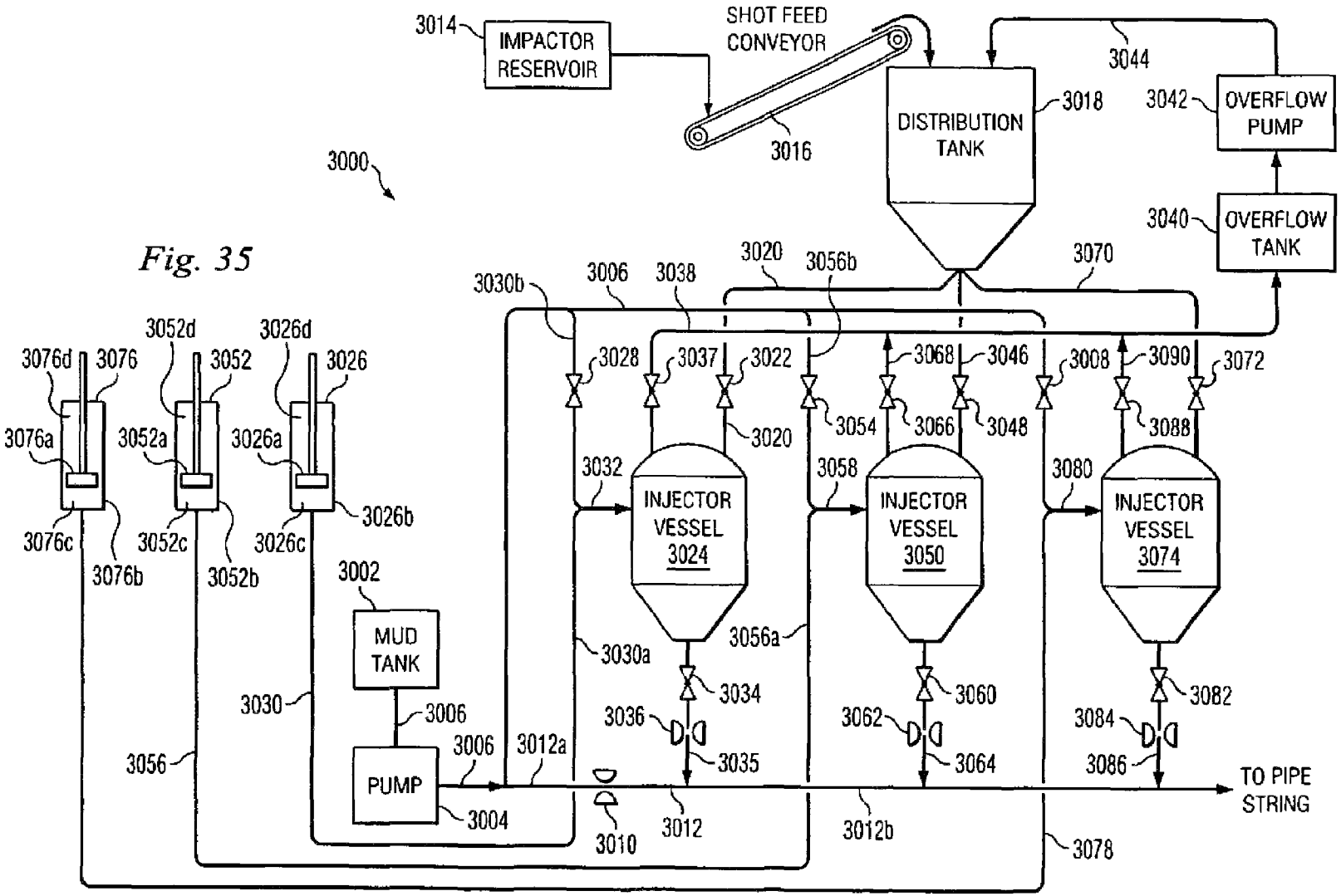
FIG. 35 is a schematic view of an injection system according to another embodiment.

Referring to FIG. 35, an injection system according to another embodiment is generally referred to by the reference numeral 3000 and includes a drilling fluid tank or mud tank 3002 that is fluidicly coupled to a pump 3004 via a hydraulic supply line 3006 that also extends from the pump to a valve 3008. An orifice 3010 is fluidicly coupled to the hydraulic supply line 3006 via a hydraulic supply line 3012 that also extends to and/or is fluidicly coupled to a pipe string such as, for example, the pipe string 55 described above in connection with the excavation system 1 of the embodiment of FIG. 1. In an exemplary embodiment, it is understood that the hydraulic supply line 3012 may be fluidicly coupled to the pipe string 55 via one or more components of the excavation system 1 of the embodiment of FIG. 1, including the impactor slurry injector head 34, the injector port 30, the fluid-conducting throughbore of the swivel 28, and/or the feed end 55*a* of the pipe string. Line portions 3012*a* and 3012*b* of the line 3012 are defined and separated by the location of the orifice 3010.

A solid-material-impactor bin or reservoir 3014 is operably coupled to a solid-impactor transport device such as a shot-feed conveyor 3016 which, in turn, is operably coupled to a distribution tank 3018. A conduit 3020 connects the tank 3018 to a valve 3022, and the conduit further extends and is connected to an injector vessel 3024.

A hydraulic-actuated cylinder 3026 is fluidicly coupled to a valve 3028 via a hydraulic flow line 3030 that also extends to the line 3006. Line portions 3030*a* and 3030*b* are defined and separated by the valve 3028. The cylinder 26 includes a piston 3026*a* that reciprocates in a cylinder housing 3026*b* in a conventional manner. The housing 3026*b* defines a variable-volume chamber 3026*c* in fluid communication with the line 3030, and further defines a variable-volume chamber 3026*d* into which hydraulic cylinder fluid is introduced, and from which the hydraulic fluid is discharged, under conditions to be described.

A hydraulic line 3032 fluidicly couples the line 3030 to the vessel 3024, and a valve 3034 is fluidicly coupled to the vessel 3024. A hydraulic line 3035 fluidicly couples an orifice 3036 to the valve 3034, and the line also extends to the line portion 3012*b* of the line 3012. A valve 3037 is fluidicly coupled to the vessel 3024 via a hydraulic line 3038 that also extends to a reservoir or tank 3040. A pump 3042 is fluidicly coupled to the tank 3040 via a hydraulic line 3044 that also extends to the tank 3018.

A conduit 3046 connects the tank 3018 to a valve 3048, and the conduit further extends and is connected to an injector vessel 3050. A hydraulic-actuated cylinder 3052 is fluidicly coupled to a valve 3054 via a hydraulic flow line 3056 that also extends to the line 3006. Line portions 3056*a* and 3056*b* are defined and separated by the valve 3054. The cylinder 3052 includes a piston 3052*a* that reciprocates in a cylinder housing 3052*b* in a conventional manner. The housing 3052*b* defines a variable-volume chamber 3052*c* in fluid communication with the line 3056, and further defines a variable-volume chamber 3052*d* into which hydraulic cylinder fluid is introduced, and from which the hydraulic fluid is discharged, under conditions to be described.

A hydraulic line 3058 fluidicly couples the line 3056 to the vessel 3050. A valve 3060 is fluidicly coupled to the vessel 3050, and an orifice 3062 is fluidicly coupled to the valve via a hydraulic line 3064 that also extends to the line portion 3012*b* of the line 3012. A valve 3066 is fluidicly coupled to the vessel 3050 via a hydraulic line 3068 that also extends to the line 3038.

A conduit 3070 connects the tank 3018 to a valve 3072, and the conduit further extends and is connected to an injector vessel 3074. A hydraulic-actuated cylinder 3076 is fluidicly coupled to the valve 3008 via a hydraulic line 3078, and the cylinder includes a piston 3076*a* that reciprocates in a cylinder housing 3076*b* in a conventional manner. The housing 3076*b* defines a variable-volume chamber 3076*c* in fluid communication with the line 3056, and further defines a variable-volume chamber 3076*d* into which hydraulic cylinder fluid is introduced, and from which the hydraulic fluid is discharged, under conditions to be described.

A hydraulic line 3080 fluidicly couples the line 3078 to the vessel 3074. A valve 3082 is fluidicly coupled to the vessel 3074, and an orifice 3084 is fluidicly coupled to the valve via a hydraulic line 3086 that also extends to the line portion 3012*b* of the line 3012. A valve 3088 is fluidicly coupled to the vessel 3074 via a hydraulic line 3090 that also extends to the line 3038. In an exemplary embodiment, it is understood that all of the above-described lines and line portions define flow regions through which fluid may flow over a range of fluid pressures.

Prior to the general operation of the injection system 3000, all of the valves in the injection system may be closed, including the valves 3022, 3048, 3072, 3028, 3037, 3054, 3066, 3008, 3088, 3034, 3060 and 3082. Moreover, the pump 3004 may cause liquid such as drilling fluid to flow from the mud tank 3002, through the line 3006, the line portion 3012*a*, the orifice 3010 and the line portion 3012*b*, and to the pipe string 55. It is understood that the pressure in the line 3006 and the line portion 3012*a* is substantially equal to the supply pressure of the pump 3004, and that the pressure in the line portion 3012*b* is less than the pressure in the line 3006 and the line portion 3012*a* due to the pressure drop caused by the orifice 3010. It is further understood that the portion of the line 3006 extending to the valve 3008, the line portions 3030*b*, 3056*b*, 3030*a* and 3056*a*, and the lines 3078, 3032, 3058, 3080, 3038, 3068 and 3090 may be full of drilling fluid. Moreover, it is understood that the injector vessels 3024, 3050 and 3074 may also be full of drilling fluid. The reservoir 3014 is filled with material such as, for example, the solid material impactors 100 discussed above in connection with FIGS. 1-20. The tank 3018 may also be filled with the solid material impactors 100, and/or may also be filled with drilling fluid.

For clarity purposes, the individual operation of the injector vessel 3024 will be described. Initially, the injector vessel 3024 is full of drilling fluid and the valve 3037 is open, while the valves 3022, 3048, 3072, 3028, 3054, 3066, 3008, 3088, 3034, 3060 and 3082 remain closed. As a result of the valve 3037 being open, the pressure in the injector vessel 3024 is substantially equal to atmospheric pressure. The pump 3004 continues to cause drilling fluid to flow from the mud tank 3002, through the line 3006, the line portion 3012*a*, the orifice 3010 and the line portion 3012*b*, and to the pipe string 55.

To operate the injector vessel 3024, the valve 3022 is opened and the conveyor 3016 transports solid material impactors 100 from the reservoir 3014 to the tank 3018. Solid material impactors 100 are also transported from the tank 3018 and into the injector vessel 3024 via the conduit 3020 and the valve 3022, thereby charging the injector vessel with the solid material impactors. In an exemplary embodiment, the solid material impactors 100 may be fed into the injector vessel 3024 with drilling fluid, in a solution or slurry form, and/or be may be gravity fed into the injector vessel 3024 via the conduit 3020 and the valve 3022. The solid material impactors 100 and the drilling fluid present in the injector vessel 3024 mix to form a suspension of liquid in the form of drilling fluid and the solid material impactors 100, that is, to form an impactor slurry.

As a result of the introduction of the solid material impactors 100 into the injector vessel 3024, drilling fluid present in the injector vessel is displaced and the volume of the displaced drilling fluid flows to the tank 3040 via the line 3038 and the valve 3037. It is understood that the pump 3042 may be operated to cause at least a portion of the displaced drilling fluid in the tank 3040 to flow into the tank 3018 via the line 3044.

After the injector vessel 3024 has been charged, that is, after the desired and relatively high volume of the solid material impactors 100 has been introduced into the injector vessel, the valve 3022 is closed to prevent further introduction of solid material impactors 100 into the injector vessel, and the valve 3037 is closed to prevent any further flow of drilling fluid to the tank 3040. The cylinder 3026 is then operated so that hydraulic cylinder fluid is introduced into the chamber 3026*d* and, in response, the piston 3026*a* applies pressure to the drilling fluid in the line 3030, thereby pressurizing the line 3030, the line 3032 and the injector vessel 3024. The cylinder 3026 pressurizes the line portion 3030*a*, the line 3032 and the injector vessel 3024 until the pressure in the line portion 3030*a*, the line 3032 and the injector vessel 3024 is greater than the pressure in the line portion 3012*b*, and is less than, substantially or nearly equal to, or greater than, the pressure in the line 3006 and the line portion 3012*a* which, in turn and as noted above, is substantially equal to the supply pressure of the pump 3004.

The valve 3028 is opened and, in response, a portion of the drilling fluid in the line portion 3030*b* may flow through the valve 3028 and into the line portion 3030*a* so that the respective pressures in the line portions 3012*a*, 3030*a* and 3030*b*, the line 3032 and the injector vessel 3024 further equalize to a pressure that still remains greater than the pressure in the line portion 3012*b*.

The valve 3034 is opened, thereby permitting the impactor slurry to flow through the line 3035 and the orifice 3036, and to the line portion 3012*b*. It is understood that the pressure in the line 3035 may be less than the pressure in the line 3006 due to several factors such as, for example, the pressure drop associated with the flow of the impactor slurry through one or more components such as, for example, the valve 3034 and the orifice 3036. Notwithstanding this pressure drop, the pump 3004 continues to maintain a pressurized flow of drilling fluid into the injector vessel 3024 via the line 3006, the line portion 3030*b*, the valve 3028, the line portion 3030*a* and the line 3032. Due to the pressurized flow of drilling fluid, and the pressure drop across the orifice 3010, the pressure in the line 3035 is still greater than the pressure in the line portion 3012*b* of the line 3012. As a result, the impactor slurry having the desired and relatively high volume of solid material impactors 100 is injected into the line portion 3012*b* of the line 3012, and therefore to the pipe string 55, at a relatively high pressure.

In an exemplary embodiment, it is understood that gravity may be employed to assist in the flow of the slurry from the injector vessel 3024 to the line portion 3012*b* via the line 3035 and the orifice 3036. In an exemplary embodiment, it is understood that the flow of impactor slurry delivered to the pipe string 55 via the line portion 3012*b* of the line 3012 may be accelerated and discharged to remove a portion of the formation 52 (FIG. 1) in a manner similar to that described above.

After the impactor slurry has been completely discharged from the injector vessel 3024, the valves 3028 and 3034 are closed, thereby preventing any flow of drilling fluid from the tank 3002, through the pump 3004, the line 3006, the line portion 3030*b*, the line portion 3030*a*, the line 3032, the injector vessel 3024, the valve 3034, the orifice 3036 and the line 3035, and to the line portion 3012*b* of the line 3012. The cylinder 3026 is then operated so that the hydraulic cylinder fluid in the chamber 3026*d* is discharged therefrom. During this discharge, the pressurized drilling fluid still present in the line 3032, the line portion 3030*a* and the injector vessel 3024 applies pressure against the piston 3026*a*. As a result, the pressure in the line 3032, the line portion 3030*a* and the injector vessel 3024 is reduced, and may be reduced to atmospheric pressure. The valve 3037 is opened, thereby permitting a volume of the pressurized drilling fluid that may still be present in the injector vessel 3024 to be displaced, thereby causing additional drilling fluid to flow from the line 3038 to the tank 3040. As a result, the pressure in the injector vessel 3024 may be vented, thereby facilitating its return to atmospheric pressure.

At this point, the injector vessel 3024 is again in its initial condition, with the injector vessel full of drilling fluid and the valve 3037 open, and the valves 3022, 3048, 3072, 3028, 3054, 3066, 3008, 3088, 3034, 3060 and 3082 closed. The pump 3004 continues to cause drilling fluid to flow from the mud tank 3002, through the line 3006, the line portion 3012*a*, the orifice 3010 and the line portion 3012*b*, and to the pipe string 55.

In an exemplary embodiment, the above-described operation of the injector vessel 3024 may be repeated by again opening the valve 3022 to again charge the injector vessel 3024, that is, to again permit introduction of the solid material impactors 100 into the injector vessel 3024, as discussed above.

The individual operation of the injector vessel 3050 will be described. In an exemplary embodiment, the individual operation of the injector vessel 3050 is substantially similar to the operation of the injector vessel 3024, with the conduit 3046, the valve 3048, the injector vessel 3050, the cylinder 3052, the piston 3052*a*, the housing 3052*b*, the chamber 3052*c*, the chamber 3052*d*, the valve 3054, the line 3056, the line portion 3056*a*, the line portion 3056*b*, the line 3058, the valve 3060, the orifice 3062, the line 3064 and the valve 3066 operating in a manner substantially similar to the above-described operation of the conduit 3020, the valve 3022, the injector vessel 3024, the cylinder 3026, the piston 3026*a*, the housing 3026*b*, the chamber 3026*c*, the chamber 3026*d*, the valve 3028, the line 3030, the line portion 3030*a*, the line portion 3030*b*, the line 3032, the valve 3034, the orifice 3036, the line 3035 and the valve 3037, respectively. The line 3068 operates in a manner similar to the line 3038, except that both the line 3068 and the line 3038 are used to vent the injector vessel 3050 during its operation.

More particularly, the injector vessel 3050 is initially full of drilling fluid and the valve 3066 is open, while the valves 3022, 3048, 3072, 3028, 3054, 3037, 3008, 3088, 3034, 3060 and 3082 remain closed. As a result of the valve 3066 being open, the pressure in the injector vessel 3050 is substantially equal to atmospheric pressure. The pump 3004 continues to cause drilling fluid to flow from the mud tank 3002, through the line 3006, the line portion 3012*a*, the orifice 3010 and the line portion 3012*b*, and to the pipe string 55.

To operate the injector vessel 3050, the valve 3048 is opened and the conveyor 3016 transports solid material impactors 100 from the reservoir 3014 to the tank 3018. Solid material impactors 100 are also transported from the tank 3018 and into the injector vessel 3050 via the conduit 3046 and the valve 3048, thereby charging the injector vessel with the solid material impactors. In an exemplary embodiment, the solid material impactors 100 may be fed into the injector vessel 3050 with drilling fluid, in a solution or slurry form, and/or may be gravity fed into the injector vessel 3050 via the conduit 3046 and the valve 3048. The solid material impactors 100 and the drilling fluid present in the injector vessel 3050 mix to form a suspension of liquid in the form of drilling fluid and the solid material impactors 100, that is, to form an impactor slurry.

As a result of the introduction of the solid material impactors 100 into the injector vessel 3050, drilling fluid present in the injector vessel is displaced and the volume of the displaced drilling fluid flows to the tank 3040 via the lines 3068 and 3038 and the valve 3066. It is understood that the pump 3042 may be operated to cause at least a portion of the displaced drilling fluid in the tank 3040 to flow into the tank 3018 via the line 3044.

After the injector vessel 3050 has been charged, that is, after the desired and relatively high volume of the solid material impactors 100 has been introduced into the injector vessel, the valve 3046 is closed to prevent further introduction of solid material impactors 100 into the injector vessel, and the valve 3066 is closed to prevent any further flow of drilling fluid to the tank 3040. The cylinder 3052 is then operated so that hydraulic cylinder fluid is introduced into the chamber 3052*d* and, in response, the piston 3052*a* applies pressure to the drilling fluid in the line 3056, thereby pressurizing the line 3056, the line 3058 and the injector vessel 3050. The cylinder 3052 pressurizes the line portion 3056*a*, the line 3058 and the injector vessel 3050 until the pressure in the line portion 3056*a*, the line 3058 and the injector vessel 3050 is greater than the pressure in the line portion 3012*b*, and is less than, substantially or nearly equal to, or greater than, the pressure in the line 3006 and the line portion 3012*a* which, in turn and as noted above, is substantially equal to the supply pressure of the pump 3004.

The valve 3054 is opened and, in response, a portion of the drilling fluid in the line portion 3056*b* may flow through the valve 3054 and into the line portion 3056*a* so that the respective pressures in the line portions 3012*a*, 3056*a* and 3056*b*, the line 3058 and the injector vessel 3050 further equalize to a pressure that still remains greater than the pressure in the line portion 3012*b*.

The valve 3060 is opened, thereby permitting the impactor slurry to flow through the line 3064 and the orifice 3062, and to the line portion 3012*b*. It is understood that the pressure in the line 3064 may be less than the pressure in the line 3006 due to several factors such as, for example, the pressure drop associated with the flow of the impactor slurry through one or more components such as, for example, the valve 3060 and the orifice 3062. Notwithstanding this pressure drop, the pump 3004 continues to maintain a pressurized flow of drilling fluid into the injector vessel 3050 via the line 3006, the line portion 3056*b*, the valve 3054, the line portion 3056*a* and the line 3058. Due to the pressurized flow of drilling fluid, and the pressure drop across the orifice 3010, the pressure in the line 3064 is still greater than the pressure in the line portion 3012*b* of the line 3012. As a result, the impactor slurry having the desired and relatively high volume of solid material impactors 100 is injected into the line portion 3012*b* of the line 3012, and therefore to the pipe string 55, at a relatively high pressure.

In an exemplary embodiment, it is understood that gravity may be employed to assist in the flow of the slurry from the injector vessel 3050 to the line portion 3012*b* via the line 3064 and the orifice 3062. In an exemplary embodiment, it is understood that the flow of impactor slurry delivered to the pipe string 55 via the line portion 3012*b* of the line 3012 may be accelerated and discharged to remove a portion of the formation 52 (FIG. 1) in order to excavate the formation, in a manner similar to that described above.

After the impactor slurry has been completely discharged from the injector vessel 3050, the valves 3054 and 3060 are closed, thereby preventing any flow of drilling fluid from the tank 3002, through the pump 3004, the line 3006, the line portion 3056*b*, the line 3058, the injector vessel 3050, the valve 3060, the orifice 3062 and the line 3064, and to the line portion 3012*b* of the line 3012. The cylinder 3052 is then operated so that the hydraulic cylinder fluid in the chamber 3052*d* is discharged therefrom. During this discharge, the pressurized drilling fluid still present in the line 3058, the line portion 3056*a* and the injector vessel 3050 applies pressure against the piston 3052*a*. As a result, the pressure in the line 3058, the line portion 3056*a* and the injector vessel 3050 is reduced, and may be reduced to atmospheric pressure. The valve 3066 is opened, thereby permitting a volume of the pressurized drilling fluid that may still be present in the injector vessel 3050 to be displaced via the line 3068, thereby causing additional drilling fluid to flow from the line 3038 to the tank 3040. As a result, the pressure in the injector vessel 3050 may be vented, thereby facilitating its return to atmospheric pressure.

At this point, the injector vessel 3050 is again in its initial condition, with the injector vessel full of drilling fluid and the valve 3066 open, and the valves 3022, 3048, 3072, 3028, 3054, 3037, 3008, 3088, 3034, 3060 and 3082 closed. The pump 3004 continues to cause drilling fluid to flow from the mud tank 3002, through the line 3006, the line portion 3012*a*, the orifice 3010 and the line portion 3012*b*, and to the pipe string 55.

In an exemplary embodiment, the above-described operation of the injector vessel 3050 may be repeated by again opening the valve 3048 to again charge the injector vessel 3050, that is, to again permit introduction of the solid material impactors 100 into the injector vessel 3050, as discussed above.

The individual operation of the injector vessel 3074 will be described. In an exemplary embodiment, the individual operation of the injector vessel 3074 is substantially similar to the operation of the injector vessel 3024, with the conduit 3070, the valve 3072, the injector vessel 3074, the cylinder 3076, the piston 3076*a*, the housing 3076*b*, the chamber 3076*c*, the chamber 3076*d*, the valve 3008, the line 3078, the line 3080, the valve 3082, the orifice 3084, the line 3086 and the valve 3088 operating in a manner substantially similar to the above-described operation of the conduit 3020, the valve 3022, the injector vessel 3024, the cylinder 3026, the piston 3026*a*, the housing 3026*b*, the chamber 3026*c*, the chamber 3026*d*, the valve 3028, the line portion 3030*a*, the line 3032, the valve 3034, the orifice 3036, the line 3035 and the valve 3037, respectively. The line 3090 operates in a manner similar to the line 30308, except that both the line 3090 and the line 3038 are used to vent the injector vessel 3074 during its operation.

More particularly, the injector vessel 3074 is initially full of drilling fluid and the valve 3088 is open, while the valves 3022, 3048, 3072, 3028, 3054, 3066, 3008, 3037, 3034, 3060 and 3082 remain closed. As a result of the valve 3088 being open, the pressure in the injector vessel 3074 is substantially equal to atmospheric pressure. The pump 3004 continues to cause drilling fluid to flow from the mud tank 3002, through the line 3006, the line portion 3012*a*, the orifice 3010 and the line portion 3012*b*, and to the pipe string 55.

To operate the injector vessel 3074, the valve 3072 is opened and the conveyor 3016 transports solid material impactors 100 from the reservoir 3014 to the tank 3018. Solid material impactors 100 are also transported from the tank 3018 and into the injector vessel 3074 via the conduit 3070 and the valve 3072, thereby charging the injector vessel with the solid material impactors. In an exemplary embodiment, the solid material impactors 100 may be fed into the injector vessel 3074 with drilling fluid, in a solution or slurry form, and/or may be gravity fed into the injector vessel 3074 via the conduit 3070 and the valve 3072. The solid material impactors 100 and the drilling fluid present in the injector vessel 3074 mix to form a suspension of liquid in the form of drilling fluid and the solid material impactors 100, that is, to form an impactor slurry.

As a result of the introduction of the solid material impactors 100 into the injector vessel 3074, drilling fluid present in the injector vessel is displaced and the volume of the displaced drilling fluid flows to the tank 3040 via the lines 3090 and 3038 and the valve 3037. It is understood that the pump 3042 may be operated to cause at least a portion of the displaced drilling fluid in the tank 3040 to flow into the tank 3018 via the line 3044.

After the injector vessel 3074 has been charged, that is, after the desired and relatively high volume of the solid material impactors 100 has been introduced into the injector vessel, the valve 3072 is closed to prevent further introduction of solid material impactors 100 into the injector vessel, and the valve 3088 is closed to prevent any further flow of drilling fluid to the tank 3040. The cylinder 3076 is then operated so that hydraulic cylinder fluid is introduced into the chamber 3076*d* and, in response, the piston 3076*a* applies pressure to the drilling fluid in the line 3078, thereby pressurizing the line 3078, the line 3080 and the injector vessel 3074. The cylinder 3076 pressurizes the line 3078, the line 3080 and the injector vessel 3074 until the pressure in the line 3078, the line 3080 and the injector vessel 3074 is greater than the pressure in the line portion 3012*b*, and is less than, substantially or nearly equal to, or greater than, the pressure in the line 3006 and the line portion 3012*a* which, in turn and as noted above, is substantially equal to the supply pressure of the pump 3004.

The valve 3008 is opened and, in response, a portion of the drilling fluid in the line portion 3006 may flow through the valve 3008 and into the line 3078 so that the respective pressures in the line portion 3012*a*, the lines 3078 and 3080 and the injector vessel 3074 further equalize to a pressure that still remains greater than the pressure in the line portion 3012*b*.

The valve 3082 is opened, thereby permitting the impactor slurry to flow through the line 3086 and the orifice 3084, and to the line portion 3012*b*. It is understood that the pressure in the line 3086 may be less than the pressure in the line 3006 due to several factors such as, for example, the pressure drop associated with the flow of the impactor slurry through one or more components such as, for example, the valve 3082 and the orifice 3084. Notwithstanding this pressure drop, the pump 3004 continues to maintain a pressurized flow of drilling fluid into the injector vessel 3074 via the line 3006, the valve 3008, the line 3078 and the line 3080. Due to the pressurized flow of drilling fluid, and the pressure drop across the orifice 3010, the pressure in the line 3086 is still greater than the pressure in the line portion 3012*b* of the line 3012. As a result, the impactor slurry having the desired and relatively high volume of solid material impactors 100 is injected into the line portion 3012*b* of the line 3012, and therefore to the pipe string 55, at a relatively high pressure.

In an exemplary embodiment, it is understood that gravity may be employed to assist in the flow of the slurry from the injector vessel 3074 to the line portion 3012*b* via the line 3086 and the orifice 3084. In an exemplary embodiment, it is understood that the flow of impactor slurry delivered to the pipe string 55 via the line portion 3012*b* of the line 3012 may be accelerated and discharged to remove a portion of the formation 52 (FIG. 1) in order to excavate the formation, in a manner similar to that described above.

After the impactor slurry has been completely discharged from the injector vessel 3074, the valves 3008 and 3082 are closed, thereby preventing any flow of drilling fluid from the tank 3002, through the pump 3004, the line 3006, the line 3078, the line 3080, the injector vessel 3074, the valve 3082, the orifice 3084 and the line 3086, and to the line portion 3012*b* of the line 3012. The cylinder 3076 is then operated so that the hydraulic cylinder fluid in the chamber 3076*d* is discharged therefrom. During this discharge, the pressurized drilling fluid still present in the line 3080, the line 3078 and the injector vessel 3074 applies pressure against the piston 3076*a*. As a result, the pressure in the line 3080, the line 3078 and the injector vessel 3074 is reduced, and may be reduced to atmospheric pressure. The valve 3088 is opened, thereby permitting a volume of the pressurized drilling fluid that may still be present in the injector vessel 3074 to be displaced via the line 3090, thereby causing additional drilling fluid to flow from the line 3038 to the tank 3040. As a result, the pressure in the injector vessel 3074 is vented, thereby facilitating its return to atmospheric pressure.

At this point, the injector vessel 3074 is again in its initial condition, with the injector vessel full of drilling fluid and the valve 3088 open, and the valves 3022, 3048, 3072, 3028, 3054, 3066, 3008, 3037, 3034, 3060 and 3082 closed. The pump 3004 continues to cause drilling fluid to flow from the mud tank 3002, through the line 3006, the line portion 3012*a*, the orifice 3010 and the line portion 3012*b*, and to the pipe string 55.

In an exemplary embodiment, the above-described operation of the injector vessel 3074 may be repeated by again opening the valve 3072 to again charge the injector vessel 3074, that is, to again permit introduction of the solid material impactors 100 into the injector vessel 3074, as discussed above.

In an exemplary embodiment, it is understood that the injector vessels 3024, 3050 and 3074 of the injection system 3000 may be operated in a manner similar to the operation of the injector vessels 324, 350 and 374 of the injection system 300 described above in connection with FIG. 22.

It is understood that the above-described clamping rings forming the above-described connections may be conventional and may form pressure-tight and fluid-tight connections.

It is understood that additional variations may be made in the foregoing without departing from the scope of the disclosure. For example, in addition to, and/or instead of the valve embodiments described above in connection with FIGS. 25-30, it is understood that each of the valves 322, 348, 372, 328, 354, 366, 308, 388, 334, 360, 382 and 406 may be in the form of a wide variety of valve types and/or may include a wide variety of components thereof such as, for example, a wide variety of ball valves and/or gate valves, and/or may be in the form of any type of closure device.

Moreover, it is understood that the injection system 300, the injection system 3000 and/or components thereof may be combined in whole or in part with the excavation system 1. For example, the injection system 300 may be added to the system 1 and the tank 94 may be replaced by the tank 318, and/or the tank 82 may be replaced by the tank 314. For another example, instead of or in addition to the slurrification tank 98, one or more of the injector vessels 324, 350 and 374 may be used in the system 1. In an exemplary embodiment, the injection system 300 may be added to the system 1 and the slurry line 88 in the system 1 may be replaced by the line portion 312*b*. In an exemplary embodiment, the injection system 300 may be employed without any removal of any of the components of the system 1. In an exemplary embodiment, the injection system 300 may be employed with the removal of one or more components of the system 1 such as, for example, one or more of the tank 94, the tank 82, the tank 98, the line 88, the impactor introducer 96, the tank 6, the pump 10 and/or any combination thereof.

In an exemplary embodiment, in addition to, or instead of the conveyor 16, it is understood that the solid material impactors 100 may be transported to the tank 318 using a wide variety of techniques such as, for example, chutes, conduits, trucks and/or any combination thereof.

In an exemplary embodiment, in addition to, or instead of the valve 334, it is understood that one or more of the above-described closings of the other valves may result in a contact line being defined by the engagement between the plug element of the valve and the corresponding plug seat, and that the contact line may be 15 degrees from an imaginary vertical axis. In an exemplary embodiment, the contact lines defined by the engagement between the plug element of the valve and the corresponding plug seat, corresponding to two 180-degree-circumferentially-spaced locations on the plug element, may define a 30-degree angle therebetween. It is understood that the angle defined by the contact lines defined by the engagement between any one of the above-described plug seats and the corresponding plug element of the corresponding valve may vary widely.

In an exemplary embodiment, and in addition to, or instead of injecting an impactor slurry into a flow region defined by the line portion 312*b* and to the pipe string 55 to remove a portion of the formation 52 (FIG. 1), the injection system 300 and/or the injection system 3000 may be used to inject an impactor slurry into a wide variety of other flow regions defined by a wide variety of systems, vessels, pipelines, naturally-formed structures, man-made structures and/or components and/or subsystems thereof, to serve a wide variety of other purposes. Moreover, the injection system 300 and/or the injection system 3000 may be used to inject an impactor slurry directly into the atmosphere and/or environment, and/or may be used in a wide variety of external applications such as, for example, cleaning applications, so that the flow region is considered to be the atmosphere or environmental surroundings.

In an exemplary embodiment, in addition to, or instead of the solid material impactors 100 and/or drilling fluid, it is understood that the impactor slurry may be a suspension of any type of impactors and/or any type of liquids. The impactors may include and/or be composed of any type of solid material in a wide variety of forms such as, for example, any type of solid pellets, shot or particles. It is understood that the type of liquid or fluid and/or the type of impactor used to form the suspension and therefore the impactor slurry may be dictated by the application for which the injection system 300 and/or the injection system 3000 is to be used.

In an exemplary embodiment, the line 327 may be used as a bleeder line, or a portion of a bleeder line, to bleed air and/or other fluids from the passage 324*fa*, the passage 324*ea* and/or the chamber 324*aa*. One or more valves may be connected to the line 327 and operated so that air and/or other fluids present in the passage 324*fa*, the passage 324*ea* and/or the chamber 324*aa* bleed out through at least a portion of the line 327. The air and/or other fluids may bleed out to, for example, the tank 340. In an exemplary embodiment, the air and/or other fluids may be bleed through at least a portion of the line 327 and be vented to atmosphere. The bleeding of air and/or other fluids from the passage 324*fa*, the passage 324*ea* and/or the chamber 324*aa*, via the line 327 or at least a portion thereof, may occur before, during and/or after one or more of the operational steps described above. For example, bleeding may occur upon start-up operation of the injector vessel 324 and/or after maintenance thereof. In an exemplary embodiment, it is understood that the lines 353 and/or 378 may also be used as bleeder lines.

In an exemplary embodiment, it is understood that, in addition to, or instead of the cylinders 326, 352 and/or 376, a wide variety of other pressurizing means, equipment and/or systems may be employed to pressurize the injector vessels 324, 350 and/or 374, and/or a wide variety of modifications may be made to the cylinders 326, 352 and/or 376. The quantity of cylinders may be increased or decreased, and/or plunger mechanisms, piston mechanisms and/or other actuating mechanisms may be connected to, or used instead of, one or more of the cylinders 326, 352 and/or 376, to pressurize the injector vessels 324, 350 and/or 374. Also, one or more pumps may be used, in addition to, or instead of one or more of the cylinders 326, 352 and/or 376. Moreover, one or more of the cylinders 326, 352 and/or 376 may be removed from the injection system 300 and a pump such as, for example, the pump 304, may be used to pressurize one or more of the injector vessels 324, 350 and/or 374. It is understood that one or more additional valves, lines and/or other components and/or systems may be added to the injection system 300 to effect any modification.

In an exemplary embodiment, any hydraulic fluid or other fluid described above and present in the injection system 300 and/or 3000, and/or present in one or more components thereof such as, for example, one or more of the cylinders 326, 352 and/or 376, may be in a wide variety of fluidic forms such as, for example, oil, drilling fluid or mud, air and/or any combination thereof, and/or any type of conventional hydraulic fluid, and/or any other type of fluid, including any type of liquid or gas.

Figure 36:
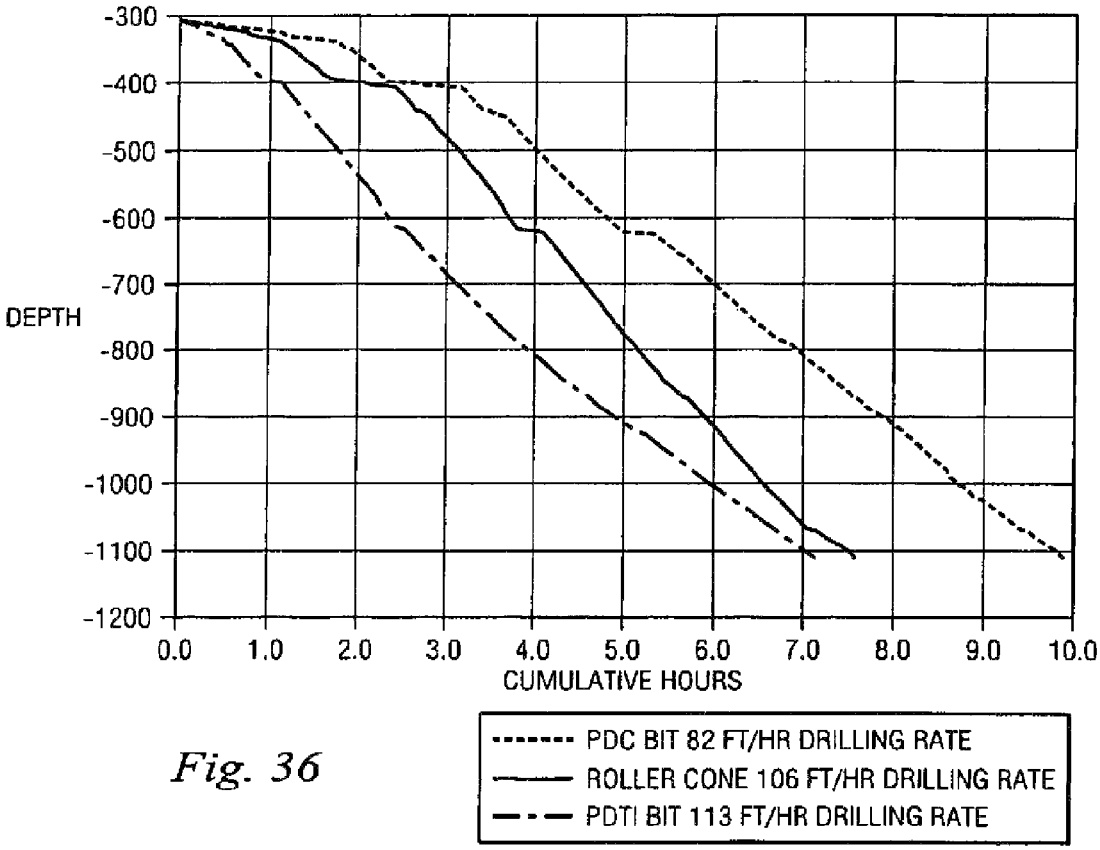
FIG. 36 is a graph depicting the performance of the excavation system according to one or more embodiments of the present disclosure as compared to two other systems.

FIG. 36 depicts a graph showing a comparison of the results of the impact excavation utilizing one or more of the above embodiments (labeled "PDTI in the drawing) as compared to excavations using two strictly mechanical drilling bits—a conventional PDC bit and a "Roller Cone" bit—while drilling through the same stratigraphic intervals. The drilling took place through a formation at the GTI (Gas Technology Institute of Chicago, Ill.) test site at Catoosa, Okla.

The PDC (Polycrystalline Diamond Compact) bit is a relatively fast conventional drilling bit in soft-to-medium formations but has a tendency to break or wear when encountering harder formations. The Roller Cone is a conventional bit involving two or more revolving cones having cutting elements embedded on each of the cones.

The overall graph of FIG. 36 details the performance of the three bits though 800 feet of the formation consisting of shales, sandstones, limestones, and other materials. For example, the upper portion of the curve (approximately 306 to 336 feet) depicts the drilling results in a hard limestone formation that has compressive strengths of up to 40,000 psi.

Note that the PDTI bit performance in this area was significantly better than that of the other two bits—the PDTI bit took only 0.42 hours to drill the 30 feet where the PDC bit took 1 hour and the roller cone took about 1.5 hours. The total time to drill the approximately 800 foot interval took a little over 7 hours with the PDTI bit, whereas the Roller cone bit took 7.5 hours and the PDC bit took almost 10 hours.

The graph demonstrates that the PDTI system has the ability to not only drill the very hard formations at higher rates, but can drill faster that the conventional bits through a wide variety of rock types.

The table below shows actual drilling data points that make up the PDTI bit drilling curve of FIG. 36. The data points shown are random points taken on various days and times. For example, the first series of data points represents about one minute of drilling data taken at 2:38 μm on Jul. 22, 2005, while the bit was running at 111 RPM, with 5.9 thousand pounds of bit weight ("WOB"), and with a total drill string and bit torque of 1,972 Ft Lbs. The bit was drilling at a total depth of 323.83 feet and its penetration rate for that minute was 136.8 Feet per Hour. The impactors were delivered at approximately 14 GPM (gallons per minute) and the impactors had a mean diameter of approximately 0.100" and were suspended in approximately 450 GPM of drilling mud.

| DATE | TIME | RPM | TORQUE Ft. Lbs. | WOB Lbs. | DEPTH Ft. | PENETRATION FT/MIN | PENETRATION FT/HR |
|---|---|---|---|---|---|---|---|
| Jul. 22, 2005 | 2:38 PM | 111 | 1,972 | 5.9 | 323.83 | 2.28 | 136.8 |
| Jul. 22, 2005 | 4:24 PM | 103 | 2,218 | 9.1 | 352.43 | 2.85 | 171.0 |
| Jul. 25, 2005 | 9:36 AM | 101 | 2,385 | 9.5 | 406.54 | 3.71 | 222.6 |
| Jul. 25, 2005 | 10:17 AM | 99 | 2.658 | 10.9 | 441.88 | 3.37 | 202.2 |
| Jul. 25, 2005 | 11:29 AM | 96 | 2.646 | 10.1 | 478.23 | 2.94 | 176.4 |
| Jul. 25, 2005 | 4:41 PM | 97 | 2,768 | 12.2 | 524.44 | 2.31 | 138.6 |
| Jul. 25, 2005 | 4:54 PM | 96 | 2,870 | 10.6 | 556.82 | 3.48 | 208.8 |

Figure 37:
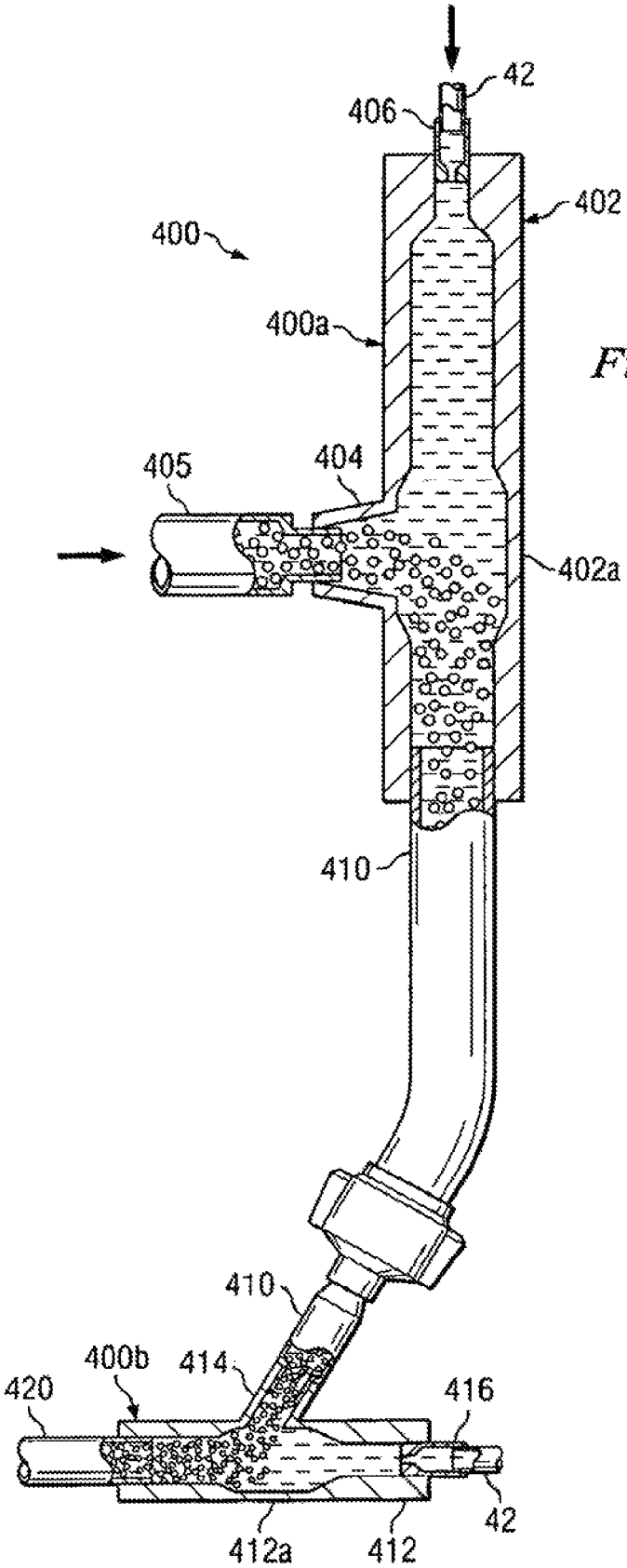
FIG. 37 is an elevational view of a two-stage eductor used in the system of FIG. 1.

Referring to FIG. 37, the reference numeral 400 refers, in general, to an alternate embodiment of a system for mixing the impactors 100 and the drilling fluid in the excavation system 1 of FIG. 1. The system 400 includes a first-stage eductor 400*a* and a second-stage eductor 400*b* that are in flow communication. The first-stage eductor 400*a* includes a cylindrical mixing vessel, or conduit 402 and a radially-extending inlet 404 registering with an opening in the vessel. The impactors 100 from the storage tank 94 (FIG. 1) are introduced into the inlet 404 by a conduit 405, which is connected to either the tank 98 or the screw elevator 14 (FIG. 1). It is understood that the impactors 100 will be premixed with a fluid, which can be the drilling fluid for the system, to form a slurry prior to being introduced into the conduit 405.

A nozzle 406 is mounted in one end portion of the vessel 402 with a portion of the nozzle extending into the vessel. The inlet of the nozzle 406 is connected to the hose 42 (also shown in FIG. 1), so that a portion of the drilling fluid 100 from the tank 6 (FIG. 1) is pumped by the pump 2 through the line 8 and the hose 42 before being introduced into the nozzle 406. The fluid is then discharged at a relatively high velocity and pressure from the nozzle 416 into the interior of the vessel 412. This creates a vacuum, or low pressure zone, by the well-known venturi-eductor effect, which draws the above slurry containing the impactors 100 from the conduit 405 into the vessel 402, via the inlet 404. The slurry mixes with the drilling fluid in the interior of the vessel 402 to form a suspension, which is discharged through a conduit 410 extending from an outlet formed in the other end of the vessel 402. It is understood that the distance, or axial length, that the nozzle 406 extends from the throat 402*a* of the vessel 402 can be determined empirically to insure that an optimum amount of the slurry from the conduit 405 is drawn into the vessel 402, based on the operating conditions.

The second-stage eductor 400*b* includes a mixing vessel, or conduit, 412 that is provided in proximity to the vessel 402 and has a throat 412*a* and an inlet 414 registering with an opening in the vessel. The suspension of the impactors 100 and the drilling fluid from the first-stage eductor 400*a* is passed, via the conduit 410, into the inlet 414.

A nozzle 416 is mounted in one end portion of the vessel 412 with a portion of the nozzle extending into the vessel. The inlet of the nozzle 416 is connected to the hose 42, or to a branch line extending from the hose, so that a portion of the drilling fluid 100 from the tank 6 (FIG. 1) is pumped by the pump 2 through the line 8 and the hose 42 before being introduced into the nozzle 416. The fluid is then discharged at a relatively high velocity and pressure from the nozzle 416 into the interior of the vessel 412. This draws the above suspension from the conduit 410 into the inlet 414 of the vessel 412, in the manner discussed above, and the suspension mixes with the drilling fluid from the nozzle 416 in the interior of the vessel 412 to form another suspension.

It is understood that the distance, or axial length, that the nozzle 416 extends from the throat 412*a* of the vessel 412 can be determined empirically to insure that an optimum amount of the suspension from the inlet 414 is drawn into the vessel 412.

A conduit 420 is connected to an outlet formed at the other end of the vessel 412 for passing the suspension to the drill bit 110 (FIG. 4) or to the drill bit 60 (FIG. 1.) for discharging in a manner to remove a portion of the formation at the bottom surface 122 (FIG. 5) of the well bore 120, as discussed above.

As a non-limiting example of the configuration and operation of the system 400, the discharge end of the nozzle 406 is axially spaced from the throat 402*a* a distance corresponding to approximately 14 nozzle diameters, while the discharge end of the nozzle 416 is axially spaced from the throat 412*a* a distance corresponding to approximately 3.5 nozzle diameters (in this context, FIG. 37 is not to scale).

The drilling fluid is discharged from the nozzle 406 into the vessel at approximately 40 gallons per minute (gpm) at a pressure of approximately 2000 pounds per square inch (psi). This creates a low pressure zone that draws the slurry including the impactors 100, which are at approximately atmospheric pressure, from the conduit 405 into the inlet 404 in the manner discussed above, at approximately 50 gpm (approximately 40 gpm of fluid and approximately 10 gpm of the impactors).

The impactors 100 mix with the drilling fluid in the interior of the vessel 402 to form a suspension that is at a positive pressure, such as approximately 200 psi, and is discharged through the outlet and to the conduit 410 at a volumetric flow rate of approximately 90 gpm. Thus, the ratio of the impactors 100 in the suspension is approximately 10:90 or approximately 11%.

The suspension of the impactors 100 and fluid flows through the conduit 410 and to the inlet 414 of the second-stage eductor 400*b* at the 200 psi pressure and 90 gpm flow rate. Another portion of the drilling fluid from the system 1 is introduced into the nozzle 416 in the manner discussed above in connection with the nozzle 406, and discharges from the nozzle 416 into the vessel 412 at a volumetric flow rate, of approximately 320 gpm and at a pressure of approximately 8500 psi. This drilling fluid creates a low pressure zone that draws the suspension of impactors 100 and the drilling fluid from the conduit 410 into the inlet 404 at the 90 gpm rate discussed above. The latter suspension mixes with the high pressure drilling fluid from the nozzle 416 in the interior of the vessel 412 to form another suspension that exits the vessel 412 and passes to the conduit 420 at a pressure of approximately 2000 psi and a discharge rate of approximately 410 gpm. This latter suspension passes to, and discharges from, the drill bit 60 in the manner discussed above to cut the formation at the bottom surface 122 (FIG. 5) of the well bore 120.

Thus, the nozzle 406 of the first-stage eductor 402*a* receives its drilling fluid from the system 1 and the horsepower from the system is utilized to pump the fluid to the nozzle. Also, the suspension of the impactors 100 and the drilling fluid that enters the inlet 414 of the second-stage eductor 400*b* is at a positive head, or pressure, (approximately 200 psi in the above example). As a result the suspension is discharged from the eductor 400*b* at a relatively high volumetric flow (410 gpm in the above example) without using any additional horsepower.

It is understood that variations can be may be made in the embodiments discussed above. For example, the axial distances that the nozzles 406 and 416 extend from the throats 402*a* and 412*a*, respectively can be varied in order to obtain optimum results. Also, the range of volumetric flow rates of the drilling fluid that is introduced into the nozzle 406 can be between 5 gpm and 100 gpm and the range of volumetric flow rates of the drilling fluid that is introduced into the nozzle 416 can be between 100 gpm and 700 gpm. Further, the percentage of impactors in the suspension discharging from the conduit 420 can vary from 5% to 30% by volume and the percentage of drilling fluid from 70% to 95% by volume.

Figure 38:
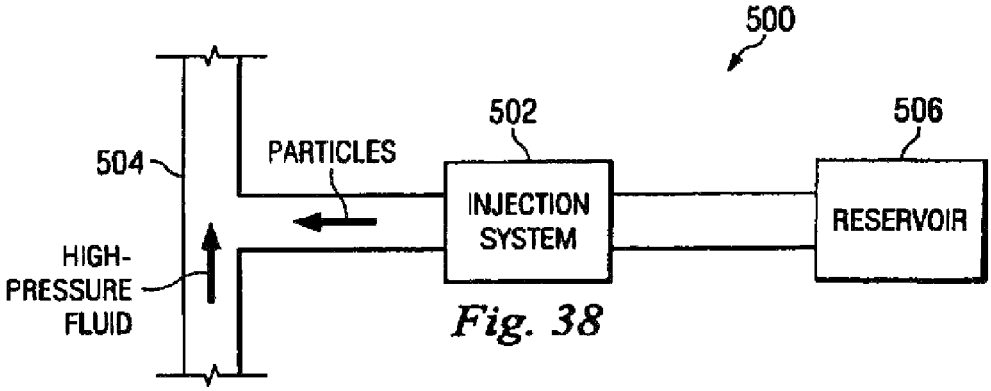
FIG. 38 is a schematic view of an injection system according to another embodiment.

In an exemplary embodiment, as illustrated in FIG. 38, an injection system is generally referred to by the reference numeral 500 and includes an injection system 502 fluidicly coupled to a line such as a standpipe 504 that defines a fluid passage or flow region for transporting pressurized fluid flow. A reservoir 506 is fluidicly coupled to the injection system 502.

In an exemplary embodiment, the standpipe 504 is a part of, is fluidicly coupled to, and/or comprises, one or more of the above-described components of the system 1, which is shown in FIG. 1.

In an exemplary embodiment, the standpipe 504 is a part of, is fluidicly coupled to, and/or comprises, the line 8, which is shown in FIG. 1. In an exemplary embodiment, the standpipe 504 is a part of, is fluidicly coupled to, and/or comprises, the hose 42, which is shown in FIG. 1. In an exemplary embodiment, the standpipe 504 is a part of, is fluidicly coupled to, and/or comprises, the pipe string 55, which is shown in FIG. 1. In several exemplary embodiments, the standpipe 504 is fluidicly coupled to the pump 2 and the pipe string 55, both of which are shown in FIG. 1.

In an exemplary embodiment, the reservoir 506 holds a plurality of particles. In an exemplary embodiment, the particles in the reservoir 506 comprise a plurality of the solid material impactors 100. In an exemplary embodiment, the impactors 100 comprise spherical steel shot, a substantial portion of which has a mean diameter of about 0.075 inches. In an exemplary embodiment, the apparent bulk density of the solid material impactors 100 in the reservoir 506 is 38 lb/gal. In an exemplary embodiment, the solid material impactors 100 in the reservoir 506 are wet. In an exemplary embodiment, the solid material impactors 100 are mixed with liquid to form a slurry in the reservoir 506. In an exemplary embodiment, the solid material impactors 100 in the reservoir 506 are in a non-slurry form. In an exemplary embodiment, the solid material impactors 100 in the reservoir 506 are cleaned and/or coated with mud. In an exemplary embodiment, the reservoir 506 is at or substantially near atmospheric pressure. In an exemplary embodiment, the reservoir 506 includes solid-material-impactor level controls. In an exemplary embodiment, the reservoir 506 includes fluid-level controls.

In an exemplary embodiment, a control system comprising a programmable logic controller may be included in the system 500 to control one or more of the components of the system 500, including the injection system 502 and/or the reservoir 506, and/or one or more components thereof. In another exemplary embodiment, a control system comprising a programmable logic controller may be included in the system 500 to control one or more of the valve of the system 500. In certain embodiments, the control system may include a potentiometer. In another exemplary embodiment, the control system allows for the system 500 to be controlled from a remote location.

In operation, circulation fluid such as, for example, drilling mud, is withdrawn from the tank 6 (FIG. 1) and pumped by the pump 2 (FIG. 1), as described above. The fluid is pumped through the standpipe 504 before being pumped through the bit 60. The fluid is at a relatively high pressure within the standpipe 504. In an exemplary embodiment, the pressure in the standpipe 504 is 5,000 psi. In an exemplary embodiment, the pressure in the standpipe 504 is greater than 5,000 psi. In an exemplary embodiment, the pressure in the standpipe 504 is less than 5,000 psi. In an exemplary embodiment, the pressure in the standpipe 504 ranges from 4,000 psi to 8,000 psi. In an exemplary embodiment, the pressure in the standpipe 504 is less than 4,000 psi. In an exemplary embodiment, the pressure in the standpipe 504 is greater than 8,000 psi. In an exemplary embodiment, the flow rate of the fluid in the standpipe 504 is 445 gpm. In an exemplary embodiment, the flow rate of the fluid in the standpipe 504 ranges from 300 gpm to 800 gpm. In several exemplary embodiments, the flow rate of the fluid in the standpipe 504 may vary over a wide range of flow rates.

The solid material impactors 100 exit the reservoir 506 and enter the injection system 502. In an exemplary embodiment, the solid material impactors 100 are fed into the injection system 502. In an exemplary embodiment, the solid material impactors 100 are gravity fed into the injection system 502.

The injection system 502 substantially directly injects the solid material impactors 100 into the fluid passage, or flow region, defined by the standpipe 504 to form a suspension of solid material impactors 100 and fluid in the standpipe 504, which subsequently flows to the drill bit 60 in order to excavate a subterranean formation, as described above. In an exemplary embodiment, the solid material impactors 100 are substantially directly injected into the standpipe 504 at a steady flow rate of 15 gpm. In an exemplary embodiment, the solid material impactors 100 are substantially directly injected into the standpipe 504 at a steady flow rate that ranges from 10 gpm to 20 gpm. In several exemplary embodiments, the solid material impactors 100 may be substantially directly injected into the standpipe 504 over a wide range of flow rates.

Since the solid material impactors 100 are substantially directly injected into the flow region of the standpipe 504, there is no need or requirement for the solid material impactors to be pre-mixed with a fluid to form a slurry, or to be pressurized before being injected into the flow region defined by the standpipe 504, after exiting the reservoir 506. As a result, in several exemplary embodiments, the design and manufacturing complexity, and the overall cost, of the injection system 500 may be appreciably reduced. In several exemplary embodiments, the solid material impactors 100 may be pre-mixed with a fluid to form a slurry, or may be pressurized before being injected into the flow region defined by the standpipe 504, after exiting the reservoir 506.

In an exemplary embodiment, the system 500 is controlled so that the solid material impactors 100 continue to enter the injection system 502, and the injection system 502 continues to inject the solid material impactors 100 into the flow region defined by the standpipe 504. As a result, after the direct injection of the solid material impactors 100 has been initiated and during the direct injection, solid material impactors 100 are continuously present in the reservoir 506, the injection system 502 and the flow region defined by the standpipe 504.

In an exemplary embodiment, the solid material impactors 100 enter the injection system 502 at, or substantially near, atmospheric pressure. In an exemplary embodiment, the solid material impactors 100 enter the injection system 502 at a pressure that is greater than atmospheric pressure. In an exemplary embodiment, the solid material impactors 100 enter the injection system 502 at a pressure that is less than atmospheric pressure.

When present in the injection system 502, the solid material impactors 100, at least in part, form a permeable media within the injection system 502. The permeable media at least partially formed by the solid material impactors 100 may also be formed, at least in part, by liquid present in the injection system 502 or reservoir 506. During the steady-state operation of the system 502, the permeable media at least partially formed by the solid material impactors 100 is continuously replenished with solid material impactors 100 as other solid material impactors 100 are injected into the flow region defined by the standpipe 504.

During operation of the system 500, the substantially steady-state pressure drop from the flow region defined by the standpipe 504 to the reservoir 506 generally equals the pressure differential between the relatively high pressure in the standpipe 504 and the relatively low, or substantially atmospheric, pressure in the reservoir 506. The permeable media at least partially formed by the solid material impactors 100 within the injection system 502 generally reduces the pressure across the injection system 502 from at or near the relatively high pressure in the flow region defined by the standpipe 504, to at or substantially near atmospheric pressure in the reservoir 506. The permeable media in the injection system 502 absorbs the pressure within the system 502, reducing the pressure therein to at or near atmospheric pressure at a location at or near the reservoir 506. As a result of the substantially steady-state pressure reduction by the permeable media at least partially formed by the solid material impactors 100, the system 500 is permitted to substantially directly inject the solid material impactors 100 into the flow region defined by the standpipe 504. In an exemplary embodiment, some circulation fluid may flow, or bleed, from the standpipe 504, through the injection system 502, and to the reservoir 506 at some bleed rate.

In several exemplary embodiments, the injection system 502 of the injection system 500 may include one or more plastic injection-molding extruders, one or more metal injection-molding extruders, one or more other types of injection-molding extruders and/or any combination thereof.

Figure 39A:
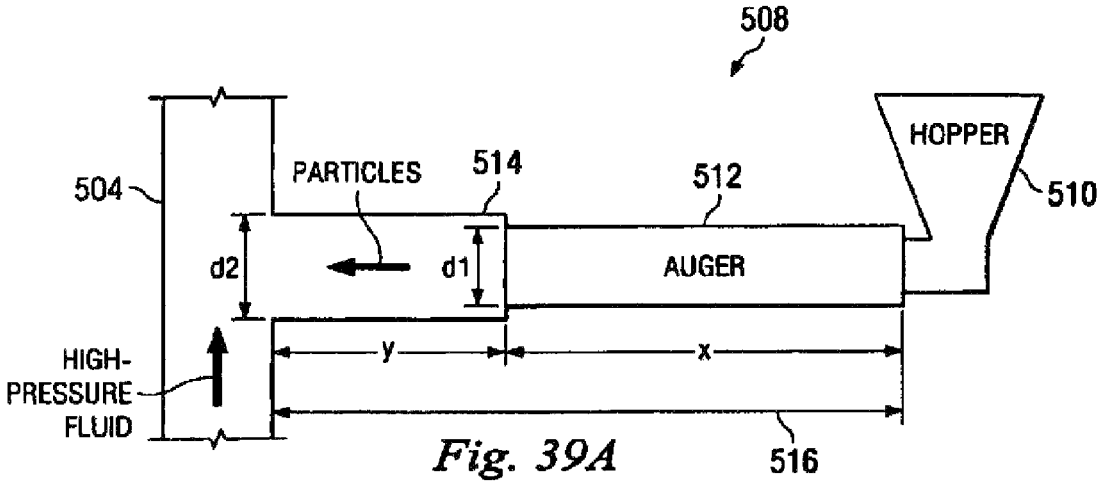
FIG. 39A is a schematic view of an injection system according to another embodiment.

In an exemplary embodiment, as illustrated in FIG. 39A, an injection system is generally referred to by the reference numeral 508 and includes a hopper 510 that is fluidicly coupled to an auger 512, which, in turn, is fluidicly coupled to a line or conduit 514. The standpipe 504 is fluidicly coupled to the conduit 514. The auger 512 defines a length x and a diameter d1. The conduit 514 defines a length y and a diameter d2. The sum of the lengths x and y defines a length 516. A plurality of the solid material impactors 100 are disposed in the hopper 510.

Figure 39B:
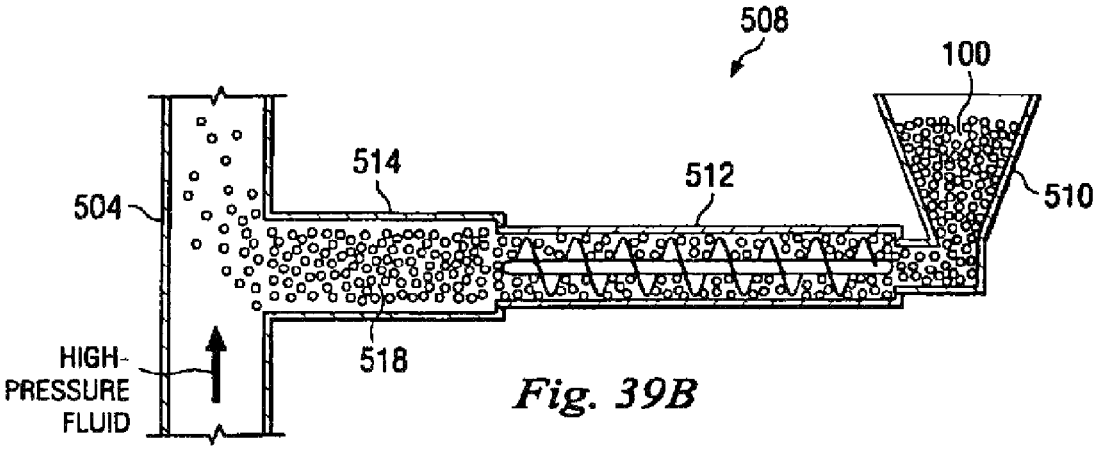
FIG. 39B is another schematic view of the injection system of FIG. 39A.

In operation, in an exemplary embodiment and as illustrated in FIG. 39B, the solid material impactors 100 are gravity fed into the auger 512. The auger 512 is operated to push the solid material impactors 100 into the conduit 514. After a while, the solid material impactors 100 are disposed in the hopper 510, the auger 512 and the conduit 514. Eventually, the solid material impactors 100 are pushed out of the conduit 514 and are substantially directly injected into the flow region defined by the standpipe 504. At and after this point in time, and during the continued operation of the auger 512, the solid material impactors 100 are simultaneously disposed in the hopper 510, the auger 512, the conduit 514 and the flow region defined by the standpipe 504. As a result, and at any point in time during the continued operation of the auger 512, the control volume of the solid material impactors 100 in the hopper 510, the auger 512 and the conduit 514 at least partially form a permeable media 518 in the hopper 510, the auger 512 and the conduit 514.

As noted above, the auger 512 operates to push the solid materials 100 out of the conduit 514 and into the flow region defined by the standpipe 504, thereby substantially directly injecting the solid material impactors 100 into the flow region defined by the standpipe 504, through which circulation fluid is flowing at a relatively high pressure. The solid material impactors 100 and the high-pressure fluid in the standpipe 504 mix to form a suspension, which subsequently flows to the drill bit 60 in order to excavate a subterranean formation, as described above.

The permeable media 518 operates to reduce the pressure across the conduit 514 and the auger 512, from the relatively high pressure in the standpipe 504 to the relatively low pressure in the hopper 510, thereby permitting the auger 512 to operate to push the solid material impactors 100 into the conduit 514 and subsequently into the flow region defined by the standpipe 504. The use of a control volume of the solid material impactors 100 to at least partially form the permeable media 518 permits the auger 512, and any associated fluid lines, fittings, control devices, etc. to operate at a substantially reduced pressure, rather than at the pressure in the standpipe 504, thereby lowering the overall cost and/or complexity of the system 508.

During operation of the system 508, the high-pressure, high-velocity fluid in the flow region defined by the standpipe 504 operates to agitate and remove, for example, debris and/or build-up at the end of the conduit 514 coupled to the standpipe 504, washing clean the end of the conduit 514 coupled to the standpipe 504. Since the end of the conduit 514 coupled to the standpipe 504 is directly exposed to high-pressure, high-velocity fluid, the end of the conduit 514 coupled to the standpipe 504 is automatically cleaned during the operation of the system 508. In an exemplary embodiment, one or more orifices may be disposed in the flow region defined by the standpipe 504 and positioned, relative to the end of the conduit 514 coupled to the standpipe 504, to create localized jets of fluid in the vicinity of the conduit 514 in order to further promote the agitation and self-cleaning of the end of the conduit 514 coupled to the standpipe 504.

The permeability of the permeable media 518 is determined, at least in part, by using Darcy's law. The permeability of the permeable media 518 is a function of the lengths x, y and 516, and the diameters d1 and d2. As a result, in several exemplary embodiments, the permeability of the permeable media 518 may be adjusted by varying the sizes of the lengths x, y and/or 516, and/or the diameters d1 and/or d2. In an exemplary embodiment, the diameter d2 is greater than the diameter d1, as illustrated in FIGS. 39A and 39B. In an exemplary embodiment, the diameter d2 may be less than the diameter d1. In an exemplary embodiment, the diameter d2 may be equal to the diameter d1. In an exemplary embodiment, the length y may be greater than the length x. In an exemplary embodiment, the length y may be less than the length x. In an exemplary embodiment, the length y may be equal to the length x. In an exemplary embodiment, the length y may be reduced to zero by removing the conduit 514 and coupling an end of the auger 512 directly to the standpipe 504. In an exemplary embodiment, d1 may vary over the length x. In an exemplary embodiment, d2 may vary over the length y. In an exemplary embodiment, d1 and/or d2 may vary over the length 516. In an exemplary embodiment, the auger 512 or at least a portion thereof, and/or the conduit 514 or at least a portion thereof, may be tapered.

In several exemplary embodiments, the permeability of the permeable media 518 may be optimized. In an exemplary embodiment, the permeability of the permeable media 518 is optimized by adjusting the sizes of the lengths x, y and/or 516, and/or the diameters d1 and/or d2. Instead of, or in addition to adjusting the sizes of the lengths x, y and/or 516, and/or the diameters d1 and/or d2, the permeability of the permeable media 518 is optimized or enhanced by sizing the solid material impactors 100 so that all of the impactors 100 are approximately equal in size. To so size the solid material impactors 100, the solid material impactors 100 are filtered before being disposed in the hopper 510, or before exiting the hopper 510. In an exemplary embodiment, one or more screens are placed over the hopper 510 and the solid material impactors 100 are disposed in the hopper 510 by permitting the impactors 100 to pass through the one or more screens. As a result, foreign particles having effective diameters larger than the solid material impactors 100 are filtered out and prevented from entering the hopper 510, thereby optimizing or enhancing the permeability of the permeable media 518 during the operation of the system 508. Alternatively, one or more screens may be disposed in, or in the vicinity of, the hopper 510, in order to filter out foreign particles having effective diameters larger than the solid material impactors 100 before the impactors 100 exit the hopper 510.

In an exemplary embodiment, one or magnets are used to separate the solid material impactors 100 from foreign, non-ferrous materials. As a result, the foreign, non-ferrous materials are filtered out and not disposed in the hopper 510, thereby optimizing or enhancing the permeability of the permeable media 518 during the operation of the system 508. Alternatively, one or magnets may be disposed in or in the vicinity of the hopper 510, in order to filter out foreign, non-ferrous materials from the solid material impactors 100 before the impactors 100 exit the hopper 510.

In several exemplary embodiments, the auger 512 comprises one or more augers. In several exemplary embodiments, instead of, or in addition to the auger 512, the system 508 comprises one or more screw feeders that push the solid material impactors 100 through the conduit 514 and into the flow region defined by the standpipe 504, with the permeable media 518 at least partially formed by the solid material impactors 100 in the control volume of the conduit 514 and the one or more screw feeders.

In several exemplary embodiments, other secondary materials and/or particles may be grouped with the impactors 100 in the hopper 510, and/or at other locations in the system 508, in order to adjust the permeability of the permeable media 518. In an exemplary embodiment, particles having effective diameters that are smaller than the effective diameters of the solid material impactors 100 may be disposed in the hopper 510 in order to decrease the permeability of the permeable media 518.

In several exemplary embodiments, one or more fluids may be introduced at one or more locations in the system 508 in order to aid the flow of the impactors in the auger 512 and/or the conduit 514. In several exemplary embodiments, one or more fluids may be introduced at one or more locations in the system 508 in order to adjust the permeability of the permeable media 518. In an exemplary embodiment, fluid with one or more additives may be introduced at one or more locations in the system 508 such as, for example, at the end of the auger 512 proximate the hopper 510, immediately downstream from the hopper 510, in order to adjust the permeability of the permeable media 518. In an exemplary embodiment, fluid with one or more additives may be introduced at one or more locations in the system 508 such as, for example, at the end of the auger 512 proximate the hopper 510, immediately downstream from the hopper 510, in order to decrease the permeability of the permeable media 518, thereby increasing the pressure differential across the permeable media 518. In an exemplary embodiment, the one or more additives in the fluid introduced into the system 508 in order to decrease the permeability of the permeable media 518 include, but are not limited to, lost circulation materials (LCMs) such as, for example, one or more commercially-available LCMs. In an exemplary embodiment, the one or more additives in the fluid introduced into the system 508 in order to decrease the permeability of the permeable media 518 include, but are not limited to, LCMs and/or sized calcium carbonate. In an exemplary embodiment, the one or more additives in the fluid introduced into the system 508 in order to decrease the permeability of the permeable media 518 include, but are not limited to, LCMs, sized calcium carbonate, mud viscosifiers and/or any combination thereof. In an exemplary embodiment, the one or more additives in the fluid introduced into the system 508 in order to decrease the permeability of the permeable media 518 include, but are not limited to, LCMs, sized calcium carbonate, mud viscosifiers, ferrous materials and/or any combination thereof.

Figure 39C:
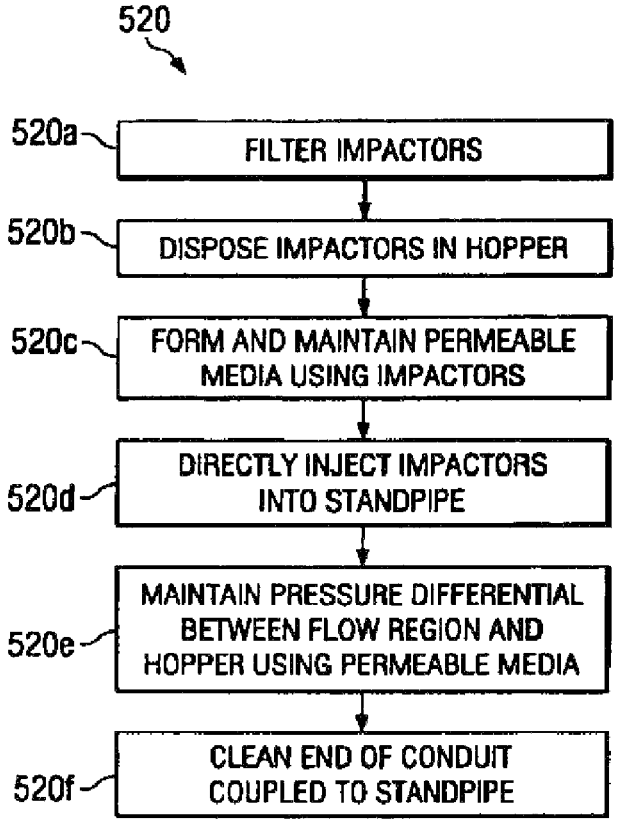
FIG. 39C is a flow chart illustration of an injection method using the injection system of FIGS. 39A and 39B.

In an exemplary embodiment, as illustrated in FIG. 39C, a method 520 of injecting the impactors 100 using the system 508 is provided and includes filtering the solid material impactors 100 in step 520*a*, in a manner substantially similar to the manner described above. Before, during and/or after filtering the solid material impactors 100 in the step 520*a*, the impactors 100 are disposed in the hopper 510 in step 520*b*. After the step 520*b*, the permeable media 518 is formed and maintained using the impactors 100 in the auger 512 and the conduit 514 in step 520*c*, in a manner substantially similar to the manner described above. Before, during and/or after the step 520*c*, the impactors 100 are substantially directly injected into the flow region defined by the standpipe 504 in step 520*d*, in a manner substantially similar to that described above. Before, during and/or after the step 520*d*, the pressure differential between the flow region defined by the standpipe 504 and the hopper 510 is maintained by the permeable media 518 in step 520*e*, in a manner substantially similar to that described above. Before, during and/or after the step 520*e*, the end of the conduit 514 coupled to the standpipe 504 is cleaned in step 520*f* by the high-pressure, high-velocity fluid flowing in the flow region defined by the standpipe 504.

Figure 40:
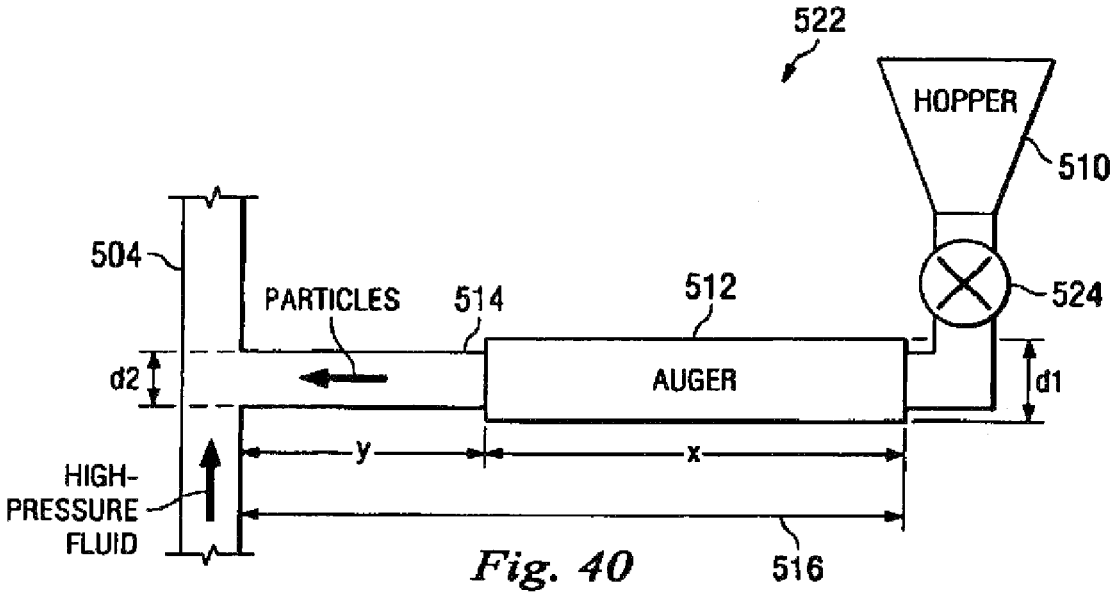
FIG. 40 is a schematic view of an injection system according to another embodiment.

In an exemplary embodiment, as illustrated in FIG. 40, an injection system is generally referred to by the reference numeral 522. The system 522 is substantially similar to the system 508, except that a valve 524 is fluidicly coupled between the hopper 510 and the auger 512, and the diameter d2 is less than the diameter d1. The operation of the system 522 is substantially similar to the above-described operation of the system 508 and therefore will not be described in detail, except that the valve 524 operates to control the entrance of the impactors 100 into the auger 512 and therefore the subsequent injection of the impactors 100 into the flow region defined by the standpipe 504. The valve 524 also operates to control any bleeding or flow of fluidic material and/or other material from the flow region defined by the standpipe 504 to the hopper 510. Appreciable and unwanted amounts of flow may occur if, for example, an accident or other unforeseen event occurs and the permeable media 518 is no longer able to maintain the pressure differential across the conduit 514 and the auger 512.

Figure 41:
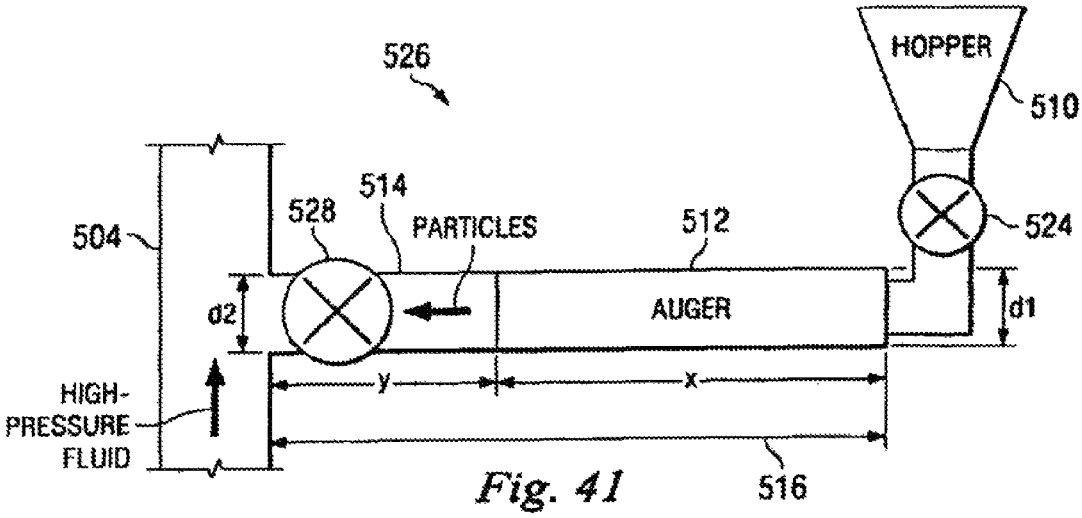
FIG. 41 is a schematic view of an injection system according to another embodiment.

In an exemplary embodiment, as illustrated in FIG. 41, an injection system is generally referred to by the reference numeral 526. The system 526 is substantially similar to the system 522, except that a valve 528 is fluidicly coupled between the conduit 514 and the standpipe 504, and the diameters d1 and d2 are equal. The operation of the system 522 is substantially similar to the above-described operation of the system 522 and therefore will not be described in detail, except that the valve 528 operates to control the injection of the impactors 100 into the flow region defined by the standpipe 504, and also operates to control any bleeding or flow of fluidic material and/or other material from the flow region defined by the standpipe 504 to the hopper 510. Appreciable and unwanted amounts of flow may occur if, for example, an accident or other unforeseen event occurs and the permeable media 518 is no longer able to maintain the pressure differential across the conduit 514 and the auger 512. In an exemplary embodiment, the valve 524 is removed from the system 526, with the valve 528 remaining and continuing to operate to control the injection of the impactors into the flow region defined by the standpipe 504, and also to control any bleeding or flow of fluidic material and/or other material from the flow region defined by the standpipe 504 to the hopper 510.

Figure 42:
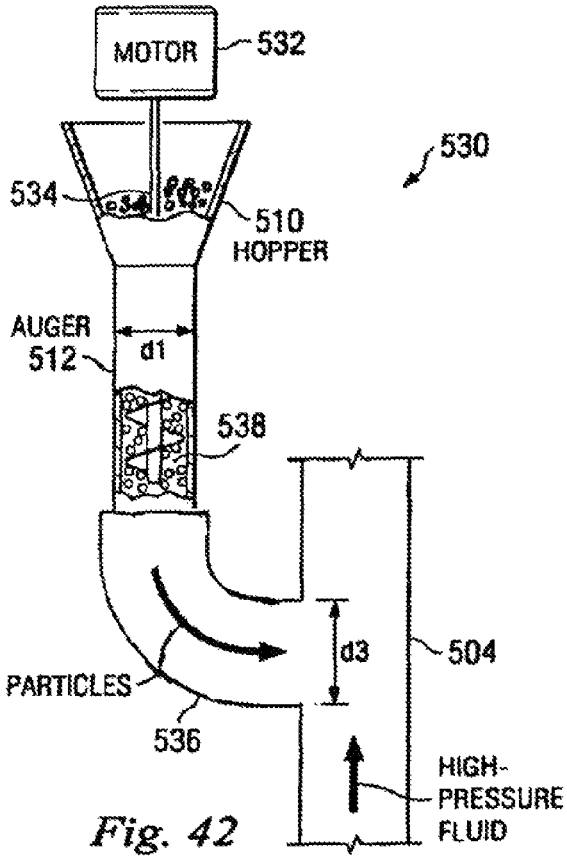
FIG. 42 is a schematic view of an injection system according to another embodiment.

In an exemplary embodiment, as illustrated in FIG. 42, an injection system is generally referred to by the reference numeral 530 and includes the hopper 510 and the auger 512 fluidicly coupled thereto. As viewed in FIG. 42, the auger 512 is vertically oriented. A motor 532 is operably coupled to the auger 512, with a shaft 534 extending through the hopper 510 and between the motor 532 and the auger 512. An elbow-shaped fitting 536 is fluidicly coupled between the auger 512 and the standpipe 504, and defines a diameter d3.

In operation, the hopper 510 holds the solid material impactors 100, which are gravity fed into the auger 512. The motor 532 operates to rotate the shaft 534, which, in turn, causes the auger 512 to operate and move the impactors 100 into the fitting 536. After a while, the solid material impactors 100 are disposed in the hopper 510, the auger 512 and the fitting 536. During the continued operation of the motor 532, the shaft 534 and the auger 512, the solid material impactors 100 are disposed throughout the fitting 536. Eventually, the solid material impactors 100 are pushed out of the fitting 536 and are substantially directly injected into the flow region defined by the standpipe 504. At and after this point in time, and during the continued operation of the auger 512, the solid material impactors 100 are simultaneously disposed in the hopper 510, the auger 512, the fitting 536 and the flow region defined by the standpipe 504. As a result, and at any point in time during the continued operation of the auger 512, the solid material impactors 100 in control volume defined by the auger 512 and the fitting 536 at least partially form a permeable media 538 in the auger 512 and the fitting 536.

As noted above, the auger 512 operates to push the solid materials 100 out of the fitting 536 and into the flow region defined by the standpipe 504, thereby substantially directly injecting the solid material impactors 100 into the flow region defined by the standpipe 504. The solid material impactors 100 and the high-pressure fluid flowing in the standpipe 504 mix to form a suspension, which subsequently flows to the drill bit 60 in order to excavate a subterranean formation, as described above.

The permeable media 538 operates to reduce the pressure across the fitting 536 and the auger 512, from the relatively high pressure in the standpipe 504 to the relatively low pressure in the hopper 510, thereby permitting the auger 512 to operate to push the solid material impactors 100 into the fitting 536 and subsequently into the flow region defined by the standpipe 504. The use of a control volume of the solid material impactors 100 to at least partially form the permeable media 538 permits the auger 512, and any associated fluid lines, fittings, control devices, etc. to operate at a substantially reduced pressure, rather than at the pressure in the standpipe 504, thereby lowering the overall cost and/or complexity of the system 508.

During operation of the system 530, the high-pressure, high-velocity fluid in the flow region defined by the standpipe 504 operates to agitate and thus wash clean the end of the fitting 536 coupled to the standpipe 504. Since the end of the fitting 536 coupled to the standpipe 504 is directly exposed to high-pressure, high-velocity fluid, the end of the fitting 536 coupled to the standpipe 504 is automatically cleaned during the operation of the system 530.

Figure 43:
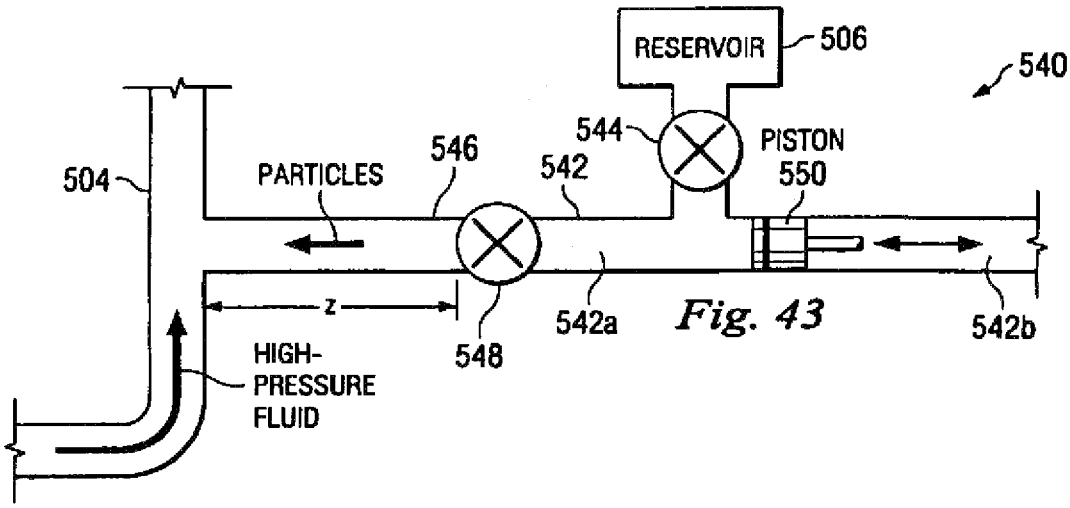
FIG. 43 is a schematic view of an injection system according to another embodiment.

In an exemplary embodiment, as illustrated in FIG. 43, an injection system is generally referred to by the reference numeral 540 and includes the reservoir 506 and a conduit 542 fluidicly coupled thereto. A valve 544 is fluidicly coupled between the reservoir 506 and the conduit 542. A conduit 546 is fluidicly coupled between the conduit 542 and the standpipe 504, and defines a dimension z. A valve 548 is fluidicly coupled between the conduits 542 and 546. A piston 550 is disposed in the conduit 542 and defines portions 542*a* and 542*b* of the conduit 542. The piston 550 is adapted to reciprocate within the conduit 542 in response to hydraulic fluid being introduced into, and discharged from, the portion 542*b* of the conduit 542. In several exemplary embodiments, one or more of the valves 544 and 548 include one or more gate valves.

In operation, the reservoir 506 holds the solid material impactors 100 and the valves 544 and 548 are closed. The valve 544 is opened and the impactors 100 begin to enter the conduit 542, filling the portion 542*a* of the conduit 542. In an exemplary embodiment, the piston 550 is drawn back to draw the impactors 100 into the conduit 542. Once the portion 542*a* of the conduit 542 is generally filled with the impactors 100, the valve 544 is closed. The volume of the solid material impactors 100 in the portion 542*a* of the conduit 542 at least partially forms a permeable media in the portion 542*a* of the conduit 542.

The valve 548 is opened and the piston 550 moves towards the valve 548, in response to hydraulic fluid being introduced into the portion 542*b* of the conduit 542, thereby pushing the impactors 100, and thus the permeable media formed thereby, through the conduit 546 and into the flow region defined by the standpipe 504. As a result, the impactors 100 are substantially directly injected into the flow region defined by the standpipe 504. When the permeable media at least partially formed by the impactors 100 is at least partially positioned within the conduit 546, the permeable media reduces the pressure across at least a portion of the conduit 546, the valve 548 and the portion 542*a* of the conduit 542, from the relatively high pressure in the standpipe 504 to the relatively low pressure at the valve 544 and/or the interface between the piston 550 and the permeable media. As a result, the operations of the valves 544 and 548 and the piston 550 are facilitated. As another result, the operable lives of the valves 544 and 548 and the piston 550 are increased.

In an exemplary embodiment, after some or all of the impactors 100 that were initially in the portion 542*a* of the conduit 542 have been substantially directly injected into the standpipe 504, the piston 550 is retracted and moves away from valve 548, in response to hydraulic fluid being discharged from the portion 542*b* of the conduit 542. Before, during or after the retraction of the piston 550, the valve 548 is closed and the valve 544 is opened, thereby permitting additional impactors 100 to enter the portion 542*a* of the conduit 542. If at least some of the impactors 100 are still present in the conduit 546, the pressure drop from the standpipe 504 to the valve 548, which is primarily provided by the portion of the permeable media that is at least partially formed by the impactors 100 in the conduit 546, facilitates the closing of the valve 548. That is, the pressure at the valve 548 is less than the pressure in the standpipe 504, thereby permitting the valve 548 to close at a lower pressure. Similarly, if at least some of the impactors 100 are still present in the conduits 546 and/or 542, the pressure drop from the standpipe 504 to the valve 544, which is primarily provided by the permeable media at least partially formed by the impactors 100 in the conduits 546 and/or 542, facilitates the opening of the valve 544. That is, the pressure at the valve 544 is less than the pressure in the standpipe 504, thereby permitting the valve 544 to open at a lower pressure.

In an exemplary embodiment, the above-described operation of the system 540 is repeated in order to substantially directly inject some or all of the additional impactors 100 into the standpipe 504. In several exemplary embodiments, the length of the conduit 542, the dimension z and/or the stroke length of the piston 552 may be varied. In an exemplary embodiment, the conduit 546 may be removed from the system 540 so that the dimension z is equal to zero and the valve 548 is fluidicly coupled between the standpipe 504 and the conduit 542.

Figure 44:
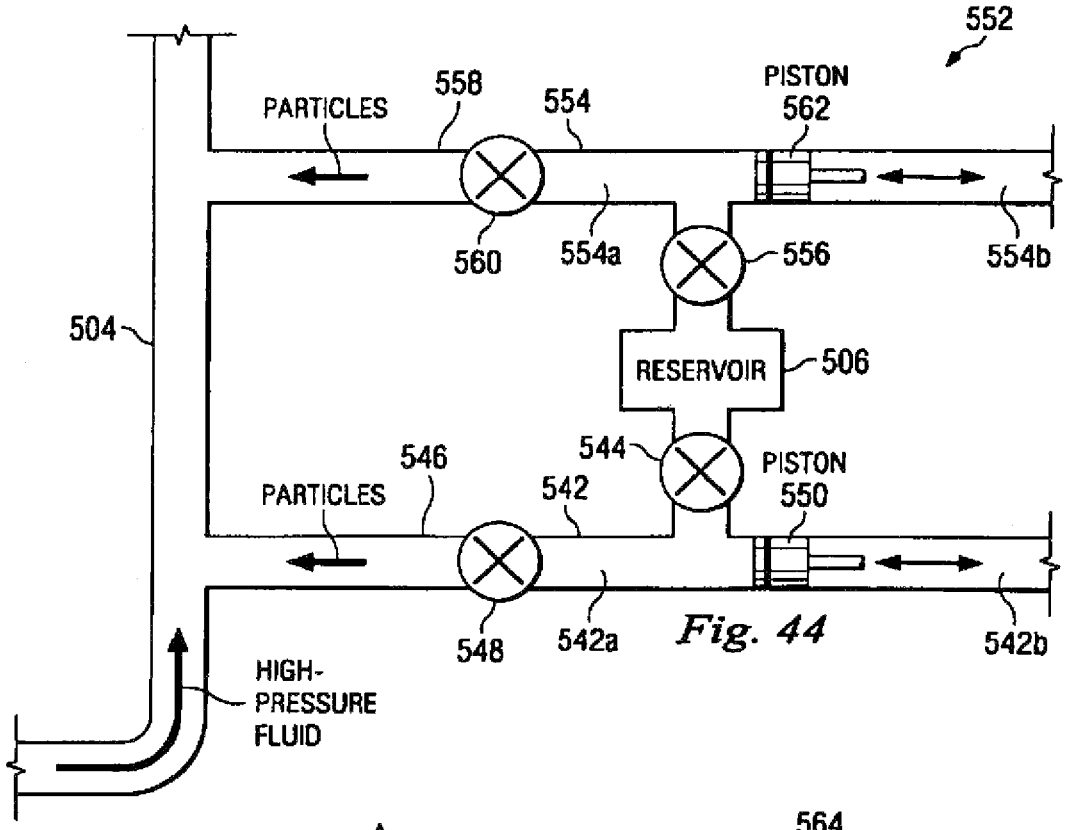
FIG. 44 is a schematic view of an injection system according to another embodiment.

In an exemplary embodiment, as illustrated in FIG. 44, an injection system is generally referred to by the reference numeral 552 and includes the reservoir 506 and a conduit 542 fluidicly coupled thereto. The valve 544 is fluidicly coupled between the reservoir 506 and the conduit 542. The conduit 546 is fluidicly coupled between the conduit 542 and the standpipe 504. The valve 548 is fluidicly coupled between the conduits 542 and 546. The piston 550 is disposed in the conduit 542 and defines the portions 542*a* and 542*b* of the conduit 542. The piston 550 is adapted to reciprocate within the conduit 542 in response to hydraulic fluid being introduced into, and discharged from, the portion 542*b* of the conduit 542.

A conduit 554 is fluidicly coupled to the reservoir 506, and a valve 556 is fluidicly coupled between the reservoir 506 and the conduit 554. A conduit 558 is fluidicly coupled between the conduit 554 and the standpipe 504, and a valve 560 is fluidicly coupled between the conduits 554 and 558. A piston 562 is disposed in the conduit 554 and defines portions 554*a* and 554*b* of the conduit 554. The piston 562 is adapted to reciprocate within the conduit 554 in response to hydraulic fluid being introduced into, and discharged from, the portion 554*b* of the conduit 554. In several exemplary embodiments, one or more of the valves 544, 556, 548 and 560 include one or more gate valves.

In operation, the reservoir 506 holds the solid material impactors 100 and the valves 544, 556, 548 and 560 are initially closed. The valve 544 is opened, the piston 550 is drawn back, and the impactors 100 begin to enter the conduit 542, filling the portion 542*a* of the conduit 542. Once the portion 542*a* of the conduit 542 is generally filled with the impactors 100, the valve 544 is closed. The volume of the solid material impactors 100 in the portion 542*a* of the conduit 542 at least partially forms a permeable media in the portion 542*a* of the conduit 542.

The valve 548 is opened and the piston 550 moves towards the valve 548, in response to hydraulic fluid being introduced into the portion 542*b* of the conduit 542, thereby pushing the impactors 100, and thus the permeable media formed thereby, through the conduit 546 and into the flow region defined by the standpipe 504. As a result, the impactors 100 are substantially directly injected into the flow region defined by the standpipe 504. When the permeable media at least partially formed by the impactors 100 is at least partially positioned within the conduit 546, the permeable media reduces the pressure across at least a portion of the conduit 546, the valve 548 and the portion 542*a* of the conduit 542, from the relatively high pressure in the standpipe 504 to the relatively low pressure at the valve 544 and/or the interface between the piston 550 and the permeable media. As a result, the operations of the valves 544 and 548 and the piston 550 are facilitated. As another result, the operable lives of the valves 544 and 548 and the piston 550 are increased.

During the direct injection of the solid material impactors 100 into the flow region defined by the standpipe 504, via the conduits 542 and 546, the valve 556 is opened, the piston 562 is drawn back and other solid material impactors 100 begin to enter the portion 554*a* of the conduit 554, filling the portion 554*a* of the conduit 554. Once the portion 554*a* is completed filled with the impactors 100, the valve 556 is closed. The volume of the solid material impactors 100 in the portion 554*a* of the conduit 554 at least partially forms a permeable media in the portion 554*a* of the conduit 554.

In an exemplary embodiment, during or after some or all of the impactors 100 that were initially in the portion 542*a* of the conduit 542 have been substantially directly injected into the standpipe 504, the valve 560 is opened and the piston 562 moves towards the valve 560, in response to hydraulic fluid being introduced into the portion 554*b* of the conduit 554, thereby pushing the impactors 100, and thus the permeable media formed thereby, through the conduit 558 and into the flow region defined by the standpipe 504. As a result, the impactors 100 are substantially directly injected into the flow region defined by the standpipe 504. When the permeable media at least partially formed by the impactors 100 is at least partially positioned within the conduit 558, the permeable media reduces the pressure across at least a portion of the conduit 558, the valve 560 and the portion 554*a* of the conduit 554, from the relatively high pressure in the standpipe 504 to the relatively low pressure at the valve 556 and/or the interface between the piston 562 and the permeable media. As a result, the operations of the valves 560 and 556 and the piston 562 are facilitated. As another result, the operable lives of the valves 560 and 556 and the piston 562 are increased.

In an exemplary embodiment, during or after some or all of the impactors 100 that were initially in the portion 542*a* of the conduit 542 have been substantially directly injected into the standpipe 504, the piston 550 is retracted and moves away from valve 548, in response to hydraulic fluid being discharged from the portion 542*b* of the conduit 542. Before, during or after the retraction of the piston 550, the valve 548 is closed and the valve 544 is opened, thereby permitting additional impactors 100 to enter the portion 542*a* of the conduit 542. If at least some of the impactors 100 are still present in the conduit 546, the pressure drop from the standpipe 504 to the valve 548, which is primarily provided by the portion of the permeable media that is at least partially formed by the impactors 100 in the conduit 546, facilitates the closing of the valve 548. That is, the pressure at the valve 548 is less than the pressure in the standpipe 504, thereby permitting the valve 548 to close at a lower pressure. Similarly, if at least some of the impactors 100 are still present in the conduits 546 and/or 542, the pressure drop from the standpipe 504 to the valve 544, which is primarily provided by the permeable media at least partially formed by the impactors 100 in the conduits 546 and/or 542, facilitates the opening of the valve 544. That is, the pressure at the valve 544 is less than the pressure in the standpipe 504, thereby permitting the valve 544 to open at a lower pressure. In an exemplary embodiment, the conduit 546 is inclined, extending upwardly from the valve 560 to the standpipe 504, in order to promote the presence of at least some of the impactors 100 in the conduit 546, which facilitates the closing of the valve 548. In an exemplary embodiment, the conduit 558 is inclined, extending upwardly from the valve 560 to the standpipe 504, in order to promote the presence of at least some of the impactors 100 in the conduit 558, which facilitates the closing of the valve 560. In an exemplary embodiment, the conduit 546 includes a pea trap in order to promote the presence of at least some of the impactors 100 in the conduit 546, which facilitates the closing of the valve 548. In an exemplary embodiment, the conduit 558 includes a pea trap in order to promote the presence of at least some of the impactors 100 in the conduit 558, which facilitates the closing of the valve 560.

In an exemplary embodiment, the above-described operation of the system 552 is repeated, with the piston 550 operating to substantially directly inject the impactors 100 into the flow region defined by the standpipe 504 via the conduit 546, in the manner described above, during or after which the piston 562 operates to substantially directly inject the impactors 100 into the flow region defined the standpipe 504 via the conduit 558, in the manner described above.

In several exemplary embodiments, impactors 100 may simultaneously enter the portions 542*a* and 554*a* of the conduits 542 and 554, respectively. In several exemplary embodiments, impactors 100 may enter the portion 554*a* before and/or during the entrance of impactors 100 into the portion 542*a*, or vice versa. In several exemplary embodiments, the pistons 550 and 562 may be operated to simultaneously substantially directly inject the impactors 100 into the flow region defined by the standpipe 504. In several exemplary embodiments, the piston 562 may be operated to substantially directly inject the impactors 100 into the flow region defined by the standpipe 504 before and/or during the direct injection of the impactors 100 into the flow region defined by the standpipe 504 using the piston 550, or vice versa.

Figure 45:
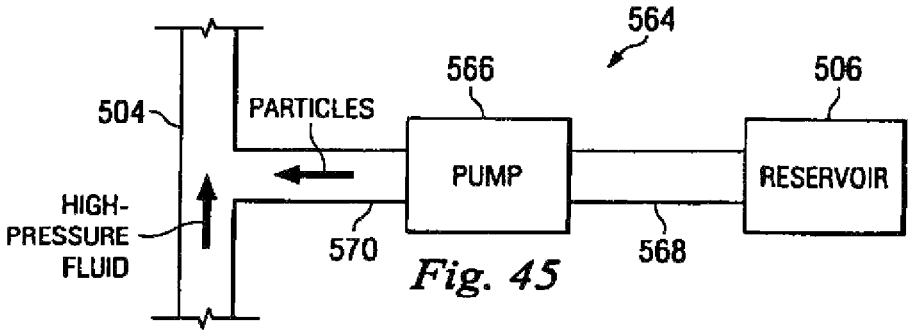
FIG. 45 is a schematic view of an injection system according to another embodiment.

In an exemplary embodiment, as illustrated in FIG. 45, an injection system is generally referred to by the reference numeral 564 and includes the reservoir 506 and a pump 566 fluidicly coupled thereto, which, in turn, is fluidicly coupled to the standpipe 504. A conduit 568 is fluidicly coupled between the reservoir 506 and the pump 566, and a conduit 570 is fluidicly coupled between the pump 566 and the standpipe 504.

In operation, the impactors 100 exit the reservoir 506, move through the conduit 568, and enter the pump 566, which pumps the impactors 100 into the flow region defined by the standpipe 504 via the conduit 570, thereby substantially directly injecting the impactors 100 into the flow region defined by the standpipe 504.

In an exemplary embodiment, and during the above-described operation of the system 564, the impactors 100 in the conduit 568, the pump 566 and the conduit 570 at least partially form a permeable media, which reduces the pressure across the conduit 570, the pump 566 and the conduit 568. As a result, the pump 566 is able to operate at lower pressure, thereby facilitating the operation of the pump 566 and the operable life of the pump 566.

In an exemplary embodiment, the pump 566 includes one or more concrete or slurry pumps. However, instead of pumping concrete, the pump 566 pumps the impactors 100, and any associated fluids, during the operation of the system 564, as described above.

In an exemplary embodiment, the pump 566 includes one or more concrete or slurry pumps manufactured by Schwing America Inc. of St. Paul, Minn. or Schwing Bioset, Inc. of Somerset, Wis. In an exemplary embodiment, the pump 566 includes one or more concrete pumps manufactured by Schwing America, Inc. of St. Paul, Minn., and at least one of the one or more concrete pumps includes a Rock Valve sequencing valve and/or a Big Rock Valve sequencing valve, which are manufactured by Schwing America, Inc. of St. Paul, Minn. Instead of pumping concrete, however, the pump 566 pumps the solid material impactors 100, and any associated fluids, during the operation of the system 564, as described above. In some exemplary embodiments, the concrete pump 566 can be used to pump dry particulate materials, and in other exemplary embodiments, the concrete pump 566 can be used to pump a slurry which may include particulate materials. In certain exemplary embodiments, the concrete pump 566 is used to introduce a particulate slurry into a wellbore.

Other pump manufacturers producing concrete or slurry pumps which may also be used to supply particulate material according to the present application include, but are not limited to, one or more of the pumps manufactured by any of the following manufactures: Putzmeister AG (Germany), Putzmeister America, Inc. (Sturtevant, Wis.); Multiquip/Mayco (Carson, Calif.); Reed Concrete Pumps (Chino, Calif.); Allentown Equipment (Allentown, Pa.) and Olin Engineering (CA). It is understood that other concrete and slurry pumps manufactured by other manufacturers not listed herein may also be used to pump particulate materials and slurries which include particulate materials. Exemplary concrete pumps may include one or more sequenced material cylinder for pumping particulate materials. Other exemplary pumps include any pump capable of taking a slurry at atmospheric pressure and discharging the slurry at a higher pressure. In certain exemplary embodiments, the cylinders may be hydraulically driven.

In an exemplary embodiment, the pump 566 includes one or more pumps and/or components thereof, and/or one or more hydraulic systems and/or components thereof, disclosed in U.S. Pat. Nos. 6,267,571 and/or 6,422,840, the disclosures of which are incorporated herein by reference in their entirety, with the outlet of at least one of the one or more pumps disclosed in U.S. Pat. Nos. 6,267,571 and/or 6,422,840 being fluidicly coupled to the standpipe 504. It is understood that other improvements and alterations may be made to the pumps suitable for use in the present invention, such as for example, those described in the following U.S. Pat. Nos. 4,392,510; 4,437,817; 4,465,441; 4,472,118; 4,556,370; 4,621,375; 4,681,022; 4,708,288; 4,852,467; 4,978,073; 5,066,203; 5,106,225; 5,106,272; 5,224,654; 5,257,912; 5,263,828; 5,281,113; 5,332,366; 5,346,368; 5,401,140; 5,479,957; 5,507,671; 5,557,526; 5,580,166; 5,638,967; 5,839,883; 6,202,013; 6,206,662; and 6,267,571, the disclosures of which are incorporated herein by reference in their entirety. Additionally, it is understood that catalogs and websites of Schwing, Schwing Bioset and Putzmeister, and other manufacturers of concrete and slurry pumps, may also include components which may augment and/or improve the performance of the process of injecting particulate material. Thus, the catalogs and websites of the above noted pump manufacturers are hereby incorporated herein by reference in their entirety.

In an exemplary embodiment, the pump 566 is a positive displacement concrete pump which includes a sequencing valve and at least one material cylinder. Preferably, the sequencing valve is selected from a Rock Valve or a Big Rock Valve, produced by Schwing America, or a Rock Valve produced by Schwing Bioset, Inc., or a like sequencing valve. Exemplary valves include those described in U.S. Pat. No. 6,450,779, which is incorporated herein by reference in its entirety. Other valves may also be employed to sequence between the intake and discharge of materials, such as for example, an S-tube valve, a C-tube valve, ball valves, or gate valves.

Figure 51:
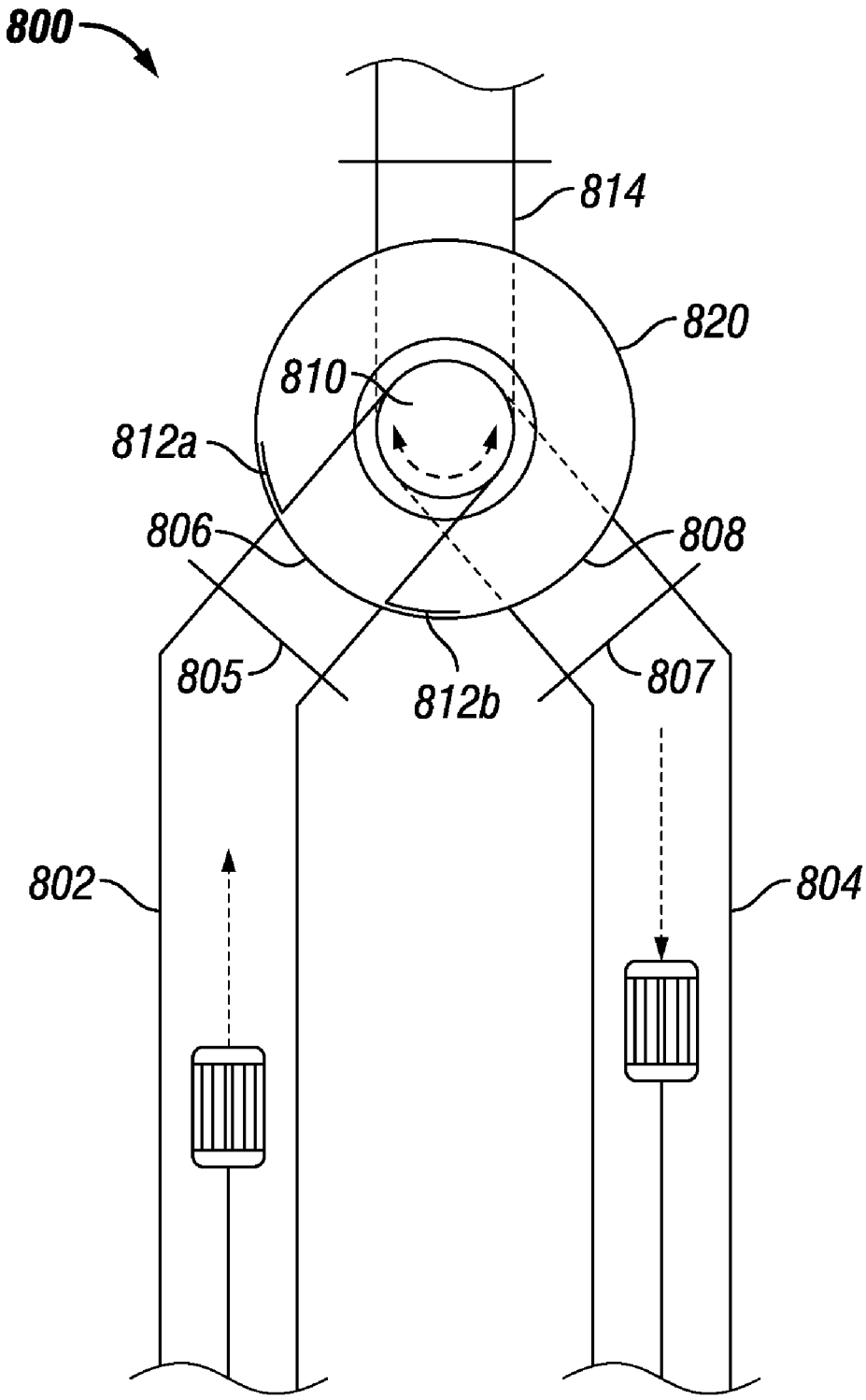
FIG. 51 is a sectional view of a sequencing valve for use with one or more of the embodiments of the present disclosure.

In an exemplary embodiment, as illustrated in FIG. 51, a valve system 800 is illustrated which is adapted to maintain a constant pressure during cycling between the intake and discharge steps of the first and second pump cylinders of a concrete pump. Valve system 800 is adapted to alternate between two feed sources, cylinders 802 and 804 respectively. As illustrated in FIG. 51, the first cylinder 802 is shown as the outlet cylinder and second cylinder 804 is shown as the inlet cylinder. The valve body 820 includes an inlet 810 which can be rotated between the first and second cylinder outlets, 805 and 808 respectively. In a first position, the valve inlet 810 is aligned with the outlet 805 of the first pump cylinder 802 and the corresponding port 806. The concrete, slurry, or other material is pumped out of cylinder 802, though the first cylinder outlet 805, and into port 806 in the sequencing valve. The material is pumped into the valve, and exits through the outlet 814. As the material is pumped out of the first cylinder, material is simultaneously introduced into the second cylinder 804. Upon completion of the pumping of the contents of the first cylinder 802, the valve inlet 810 rotates to facilitate the introduction of the material from the second cylinder 804. Valve inlet 810 aligns with the second cylinder outlet 807 and valve body port 808. After the contents of the second cylinder 804 have been pumped through the valve system 800, the valve inlet 810 rotates to again align with the first cylinder 802 and the process is repeated.

As shown in FIG. 51, the valve inlet 810 can include shoulders or wings 812*a* and 812*b* located on either side of the inlet 810. The shoulders or wings 812*a* and 812*b* are adapted to cover the inlet ports 806 and 808 of the valve system when the valve inlet 810 is rotated from the first cylinder 802 to the second cylinder 804. In one embodiment, the shoulders/wings 812*a* and 812*b* prevent a loss of pressure, thereby achieving constant pressure on the discharge outlet of the valve 814.

In an exemplary embodiment, a valve is described for use with a concrete pump having a single material cylinder. The valve can be adapted to maintain pressure in the cylinder between intake and discharge cycles. In an exemplary embodiment, the valve includes a wing or shoulder, similar to the wings or shoulders 812*a* and 812*b* shown in FIG. 51, positioned on either side of the inlet which is adapted to cover the cylinder and prevent a loss of pressure, thereby achieving constant pressure on the discharge outlet of the valve. This improvement may be incorporated to any conventional concrete pump, such as for example, the concrete pumps produced by, but not limited to, Schwing Bioset, Schwing and Putzmeister.

Figure 52A:
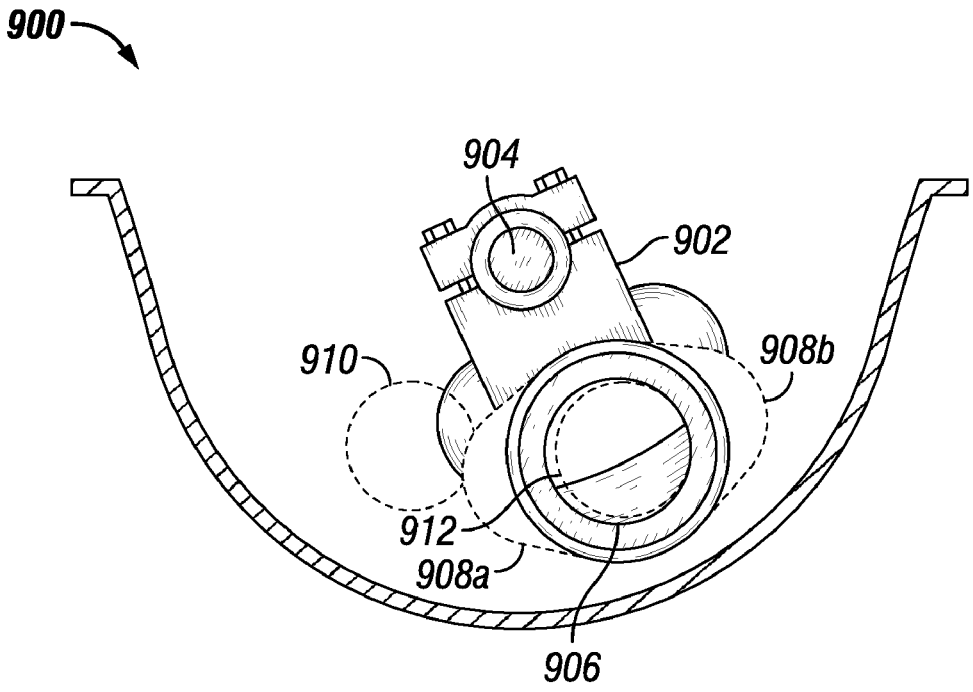
FIG. 52A is a sectional view of an alternate embodiment of a sequencing valve for use with one or more of the embodiments of the present disclosure.
Figure 52B:
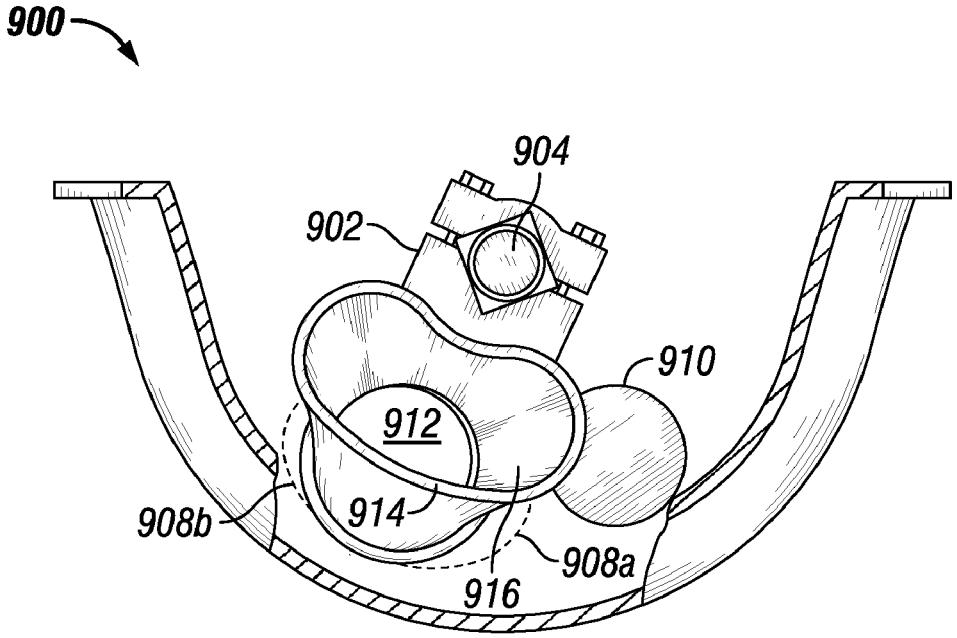
FIG. 52B is a sectional view of an alternate embodiment of a sequencing valve for use with one or more of the embodiments of the present disclosure.

In an exemplary embodiment, as illustrated in FIGS. 52A and 52B, another valve 900 is illustrated which is similarly adapted to maintain a constant pressure during cycling between the intake and discharge steps of a first and second cylinder. FIG. 52A is a sectional view of the inlet of the valve 900. The valve consists of a body 902 connected to a shaft 904, on which the body swings between the first and second cylinder outlets (shown with dashed lines as 910 and 912). The inlet 906 to the valve 900 is adapted to cycle between the outlet 910 of the first cylinder and the outlet 912 of the second cylinder. The valve may include a shoulder portion (shown with the dashed line as 908*a* and 908*b*) which extends outward from the portion of the valve body 900 surrounding the valve inlet 906. The shoulder portions 908*a* and 908*b* may be fashioned in different shapes and sizes to achieve the result of preventing a loss of pressure during cycling of the valve.

FIG. 52B is a sectional view of the outlet of the valve 900. The outlet 914 can be a variety of different shapes, as shown here the outlet has a kidney shape, allowing for simplified alignment with the outlet 916. As can been seen by the in the two figures, the cylinder outlets 910 and 912 are parallel to the valve outlet 916 but offset from it.

In an exemplary embodiment, the pump 566 includes one or more pumps such as for example, one or more solids pumps, cavity pumps, positive displacement pumps, progressive cavity pumps, auger pumps, Moineau pumps and/or any combination thereof. In several exemplary embodiments, one or more of the pumps that comprise the pump 566 are configured to pump dry or almost-dry solid material impactors. In several exemplary embodiments, one or more of the pumps that comprise the pump 566 are similar to pumps used to pump concrete, and/or to pump slurries. Examples of these types of pumps are manufactured by a variety of manufacturers, including but not limited to, Schwing Bioset, Schwing, and Putzmeister.

In an exemplary embodiment, impactors may be supplied to the concrete pump via means of a volumetric feeder. In another exemplary embodiment, impactors may be supplied to the concrete pump via means of a hopper. In another exemplary embodiment, impactors which are recovered from the wellbore are processed to remove drill cuttings, small particulate materials, and drilling fluids and may be then resupplied to the concrete pump 566.

In an exemplary embodiment, system 564, which may include concrete pump 566, may also include one or more abrasion resistant or longer-wear components, such as for example, non-hardened pipe, heat-treated pipe, abrasion resistant single wall pipe, and twin wall pipe, each of which may optionally include chrome carbide insert ends or chrome carbide liners. Similarly, system 564, which may include the concrete pump 566, may also include one or more ceramic, cast manganese or cast steel hardened elbow or bends having chrome carbide ends and/or chrome carbide lining. Exemplary systems 564 which employ concrete pumps for the injection of solid material impactors for drilling purposes, are particularly suited for the use of reinforced elbows, joints, pipes and other components. Exemplary abrasion resistant parts suitable for use for the present application include those manufactured by Schwing America, Inc., Schwing Bioset, Inc., and Construction Forms, Inc. of Port Washington, Wis.

In other exemplary embodiments, a wear ring can be included at the interface between piping components, such as between the standpipe and the elbow. Preferably, the wear ring is manufactured from a highly wear and abrasion resistant material. In certain exemplary embodiments, the material has a higher hardness than the particulate matter. In certain embodiments, the wear ring is a wearable surface which can resist chipping or cracking in a highly abrasive environments.

In an exemplary embodiment, the pump 566 may be connected to one or more hydraulic or manual diversion or shut-off valves which are designed for concrete pumping applications. In another exemplary embodiment, the pump 566 may be connected to one or more diversion or shut-off valves which are designed for high pressure applications. In another exemplary embodiment, the pump 566 may be connected to one or more diversion or shut-off valves which are designed for pumping highly abrasive slurries.

In certain exemplary embodiments, the valves associated with the concrete pump may be controlled by a computer. That is, a computer may be connected to the concrete pump to control the opening and shutting of various valves to ensure that solid material impactors are pumped at a constant and consistent pressure. An exemplary system for the control of valve system is described, for example, in U.S. Pat. No. 5,401,140, the disclosure of which is incorporated by reference in its entirety.

Figure 53:
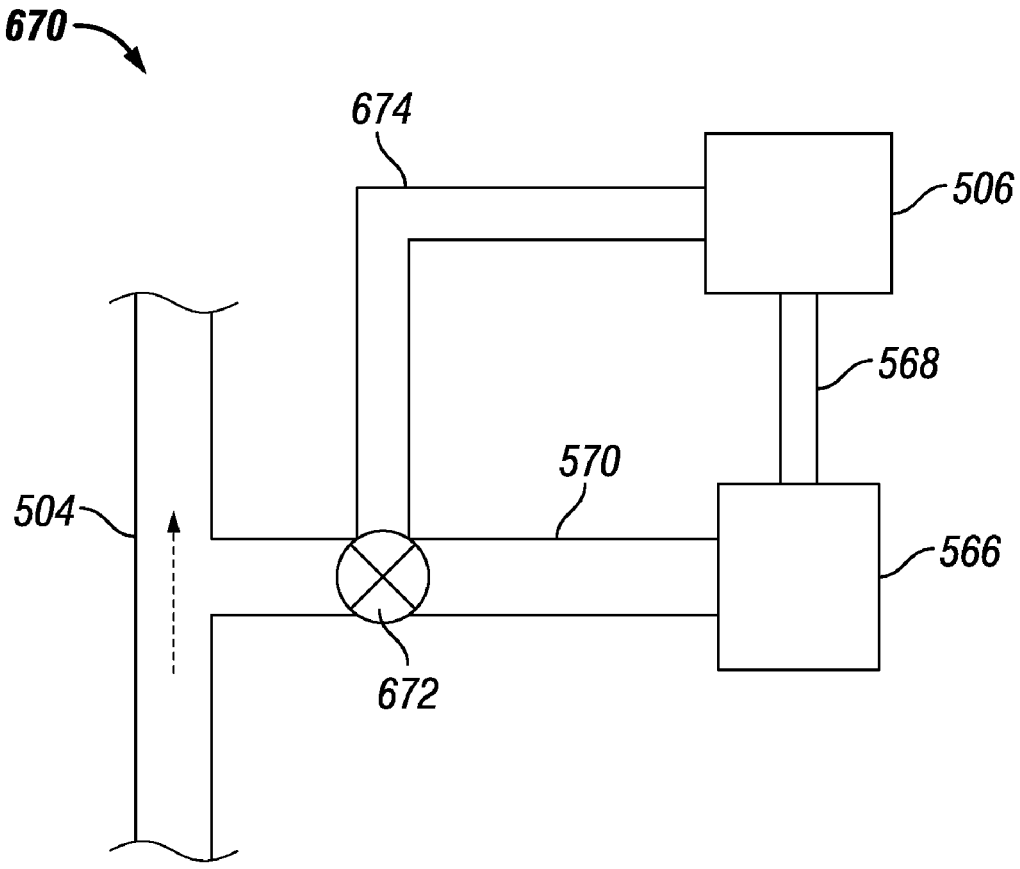
FIG. 53 is a schematic view of an injection system according to another embodiment.

In an exemplary embodiment, as illustrated in FIG. 53, the injection system 670 may include a concrete pump 566 which includes sequencing valve (not shown) selected from either a Rock Valve or a Big Rock Valve, produced by Schwing America, Inc., or a like valve. The injection system 670 may further include a diversion valve 672 connected to the pump 566 by pipe 570. The diversion valve 672 serves to delay the injection of the impactors 100 until the system is prepared to go "on-line." Diversion valve 672 diverts the steam of impactors via line 674 to the hopper 506, where the impactors may be resupplied to pump 566. Optionally, line 674 may supply a stream of impactors to a particle processing step. Thus, in one exemplary embodiment, the injection system is operated and a continuous stream of the impactors is held in a continuous loop, wherein the impactors are supplied to the pump, discharge from the pump and are diverted to the hopper or processing step, and resupplied to the pump. Once the operator is ready to bring the injection system 670 "on-line", the diversion valve may be operated to supply impactors to the standpipe 504. In an exemplary embodiment, a check valve is employed between the pump and the standpipe to maintain a steady pressure in the standpipe.

In exemplary embodiments, the concrete or slurry pump may operate at an output pressure of greater than 2000 psi, preferably greater than 2500 psi, more preferably greater than 3000 psi, and even more preferably greater than 4000 psi. Higher pressures likely lead to increased drilling capabilities and greater penetration of impactors.

In certain exemplary embodiments, the concrete or slurry pump preferably operates at an output pressure of between 1000 and 10,000 psi, more preferably between 2000 and 8000 psi, even more preferably at an output pressure between 3000 and 6000 psi, and most preferably at a pressures of at least approximately 3000 psi.

In an exemplary embodiment, the pump is a Schwing BP8800 concrete pump having which includes either a Rock Valve, a Big Rock Valve, or a similar functioning valve. In certain exemplary embodiments, the concrete pump may be modified so that the output pressure of the cylinder is approximately the same as the piston pressure. Such modifications may include, but are not limited to, decreasing the area of the cylinder, increasing the operating pressure, and/or increasing the piston size. In certain embodiments, the output horsepower of the engine associated with the concrete pump may be increased. In certain other embodiments, the rock valve may be modified to include wings or shoulder (as described herein) to maintain a constant output pressure and reduce a decrease in pressure between intake and discharge steps during pumping with the concrete pump. In certain embodiments, a check valve may also be employed with the rock valve and the wings/shoulders employed at the inlet of the valve.

Figure 46:
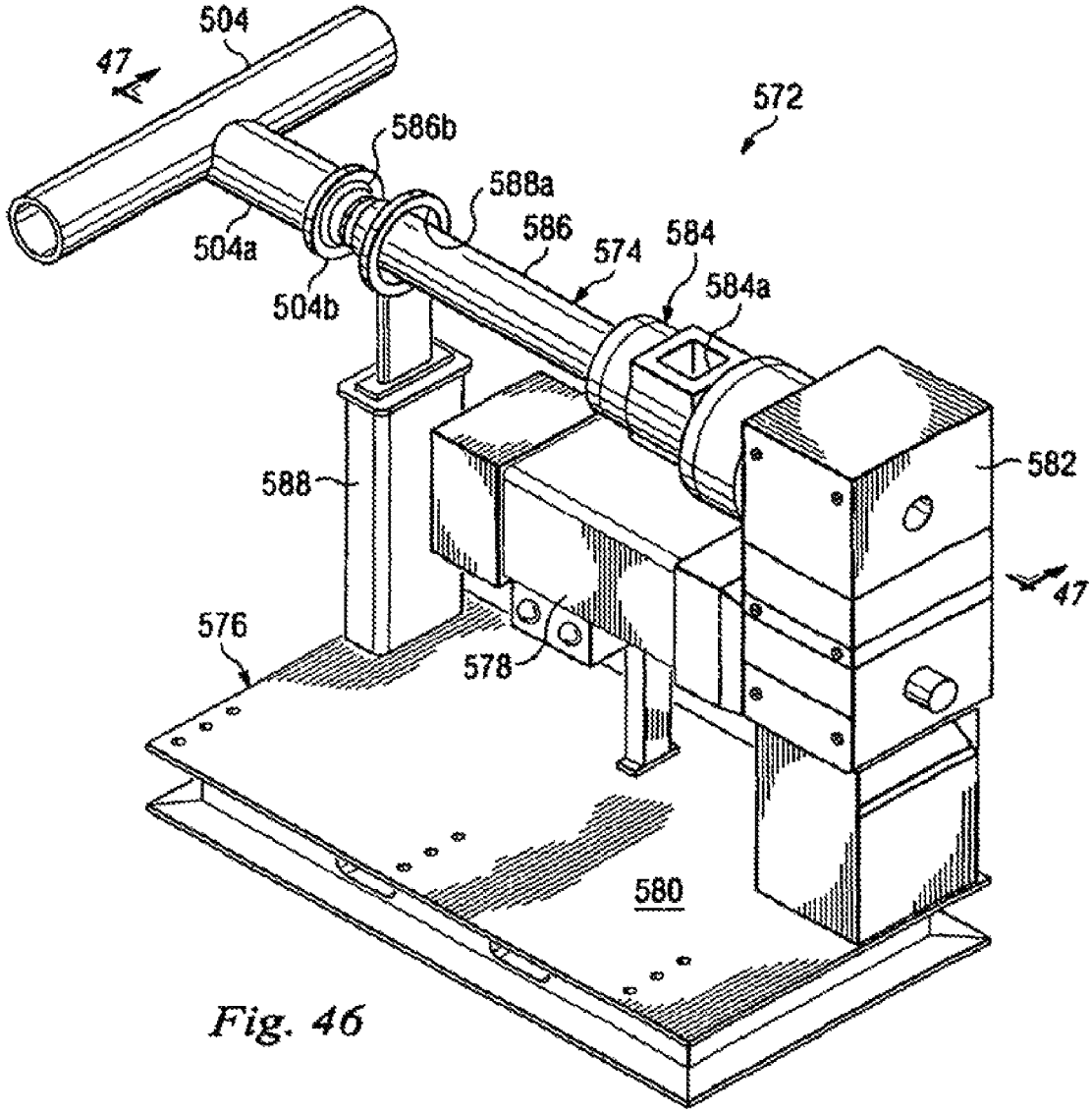
FIG. 46 is a perspective view of an injection system according to another embodiment.
Figure 47:
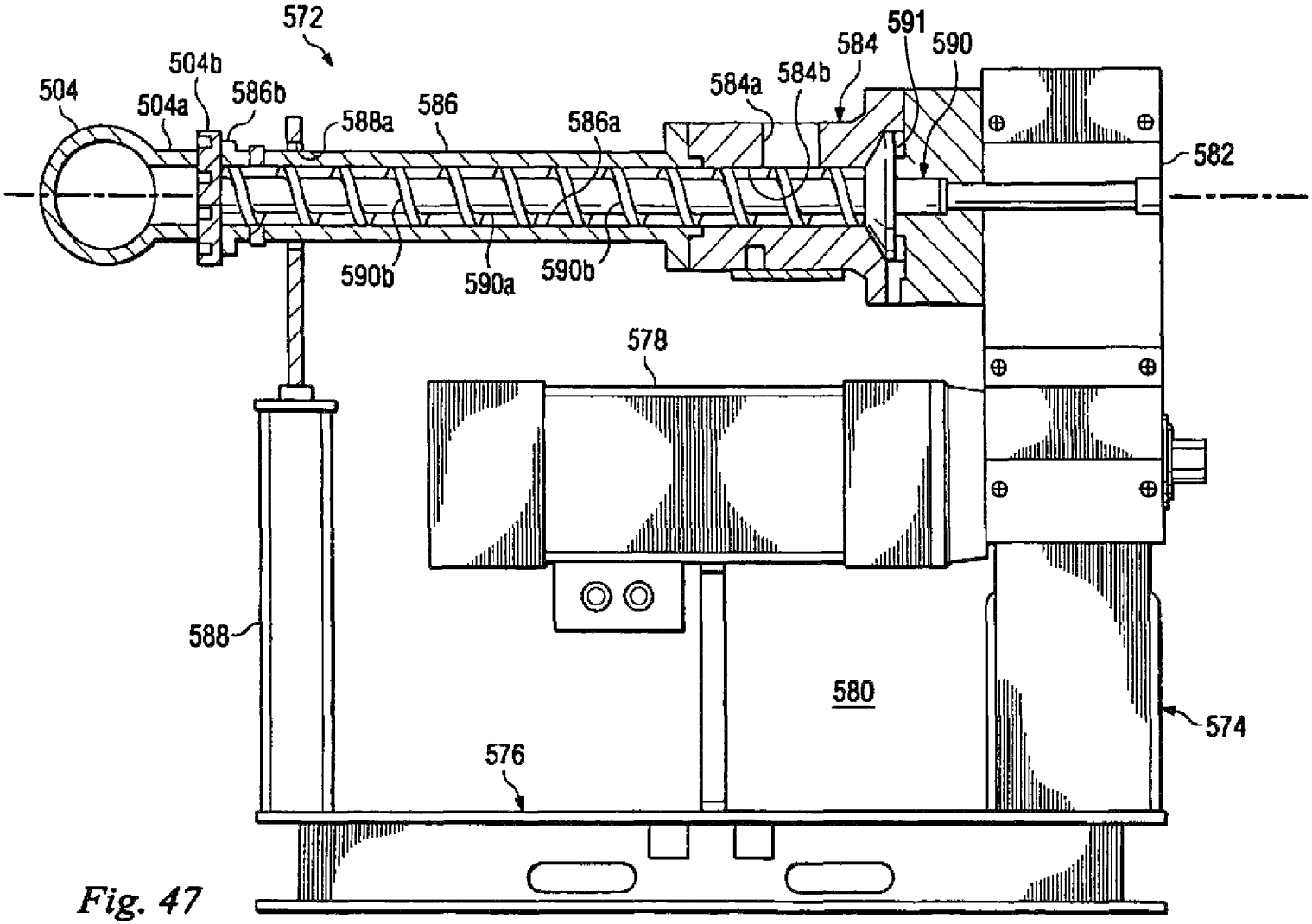
FIG. 47 is a partial elevational/partial sectional view of the injection system of FIG. 46.

In an exemplary embodiment, as illustrated in FIGS. 46 and 47, an injection system is generally referred to by the reference numeral 572 and includes an extruder 574 coupled to a port 504*a* of the standpipe 504.

In an exemplary embodiment, the extruder 574 includes a base 576 upon which a driver motor 578 is mounted. In an exemplary embodiment, the driver motor 578 comprises a 37 kW direct drive motor. In an exemplary embodiment, the drive motor 578 comprises a 50 horsepower AC explosion-proof motor. In an exemplary embodiment, the driver motor 578 comprises a variable-speed drive and controls mounted in an enclosure suitable for outdoor use. The base 576 further defines an area 580 in which control, electric and/or electronic components, and/or other types of components, may be mounted. A gearbox 582 is operably coupled to the motor 578. A feed housing 584 is coupled to the gearbox 582 and includes a an inlet 584*a* and a longitudinally-extending bore 584*b* fluidicly coupled thereto. The inlet 584*a* is adapted to be fluidicly coupled to one or more reservoirs such as, for example, the reservoir 506 and/or the hopper 510, neither of which is shown in FIGS. 46 and 47.

A barrel 586 is coupled to the feed housing 584 and includes a longitudinally-extending bore 586*a* that is axially aligned with, and fluidicly coupled to, the bore 584*b* of the feed housing 584. A flange connection 586*b* is positioned on an end of the barrel 586 and is coupled to a flange connection 504*b* at an end of the port 504*a* of the standpipe 504. A vertical support 588 extends upward from the base 576 and defines an opening 588*a* through which the barrel 586 extends. In an exemplary embodiment, instead of, or in addition to using the flange connections 586*b* and 504*b*, the barrel 586 may be coupled to the standpipe 504 using a wide variety of connections such as, for example, one or more threaded connections, one or more hammer union connections, and/or any combination thereof. In an exemplary embodiment, a hammer union connection may be installed between the flange connections 586*b* and 504*b*.

A screw feeder 590 includes a shaft 590*a* that extends through the bore 586*a* of the barrel 586, extends through the bore 584*b* of the feed housing 584, and is operably coupled to the gearbox 582, with the shaft 590*a* being operably coupled to the gearbox 582. An end of the shaft 590*a* is substantially aligned with the flange connection 586*b* of the barrel 586. A thread 590*b* extends about the shaft 590*a*, and extends longitudinally along the portion of the shaft 590*a* that extends within the bore 586*a* of the barrel 586, and at least along a portion of the shaft 590*a* that extends within the bore 584*b* of the feed housing 584. The thread 590*b* is configured to move materials in a direction from right to left, as viewed in FIG. 47, in response to the rotation of the shaft 590*a* about its longitudinal axis. In an exemplary embodiment, the thread 590*b* is formed integrally with the shaft 590*a* of the screw feeder 590. A bearing 591 is coupled to the shaft 590*a* and includes one or more sealing elements that fluidicly isolate the bore 584*b* from the gearbox 582. In an exemplary embodiment, the barrel 586 and the housing 584 are integral with each other. In an exemplary embodiment, the barrel 586 and the housing 584 are combined to form a single component of the extruder 574.

In operation, circulation fluid such as, for example, drilling mud, is withdrawn from the tank 6 (FIG. 1) and pumped by the pump 2 (FIG. 1), as described above. The fluid is pumped through the standpipe 504 before being pumped through the bit 60. The fluid is at a relatively high pressure within the standpipe 504. The inlet 584*a* of the feed housing 584 is at or substantially near atmospheric pressure.

Figure 48:
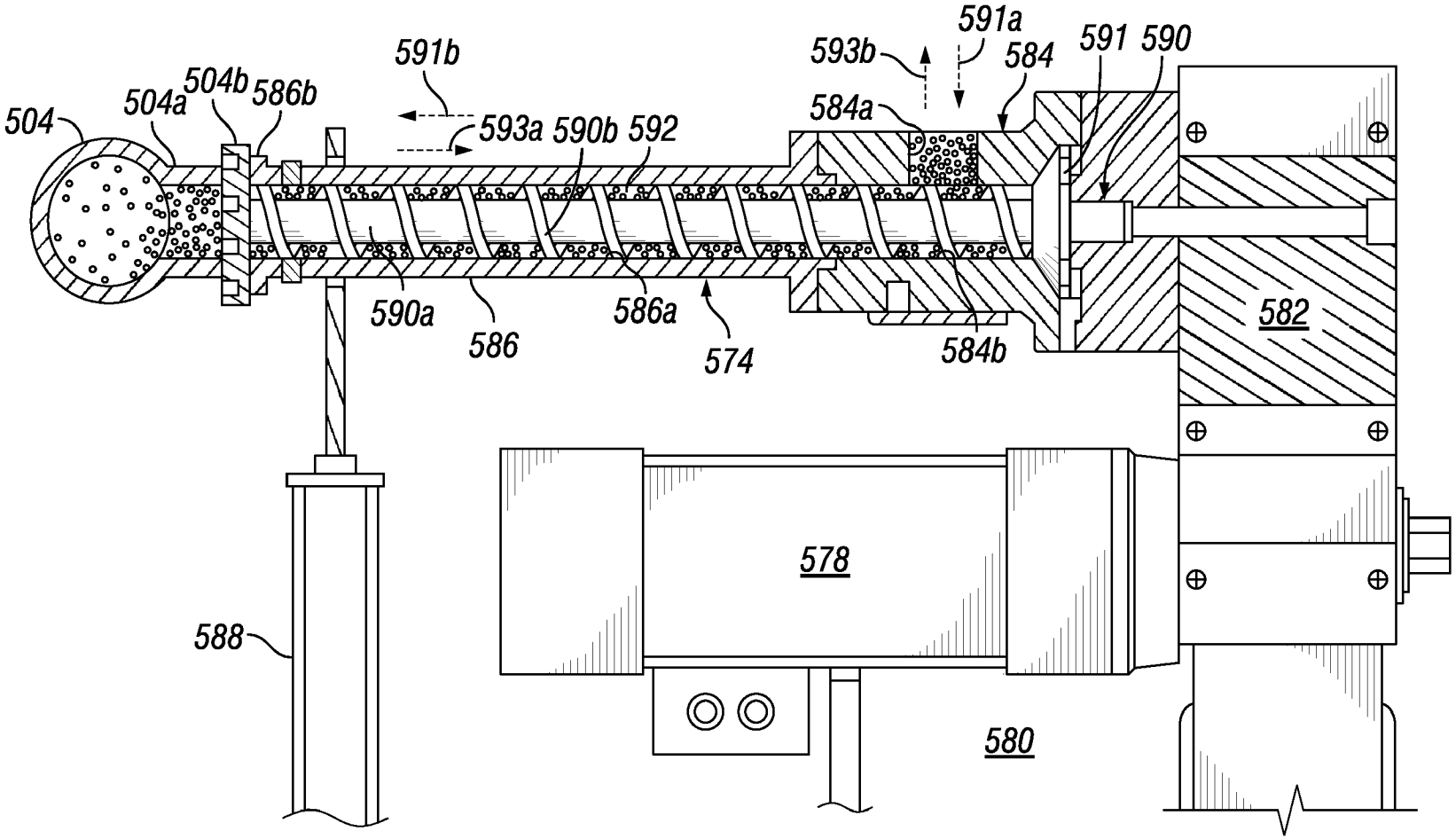
FIG. 48 is a view similar to that of FIG. 47, but depicting the injection system in another operational mode.

In an exemplary embodiment, as illustrated in FIG. 48, particles, such as a plurality of the solid material impactors 100, enter the bore 584*b* of the feed housing 584 via the inlet 584*a*, as indicated by an arrow 591*a*. The motor 578 operates, which, in turn, causes the gearbox 582 to operate, thereby causing the shaft 590*a* of the screw feeder 590 to rotate in place about its longitudinal axis. As a result of the rotation of the shaft 590*a*, the thread 590*b* moves the impactors 100 from right to left, as viewed in FIG. 48 and as indicated by an arrow 591*b*, away from the inlet 584*a* and towards the flange connection 586*b* of the barrel 586.

During the continued entrance of the impactors 100 into the bore 584*b* and the rotation of the shaft 590*a*, the impactors 100 are positioned between the shaft 590*a* and the inside surface of the barrel 586 defined by the bore 586*a* and along the length of the barrel 586, thereby forming a permeable media 592 having a control volume that extends substantially from the flange connection 586*b* of the barrel 586 and to at least the inlet 584*a* of the feed housing 584.

During the continued operation of the extruder 574, the thread 590*b* moves the impactors 100 out of the bore 586*b* of the barrel 586 and, via the port 504*a*, into the flow region defined by the standpipe 504. The impactors 100 mix with the high-velocity, high-pressure fluid flowing in the standpipe 504 to form a suspension of the impactors 100 and fluid, which subsequently flows to the drill bit 60 in order to excavate a subterranean formation, as described above.

The permeable media 592 operates to generally reduce the pressure across the port 504*a*, the barrel 586 and at least a portion of the feed housing 584, from the relatively high pressure in the flow region defined by the standpipe 504 to the relatively low pressure at the inlet 584*a*, thereby permitting the extruder 574 to inject the impactors 100 into the flow region defined by the standpipe 504 with less work, or power, than required if there was no such pressure reduction. The use of a control volume of the solid material impactors 100 to at least partially form the permeable media 592 permits the screw feeder 590 to operate at a substantially reduced pressure, rather than at the relatively high pressure in the flow region defined by the standpipe 504, thereby lowering the overall cost and/or complexity of the system 572. In an exemplary embodiment, the pressure in the flow region defined by the standpipe 504 during the operation of the system 572, including the operation of the extruder 574, is 5,000 psi. In an exemplary embodiment, the pressure in the flow region defined by the standpipe 504 during the operation of the system 572, including the operation of the extruder 574, is greater than 5,000 psi. In an exemplary embodiment, the pressure in the flow region defined by the standpipe 504 during the operation of the system 572, including the operation of the extruder 574, is less than 5,000 psi. In an exemplary embodiment, the pressure at the inlet 584*a* of the feed housing 584 is atmospheric pressure. In an exemplary embodiment, the pressure drop from the flow region defined by the standpipe 504 to the inlet 584*a* of the feed housing 584 is substantially equal to the difference between the pressure in the standpipe 504 and atmospheric pressure.

During the operation of the system 572, the high-pressure, high-velocity fluid in the flow region defined by the standpipe 504 operates to agitate and thus wash clean the flow region defined by the port 504*a* of the standpipe 504, and/or the end of the bore 586*a* at the flange connection 586*b*. In an exemplary embodiment, one or more orifices may be disposed in, for example, the flow region defined by the standpipe 504 and positioned, relative to the end of the port 504*a*, to create localized jets of fluid in the vicinity of the port 504*a* in order to further promote the agitation and self-cleaning of the port 504*a*.

During the operation of the system 572, and in several exemplary embodiments, the high-pressure, high velocity fluid flowing in the standpipe 504 may flow, or bleed, through the permeable media 592 at some bleed rate. More particularly, during the operation of the system 572 and as indicated by arrows 593*a* and 593*b* in FIG. 48, some of the circulation fluid flowing in the flow region defined by the standpipe 504 may flow, or bleed, through the port 504*a*, through the barrel 586, through at least a portion of the feed housing 584, through the inlet 584*a* of the feed housing 584, and into the reservoir 506, which, as described above, is fluidicly coupled to the inlet 584*a* of the feed housing 584.

In an exemplary embodiment, to negate the impact of gravity on the impactors 100 in the barrel 586 and/or the housing 584, which impact may create a bypass over, under and/or around the permeable media 592, the end of the barrel 586 proximate the flange connection 586*b*, may be placed at an elevated position with respect to the inlet 584*a*. In an exemplary embodiment, to negate the impact of gravity on the impactors 100 in the barrel 586 and/or the housing 584, which impact may create a bypass over, under and/or around the permeable media 592, the barrel 586 and/or the housing 584 may include a pea trap.

In an exemplary embodiment, one or more magnets are coupled to the outside surface of the barrel 586 and/or the housing 584, at one or more locations along the length of the barrel 586 and/or the housing 584, and the impactors 100 are at least partially composed of one or more ferritic materials. During the above-described operation of the extruder 574, the one or more magnets coupled to the outside surface of the barrel 586 and/or the housing 584 create one or more magnetic fields, which urge the impactors 100 against the inside surface of the barrel 586 and/or the inside surface of the housing 584, thereby creating drag. This drag provides opposing drag forces that resist the forces applied on the impactors 100 by the thread 590*b* of the screw feeder 590. As a result, the impactors 100 are thrust forward towards the standpipe 504, moving along the bores 584*b* and 586*a*. In an exemplary embodiment, a first pair of opposing magnets are coupled to a pair of opposing sides, respectively, of the outside surface of the barrel 586 at a particular axial location along the barrel 586, and a second pair of opposing magnets are coupled to another pair of opposing sides, respectively, of the outside surface of the barrel 586 at the same particular axial location along the barrel 586.

In several exemplary embodiments, the permeability of the permeable media 592 may be optimized. In several exemplary embodiments, the permeability of the permeable media 592 is optimized by adjusting the length and/or diameter of the bore 586*a* of the barrel 586. In several exemplary embodiments, the permeability of the permeable media 592 is optimized or enhanced by sizing the solid material impactors 100 so that all of the impactors 100 are approximately equal in size. To so size the solid material impactors 100, the solid material impactors 100 are filtered before entering the inlet 584*a* of the feed housing 584. As a result, foreign particles having effective diameters larger than the solid material impactors 100 are filtered out and prevented from entering the feed housing 584, thereby optimizing or enhancing the permeability of the permeable media 592 during the operation of the system 572. In an exemplary embodiment, one or magnets are used to separate the solid material impactors 100 from foreign, non-ferrous materials. As a result, the foreign, non-ferrous materials are generally filtered out and do not enter the inlet 584*a* of the feed housing 584, thereby optimizing or enhancing the permeability of the permeable media 592 during the operation of the system 572.

In several exemplary embodiments, in order to adjust and/or optimize the permeability of the permeable media 592, other secondary materials and/or particles may be mixed with the impactors 100 before, during or after the entry of the impactors 100 into the inlet 584*a*. In an exemplary embodiment, particles having effective diameters that are smaller than the solid material impactors 100 may be mixed with the impactors 100 prior to the entry of the impactors 100 into the feed housing 584.

In several exemplary embodiments, any one or more of the systems 500, 508, 522, 526, 530, 540, 552, 564 and/or 572 may be combined in whole or in part with any other of the systems 500, 508, 522, 526, 530, 540, 552, 564 and/or 572. In several exemplary embodiments, the systems 500, 508, 522, 526, 530, 540, 552, 564 and/or 572, and/or any components thereof, may be arranged horizontally, vertically or angularly, and/or in any combination thereof.

In several exemplary embodiments, instead of, or in addition to substantially directly injecting the solid material impactors 100, any one or more of the systems 500, 508, 522, 526, 530, 540, 552, 564 and/or 572, and/or any one or more components thereof, may inject other types of particles such as, for example, proppant materials including, for example, naturally occurring sand grains, and/or man-made or specially-engineered proppants such as, for example, resin-coated sand or high-strength ceramic materials such as sintered bauxite.

In several exemplary embodiments, the impactors 100 may include and/or be composed of any type of solid material in a wide variety of forms such as, for example, any type of solid pellets, shot or particles. In several exemplary embodiments, the type of liquid or fluid and/or the type of impactor used to form the above-described suspension may be dictated by the application for which one or more of the above-described injection systems are to be used.

In several exemplary embodiments, instead of, or in addition to substantially directly injecting particles into the flow region defined by the standpipe 504, any one or more of the systems 500, 508, 522, 526, 530, 540, 552, 564 and/or 572, and/or any one or more components thereof, may inject particles into other types of flow regions. For example, the systems 500, 508, 522, 526, 530, 540, 552, 564 and/or 572, and/or any one or more components thereof, may be used to inject particles into other flow regions such as, for example, into one or more fractures in one or more subterranean formations, and/or into one or more wellbores.

In several exemplary embodiments, and in addition to, or instead of injecting the impactors 100 into the flow region defined by the standpipe 504, one or more of the above-described injections systems, and/or any combination thereof, may be used to inject particles such as the impactors 100 into a wide variety of other flow regions defined by a wide variety of systems, vessels, pipelines, naturally-formed structures, man-made structures and/or components and/or subsystems thereof, to serve a wide variety of other purposes. Moreover, one or more of the above-described injections systems, and/or any combination thereof, may be used to inject particles such as the impactors 100 directly into the atmosphere and/or environment, and/or may be used in a wide variety of external applications such as, for example, cleaning applications, so that the flow region is considered to be the atmosphere or environmental surroundings.

In several exemplary embodiments, instead of, or in addition to substantially directly injecting the solid material impactors 100 into the flow region defined by the standpipe 504, any one or more of the systems 500, 508, 522, 526, 530, 540, 552, 564 and/or 572, and/or any one or more components thereof, may inject other types of particles into other types of flow regions. For example, the systems 500, 508, 522, 526, 530, 540, 552, 564 and/or 572, and/or any one or more components thereof, may be used to inject proppant materials including, for example, naturally occurring sand grains, and/or man-made or specially-engineered proppants such as, for example, resin-coated sand or high-strength ceramic materials such as sintered bauxite, into, for example, one or more fractures in one or more subterranean formations, and/or into one or more wellbores.

In several exemplary embodiments, any hydraulic fluid or other fluid described above and present in one or more of the above-described injection systems, and/or present in one or more components thereof, may be in a wide variety of fluidic forms such as, for example, oil, drilling fluid or mud, air and/or any combination thereof, and/or any type of conventional hydraulic fluid, and/or any other type of fluid, including any type of liquid or gas.

Figure 54A:
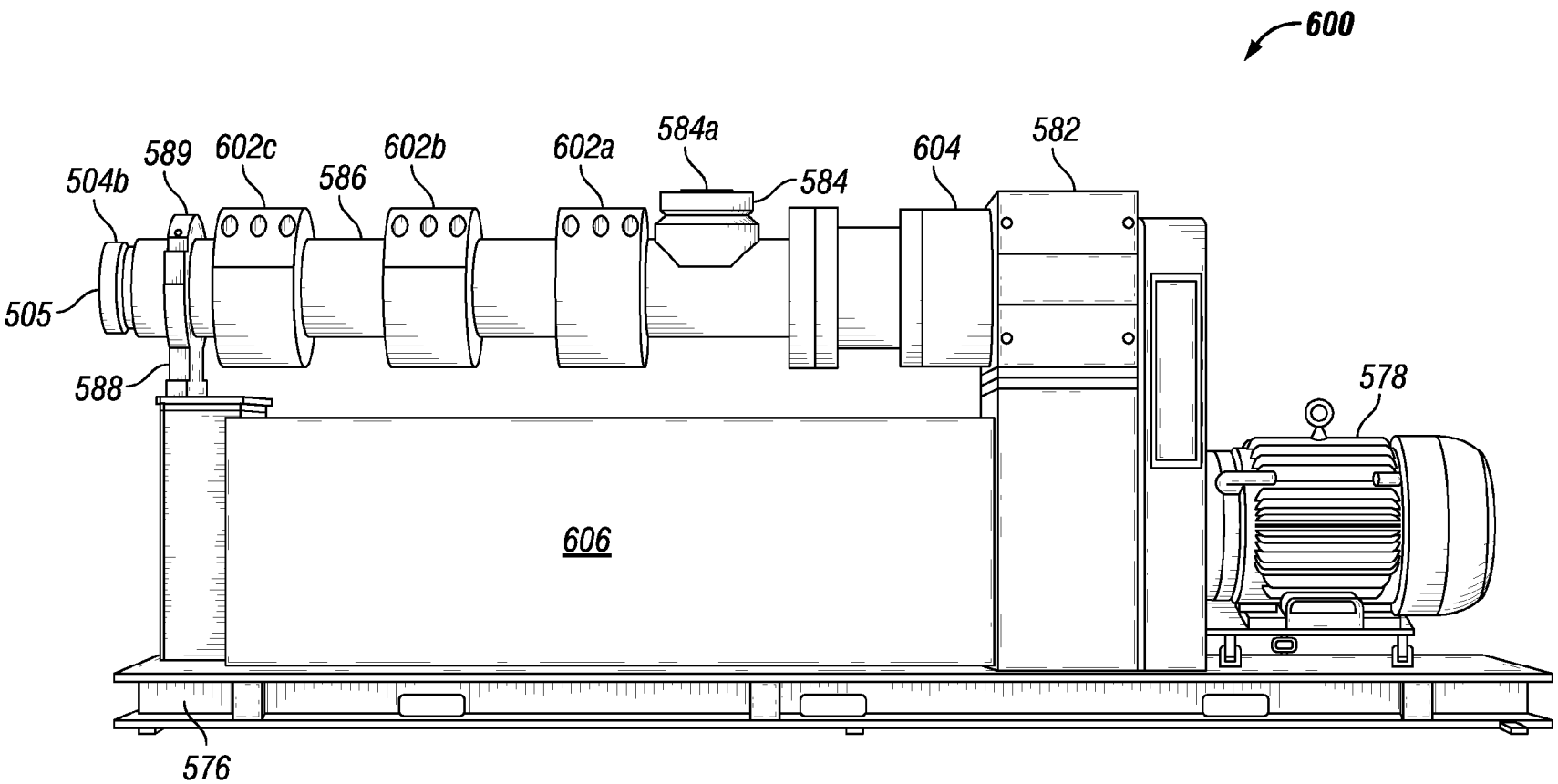
FIG. 54A is an elevational view of an injection system according to another embodiment.
Figure 54B:
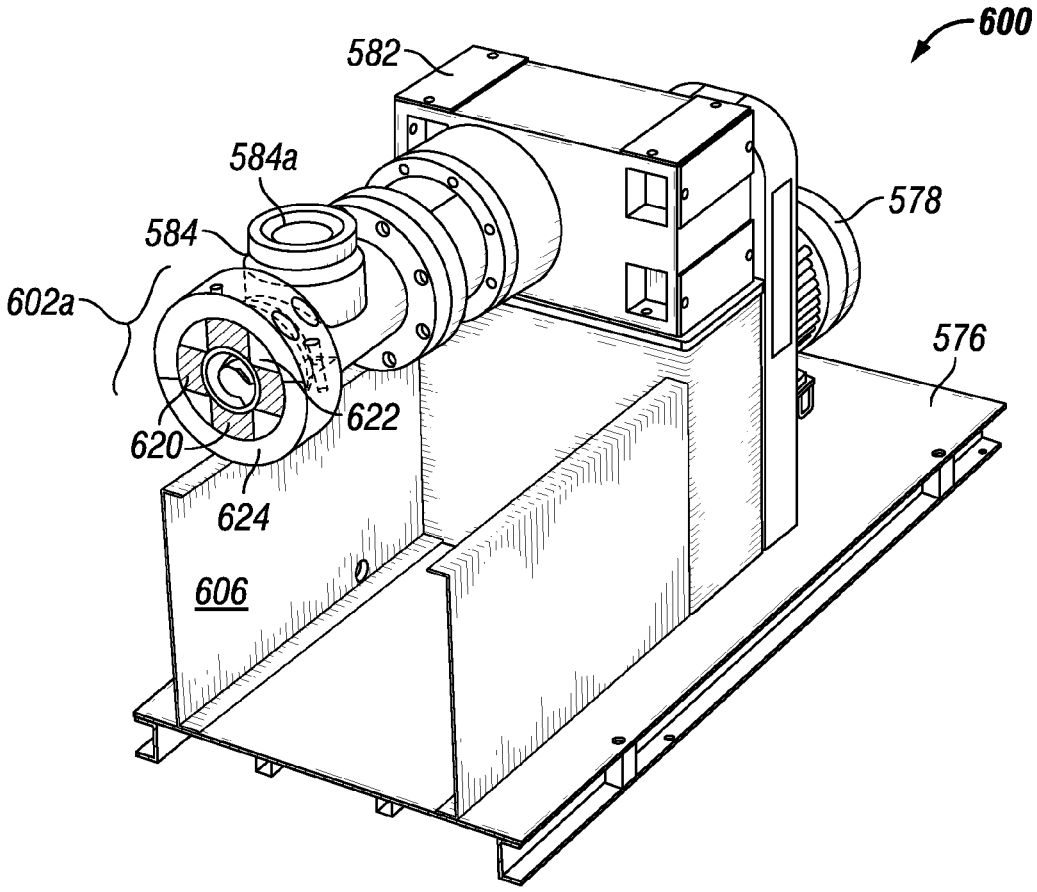
FIG. 54B is a partial sectional view of the barrel of the injection system according to another embodiment.

In an exemplary embodiment, as illustrated in FIGS. 54A and 54B, the extruder 600 may be provided with one or more magnetic circuits 602 to facilitate movement of ferrous particles. Extruder 600 can include a base 576 on which a motor 578 is mounted. Exemplary motors have been previously discussed herein. As also noted previously, the base 576 of the extruder 600 can define a space upon which a variety of control, electric, electronic and/or other associated components may be mounted or positioned. In an exemplary embodiment, as illustrated in FIGS. 54A and 54B, an overflow hopper 606 may be mounted on the base 576, below the barrel 586 of the extruder 600. One or more vertical supports 588 can be provided, preferably near the discharge end of the extruder 600, to support the barrel 586. Additionally, a centralizer or stabilizer 589 can be provided. The overflow hopper 606 is preferably positioned below the inlet of the extruder barrel 586, allowing solid and liquid contents which overflow from the hopper (not shown) during the introduction into the extruder inlet 584*a* to be collected and optionally recycled back to the process. Although not shown in FIGS. 54A and 54B, a hopper may also be positioned at inlet 584. Alternatively, impactors or an impactor slurry may be supplied to the extruder inlet 584 via a feed pipe. The various feed means can be connected to the barrel of the injection apparatus via a variety of methods, including a flange connection, or by welding. In an exemplary embodiment, the feed is supplied to the extruder at approximately atmospheric pressure.

The extruder motor 578 may optionally be mounted to the extruder base 576 and is operably coupled to a gear box 582, which includes a drive shaft coupled to the shaft of the extruder 600. The extruder 600 includes a barrel 586 which houses a shaft having a screw feeder. The barrel 586 may be coupled to the feed housing 584, which includes an inlet 584*a* for introduction of a plurality of particles, such as for example, solid material impactors, into the extruder barrel 586. The barrel 586 may be coupled to a drive shaft and the gear box 582 by a variety of means, including one or more flange connections. The flange connections may include a variety of sealing or packing means, such as for example, a gasket or o-ring.

In an exemplary embodiment, the discharge end 505 of the extruder barrel 586 may be attached to a stand pipe (not shown) and may be attached by known means in the art, such as for example, by threaded connection, by weld, or with a flange connection.

In an exemplary embodiment, at least one magnetic circuit 602 may be positioned about the exterior of the extruder barrel 586. As noted previously, the magnetic circuit 602 facilitates the movement of magnetic particles through the barrel 586. Although not wishing to be bound to any theory, it is believed that the presence of the magnetic circuits 602 about the circumference of the extruder barrel 586 assists in the magnetic particles completely filling the space between the blades of the extruder screw. One reason for this is that it is believed that the presence of the magnetic field helps to create a drag at the barrel wall which allows the impactors to fill the space from the bottom to the top of the extruder barrel. In addition, the use of the magnetic circuits may help to create a viscosity-like property in a solid particulate material, thereby allowing a slurry which doesn't have viscous drag to be thrust forward as is found in conventional plastics injection equipment. In other exemplary embodiments, two, three or more magnetic circuits 602 may be positioned about the exterior of the barrel 586, depending upon the overall length of the extruder barrel 586.

Figure 55:
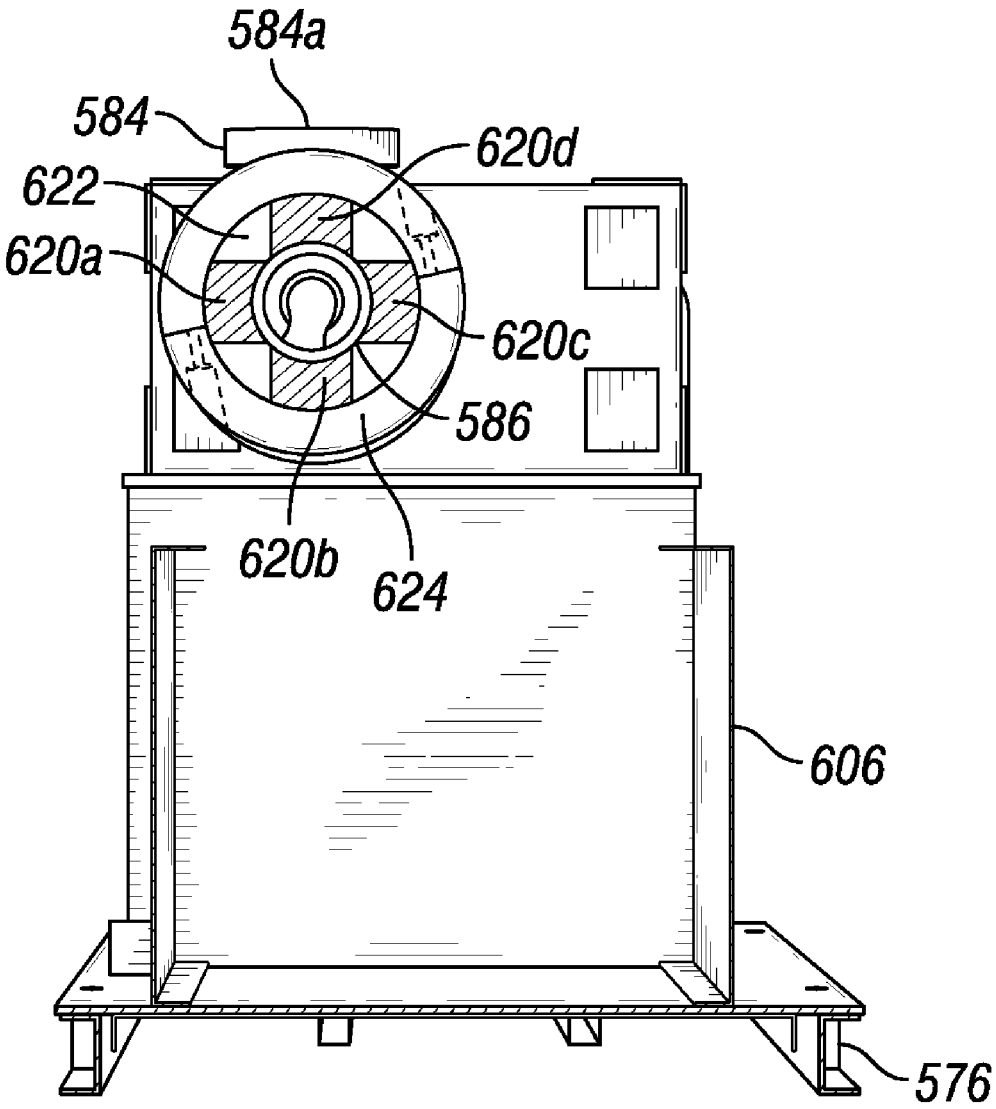
FIG. 55 is a sectional view of the barrel of the injection system according to another embodiment.

As illustrated in FIG. 55, in an exemplary embodiment, the magnetic circuit 602 can include a plurality of magnets 620 spaced about the exterior of the barrel 586. In an exemplary embodiment, as illustrated in FIG. 55, the magnetic circuit 602 can include four magnets, illustrated as 620*a*, 620*b*, 620*c* and 620*d*, equally spaced about the exterior of the barrel 586. In an exemplary embodiment, the magnets are from the "rare earth" magnet classification, and may formed from alloys of rare earth elements. In an exemplary embodiment, the magnets may include Neodimium-iron-boron magnets and which have a high flux density. In an exemplary embodiment, each of the magnets 620 are separated from each other by a non-ferrous magnetic barrier 622. Exemplary materials for the non-ferrous magnetic barriers include, but are not limited to, Austenitic stainless steel, brass, aluminum alloys, rubber, and the like. As is known in the art, the magnets are preferably positioned about the barrel having opposing poles proximate to the barrel, i.e., first magnet 620*a* has the north pole (positive) adjacent to the barrel, second magnet 620*b* is positioned having the south pole (negative) adjacent to the barrel, third magnet 620*c* is positioned having the north pole (positive) adjacent to the barrel, and fourth magnet 620*d* is positioned having the south pole (negative) adjacent to the barrel. This arrangement of magnets produces the desired magnetic circuit. A magnetic (ferrous) flux ring is 624 is secured about the plurality of magnets 620*a-d* and the non-magnetic barriers 622. Exemplary materials for the flux ring 624 are known in the art, including, but not limited to, ferromagnetic materials such as, for example, steel alloy or iron.

Figure 56:
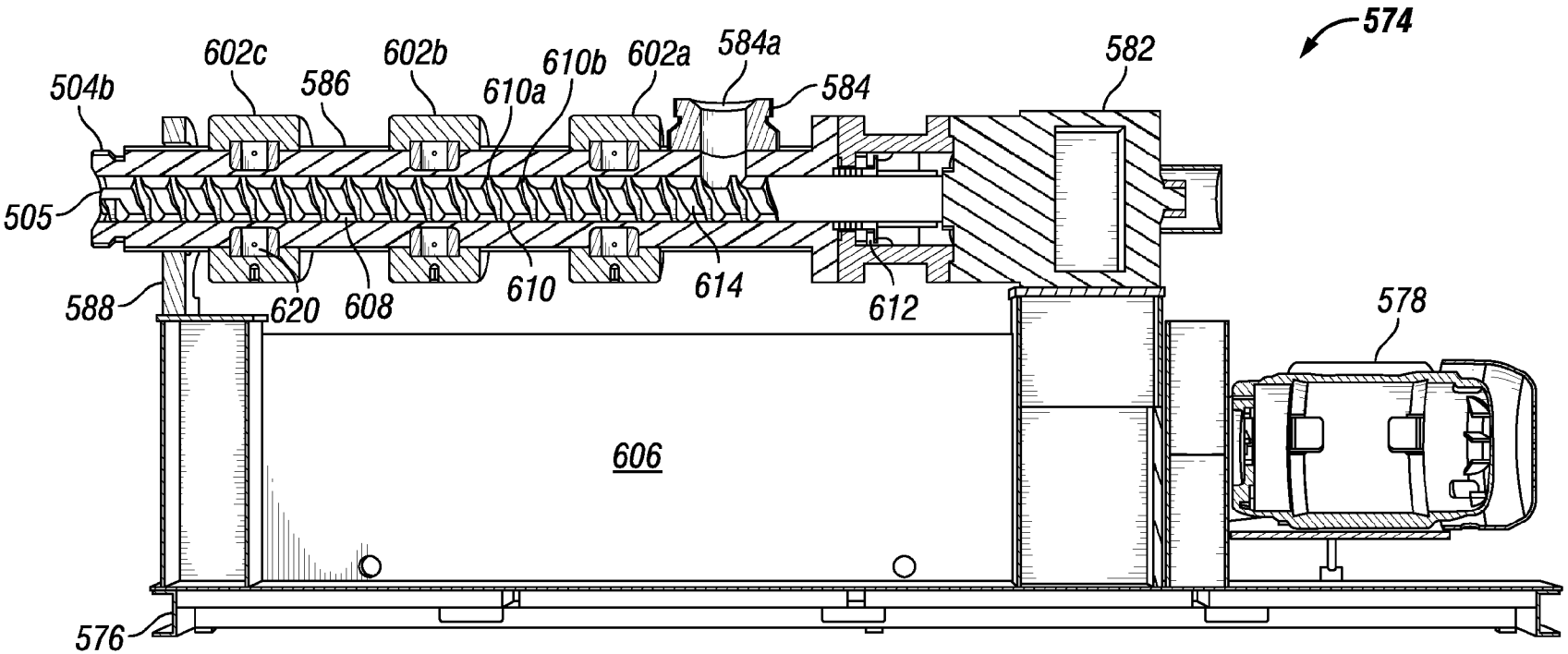
FIG. 56 is a sectional view of the barrel of the injection system according to another embodiment.

FIG. 56 illustrates the interior portion of an exemplary embodiment of the extruder 574. As shown in FIGS. 54A and 54B, a plurality of magnetic circuits 602 are shown positioned about barrel 586. In one embodiment, a first magnetic circuit 602*a* is shown positioned directly adjacent to and downstream of the inlet housing 584. The shaft of the extruder is positioned within the annulus of the barrel 586 and includes a plurality of threads 610 which extend from the bottom to the top of the interior of the barrel 586. The space located between adjacent threads 610 (specifically shown in FIG. 56 as 610*a* and 610*b*), provides a cavity 608, (also known as a flight), which can accommodate and move particles introduced at inlet housing 584 to the discharge end 505 of the extruder barrel 586. In an exemplary embodiment, a flange connection may connect the gearbox 582 and drive shaft housing 604 to the barrel 586. The flange connection may include seals or packing 612 which are designed to withstand high pressure conditions.

Figure 57:
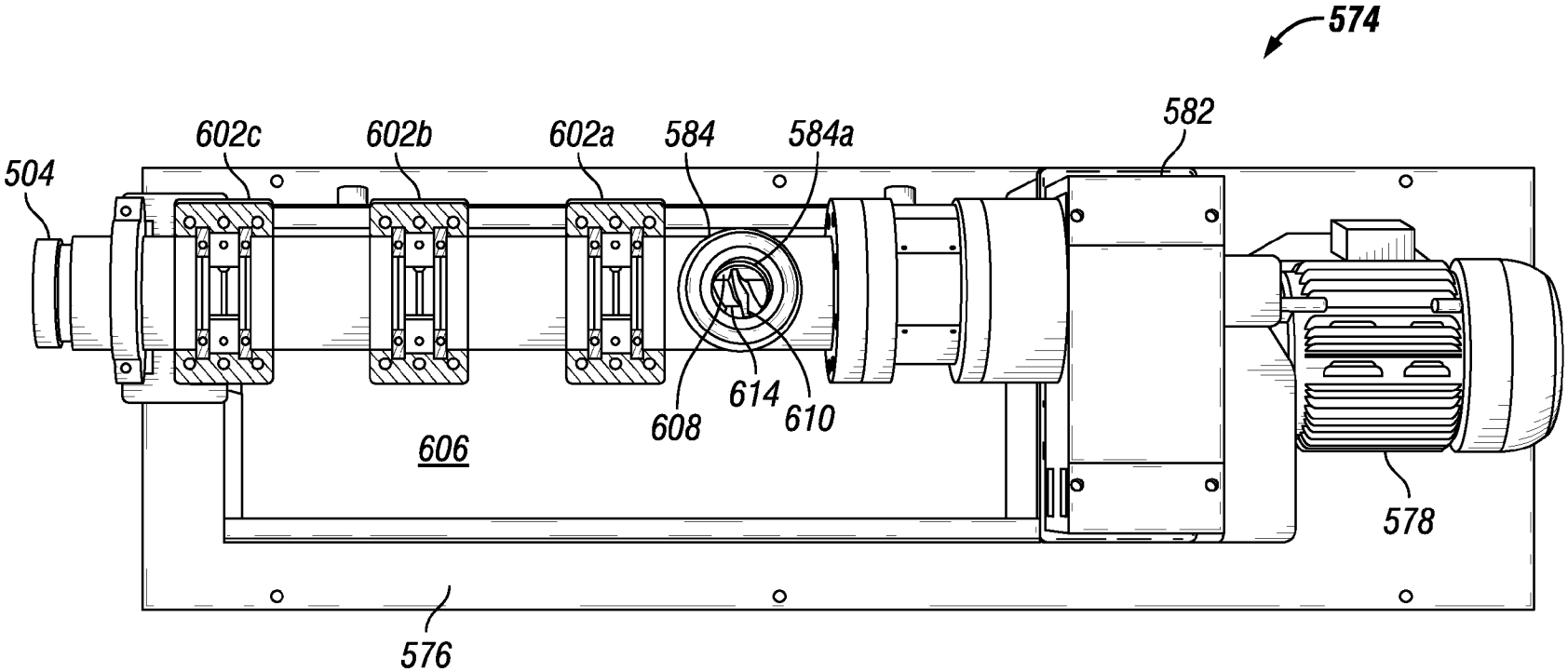
FIG. 57 is a top elevation view of the barrel of the injection system according to another embodiment.

A top view of an exemplary embodiment, as illustrated in FIG. 57, helps illustrate an exemplary arrangement of magnetic circuits 602 about the barrel 586 of the extruder. The extruder shaft is visible through the inlet 584*a*. Also visible are the threads 610 and a partial view of the cavity 608 provided between adjacent threads.

In certain embodiments, the core 614 of the extruder screw has a constant width throughout the length of the extruder barrel 586. In certain other embodiments, the core 614 of the screw shaft of the extruder is tapered such that the core of the shaft is thicker at the discharge end 505 of the extruder barrel 586 than at a point adjacent to the inlet 584 (i.e., the thickness of the screw shaft increases along the length of the barrel from the inlet end 584 to the discharge end 505). In certain other embodiments, the core 614 of the screw shaft of the extruder is tapered such that the core of the shaft has a smaller diameter at the discharge end 505 of the extruder barrel 586 than at a point adjacent to the inlet 584 (i.e., the thickness of the screw shaft decreases along the length of the barrel from the inlet end 584 to the discharge end 505).

In an exemplary embodiment, the extruder extrudes an impactor slurry at a pressure of at least 1000 psi. Generally, it is the fluid in the pipe, rather than the particles, which is the source of the pressure. In another exemplary embodiment, the extruder extrudes an impactor slurry at a pressure of at least 2000 psi. In yet another exemplary embodiment, the extruder extrudes an impactor slurry at a pressure of at least 3000 psi. In a preferred exemplary embodiment, the extruder extrudes an impactor slurry at a pressure of greater than 3000 psi, more preferably at a pressure greater than 4000 psi.

Figure 58:
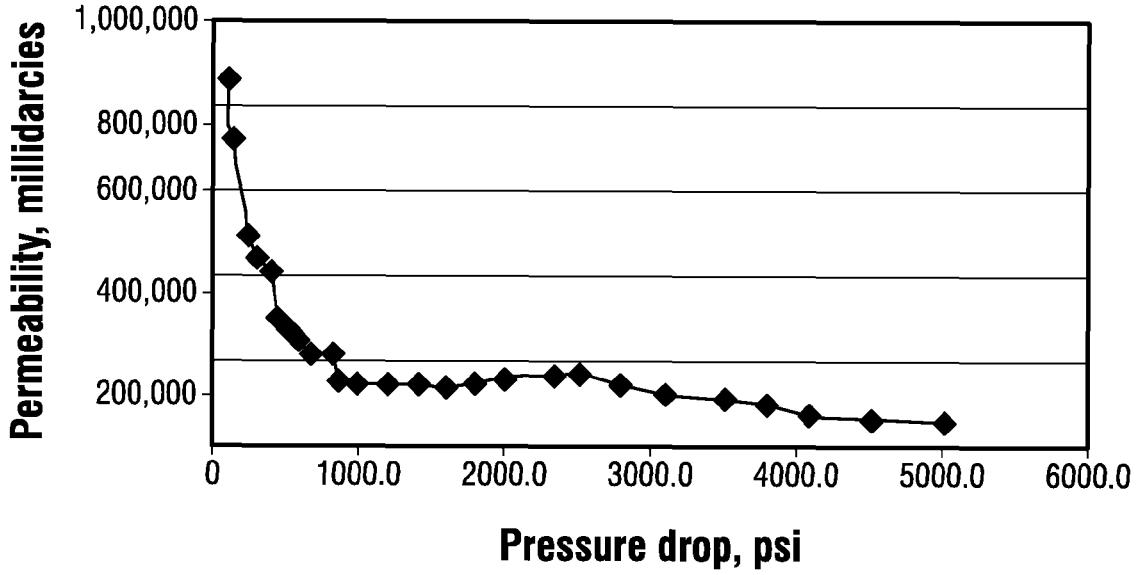
FIG. 58 is a graph depicting the relationship between the permeability and the standpipe pressure according to another embodiment.

In an exemplary embodiment, the extruder includes a plurality of magnets, preferably resulting in substantially denser packing of the impactors between the extruder screws. As shown in FIG. 58, as permeability decreases, pressure increases. Furthermore, as illustrated in FIG. 58, permeability decays rapidly to approximately 200,000 mD (milliDarcies) at a pressure within the extruder of approximately 800 psi, and a permeability of less than approximately 100,000 mD at a pressure of approximately 5000 psi, when tested in a static condition.

In an exemplary embodiment, air bubbles can be minimized in the feed supplied to the extruder. In an exemplary embodiment, the vibrators at the inlet eliminate the chance of bridging of the particles. In an exemplary embodiment, the feed pipe to the extruder may include vibratory means, adapted to prevent air bubbles present in the impactor/drilling fluid slurry from being introduced into the extruder. The vibratory means can include any known vibratory device, such as for example, a variable amplitude, variable frequency vibrator produced by Eriez Magnetics. Exemplary Eriez Magnetics vibrators include the Hi-Vi Electromagnetic vibrator.

In an exemplary embodiment, the extruder injects 10 gallons of impactors per minute (hereinafter, "gpm"). In another exemplary embodiments, the extruder injects 15 gpm. In an exemplary embodiment, the extruder injects at least 20 gpm, preferably at least 22.5 gpm and most preferably at least 25 gpm. In certain embodiments, the extruder injects at least 30 gpm. In certain embodiments, the extruder injects at least 40 gpm. In certain other embodiments, the extruder injects at least 50 gpm.

In the operation of extruder 600, circulation fluid such as, for example, drilling mud, is withdrawn from the tank 6 (FIG. 1) and pumped by the pump 2 (FIG. 1), as described above. The fluid is pumped through the standpipe 504 before being pumped through the bit 60. The fluid is at a relatively high pressure within the standpipe 504. The inlet 584*a* of the feed housing 584 is at or substantially near atmospheric pressure.

In an exemplary embodiment, particles 100, such as a plurality of the solid material magnetic impactors 100, enter the feed housing 584 via the inlet 584*a*. The motor 578 operates, which, in turn, causes the gearbox 582 to operate, thereby causing the shaft of the screw feeder to rotate in place about its longitudinal axis. As a result of the rotation of the shaft, the extruder screw thread moves the impactors 100 from right to left, as viewed in FIG. 54A, away from the inlet 584*a* and towards the discharge end 505 of the barrel 586.

During the continued entrance of the impactors 100 into the bore 584*b* and the rotation of the shaft, the impactors 100 are positioned between the shaft and the inside surface of the barrel 586 defined by the bore 586*a* and along the length of the barrel 586, thereby forming a permeable media having a control volume that extends substantially from the discharge end 505 of the barrel 586 and to at least the inlet 584*a* of the feed housing 584.

During the continued operation of the extruder 574, the screw thread moves the impactors 100 out of the bore 586*b* of the barrel 586 and, via the port 504*a*, into the flow region defined by the standpipe 504. The impactors 100 mix with the high-velocity, high-pressure fluid flowing in the standpipe 504 to form a suspension of the impactors 100 and fluid, which subsequently flows to the drill bit 60 in order to excavate a subterranean formation, as described above.

The permeable media 592 operates to generally reduce the pressure across the port 504*a*, the barrel 586 and at least a portion of the feed housing 584, from the relatively high pressure in the flow region defined by the standpipe 504 to the relatively low pressure at the inlet 584*a*. The extruder 574 injects the impactors 100 into the flow region defined by the standpipe 504 by rotating the shaft, as described above.

In an exemplary embodiment, the pressure in the flow region defined by the standpipe during the operation of the system 600 is 5,000 psi. In an exemplary embodiment, the pressure in the flow region defined by the standpipe during the operation of the system 600, including the operation of the extruder, is greater than 5,000 psi. In an exemplary embodiment, the pressure in the flow region defined by the standpipe during the operation of the system 600, including the operation of the extruder, is less than 5,000 psi. In an exemplary embodiment, the pressure at the inlet 584*a* of the feed housing 584 is atmospheric pressure. In an exemplary embodiment, the pressure drop from the flow region defined by the standpipe 504 to the inlet 584*a* of the feed housing 584 is substantially equal to the difference between the pressure in the standpipe and atmospheric pressure.

During the operation of the system 600, the high-pressure, high-velocity fluid in the flow region defined by the standpipe operates to agitate and thus wash clean the flow region defined by the port 504*a* of the standpipe 504, and/or the discharge end 505 of the barrel 586. In an exemplary embodiment, one or more orifices may be disposed in, for example, the flow region defined by the standpipe and positioned, relative to the discharge end 505, to create localized jets of fluid in the vicinity of the port 504*a* in order to further promote the agitation and self-cleaning.

In an exemplary embodiment, to negate the impact of gravity on the impactors 100 in the barrel 586 and/or the housing 584, which impact may create a bypass over, under and/or around the permeable media, the end of the barrel 586 proximate the flange connection 586*b*, may be placed at an elevated position with respect to the inlet 584*a*. In an exemplary embodiment, to negate the impact of gravity on the impactors 100 in the barrel 586 and/or the housing 584, which impact may create a bypass over, under and/or around the permeable media 592, the barrel 586 and/or the housing 584 may include a pea trap.

Figure 59:
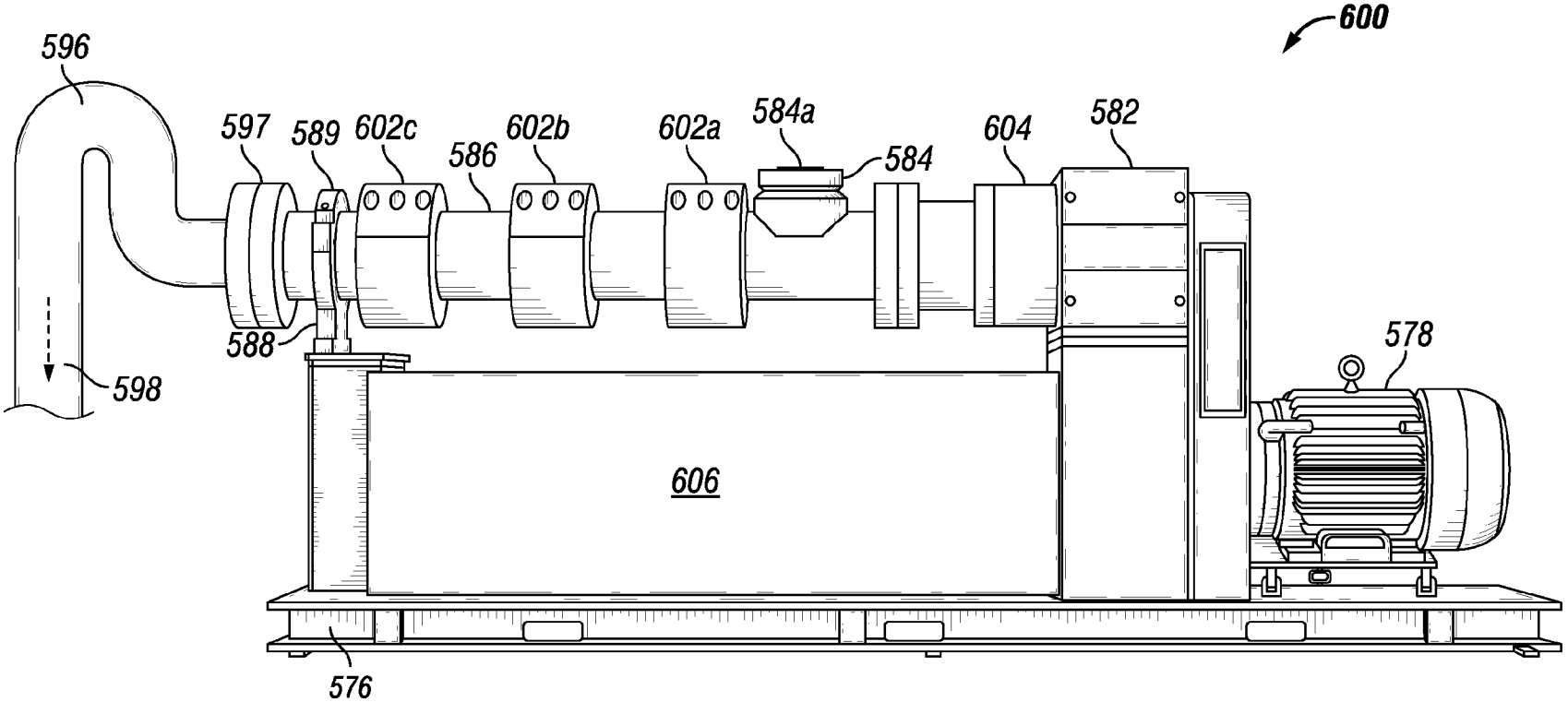
FIG. 59 is an elevational view according to another embodiment.

FIG. 59 illustrates the use of a pea trap 596 at the outlet of the extruder. The pea trap 596 may be connected to the discharge 505 of the extruder barrel 586 by means of a weld, flange (597, shown here), or other known connection. The pea trap discharge 598 may be connected directly to the stand pipe (not shown), by known means, such as for example, a weld or flange connection.

One or more magnetic circuits 602 may be coupled to the outside surface of the barrel 586 and/or the housing 584, at one or more locations along the length of the barrel 586. During the above-described operation of the extruder 574, the one or more magnetic circuits 602 coupled to the outside surface of the barrel 586 and/or the housing 584 create one or more magnetic fields, which urge the impactors 100 against the inside surface of the barrel 586 and/or the inside surface of the housing 584, thereby creating drag. This drag provides opposing drag forces that resist the forces applied on the impactors 100 by the thread 590*b* of the screw feeder 590. As a result, the impactors 100 are thrust forward towards the standpipe 504. In an exemplary embodiment, a first magnetic circuit 602*a* is coupled to the outside surface of the barrel 586 at a particular axial location along the barrel 586, and a second magnetic circuit 602*b* is coupled to the outside surface of the barrel 586 at an axial location along the barrel 586 downstream from the first magnetic circuit 602*a*. The drag force can be reduced by selecting particles which are more generally round and likewise, the drag force can be increased by introducing more irregular particles. We will be testing this in the weeks to come, but samples indicate this is true. We have seen that the barrel, when honed allows the shot to be pushed a lot further.

In several exemplary embodiments, the permeability of the permeable media 592 may be optimized. In several exemplary embodiments, the permeability of the permeable media 592 is optimized by adjusting the length and/or diameter of the bore 586*a* of the barrel 586. In several exemplary embodiments, the permeability of the permeable media 592 is optimized or enhanced by sizing the solid material impactors 100 so that all of the impactors 100 are approximately equal in size. To so size the solid material impactors 100, the solid material impactors 100 are filtered before entering the inlet 584*a* of the feed housing 584. As a result, foreign particles having effective diameters larger than the solid material impactors 100 are filtered out and prevented from entering the feed housing 584, thereby optimizing or enhancing the permeability of the permeable media 592 during the operation of the system 572. In an exemplary embodiment, one or magnets are used to separate the solid material impactors 100 from foreign, non-ferrous materials. As a result, the foreign, non-ferrous materials are generally filtered out and do not enter the inlet 584*a* of the feed housing 584, thereby optimizing or enhancing the permeability of the permeable media 592 during the operation of the system 572.

In several exemplary embodiments, in order to adjust and/or optimize the permeability of the permeable media 592, other secondary materials and/or particles may be mixed with the impactors 100 before, during or after the entry of the impactors 100 into the inlet 584*a*. In an exemplary embodiment, particles having effective diameters that are smaller than the solid material impactors 100 may be mixed with the impactors 100 prior to the entry of the impactors 100 into the feed housing 584.

In several exemplary embodiments, any one or more of the systems 500, 508, 522, 526, 530, 540, 552, 564, 572, 600 and/or 800 may be combined in whole or in part with any other of the systems 500, 508, 522, 526, 530, 540, 552, 564, 572, 600 and/or 800. In several exemplary embodiments, the systems 500, 508, 522, 526, 530, 540, 552, 564, 572, 600 and/or 800, and/or any components thereof, may be arranged horizontally, vertically or angularly, and/or in any combination thereof.

In several exemplary embodiments, instead of, or in addition to substantially directly injecting the solid material impactors 100, any one or more of the systems 500, 508, 522, 526, 530, 540, 552, 564, 572, 600 and/or 800, and/or any one or more components thereof, may inject other types of particles such as, for example, proppant materials including, for example, naturally occurring sand grains, and/or man-made or specially-engineered proppants such as, for example, resin-coated sand or high-strength ceramic materials such as sintered bauxite. In certain embodiments, materials may be included with the solid material impactors which can increase permeability of the slurry. In alternate embodiments, materials may be include with the solid material impactors which decrease the permeability of the slurry.

In several exemplary embodiments, the impactors 100 may include and/or be composed of any type of solid material in a wide variety of forms such as, for example, any type of solid pellets, shot or particles. In several exemplary embodiments, the type of liquid or fluid and/or the type of impactor used to form the above-described suspension may be dictated by the application for which one or more of the above-described injection systems are to be used.

In several exemplary embodiments, instead of, or in addition to substantially directly injecting particles into the flow region defined by the standpipe 504, any one or more of the systems 500, 508, 522, 526, 530, 540, 552, 564, 572, 600 and/or 800, and/or any one or more components thereof, may inject particles into other types of flow regions. For example, the systems 500, 508, 522, 526, 530, 540, 552, 564, 572, 600 and/or 800, and/or any one or more components thereof, may be used to inject particles into other flow regions such as, for example, into one or more fractures in one or more subterranean formations, and/or into one or more wellbores.

In several exemplary embodiments, and in addition to, or instead of injecting the impactors 100 into the flow region defined by the standpipe 504, one or more of the above-described injections systems, and/or any combination thereof, may be used to inject particles such as the impactors 100 into a wide variety of other flow regions defined by a wide variety of systems, vessels, pipelines, naturally-formed structures, man-made structures and/or components and/or subsystems thereof, to serve a wide variety of other purposes. Moreover, one or more of the above-described injections systems, and/or any combination thereof, may be used to inject any particulate matter, such as for example impactors 100, directly into the atmosphere and/or environment, and/or may be used in a wide variety of external applications such as, for example, cleaning applications, so that the flow region is considered to be the atmosphere or environmental surroundings.

In several exemplary embodiments, instead of, or in addition to substantially directly injecting the solid material impactors 100 into the flow region defined by the standpipe 504, any one or more of the systems 500, 508, 522, 526, 530, 540, 552, 564, 572, 600 and/or 800, and/or any one or more components thereof, may inject other types of particles into other types of flow regions. For example, the systems 500, 508, 522, 526, 530, 540, 552, 564, 572, 600 and/or 800, and/or any one or more components thereof, may be used to inject proppant materials including, for example, naturally occurring sand grains, and/or man-made or specially-engineered proppants such as, for example, resin-coated sand or high-strength ceramic materials such as sintered bauxite, into, for example, one or more fractures in one or more subterranean formations, and/or into one or more wellbores.

In several exemplary embodiments, any hydraulic fluid or other fluid described above and present in one or more of the above-described injection systems, and/or present in one or more components thereof, may be in a wide variety of fluidic forms such as, for example, oil, drilling fluid or mud, air and/or any combination thereof, and/or any type of conventional hydraulic fluid, and/or any other type of fluid, including any type of liquid or gas. In certain other exemplary embodiments, additional materials may be added to the particulate slurry to optimize performance. In certain embodiments, the additional material can include particles designed to decrease the permeability of the particulate slurry or fluids designed to increase the viscosity of the fluid in the pore space in the injector.

Figure 60:
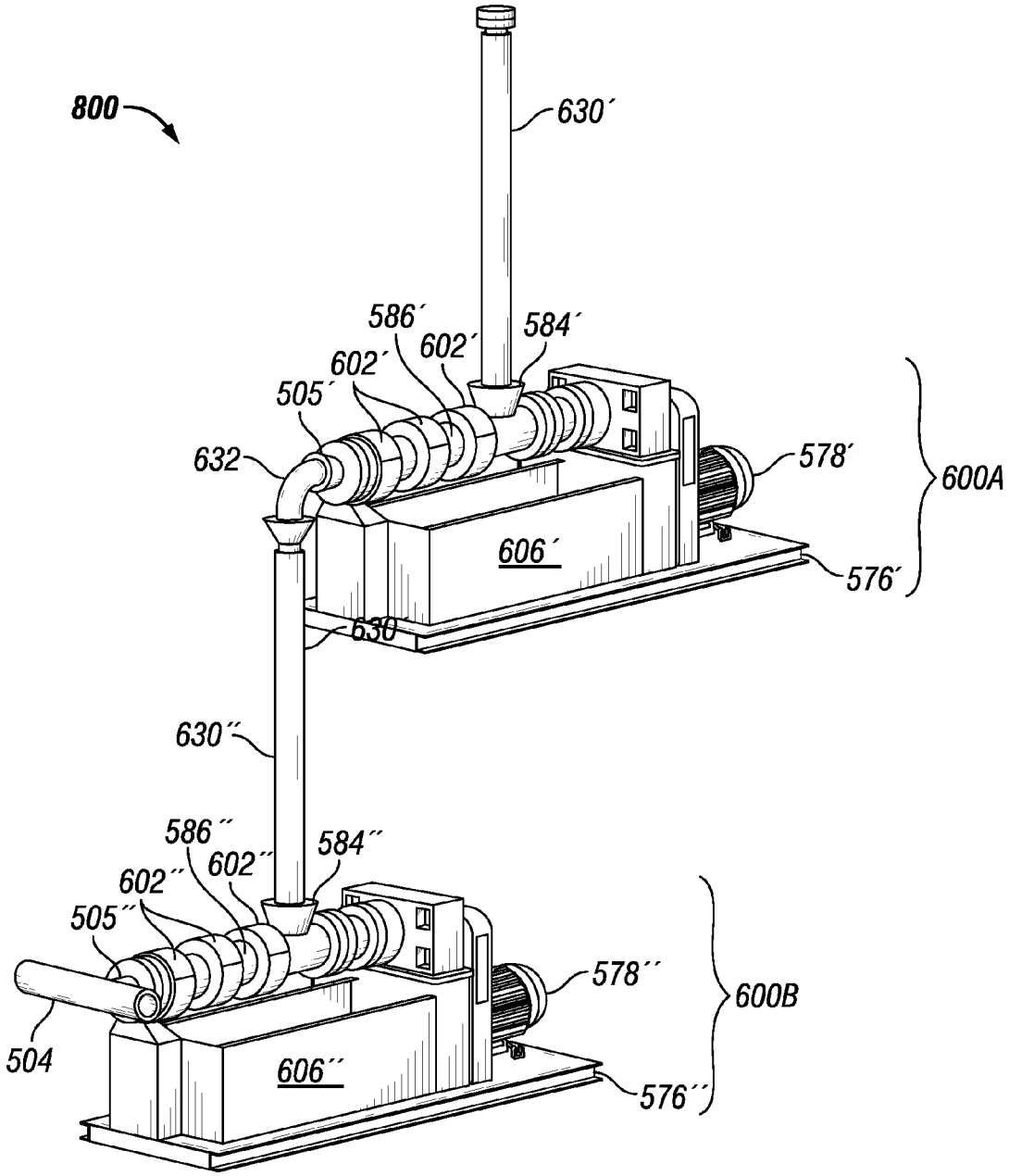
FIG. 60 is a partial elevational view according to another embodiment.
Figure 61:
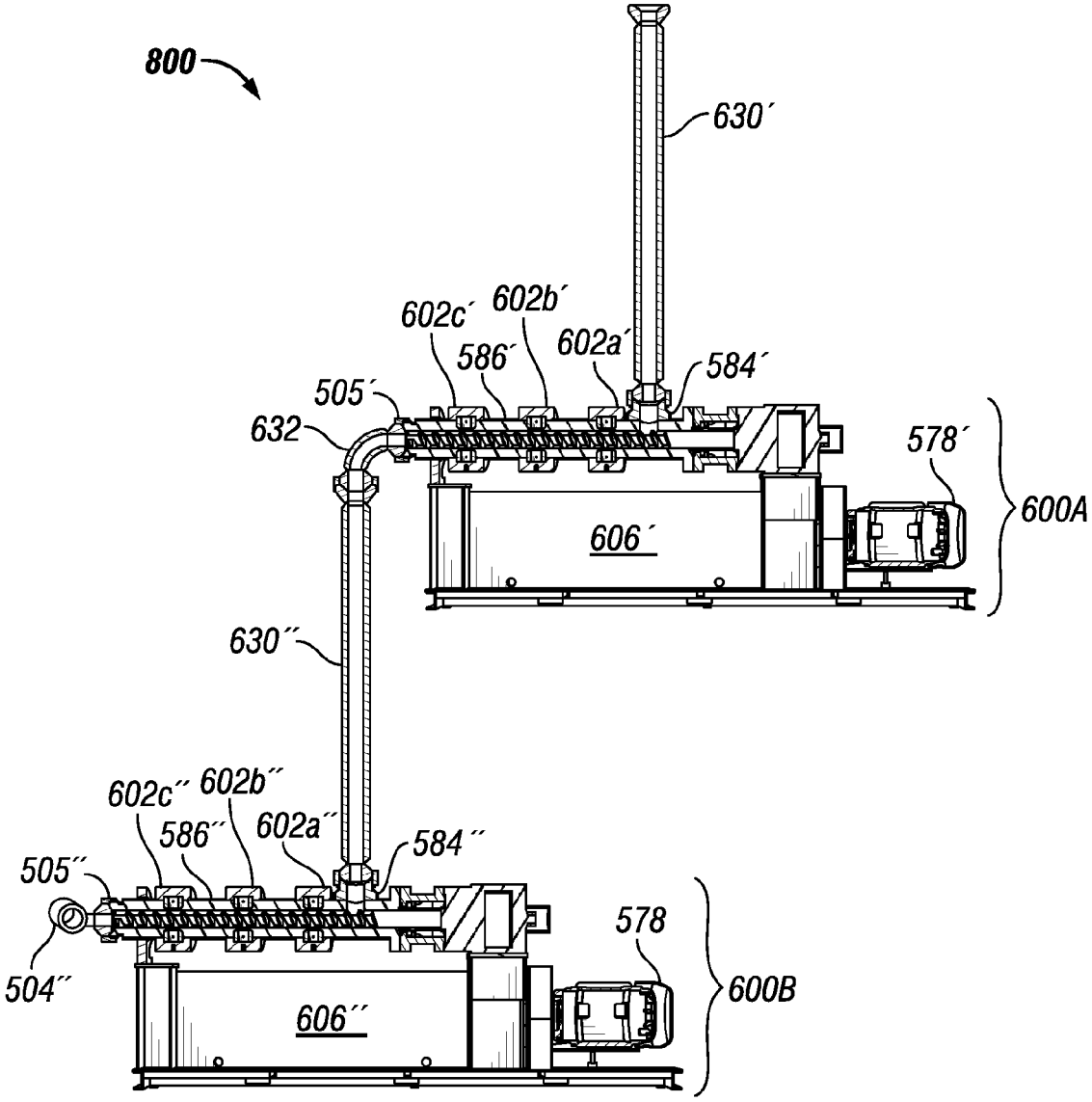
FIG. 61 is a sectional view according to another embodiment.

In another exemplary embodiment, as illustrated in FIGS. 60 and 61, an apparatus featuring two extruders 800, connected at the discharge of the first extruder 600A and the inlet of the second extruder 600B is provided. As shown, in the two-extruder apparatus 800, a first extruder 600A and second extruder 600B are positioned in a manner such that the discharge outlet 505' of the first extruder 600A is introduced into a stand pipe 630 or other connector, which then introduces the particles from the first extruder 600A into the inlet 584" of the second extruder 600B.

In one exemplary embodiment, as illustrated in FIG. 60, the first and second extruders 600A and 600B are positioned such that the first extruder 600A is positioned directly above the second extruder 600B, and the two extruders are connected by an elbow connector 632 and a connecting pipe 630. Each extruder in the two-extruder apparatus 800 may include one or more magnetic circuits 602, as shown in FIGS. 60 and 61, which, as previously discussed herein, assist in the movement and discharge of solid magnetic particles 100 therefrom.

In operation, the speed at which the first extruder 600A and the second extruder 600B are operated is preferably such that the extruder screws turn at approximately the same speed.

In exemplary embodiments, the second extruder 600B is operated at a constant output rate and the first extruder 600A is operated at a variable speed, wherein the speed is varied to provide sufficient feed to allow the second extruder 600B to operate at a constant discharge rate.

In exemplary embodiments, during operation of the two-extruder apparatus 800, it is preferable that the stand pipe 630 connecting the first extruder 600A and second extruder 600B is filled to at least half full, and more preferably completely full, of solid particulate materials 100 or a slurry thereof before the second extruder 600B is operated. Allowing the stand pipe 630 to partially or completely fill prior to starting the second extruder 600B may help to ensure that each flight is full of particulate material, wherein a flight is defined as the space within the extruder barrel defined by the barrel wall, the core of the shaft and the walls of two adjacent screw threads. The amount of solid particulate material 100 or slurry required in the pipe 630" is determined by the permeability of the particulate material and the pressure of the standpipe.

Additionally, in some exemplary embodiments, a vibrational source may be attached to the stand pipe. Any known vibrational source which may be mounted to the stand pipe may be employed, such as, for example, a variable amplitude variable frequency vibrational apparatus produced by Eriez Magnetics, and the like. The vibrational apparatus may assist with the efficient and thorough packing of the stand pipe, allowing for larger amounts of particulate materials to occupy the same volume. The addition of a vibrational source to the stand pipe, or to pipe connecting extruders in a multiple extruder apparatus, can result in more efficient packing, preferably packing at least 10% more particles, more preferably packing at least 20% more particles, more preferably packing at least 30% more particles, more preferably packing at least 40% more particles, and most preferably resulting in packing at least 50% more particles. In exemplary embodiments, the vibrational source is preferably placed near the bottom of the pipe, preferably in the lower half of the standpipe or connecting pipe, more preferably at between approximately 25 and 40% from the bottom of the standpipe or the connecting pipe.

In operation, the two-extruder apparatus 800 is operated in a fashion similar to the operation of the single extruder 600. Circulation fluid such as, for example, drilling mud, is withdrawn from the tank 6 (FIG. 1) and pumped by the pump 2 (FIG. 1). The fluid is pumped through the standpipe 504 before being pumped through the bit 60. The fluid is at a relatively high pressure within the standpipe 504. The inlet 584*a* of the feed housing 584 is at or substantially near atmospheric pressure.

In an exemplary embodiment, particles 100, such as a plurality of the solid material magnetic impactors 100, enter the feed housing 584' of the first extruder 600A via the standpipe 630', which is connected to a source of solid material impactors 100. The motor 578 operates, which, in turn, causes the gearbox to operate, thereby causing the shaft of the screw feeder to rotate in place about its longitudinal axis. As a result of the rotation of the shaft, the extruder screw thread moves the impactors 100 from right to left, as viewed in FIGS. 60 and 61, away from the inlet 584' and towards the discharge end 505' of the barrel 586.

During the continued introduction of the impactors 100 into the extruder 600A, the impactors 100 are positioned between the extruder shaft and the inside surface of the barrel 586' defined by the bore and along the length of the barrel 586', thereby forming a permeable media that will diffuse the standpipe pressure, as previously described with respect to the system 600.

During the continued operation of the apparatus 800, the impactors 100 are pushed through barrel 586 and exit the discharge end 505' of the first extruder 600A into standpipe 630". The impactors 100 are allowed to collect in standpipe 630" and are introduced into the inlet 584" of the second extruder 600B.

The motor of the second extruder 600B operates to cause the gearbox to rotate the shaft of the screw feeder to rotate in place about its longitudinal axis. As a result of the rotation of the shaft, the extruder screw thread moves the impactors 100 from right to left, as viewed in FIGS. 60 and 61, away from the inlet 584' and towards the discharge end 505' and standpipe 504 of the barrel 586".

During the continued operation of the apparatus 800, the impactors 100 are pushed through barrel 586" and exit the discharge end 505" of the first extruder 600B into standpipe 504. The impactors 100 exit the second extruder 600B, and are introduced into the flowline in standpipe 504. A check valve or other pressure isolating means may be placed between the standpipe 504 and the injection systems, including for example, injection systems 600 and 800, to control and limit pressure surges experienced during operation.

Similar to the description above with respect to the system 600, the permeable media 592 operates to generally reduce the pressure across the discharge end 505" the barrel 586" and at least a portion of the feed housing 584', from the relatively high pressure in the flow region defined by the standpipe 504 to the relatively low pressure at the inlet 584", thereby permitting the apparatus 800 to inject the impactors 100 into the flow region defined by the standpipe 504 with less work, or power, than required if there was no such pressure reduction. The use of a control volume of the solid material impactors 100 to at least partially form the permeable media permits the screw feeder to operate at a substantially reduced pressure, rather than at the relatively high pressure in the flow region defined by the standpipe 504, thereby lowering the overall cost and/or complexity of the system 800. In an exemplary embodiment, the pressure in the flow region defined by the standpipe 504 during the operation of the system 800, including the operation of the first and second extruders 600A and 600B, is 5,000 psi. In an exemplary embodiment, the pressure in the flow region defined by the standpipe 504 during the operation of the system 800, including the operation of the first and second extruders 600A and 600B, is greater than 5,000 psi. In an exemplary embodiment, the pressure in the flow region defined by the standpipe 504 during the operation of the system 800, including the operation of the first and second extruders 600A and 600B, is less than 5,000 psi. In an exemplary embodiment, the pressure drop from the flow region defined by the standpipe 504 to the inlet 584" is substantially equal to the difference between the pressure in the standpipe 504 and atmospheric pressure.

In an exemplary embodiment, one or more magnet circuits are coupled to the outside surface of the barrels 586' and 586" of the first and second extruders 600A and 600B. During the above-described operation of the apparatus 800, the one or more magnet circuits coupled to the outside surface of the barrels 586' and 586" create one or more magnetic fields, which urge the impactors 100 against the inside surface of the barrels 586' and 586" of the first and second extruders 600A and 600B, thereby creating drag. This drag provides opposing drag forces that resist the forces applied on the impactors 100 by the thread of the screw feeder. As a result, the impactors 100 are thrust down the barrel of the first and second extruders 600A and 600B.

In several exemplary embodiments, in order to adjust and/or optimize the permeability of the permeable media, other secondary materials and/or particles may be mixed with the impactors 100 before, during or after the entry of the impactors 100 into the inlet 584'. In an exemplary embodiment, particles having effective diameters that are smaller than the solid material impactors 100 may be mixed with the impactors 100 prior to the entry of the impactors 100 into the feed housing 584'.

In several exemplary embodiments, any one or more of the systems 500, 508, 522, 526, 530, 540, 552, 564 and/or 572 may be combined in whole or in part with any other of the systems 500, 508, 522, 526, 530, 540, 552, 564, 572, 600 and/or 800. In several exemplary embodiments, the systems 500, 508, 522, 526, 530, 540, 552, 564, 572, 600 and/or 800, and/or any components thereof, may be arranged horizontally, vertically or angularly, and/or in any combination thereof.

In several exemplary embodiments, instead of, or in addition to substantially directly injecting the solid material impactors 100, any one or more of the systems 500, 508, 522, 526, 530, 540, 552, 564, 572, 600 and/or 800, and/or any one or more components thereof, may inject other types of particles such as, for example, proppant materials including, for example, naturally occurring sand grains, and/or man-made or specially-engineered proppants such as, for example, resin-coated sand or high-strength ceramic materials such as sintered bauxite.

In several exemplary embodiments, the impactors 100 may include and/or be composed of any type of solid material in a wide variety of forms such as, for example, any type of solid pellets, shot or particles. In several exemplary embodiments, the type of liquid or fluid and/or the type of impactor used to form the above-described suspension may be dictated by the application for which one or more of the above-described injection systems are to be used.

In several exemplary embodiments, instead of, or in addition to substantially directly injecting particles into the flow region defined by the standpipe 504, any one or more of the systems 500, 508, 522, 526, 530, 540, 552, 564, 572, 600 and/or 800, and/or any one or more components thereof, may inject particles into other types of flow regions. For example, the systems 500, 508, 522, 526, 530, 540, 552, 564, 572, 600 and/or 800, and/or any one or more components thereof, may be used to inject particles into other flow regions such as, for example, into one or more fractures in one or more subterranean formations, and/or into one or more wellbores.

In several exemplary embodiments, and in addition to, or instead of injecting the impactors 100 into the flow region defined by the standpipe 504, one or more of the above-described injections systems, and/or any combination thereof, may be used to inject particles such as the impactors 100 into a wide variety of other flow regions defined by a wide variety of systems, vessels, pipelines, naturally-formed structures, man-made structures and/or components and/or subsystems thereof, to serve a wide variety of other purposes. Moreover, one or more of the above-described injections systems, and/or any combination thereof, may be used to inject particles such as the impactors 100 directly into the atmosphere and/or environment, and/or may be used in a wide variety of external applications such as, for example, cleaning applications, so that the flow region is considered to be the atmosphere or environmental surroundings.

In several exemplary embodiments, instead of, or in addition to substantially directly injecting the solid material impactors 100 into the flow region defined by the standpipe 504, any one or more of the systems 500, 508, 522, 526, 530, 540, 552, 564, 572, 600 and/or 800, and/or any one or more components thereof, may inject other types of particles into other types of flow regions. For example, the systems 500, 508, 522, 526, 530, 540, 552, 564, 572, 600 and/or 800, and/or any one or more components thereof, may be used to inject proppant materials including, for example, naturally occurring sand grains, and/or man-made or specially-engineered proppants such as, for example, resin-coated sand or high-strength ceramic materials such as sintered bauxite, into, for example, one or more fractures in one or more subterranean formations, and/or into one or more wellbores.

In several exemplary embodiments, any hydraulic fluid or other fluid described above and present in one or more of the above-described injection systems, and/or present in one or more components thereof, may be in a wide variety of fluidic forms such as, for example, oil, drilling fluid or mud, air and/or any combination thereof, and/or any type of conventional hydraulic fluid, and/or any other type of fluid, including any type of liquid or gas.

During the experimental testing, in one embodiment, the stand pipe is filled prior to the injection of particles into a wellbore. The initial "pack-off" of the stand pipe may assist in achieving higher injection pressures.

Figures 49, 50:
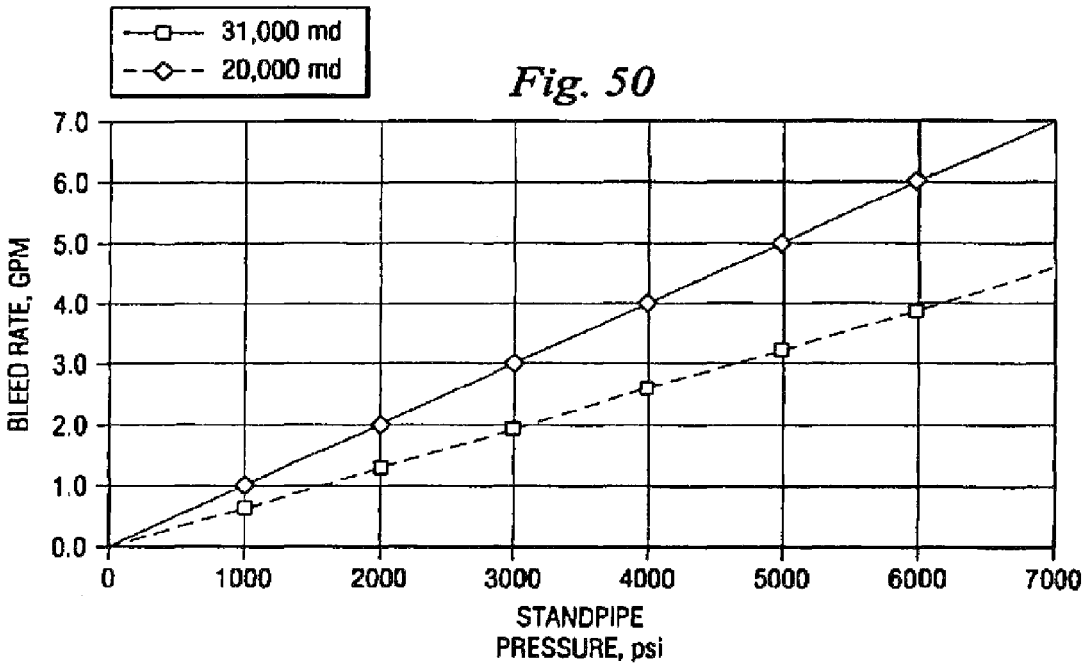
FIG. 49 is a table depicting experimental permeability measurements for examples of permeable media that are representative of permeable media associated with one or more embodiments of the present disclosure.
FIG. 50 is a graph depicting plots of theoretical bleed rate versus standpipe pressure for examples of permeable media that are representative of permeable media associated with one or more embodiments of the present disclosure.

In an exemplary embodiment, as illustrated in FIG. 49, experimental testing was conducted to determine the permeability of different samples of different pluralities of the solid material impactors 100. During the experimental testing, standard permeability testing procedures were followed, the experimental net confining stress was 800 psi, the experimental temperature was 70° F., and the experimental fluid was Kaydol Mineral Oil.

During the experimental testing, Experimental Sample Number 1A comprised a plurality of the solid material impactors 100 arranged in a generally cylindrically-shaped control volume having a length of 5.39 cm and a diameter of 3.94 cm, with a substantial portion by weight of the solid material impactors 100 having an average mean diameter of approximately 0.075 inches. The experimental permeability-to-oil of the Experimental Sample Number 1A was experimentally measured to be 31,800.00 millidarcys (md). This experimental permeability measurement was an unexpected result.

During the experimental testing, Experimental Sample Number 1B comprised a plurality of the solid material impactors 100 arranged in a generally cylindrically-shaped control volume having a length of 5.19 cm and a diameter of 3.95 cm, with a substantial portion by weight of the solid material impactors 100 having an average mean diameter of approximately 0.075 inches. The experimental permeability-to-oil of the Experimental Sample Number 1B was experimentally measured to be 31,300.00 md. This experimental permeability measurement was an unexpected result.

During the experimental testing, Experimental Sample Number 1B comprised a plurality of the solid material impactors 100 arranged in a generally cylindrically-shaped control volume having a length of 4.49 cm and a diameter of 3.97 cm, with a substantial portion by weight of the solid material impactors 100 having an average mean diameter of approximately 0.075 inches. The experimental permeability-to-oil of the Experimental Sample Number 1C was experimentally measured to be 19,600.00 md. This experimental permeability measurement was an unexpected result.

In an exemplary embodiment, as illustrated in FIG. 50, the theoretical bleed rate of the circulation fluid, such as drilling mud, flowing in the standpipe 504 is plotted versus the theoretical pressure in the standpipe 504. The bleed rate of the circulation fluid, such as drilling mud, refers to the above-described flow rate of the circulation fluid flowing into the port 504*a*, through the bore 586*a* of the barrel 586 of the extruder 574, at least partially through the bore 584*b* of the feed housing 584 of the extruder 574, and out of the inlet 584*a* of the feed housing 584, as indicated by the arrows 593*a* and 593*b* in FIG. 48. The theoretical bleed rate was calculated using the following formula:

$$q = \frac{k \times A \times \Delta P}{14700 \times \mu \times L}$$

where:

q=bleed rate, mL/s k=permeability-to-oil, md;

A=cross-sectional area of permeable media, 82.3 $cm^2$ (held constant);

ΔP=pressure differential across experimental sample, psi;

μ=viscosity, 20 cp (held constant); and

L=length of permeable media, 137.2 cm (held constant).

As illustrated in FIG. 50, if a permeable media has a permeability-to-oil of 20,000 md, which is roughly equivalent to the experimental permeability of Experimental Sample 1C as described above, the bleed rate is calculated to be 0.6 gpm at a standpipe pressure of 1,000 psi, 1.3 gpm at a standpipe pressure of 2,000 psi, 1.9 gpm at a standpipe pressure 3,000 psi, 2.6 gpm at a standpipe pressure of 4,000 psi, 3.2 gpm at a standpipe pressure of 5,000 psi, and 3.9 gpm at a standpipe pressure of 6,000 psi. These calculation results, which were based on, and motivated by, the above-described unexpected experimental test results, were unexpected.

As further illustrated in FIG. 50, if a permeable media has a permeability-to-oil of 31,000 md, which is roughly equivalent to the experimental permeability of Experimental Samples 1A and 1B as described above, the bleed rate is calculated to be 1.0 gpm at a standpipe pressure of 1,000 psi, 2.0 gpm at a standpipe pressure of 2,000 psi, 3.0 gpm at a standpipe pressure 3,000 psi, 4.0 gpm at a standpipe pressure of 4,000 psi, 5.0 gpm at a standpipe pressure of 5,000 psi, and 6.0 gpm at a standpipe pressure of 6,000 psi. These calculation results, which were based on, and motivated by, the above-described unexpected experimental test results, were unexpected.

The bleed rate versus standpipe pressure plots in FIG. 50 indicate that the bleed rate of any flow, or bleeding, of the circulation fluid from the standpipe 504, through the port 504*a*, through the barrel 586, through at least a portion of the feed housing 584, and through the inlet 584*a*, which may occur during the operation of the system 572, may be less than 6 gpm. This was an unexpected result.

The bleed rate versus standpipe pressure plots in FIG. 50 indicate that the bleed rate of any flow, or bleeding, of the circulation fluid from the standpipe 504, through the port 504*a*, through the barrel 586, through at least a portion of the feed housing 584, and through the inlet 584*a*, which may occur during the operation of the system 572, may be acceptable and may not affect the overall operation of the system 572, including the operation of the extruder 574. That is, the permeability of the permeable media 592 may be such that the bleed rate of any bleeding circulation fluid may be low enough so as to not affect the normal operation of the system 1 and the system 572, including the injection of the impactors 100 into the flow region defined by the standpipe 504 by the extruder 572 and the simultaneous maintenance of the pressure differential by the permeable media 592, including the maintenance of a pressure differential that is substantially equal to the difference between the pressure in the standpipe 504 and atmospheric pressure.

Experimental testing was conducted using one or more of the above-described embodiments, and/or combinations thereof. In several exemplary experimental embodiments, rock that was penetrated during the experimental testing was stressed to simulate a subterranean formation. In several exemplary experimental embodiments, the rock that was penetrated during the experimental testing was stressed to simulate downhole conditions in a subterranean formation at about 4,000 ft of drilling depth. In several exemplary experimental embodiments, the rock that was penetrated during the experimental testing was stressed to simulate downhole conditions in a subterranean formation at about 5,000 ft of drilling depth. In several exemplary experimental embodiments, the rock that was penetrated during the experimental testing was stressed to simulate downhole conditions in a subterranean formation from about 4,000 ft to about 5,000 ft of drilling depth. In several exemplary experimental embodiments, as a result of the stressing of the rock that was penetrated during the experimental testing, the rock had a confined pressure (horizontal stress) and an overburden stress (vertical stress).

In an exemplary experimental embodiment, an experimental test was conducted using the system 1 and the drill bit 110, which had a bit diameter of about 8.5 in. Carthage marble, which has an unconfined compressive strength of at least about 16,000 psi, was penetrated with the drill bit 110. The carthage marble was stressed so that the carthage marble had a confined pressure (horizontal stress) of about 2,896 psi and an overburden stress (vertical stress) of about 4,400 psi. The circulation fluid in the system 1 was in the form of conventional drilling mud, and was pumped to the drill bit 110 at a flow rate of 462 gpm and a temperature of 62.2 degrees F. The impactors in the system 1 were injected into the drilling mud at a flow rate of 12 gpm, and a substantial portion of the impactors had a mean diameter of greater than 0.100 in. During the penetration of the carthage marble, the rotary speed of the drill bit 110 was 100 rpm. The pressure in the bore and below the drill bit 110 was 1,035 psi, and the pressure at the swivel above the drill bit 110 was 3,822 psi. During at least a portion of the penetration of the carthage marble, the drill bit 110 had an average weight-on-bit of less than or equal to about 16,494 lb, an average torque of less than or equal to about 1,253 ft-lb, and an average rate-of-penetration of greater than or equal to about 28.7 ft/hr, which was unexpectedly greater than the average rate-of-penetration of a conventional drill bit. The combination of these operating parameters was an unexpected result. Also, no damage to the drill bit 110 was observed. This was an unexpected result.

In an exemplary experimental embodiment, an experimental test was conducted using the system 1 and the drill bit 110, which had a bit diameter of about 8.5 in. Carthage marble, which has an unconfined compressive strength of at least about 16,000 psi, was penetrated with the drill bit 110. The carthage marble was stressed so that the carthage marble had a confined pressure (horizontal stress) of about 2,896 psi and an overburden stress (vertical stress) of about 3,953 psi. The circulation fluid in the system 1 was in the form of conventional drilling mud, and was pumped to the drill bit 110 at a flow rate of 462 gpm and a temperature of 82.6 degrees F. The impactors in the system 1 were injected into the drilling mud at a flow rate of 12 gpm, and a substantial portion of the impactors had a mean diameter of greater than 0.100 in. During the penetration of the carthage marble, the rotary speed of the drill bit 110 was 100 rpm. The pressure in the bore and below the drill bit 110 was 967 psi, and the pressure at the swivel above the drill bit 110 was 3,612 psi. During at least a portion of the penetration of the carthage marble, the drill bit 110 had an average weight-on-bit of less than or equal to about 31,277 lb, an average torque of less than or equal to about 2,406 ft-lb, and an average rate-of-penetration of greater than or equal to about 35.9 ft/hr, which was unexpectedly greater than the average rate-of-penetration of a conventional drill bit. The combination of these operating parameters was an unexpected result. Also, no damage to the drill bit 110 was observed. This was an unexpected result.

In an exemplary experimental embodiment, an experimental test was conducted using the system 1 and the drill bit 110, which had a bit diameter of about 8.5 in. Carthage marble, which has an unconfined compressive strength of at least about 16,000 psi, was penetrated with the drill bit 110. The carthage marble was stressed so that the carthage marble had a confined pressure (horizontal stress) of about 2,888 psi and an overburden stress (vertical stress) of about 3,935 psi. The circulation fluid in the system 1 was in the form of conventional drilling mud, and was pumped to the drill bit 110 at a flow rate of 462 gpm and a temperature of 84.6 degrees F. The impactors in the system 1 were injected into the drilling mud at a flow rate of 12 gpm, and a substantial portion of the impactors had a mean diameter of greater than 0.100 in. During the penetration of the carthage marble, the rotary speed of the drill bit 110 was 101 rpm. The pressure in the bore and below the drill bit 110 was 967 psi, and the pressure at the swivel above the drill bit 110 was 3,623 psi. During at least a portion of the penetration of the carthage marble, the drill bit 110 had an average weight-on-bit of less than or equal to about 42,678 lb, an average torque of less than or equal to about 3,326 ft-lb, and an average rate-of-penetration of greater than or equal to about 42.6 ft/hr, which was unexpectedly greater than the average rate-of-penetration of a conventional drill bit. The combination of these operating parameters was an unexpected result. Also, no damage to the drill bit 110 was observed. This was an unexpected result.

In an exemplary experimental embodiment, an experimental test was conducted using the system 1 and the drill bit 110, which had a bit diameter of about 8.5 in. Carthage marble, which has an unconfined compressive strength of at least about 16,000 psi, was penetrated with the drill bit 110. The carthage marble was stressed so that the carthage marble had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at a flow rate of 12 gpm, and a substantial portion of the impactors had a mean diameter of greater than 0.100 in. During the penetration of the carthage marble, the rotary speed of the drill bit 110 was 100 rpm. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2886 | 2889 | 2886 |
| Avg. Overburden Stress (psi) | 3958 | 3948 | 3929 |
| Avg. Mud Temperature (F.) | 61.7 | 62.7 | 62.8 |
| Avg. Bore Pressure (psi) | 998 | 1001 | 895 |
| Avg. Swivel Pressure (psi) | 3485 | 3493 | 3324 |
| Avg. Torque (ft-lb) | 3699 | 4785 | 5111 |
| Avg. Weight-On-Bit (lb) | 49035 | 61298 | 64073 |
| Avg. Rate-Of-Penetration (ft/hr) | 39.6 | 46.0 | 48.5 |

The average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Carthage marble, which has an unconfined compressive strength of at least about 16,000 psi, was penetrated with the drill bit 110. The carthage marble was stressed so that the carthage marble had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at different flow rates, and a substantial portion of the impactors had a mean diameter of greater than 0.100 in. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2896 | 2891 | 2904 |
| Avg. Overburden Stress (psi) | 3955 | 3939 | 3954 |
| Avg. Mud Temperature (F.) | 72.3 | 73.4 | 77.1 |
| Avg. Bore Pressure (psi) | 929 | 936 | 1007 |
| Avg. Swivel Pressure (psi) | 3185 | 3226 | 3599 |
| Avg. Torque (ft-lb) | 452 | 2216 | 938 |
| Avg. Weight-On-Bit (lb) | 2219 | 29390 | 12546 |
| Avg. Rate-Of-Penetration (ft/hr) | 35.5 | 32.3 | 31.5 |
| Avg. Rotary Speed (RPM) | 103 | 101 | 100 |
| Avg. Impactor-Injection Flow Rate (gpm) | 12 | 12 | 15 |

The average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Sierra white granite, which has an unconfined compressive strength of at least about 28,000 psi, was penetrated with the drill bit 110. The sierra white granite was stressed so that the sierra white granite had a confined pressure (horizontal stress) of about 2,896 psi and an overburden stress (vertical stress) of about 0 psi. The circulation fluid in the system 1 was in the form of conventional drilling mud, and was pumped to the drill bit 110 at a flow rate of 462 gpm and a temperature of 43.3 degrees F. The impactors in the system 1 were injected into the drilling mud at a flow rate of 12 gpm, and a substantial portion of the impactors had a mean diameter of greater than 0.100 in. During the penetration of the sierra white granite, the rotary speed of the drill bit 110 was 100 rpm. The pressure in the bore and below the drill bit 110 was 961 psi, and the pressure at the swivel above the drill bit 110 was 3,753 psi. During at least a portion of the penetration of the sierra white granite, the drill bit 110 had an average weight-on-bit of less than or equal to about 11,675 lb, an average torque of less than or equal to about 728 ft-lb, and an average rate-of-penetration of greater than or equal to about 29.9 ft/hr. Each of these operating parameters, and/or any combinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2898 | 2895 | 2891 |
| Avg. Overburden Stress (psi) | 3959 | 3955 | 3948 |
| Avg. Mud Temperature (F.) | 93.5 | 94.1 | 95.1 |
| Avg. Bore Pressure (psi) | 1006 | 1003 | 999 |
| Avg. Swivel Pressure (psi) | 3662 | 3653 | 3637 |
| Avg. Torque (ft-lb) | 1235 | 1691 | 1852 |
| Avg. Weight-On-Bit (lb) | 17809 | 25537 | 29300 |
| Avg. Rate-Of-Penetration (ft/hr) | 34.2 | 40.9 | 45.2 |
| Avg. Rotary Speed (RPM) | 100 | 100 | 101 |

The average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least eight data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 | DATA POINT #6 | DATA POINT #7 | DATA POINT #8 |
|---|---|---|---|---|---|---|---|---|
| Avg. Confined Pressure (psi) | 2911 | 2907 | 2901 | 2897 | 2891 | 2886 | 2885 | 2883 |
| Avg. Overburden | 3961 | 3949 | 3938 | 3938 | 3934 | 3924 | 3921 | 3921 |

-continued

| OPERATING PARAMETER | DATA POINT #1 | DATA POINT #2 | DATA POINT #3 | DATA POINT #4 | DATA POINT #5 | DATA POINT #6 | DATA POINT #7 | DATA POINT #8 |
|---|---|---|---|---|---|---|---|---|
| Stress (psi) | | | | | | | | |
| Avg. Mud Temperature (F.) | 72.1 | 72.4 | 72.4 | 72.6 | 73.7 | 74.1 | 74.7 | 75.0 |
| Avg. Bore Pressure (psi) | 1037 | 1016 | 1001 | 1003 | 1003 | 1004 | 1000 | 994 |
| Avg. Swivel Pressure (psi) | 3555 | 3447 | 3413 | 3420 | 3426 | 3427 | 3501 | 3717 |
| Avg. Torque (ft-lb) | 737 | 1973 | 2272 | 2540 | 2836 | 3315 | 3596 | 4135 |
| Avg. Weight-On-Bit (lb) | 11961 | 29741 | 34806 | 38487 | 41714 | 47132 | 55980 | 68880 |
| Avg. Rate-Of-Penetration (ft/hr) | 31.9 | 43.2 | 45.7 | 51.7 | 53.4 | 57.9 | 52.0 | 29.1 |
| Avg. Rotary Speed (RPM) | 100 | 100 | 100 | 101 | 100 | 100 | 100 | 100 |

The average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Crab orchard sandstone, which has an unconfined compressive strength of at least about 27,000 psi, was penetrated with the drill bit 110. The crab orchard sandstone was stressed so that the crab orchard sandstone had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least two data points were taken during this experimental test, and the operating parameters for these data points are shown in the following table:

| OPERATING PARAMETER | DATA POINT #1 | DATA POINT #2 |
|---|---|---|
| Avg. Confined Pressure (psi) | 2895 | 2891 |
| Avg. Overburden Stress (psi) | 3946 | 3936 |
| Avg. Mud Temperature (F.) | 93.5 | 95.4 |
| Avg. Bore Pressure (psi) | 956 | 966 |
| Avg. Swivel Pressure (psi) | 3321 | 3281 |
| Avg. Torque (ft-lb) | 1585 | 1835 |
| Avg. Weight-On-Bit (lb) | 22964 | 26208 |
| Avg. Rate-Of-Penetration (ft/hr) | 31.0 | 34.1 |
| Avg. Rotary Speed (RPM) | 100 | 100 |

The average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Crab orchard sandstone, which has an unconfined compressive strength of at least about 27,000 psi, was penetrated with the drill bit 110. The crab orchard sandstone was stressed so that the crab orchard sandstone had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least two data points were taken during this experimental test, and the operating parameters for these data points are shown in the following table:

| OPERATING PARAMETER | DATA POINT #1 | DATA POINT #2 |
|---|---|---|
| Avg. Confined Pressure (psi) | 2895 | 2891 |
| Avg. Overburden Stress (psi) | 3946 | 3936 |
| Avg. Mud Temperature (F.) | 93.5 | 95.4 |
| Avg. Bore Pressure (psi) | 956 | 966 |
| Avg. Swivel Pressure (psi) | 3321 | 3281 |
| Avg. Torque (ft-lb) | 1585 | 1835 |
| Avg. Weight-On-Bit (lb) | 22964 | 26208 |
| Avg. Rate-Of-Penetration (ft/hr) | 31.0 | 34.1 |
| Avg. Rotary Speed (RPM) | 100 | 100 |

The average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Crab orchard sandstone, which has an unconfined compressive strength of at least about 27,000 psi, was penetrated with the drill bit 110. The crab orchard sandstone was stressed so that the crab orchard sandstone had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2895 | 2903 | 2897 |
| Avg. Overburden Stress (psi) | 3702 | 3703 | 3688 |
| Avg. Mud Temperature (F.) | 73.6 | 73.8 | 75.0 |
| Avg. Bore Pressure (psi) | 977 | 935 | 942 |
| Avg. Swivel Pressure (psi) | 3522 | 3328 | 3098 |
| Avg. Torque (ft-lb) | 2788 | 3156 | 3490 |
| Avg. Weight-On-Bit (lb) | 46523 | 47100 | 48330 |
| Avg. Rate-Of-Penetration (ft/hr) | 42.4 | 46.7 | 52.7 |
| Avg. Rotary Speed (RPM) | 100 | 100 | 100 |

The average rates of penetrations shown in the table above were unexpectedly greater than average rates-of-penetration of conventional drill bits and thus were unexpected results. Further, the respective combinations of the average weights-on-bit, the average torques, and the average rates-of-penetration shown in the table above, were unexpected results. Still further, the respective combinations of the operating parameters shown in the table above, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in. Mancos shale, which has an unconfined compressive strength of at least about 9,800 psi, was penetrated with the drill bit 110. The mancos shale was stressed so that the mancos shale had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least two data points were taken during this experimental test, and the operating parameters for these data points are shown in the following table:

| OPERATING PARAMETER | DATA POINT #1 | DATA POINT #2 |
|---|---|---|
| Avg. Confined Pressure (psi) | 2909 | 2911 |
| Avg. Overburden Stress (psi) | 3681 | 3680 |
| Avg. Mud Temperature (F.) | 79.7 | 82.8 |
| Avg. Bore Pressure (psi) | 1006 | 976 |
| Avg. Swivel Pressure (psi) | 3474 | 3616 |
| Avg. Torque (ft-lb) | 3374 | 4290 |
| Avg. Weight-On-Bit (lb) | 25720 | 39141 |
| Avg. Rate-Of-Penetration (ft/hr) | 64.5 | 49.6 |
| Avg. Rotary Speed (RPM) | 100 | 101 |

In an exemplary experimental embodiment, an experimental test was conducted using the system 1 and the drill bit 110, which had a bit diameter of about 8.5 in. Mancos shale, which has an unconfined compressive strength of at least about 9,800 psi, was penetrated with the drill bit 110. The mancos shale was stressed so that the mancos shale had a confined pressure (horizontal stress) and an overburden stress (vertical stress). The circulation fluid in the system 1 was in the form of conventional drilling mud, and was pumped to the drill bit 110 at a flow rate of 462 gpm. The impactors in the system 1 were injected into the drilling mud at 12 gpm, and a substantial portion of the impactors had a mean diameter of greater than 0.100 in. At least five data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 |
|---|---|---|---|---|---|
| Avg. Confined Pressure (psi) | 2825 | 2902 | 2915 | 2920 | 2929 |
| Avg. Overburden Stress (psi) | 3387 | 3573 | 3694 | 3681 | 3705 |
| Avg. Mud Temperature (F.) | 77.6 | 79.0 | 80.2 | 81.5 | 83.3 |
| Avg. Bore Pressure (psi) | 1023 | 957 | 966 | 975 | 985 |
| Avg. Swivel Pressure (psi) | 3496 | 3212 | 3338 | 3423 | 3718 |
| Avg. Torque (ft-lb) | 1694 | 2841 | 2851 | 3182 | 2408 |
| Avg. Weight-On-Bit (lb) | 10710 | 19993 | 25889 | 29985 | 25218 |
| Avg. Rate-Of-Penetration (ft/hr) | 29.6 | 40.2 | 32.5 | 36.9 | 14.6 |
| Avg. Rotary Speed (RPM) | 101 | 100 | 101 | 100 | 101 |

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at 15 gpm, and a substantial portion of the impactors had a mean diameter of about 0.075 in, as noted above. At least two data points were taken during this experimental test, and the operating parameters for these data points are shown in the following table:

| OPERATING PARAMETER | DATA POINT #1 | DATA POINT #2 |
|---|---|---|
| Avg. Confined Pressure (psi) | 2903 | 2904 |
| Avg. Overburden Stress (psi) | 4382 | 4382 |
| Avg. Mud Temperature (F.) | 90.7 | 91.1 |
| Avg. Bore Pressure (psi) | 1510 | 1631 |
| Avg. Swivel Pressure (psi) | 3107 | 3238 |
| Avg. Torque (ft-lb) | 1505 | 2014 |
| Avg. Weight-On-Bit (lb) | 9762 | 15266 |
| Avg. Rate-Of-Penetration (ft/hr) | 38.7 | 44.0 |
| Avg. Mud Flow Rate (gpm) | 604 | 609 |
| Avg. Rotary Speed (RPM) | 99 | 99 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at 15 gpm, and a substantial portion of the impactors had a mean diameter of about 0.075 in, as noted above. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2884 | 2885 | 2883 |
| Avg. Overburden Stress (psi) | 4410 | 4421 | 4415 |
| Avg. Mud Temperature (F.) | 99.6 | 103.8 | 104.5 |
| Avg. Bore Pressure (psi) | 1700 | 1876 | 1747 |
| Avg. Swivel Pressure (psi) | 3390 | 3518 | 3233 |
| Avg. Torque (ft-lb) | 939 | 754 | 1529 |
| Avg. Weight-On-Bit (lb) | 8747 | 9532 | 15244 |
| Avg. Rate-Of-Penetration (ft/hr) | 34.7 | 28.3 | 31.2 |
| Avg. Mud Flow Rate (gpm) | 617 | 606 | 590 |
| Avg. Rotary Speed (RPM) | 100 | 100 | 100 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at 574 gpm. The impactors in the system 1 were injected into the drilling mud at 16.5 gpm, and a substantial portion of the impactors had a mean diameter of about 0.075 in, as noted above. At least two data points were taken during this experimental test, and the operating parameters for these data points are shown in the following table:

| OPERATING PARAMETER | DATA POINT #1 | DATA POINT #2 |
|---|---|---|
| Avg. Confined Pressure (psi) | 2888 | 2882 |
| Avg. Overburden Stress (psi) | 4553 | 4525 |
| Avg. Mud Temperature (F.) | 41.0 | 38.9 |

-continued

| OPERATING PARAMETER | DATA POINT #1 | DATA POINT #2 |
|---|---|---|
| Avg. Bore Pressure (psi) | 1662 | 1666 |
| Avg. Swivel Pressure (psi) | 3327 | 3331 |
| Avg. Torque (ft-lb) | 989 | 1271 |
| Avg. Weight-On-Bit (lb) | 9984 | 15081 |

-continued

| OPERATING PARAMETER | DATA POINT #1 | DATA POINT #2 |
|---|---|---|
| Avg. Rate-Of-Penetration (ft/hr) | 29.8 | 33.3 |
| Avg. Mud Flow Rate (gpm) | 574 | 574 |
| Avg. Rotary Speed (RPM) | 101 | 101 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at different flow rates, and a substantial portion of the impactors had a mean diameter of about 0.075 in, as noted above. At least six data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 | DATA POINT #6 |
|---|---|---|---|---|---|---|
| Avg. Confined Pressure (psi) | 2896 | 2896 | 2895 | 2895 | 2896 | 2903 |
| Avg. Overburden Stress (psi) | 4392 | 4387 | 4384 | 4382 | 4381 | 4385 |
| Avg. Mud Temperature (F.) | 97.9 | 98.0 | 98.9 | 100.6 | 95.4 | 94.2 |
| Avg. Bore Pressure (psi) | 1667 | 1681 | 1697 | 1680 | 1720 | 1959 |
| Avg. Swivel Pressure (psi) | 3247 | 3271 | 3256 | 3251 | 3276 | 3403 |
| Avg. Torque (ft-lb) | 929 | 864 | 967 | 1259 | 1322 | 1406 |
| Avg. Weight-On-Bit (lb) | 10358 | 9895 | 10032 | 15313 | 15343 | 15078 |
| Avg. Rate-Of-Penetration (ft/hr) | 25.7 | 26.2 | 26.6 | 32.8 | 31.4 | 26.7 |
| Avg. Mud Flow Rate (gpm) | 602 | 602 | 601 | 601 | 601 | 602 |
| Avg. Rotary Speed (RPM) | 100 | 100 | 100 | 100 | 100 | 100 |
| Avg. Impactor-Injection Flow Rate (gpm) | 12 | 14 | 16.5 | 16.5 | 14 | 12 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at different flow rates, and a substantial portion of the impactors had a mean diameter of about 0.075 in, as noted above. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2887 | 2884 | 29402 |
| Avg. Overburden Stress (psi) | 4379 | 4373 | 4396 |
| Avg. Mud Temperature (F.) | 106.5 | 108.5 | 109.7 |
| Avg. Bore Pressure (psi) | 1693 | 1648 | 1679 |
| Avg. Swivel Pressure (psi) | 3239 | 3232 | 3187 |
| Avg. Torque (ft-lb) | 894 | 896 | 1022 |
| Avg. Weight-On-Bit (lb) | 10217 | 9959 | 13641 |
| Avg. Rate-Of-Penetration (ft/hr) | 29.1 | 30.3 | 27.8 |
| Avg. Mud Flow Rate (gpm) | 662 | 662 | 646 |
| Avg. Rotary Speed (RPM) | 101 | 101 | 101 |
| Avg. Impactor-Injection Flow Rate (gpm) | 12 | 14 | 14 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at different flow rates, and a substantial portion of the impactors had a mean diameter of about 0.075 in, as noted above. At least four data points were taken during this experimental test, and the operating parameters for these data points are shown in the following:

| OPERATING PARAMETER | DATA POINT #1 | DATA POINT #2 | DATA POINT #3 | DATA POINT #4 |
|---|---|---|---|---|
| Avg. Confined Pressure (psi) | 2899 | 2899 | 2896 | 2885 |
| Avg. Overburden Stress (psi) | 4394 | 4388 | 4378 | 4371 |
| Avg. Mud Temperature (F.) | 98.5 | 98.9 | 99.4 | 98.8 |
| Avg. Bore Pressure (psi) | 1671 | 1730 | 1714 | 1057 |

-continued

| OPERATING PARAMETER | DATA POINT #1 | DATA POINT #2 | DATA POINT #3 | DATA POINT #4 |
|---|---|---|---|---|
| Avg. Swivel Pressure (psi) | 3299 | 3335 | 3320 | 2803 |
| Avg. Torque (ft-lb) | 851 | 820 | 829 | 1121 |
| Avg. Weight-On-Bit (lb) | 10227 | 10024 | 9950 | 13845 |
| Avg. Rate-Of-Penetration (ft/hr) | 28.9 | 30.6 | 30.2 | 42.2 |
| Avg. Mud Flow Rate (gpm) | 668 | 668 | 668 | 665 |
| Avg. Rotary Speed (RPM) | 99 | 100 | 100 | 100 |
| Avg. Impactor-Injection Flow Rate (gpm) | 12 | 14 | 16.5 | 16.5 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at different flow rates, and a substantial portion of the impactors had a mean diameter of about 0.075 in, as noted above. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2888 | 2879 | 2906 |
| Avg. Overburden Stress (psi) | 4395 | 4381 | 4389 |
| Avg. Mud Temperature (F.) | 85.7 | 88.1 | 89.3 |
| Avg. Bore Pressure (psi) | 1677 | 1696 | 1726 |
| Avg. Swivel Pressure (psi) | 3294 | 3295 | 3344 |
| Avg. Torque (ft-lb) | 1199 | 1197 | 1217 |
| Avg. Weight-On-Bit (lb) | 15156 | 14955 | 15371 |

-continued

| OPERATING PARAMETER | DATA POINT #1 | DATA POINT #2 | DATA POINT #3 |
|---|---|---|---|
| Avg. Rate-Of-Penetration (ft/hr) | 38.7 | 35.1 | 32.7 |
| Avg. Mud Flow Rate (gpm) | 625 | 625 | 625 |
| Avg. Rotary Speed (RPM) | 100 | 100 | 100 |
| Avg. Impactor-Injection Flow Rate (gpm) | 16.5 | 14 | 12 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at 14 gpm, and a substantial portion of the impactors had a mean diameter of about 0.075 in, as noted above. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2899 | 2889 | 2883 |
| Avg. Overburden Stress (psi) | 4435 | 4415 | 4402 |
| Avg. Mud Temperature (F.) | — | — | — |
| Avg. Bore Pressure (psi) | 1636 | 1633 | 1637 |
| Avg. Swivel Pressure (psi) | 3284 | 3283 | 3275 |
| Avg. Torque (ft-lb) | 868 | 865 | 870 |
| Avg. Weight-On-Bit (lb) | 10492 | 10614 | 10471 |
| Avg. Rate-Of-Penetration (ft/hr) | 31.5 | 30.4 | 30.2 |
| Avg. Mud Flow Rate (gpm) | 624 | 624 | 624 |
| Avg. Rotary Speed (RPM) | 100 | 100 | 100 |
| Avg. Impactor-Injection Flow Rate (gpm) | 14 | 14 | 14 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at 16.5 gpm, and a substantial portion of the impactors had a mean diameter of about 0.075 in, as noted above. At least three data points were taken during this experimental test, and the operating parameters for these data points are shown in the following table:

| OPERATING PARAMETER | DATA POINT #1 | DATA POINT #2 | DATA POINT #3 |
|---|---|---|---|
| Avg. Confined Pressure (psi) | 2878 | 2893 | 2878 |
| Avg. Overburden Stress (psi) | 4379 | 4381 | 4366 |
| Avg. Mud Temperature (F.) | 103.6 | 104.6 | 107.3 |
| Avg. Bore Pressure (psi) | 1667 | 1668 | 1675 |
| Avg. Swivel Pressure (psi) | 3317 | 3303 | 3299 |
| Avg. Torque (ft-lb) | 810 | 788 | 827 |
| Avg. Weight-On-Bit (lb) | 10342 | 10264 | 10353 |
| Avg. Rate-Of-Penetration (ft/hr) | 31.8 | 30.8 | 31.6 |
| Avg. Mud Flow Rate (gpm) | 621 | 621 | 621 |
| Avg. Rotary Speed (RPM) | 100 | 100 | 100 |
| Avg. Impactor-Injection Flow Rate (gpm) | 16.5 | 16.5 | 16.5 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at 14 gpm, and a substantial portion of the impactors had a mean diameter of about 0.075 in, as noted above. At least four data points were taken during this experimental test, and the operating parameters for these data points are shown in the following table:

| OPERATING PARAMETER | DATA POINT #1 | DATA POINT #2 | DATA POINT #3 | DATA POINT #4 |
|---|---|---|---|---|
| Avg. Confined Pressure (psi) | 2905 | 2902 | 2896 | 2894 |
| Avg. Overburden Stress (psi) | 4420 | 4385 | 4425 | 4424 |
| Avg. Mud Temperature (F.) | — | — | — | — |
| Avg. Bore Pressure (psi) | 1660 | 1660 | 1653 | 1676 |
| Avg. Swivel Pressure (psi) | 3440 | 3426 | 3439 | 3426 |
| Avg. Torque (ft-lb) | 776 | 1408 | 1700 | 2146 |
| Avg. Weight-On-Bit (lb) | 5232 | 10094 | 12425 | 14924 |
| Avg. Rate-Of-Penetration (ft/hr) | 28.7 | 34.7 | 37.3 | 44.0 |
| Avg. Mud Flow Rate (gpm) | 351 | 351 | 351 | 351 |
| Avg. Rotary Speed (RPM) | 101 | 101 | 101 | 101 |
| Avg. Impactor-Injection Flow Rate (gpm) | 14 | 14 | 14 | 14 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at 16.5 gpm, and a substantial portion of the impactors had a mean diameter of about 0.075 in, as noted above. At least four data points were taken during this experimental test, and the operating parameters for these data points are shown in the following table:

| OPERATING PARAMETER | DATA POINT #1 | DATA POINT #2 | DATA POINT #3 | DATA POINT #4 |
|---|---|---|---|---|
| Avg. Confined Pressure (psi) | 2851 | 2861 | 2856 | 2847 |
| Avg. Overburden Stress (psi) | 4376 | 4373 | 4376 | 4391 |
| Avg. Mud Temperature (F.) | 95.2 | 96.8 | 97.7 | 98.8 |
| Avg. Bore Pressure (psi) | 1591 | 1554 | 1524 | 1574 |
| Avg. Swivel Pressure (psi) | 3351 | 3308 | 3267 | 3319 |
| Avg. Torque (ft-lb) | 779 | 1319 | 1589 | 1903 |
| Avg. Weight-On-Bit (lb) | 5101 | 9940 | 12553 | 14969 |
| Avg. Rate-Of-Penetration (ft/hr) | 30.3 | 35.8 | 36.0 | 40.6 |
| Avg. Mud Flow Rate (gpm) | 451 | 451 | 451 | 451 |
| Avg. Rotary Speed (RPM) | 100 | 100 | 100 | 100 |
| Avg. Impactor-Injection Flow Rate (gpm) | 16.5 | 16.5 | 16.5 | 16.5 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at various flow rates, and a substantial portion of the impactors had a mean diameter of about 0.075 in, as noted above. At least three data points were taken during this experimental test, and the operating parameters for these data points are shown in the following table

| OPERATING PARAMETER | DATA POINT #1 | DATA POINT #2 | DATA POINT #3 |
|---|---|---|---|
| Avg. Confined Pressure (psi) | 2909 | 2922 | 2936 |
| Avg. Overburden Stress (psi) | 4419 | 4430 | 4427 |
| Avg. Mud Temperature (F.) | 107.8 | 108.5 | 110.3 |
| Avg. Bore Pressure (psi) | 2021 | 2043 | 1976 |
| Avg. Swivel Pressure (psi) | 3606 | 3628 | 3561 |

-continued

| OPERATING PARAMETER | DATA POINT #1 | DATA POINT #2 | DATA POINT #3 |
|---|---|---|---|
| Avg. Torque (ft-lb) | 760 | 1006 | 1281 |
| Avg. Weight-On-Bit (lb) | 5623 | 8036 | 10682 |
| Avg. Rate-Of-Penetration (ft/hr) | 34.8 | 33.1 | 36.6 |
| Avg. Mud Flow Rate (gpm) | 598 | 599 | 598 |
| Avg. Rotary Speed (RPM) | 101 | 101 | 101 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at various flow rates, and a substantial portion of the impactors had a mean diameter of about 0.075 in, as noted above. At least six data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 | DATA POINT #6 |
|---|---|---|---|---|---|---|
| Avg. Confined Pressure (psi) | 2893 | 2893 | 2901 | 2900 | 2898 | 2893 |
| Avg. Overburden Stress (psi) | 4494 | 4435 | 4412 | 4413 | 4414 | 4413 |
| Avg. Mud Temperature (F.) | 85.9 | 86.4 | 87.0 | 88.0 | 88.7 | 90.8 |
| Avg. Bore Pressure (psi) | 1907 | 1962 | 1979 | 1950 | 1959 | 1991 |
| Avg. Swivel Pressure (psi) | 3554 | 3614 | 3635 | 3693 | 3700 | 3700 |
| Avg. Torque (ft-lb) | 951 | 693 | 533 | 418 | 750 | 943 |
| Avg. Weight-On-Bit (lb) | 6986 | 5462 | 5905 | 5597 | 7420 | 10138 |
| Avg. Rate-Of-Penetration (ft/hr) | 38.3 | 32.2 | 19.7 | 20.8 | 32.6 | 29.6 |
| Avg. Mud Flow Rate (gpm) | 600 | 601 | 601 | 600 | 602 | 602 |
| Avg. Rotary Speed (RPM) | 99 | 100 | 100 | 100 | 100 | 100 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at various flow rates, and a substantial portion of the impactors had a mean diameter of about 0.075 in, as noted above. At least five data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 |
|---|---|---|---|---|---|
| Avg. Confined Pressure (psi) | 2904 | 2896 | 2894 | 2892 | 2894 |
| Avg. Overburden Stress (psi) | 4427 | 4426 | 4423 | 4422 | 4421 |
| Avg. Mud Temperature (F.) | 95.7 | 96.2 | 97.4 | 97.9 | 99.1 |
| Avg. Bore Pressure (psi) | 1936 | 1931 | 1903 | 1947 | 1956 |
| Avg. Swivel Pressure (psi) | 3689 | 3736 | 3752 | 3729 | 3727 |
| Avg. Torque (ft-lb) | 440 | 562 | 659 | 667 | 831 |
| Avg. Weight-On-Bit (lb) | 3197 | 7348 | 8423 | 9621 | 9616 |
| Avg. Rate-Of-Penetration (ft/hr) | 46.4 | 33.3 | 37.9 | 24.3 | 28.8 |
| Avg. Mud Flow Rate (gpm) | 602 | 603 | 603 | 603 | 603 |
| Avg. Rotary Speed (RPM) | 101 | 101 | 101 | 101 | 101 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at various flow rates, and a substantial portion of the impactors had a mean diameter of about 0.075 in, as noted above. At least five data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 |
|---|---|---|---|---|---|
| Avg. Confined Pressure (psi) | 2887 | 2884 | 2881 | 2873 | 2886 |
| Avg. Overburden Stress (psi) | 4406 | 4407 | 4403 | 4394 | 4393 |
| Avg. Mud Temperature (F.) | 85.9 | 86.8 | 87.8 | 89.3 | 91.3 |
| Avg. Bore Pressure (psi) | 1971 | 1982 | 2005 | 1988 | 2022 |
| Avg. Swivel Pressure (psi) | 3673 | 3670 | 3684 | 3668 | 3704 |
| Avg. Torque (ft-lb) | 441 | 1360 | 1229 | 1217 | 1190 |
| Avg. Weight-On-Bit (lb) | 3685 | 10817 | 11050 | 10972 | 11101 |
| Avg. Rate-Of-Penetration (ft/hr) | 26.4 | 41.7 | 33.8 | 34.1 | 34.0 |
| Avg. Mud Flow Rate (gpm) | 601 | 601 | 601 | 601 | 601 |
| Avg. Rotary Speed (RPM) | 101 | 100 | 100 | 100 | 100 |
| Avg. Impactor-Injection Flow Rate (gpm) | | | 12 | 13 | 12 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at the same flow rate. The impactors in the system 1 were injected into the drilling mud at 14 gpm, and a substantial portion of the impactors had a mean diameter of about 0.075 in, as noted above. At least five data points were taken during this experimental test, and the operating parameters for these data points are shown in the following table:

| OPERATING PARAMETER | DATA POINT #1 | DATA POINT #2 | DATA POINT #3 | DATA POINT #4 | DATA POINT #5 |
|---|---|---|---|---|---|
| Avg. Confined Pressure (psi) | 2918 | 2918 | 2917 | 2916 | 2913 |
| Avg. Overburden Stress (psi) | 4426 | 4427 | 4418 | 4415 | 4409 |
| Avg. Mud Temperature (F.) | 95.0 | 95.0 | 95.0 | 95.0 | 95.0 |
| Avg. Bore Pressure (psi) | 1685 | 1708 | 1747 | 1719 | 1700 |
| Avg. Swivel Pressure (psi) | 3523 | 3650 | 3535 | 3542 | 3539 |
| Avg. Torque (ft-lb) | 731 | 595 | 705 | 507 | 569 |
| Avg. Weight-On-Bit (lb) | 11269 | 11847 | 11514 | 11489 | 11395 |
| Avg. Rate-Of-Penetration (ft/hr) | 36.8 | 33.7 | 34.0 | 28.4 | 30.7 |
| Avg. Mud Flow Rate (gpm) | 601 | 601 | 601 | 601 | 601 |
| Avg. Rotary Speed (RPM) | 101 | 101 | 101 | 101 | 101 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In an exemplary experimental embodiment, an experimental test was conducted using the system 1 and the drill bit 110, which had a bit diameter of about 8.5 in, and which also included a fourth nozzle located in the side arm 214B, with the fourth nozzle being similar to the nozzle 200A or 200B. Locating the fourth nozzle in the side arm 214B was possible because a substantial portion of the impactors used in the exemplary experimental embodiment had a mean diameter of about 0.075 in, instead of a mean diameter that was greater than 0.100 in, thereby permitting the use of smaller-sized nozzles, thereby permitting two smaller-sized nozzles to be located in the side arm 214B. Sierra white granite, which has an unconfined compressive strength of at least about 28,000 psi, was penetrated with the drill bit 110. The sierra white granite was stressed so that the sierra white granite had a confined pressure (horizontal stress) and an overburden stress (vertical stress). The circulation fluid in the system 1 was in the form of conventional drilling mud, and was pumped to the drill bit 110 at about the same flow rate. The impactors in the system 1 were injected into the drilling mud at 14 gpm, and a substantial portion of the impactors had a mean diameter of about 0.075 in, as noted above. At least four data points were taken during this experimental test, and the operating parameters for these data points are shown in the following table:

| OPERATING PARAMETER | DATA POINT #1 | DATA POINT #2 | DATA POINT #3 | DATA POINT #4 |
|---|---|---|---|---|
| Avg. Confined Pressure (psi) | 2900 | 2896 | 2884 | 2891 |
| Avg. Overburden Stress (psi) | 4410 | 4401 | 4390 | 4394 |
| Avg. Mud Temperature (F.) | 82.3 | 83.3 | 84.3 | 85.6 |
| Avg. Bore Pressure (psi) | 1655 | 1682 | 1697 | 1698 |
| Avg. Swivel Pressure (psi) | 3373 | 3395 | 3395 | 3391 |
| Avg. Torque (ft-lb) | 938 | 916 | 1378 | 1381 |
| Avg. Weight-On-Bit (lb) | 9074 | 9125 | 14398 | 14006 |
| Avg. Rate-Of-Penetration (ft/hr) | 40.1 | 34.0 | 41.1 | 40.0 |
| Avg. Mud Flow Rate (gpm) | 600 | 601 | 600 | 600 |
| Avg. Rotary Speed (RPM) | 100 | 100 | 99 | 99 |

The average weights-on-bit shown in the table above were unexpectedly less than average weights-on-bit of conventional drill bits and thus were unexpected results, the average torques shown in the table above were unexpectedly less than average torques of conventional drill bits and thus were unexpected results, and the average rates-of-penetration shown in the table above were unexpectedly greater than average rates-of-penetration of conventional drill bits and thus were unexpected results. Further, the respective combinations of the average weights-on-bit, the average torques, and the average rates-of-penetration shown in the table above, and/or any subcombinations thereof, were unexpected results. Still further, the respective combinations of the operating parameters shown in the table above, and/or any subcombinations thereof, were unexpected results. Also, no damage to the drill bit 110 was observed. This was an unexpected result.

In several exemplary embodiments, although the drill bits in all of the above-described exemplary experimental embodiments had an 8½ inch bit diameter, the above-described unexpected results, including the respective operating parameters for the drill bits, may be predictive of operating parameters for drill bits having other bit diameters such as, for example, a drill bit having a 7⅞ inch bit diameter. In several exemplary embodiments, although the drill bits in all of the above-described exemplary experimental embodiments had an 8½ inch bit diameter, the above-described unexpected results, including the respective operating parameters for the drill bits, may be predictive of operating parameters for drill bits having a wide range of bit diameters.

In an exemplary embodiment, the slurry feed of solid material impactors and drilling fluid to the pump contains from 50-90% by weight solid material impactors and from 10-50% by weight drilling fluids. In another exemplary embodiment, the slurry feed to the pump contains from 55-75% by weight solid material impactors and from 25-45% by weight drilling fluids. In another exemplary embodiment, the slurry feed to the pump contains from 58-65% by weight solid material impactors and from 35-42% by weight drilling fluids. In another exemplary embodiment, the slurry feed to the pump contains approximately 62% by weight solid material impactors and approximately 38% by weight drilling fluids.

In an exemplary embodiment, the feed rate of impactors to the cement pump is at least 2 gal/min. In another exemplary embodiment, the feed rate of impactors to the cement pump is at least 10 gal/min. In yet another exemplary embodiment, the feed rate of impactors to the cement pump is at least 15 gal/min. In yet another exemplary embodiment, the feed rate of impactors to the cement pump is at least 20 gal/min. In yet another exemplary embodiment, the feed rate of impactors to the cement pump is at least 30 gal/min. In yet another exemplary embodiment, the feed rate of impactors to the cement pump is at least 40 gal/min. In yet another exemplary embodiment, the feed rate of impactors to the cement pump is at least 50 gal/min.

In an exemplary experimental embodiment, an test was conducted using a Schwing BP8800 concrete pump for injection of a slurry of solid material impactors. The concrete pump was operated at 2,100 RPM, a piston pressure of 4,900 psi, a high cylinder pressure of 3,900 psi and a low cylinder pressure of 1,700 psi. The concrete pump was able to inject the slurry of solid material impactors at a rate of up to 17.0 gpm at a standpipe pressure of greater than 3,000 psi.

A system for injecting a suspension of liquid and a plurality of impactors into a flow region having a first pressure has been described that includes a vessel; a first valve fluidicly coupled to the vessel and movable from a closed position to an open position in which fluid is permitted to flow into the vessel; pressurizing means fluidicly coupled to the vessel for pressurizing the vessel to a second pressure that is greater than the first pressure; and a second valve fluidicly coupled to the vessel and movable from a closed position to an open position in which the vessel is permitted to inject the suspension into the flow region at a third pressure that is greater than the first pressure. In an exemplary embodiment, the system comprises a fluid reservoir; and a pump fluidicly coupled to the fluid reservoir and the flow region for passing fluid from the fluid reservoir and through the flow region wherein the fluid flows through the flow region at the first pressure. In an exemplary embodiment, the system comprises means fluidicly coupled between the pump and the flow region for reducing the pressure of the fluid flow in the flow region to the first pressure. In an exemplary embodiment, the pump is fluidicly coupled to the first valve so that, when the first valve is in its open position, the pump passes fluid from the fluid reservoir and to the vessel. In an exemplary embodiment, the system comprises an impactor reservoir connected to the vessel. In an exemplary embodiment, the system comprises a third valve connected between the impactor reservoir and the vessel and movable from an open position in which charging of the vessel with the plurality of impactors to form the suspension is permitted, and to a closed position in which the charging of the vessel with the plurality of impactors is prevented. In an exemplary embodiment, the vessel comprises a first configuration in which the first valve is in its closed position, the second valve is in its closed position, and the third valve is in its open position so that the charging of the vessel with the plurality of impactors to form the suspension is permitted. In an exemplary embodiment, the vessel further comprises a second configuration in which the first, second and third valves are in their respective closed positions so that the pressurizing means is able to increase the pressure in the vessel. In an exemplary embodiment, the vessel further comprises a third configuration in which the first valve is in its open position to permit the pump to pass fluid from the fluid reservoir and to the vessel; and the second valve is in its open position to permit the vessel to inject the suspension into the flow region at the third pressure. In an exemplary embodiment, the pressurizing means comprises a cylinder. In an exemplary embodiment, the third pressure is substantially equal to the second pressure. In an exemplary embodiment, the third pressure is less than the second pressure. In an exemplary embodiment, the third pressure is greater than the second pressure. In an exemplary embodiment, a flow of the suspension in the flow region is produced in response to the injection of the suspension into the flow region; and the system further comprises means for accelerating the velocity of and discharging the flow of the suspension. In an exemplary embodiment, a portion of a subterranean formation is removed in response to the discharge of the flow of the suspension. In an exemplary embodiment, the system comprises a second vessel; a fourth valve fluidicly coupled to the second vessel and movable from a closed position to an open position in which fluid is permitted to flow into the second vessel; a second pressurizing means fluidicly coupled to the second vessel for pressurizing the second vessel to the second pressure; and a fifth valve fluidicly coupled to the second vessel and movable from a closed position to an open position in which the second vessel is permitted to inject a second suspension of liquid and a plurality of impactors into the flow region at the third pressure. In an exemplary embodiment, the system comprises a third vessel; a sixth valve fluidicly coupled to the third vessel and movable from a closed position to an open position in which fluid is permitted to flow into the second vessel; a third pressurizing means fluidicly coupled to the third vessel for pressurizing the third vessel to the second pressure; and a seventh valve fluidicly coupled to the third vessel and movable from a closed position to an open position in which the second vessel is permitted to inject a third suspension of liquid and a plurality of impactors into the flow region at the third pressure.

A method has been described that includes charging at least a first vessel with a plurality of impactors during at least a portion of a first time period; pressurizing at least a second vessel during at least a portion of the first time period; and permitting at least a third vessel to inject a suspension of liquid and a plurality of impactors into a flow region during at least a portion of the first time period. In an exemplary embodiment, the method comprises pressurizing the at least a first vessel during at least a portion of a second time period; permitting the at least a second vessel to inject a suspension of liquid and a plurality of impactors into the flow region during at least a portion of the second time period; and charging the at least a third vessel with a plurality of impactors during at least a portion of the second time period. In an exemplary embodiment, the method comprises permitting the at least a first vessel to inject a suspension of liquid and a plurality of impactors into the flow region during at least a portion of a third time period; charging the at least a second vessel with a plurality of impactors during at least a portion of the third time period; and pressurizing the at least a third vessel during at least a portion of the third time period. In an exemplary embodiment, a constant flow of a suspension of liquid and a plurality of impactors is produced in the flow region in response to permitting the at least a third vessel to inject a suspension of liquid and a plurality of impactors into the flow region during at least a portion of the first time period, permitting the at least a second vessel to inject a suspension of liquid and a plurality of impactors into the flow region during at least a portion of the second time period, and permitting the at least a first vessel to inject a suspension of liquid and a plurality of impactors during at least a portion of the third time period. In an exemplary embodiment, the method comprises accelerating the velocity of the constant flow of a suspension of liquid and a plurality of impactors; and discharging the constant flow of a suspension of liquid and a plurality of impactors to remove a portion of a subterranean formation. In an exemplary embodiment, the method comprises permitting liquid to flow through the flow region at a first pressure; wherein pressurizing the at least a second vessel during at least a portion of the first time period comprises pressurizing the at least a second vessel during at least a portion of the first time period to a second pressure that is greater than the first pressure. In an exemplary embodiment, permitting the at least a third vessel to inject a suspension of liquid and a plurality of impactors into the flow region during at least a portion of the first time period comprises permitting the at least a third vessel to inject a suspension of liquid and a plurality of impactors into the flow region during at least a portion of the first time period so that the suspension of liquid and a plurality of impactors is injected into the flow region at a third pressure that is greater than the first pressure. In an exemplary embodiment, the method comprises the third pressure is substantially equal to the second pressure. In an exemplary embodiment, the method comprises the third pressure is less than the second pressure. In an exemplary embodiment, the method comprises the third pressure is greater than the second pressure. In an exemplary embodiment, the method comprises accelerating the velocity of the suspension of liquid and a plurality of impactors; and discharging the suspension of liquid and a plurality of impactors to remove a portion of a subterranean formation.

A system has been described that includes means for charging at least a first vessel with a plurality of impactors during at least a portion of a first time period; means for pressurizing at least a second vessel during at least a portion of the first time period; and means for permitting at least a third vessel to inject a suspension of liquid and a plurality of impactors into a flow region during at least a portion of the first time period. In an exemplary embodiment, the system comprises means for pressurizing the at least a first vessel during at least a portion of a second time period; means for permitting the at least a second vessel to inject a suspension of liquid and a plurality of impactors into the flow region during at least a portion of the second time period; and means for charging the at least a third vessel with a plurality of impactors during at least a portion of the second time period. In an exemplary embodiment, the system comprises means for permitting the at least a first vessel to inject a suspension of liquid and a plurality of impactors during at least a portion of a third time period; means for charging the at least a second vessel with a plurality of impactors during at least a portion of the third time period; and means for pressurizing the at least a third vessel during at least a portion of the third time period. In an exemplary embodiment, a constant flow of a suspension of liquid and a plurality of impactors is produced in the flow region in response to permitting the at least a third vessel to inject a suspension of liquid and a plurality of impactors into the flow region during at least a portion of the first time period, permitting the at least a second vessel to inject a suspension of liquid and a plurality of impactors into the flow region during at least a portion of the second time period, and permitting the at least a first vessel to inject a suspension of liquid and a plurality of impactors during at least a portion of the third time period. In an exemplary embodiment, the system comprises means for accelerating the velocity of and discharging the constant flow of a suspension of liquid and a plurality of impactors wherein a subterranean formation is removed in response to the discharge of the constant flow of a suspension of liquid and a plurality of impactors. In an exemplary embodiment, the system comprises means for permitting liquid to flow through the flow region at a first pressure; wherein the means for pressurizing the at least a second vessel during at least a portion of the first time period comprises means for pressurizing the at least a second vessel during at least a portion of the first time period to a second pressure that is greater than the first pressure. In an exemplary embodiment, the means for permitting the at least a third vessel to inject a suspension of liquid and a plurality of impactors into the flow region during at least a portion of the first time period comprises means for permitting the at least a third vessel to inject a suspension of liquid and a plurality of impactors into the flow region during at least a portion of the first time period so that the suspension of liquid and a plurality of impactors is injected into the flow region at a third pressure that is greater than the first pressure. In an exemplary embodiment, the system comprises the third pressure is substantially equal to the second pressure. In an exemplary embodiment, the system comprises the third pressure is less than the second pressure. In an exemplary embodiment, the system comprises the third pressure is greater than the second pressure. In an exemplary embodiment, the system comprises means for accelerating the velocity of and discharging the suspension of liquid and a plurality of impactors; wherein a portion of a subterranean formation is removed in response to the discharge of the suspension of liquid and a plurality of impactors.

A method of injecting a suspension of liquid and a plurality of impactors into a flow region having a first pressure has been described that includes charging a vessel with the plurality of impactors to form the suspension of liquid and the plurality impactors in the vessel; pressurizing the vessel to a second pressure that is greater than the first pressure; and permitting the vessel to inject the suspension of liquid and the plurality of impactors into the flow region at a third pressure that is greater than the first pressure. In an exemplary embodiment, a flow of the suspension of liquid and the plurality of impactors in the flow region is produced in response to permitting the vessel to inject the suspension of liquid and the plurality of impactors into the flow region at a third pressure that is greater than the first pressure; and the method comprises accelerating the velocity of the flow of the suspension of liquid and the plurality of impactors. In an exemplary embodiment, the method comprises discharging the flow of the suspension of liquid and the plurality of impactors to remove a portion of a subterranean formation. In an exemplary embodiment, the method comprises the third pressure is substantially equal to the second pressure. In an exemplary embodiment, the method comprises the third pressure is less than the second pressure. In an exemplary embodiment, the method comprises the third pressure is greater than the second pressure. In an exemplary embodiment, the method comprises permitting a second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel; and pressurizing a third vessel to the second pressure during at least a portion of charging the first-mentioned vessel with a plurality of impactors to form a suspension of liquid and the plurality impactors in the first-mentioned vessel. In an exemplary embodiment, the method comprises charging the second vessel with a plurality of impactors during at least a portion of pressurizing the first-mentioned vessel to a second pressure that is greater than the first pressure; and permitting the third vessel to inject a suspension of liquid and a plurality of impactors into the flow region at the third pressure during at least a portion of pressurizing the first-mentioned vessel to a second pressure that is greater than the first pressure. In an exemplary embodiment, the method comprises pressurizing the second vessel to the second pressure during at least a portion of permitting the first-mentioned vessel to inject the suspension of liquid and the plurality of impactors into the flow region at a third pressure that is greater than the first pressure; and charging the third vessel with a plurality of impactors during at least a portion of permitting the first-mentioned vessel to inject the suspension of liquid and the plurality of impactors into the flow region at a third pressure that is greater than the first pressure. In an exemplary embodiment, a constant flow of a suspension of liquid and a plurality of impactors is produced in the flow region in response to permitting the first-mentioned vessel to inject the suspension of liquid and the plurality of impactors into the flow region at a third pressure that is greater than the first pressure, permitting the second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel, and permitting the third vessel to inject a suspension of liquid and a plurality of impactors into the flow region at the third pressure during at least a portion of pressurizing the first-mentioned vessel to a second pressure that is greater than the first pressure. In an exemplary embodiment, the method comprises accelerating the velocity of the constant flow of a suspension of liquid and a plurality of impactors; and discharging the constant flow of a suspension of liquid and a plurality of impactors to remove a portion of a subterranean formation.

A system for injecting a suspension of liquid and a plurality of impactors into a flow region having a first pressure has been described that includes means for charging a vessel with the plurality of impactors to form the suspension of liquid and the plurality impactors in the vessel; means for pressurizing the vessel to a second pressure that is greater than the first pressure; and means for permitting the vessel to inject the suspension of liquid and the plurality of impactors into the flow region at a third pressure that is greater than the first pressure. In an exemplary embodiment, a flow of the suspension of liquid and the plurality of impactors in the flow region is produced in response to permitting the vessel to inject the suspension of liquid and the plurality of impactors into the flow region at a third pressure that is greater than the first pressure; and the system further comprises means for accelerating the velocity of the flow of the suspension of liquid and the plurality of impactors. In an exemplary embodiment, the system comprises means for discharging the flow of the suspension of liquid and the plurality of impactors to remove a portion of a subterranean formation. In an exemplary embodiment, the system comprises the third pressure is substantially equal to the second pressure. In an exemplary embodiment, the system comprises the third pressure is less than the second pressure. In an exemplary embodiment, the system comprises the third pressure is greater than the second pressure. In an exemplary embodiment, the system comprises means for permitting a second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel; and means for pressurizing a third vessel to the second pressure during at least a portion of charging the first-mentioned vessel with a plurality of impactors to form a suspension of liquid and the plurality impactors in the first-mentioned vessel. In an exemplary embodiment, the system comprises means for charging the second vessel with a plurality of impactors during at least a portion of pressurizing the first-mentioned vessel to a second pressure that is greater than the first pressure; and means for permitting the third vessel to inject a suspension of liquid and a plurality of impactors into the flow region at the third pressure during at least a portion of pressurizing the first-mentioned vessel to a second pressure that is greater than the first pressure. In an exemplary embodiment, the system comprises means for pressurizing the second vessel to the second pressure during at least a portion of permitting the first-mentioned vessel to inject the suspension of liquid and the plurality of impactors into the flow region at a third pressure that is greater than the first pressure; and means for charging the third vessel with a plurality of impactors during at least a portion of permitting the first-mentioned vessel to inject the suspension of liquid and the plurality of impactors into the flow region at a third pressure that is greater than the first pressure. In an exemplary embodiment, the system comprises a constant flow of a suspension of liquid and a plurality of impactors is produced in the flow region in response to permitting the first-mentioned vessel to inject the suspension of liquid and the plurality of impactors into the flow region at a third pressure that is greater than the first pressure, permitting the second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel, and permitting the third vessel to inject a suspension of liquid and a plurality of impactors into the flow region at the third pressure during at least a portion of pressurizing the first-mentioned vessel to a second pressure that is greater than the first pressure. In an exemplary embodiment, the system comprises means for accelerating the velocity of and discharging the constant flow of a suspension of liquid and a plurality of impactors; wherein a portion of a subterranean formation is removed in response to the discharge of the constant flow of a suspension of liquid and a plurality of impactors.

A system for injecting a suspension of liquid and a plurality of impactors into a flow region having a first pressure has been described that includes a pump; first, second and third vessels, wherein a first valve is fluidicly coupled between the pump and each of the first, second and third vessels; a pressurizing means is fluidicly coupled to each of the first, second and third vessels for pressurizing the respective vessel to a second pressure that is greater than the first pressure; and a second valve is coupled to each of the first, second and third vessels; wherein each of the first valves is movable from a closed position to an open position in which the pump is permitted to pass fluid to the respective vessel; and wherein each of the second valves is movable from a closed position to an open position in which the respective vessel is permitted to inject at least a portion of the suspension into the flow region at a third pressure that is greater than the first pressure. In an exemplary embodiment, the system comprises a fluid reservoir to which the pump is fluidicly coupled, wherein the pump is adapted to pass fluid from the fluid reservoir and through the flow region, and wherein the fluid flows through the flow region at the first pressure. In an exemplary embodiment, the system comprises means fluidicly coupled between the pump and the flow region for reducing the pressure of the fluid flow in the flow region to the first pressure. In an exemplary embodiment, the system comprises an impactor reservoir; wherein a third valve is connected between the impactor reservoir and each of the first, second and third vessels, each of the third valves being movable from an open position in which charging of the respective vessel with at least a portion of the plurality of impactors to form at least a portion of the suspension is permitted, and to a closed position in which the charging of the respective vessel is prevented. In an exemplary embodiment, each of the first, second and third vessels comprises a first configuration in which the respective first valve is in its closed position, the respective second valve is in its closed position, and the respective third valve is in its open position so that the charging of the vessel with at least a portion of the plurality of impactors to form at least a portion of the suspension is permitted. In an exemplary embodiment, each of the first, second and third vessels further comprises a second configuration in which the respective first, second and third valves are in their respective closed positions so that the pressurizing means is able to increase the pressure in the respective vessel. In an exemplary embodiment, each of the first, second and third vessels further comprises a third configuration in which the respective first valve is in its open position to permit the pump to pass fluid from the fluid reservoir and to the respective vessel; and the respective second valve is in its open position to permit the respective vessel to inject the at least a portion of the suspension into the flow region at the third pressure. In an exemplary embodiment, the pressurizing means comprises a cylinder. In an exemplary embodiment, the system comprises the third pressure is substantially equal to the second pressure. In an exemplary embodiment, the system comprises the third pressure is less than the second pressure. In an exemplary embodiment, the system comprises the third pressure is greater than the second pressure. In an exemplary embodiment, a flow of the suspension in the flow region is produced in response to the respective injections; and wherein the system further comprises means for accelerating the velocity of and discharging the flow of the suspension. In an exemplary embodiment, a portion of a subterranean formation is removed in response to the discharge of the flow of the suspension.

A system for injecting a suspension of liquid and a plurality of impactors into a flow region having a first pressure has been described that includes a vessel; a first valve fluidicly coupled to the vessel and movable from a closed position to an open position in which fluid is permitted to flow into the vessel; pressurizing means fluidicly coupled to the vessel for pressurizing the vessel to a second pressure that is greater than the first pressure; a second valve fluidicly coupled to the vessel and movable from a closed position to an open position in which the vessel is permitted to inject the suspension into the flow region at a third pressure that is greater than the first pressure; a fluid reservoir; a pump fluidicly coupled to the fluid reservoir and the flow region for passing fluid from the fluid reservoir and through the flow region wherein the fluid flows through the flow region at the first pressure; means fluidicly coupled between the pump and the flow region for reducing the pressure of the fluid flow in the flow region to the first pressure, wherein the pump is fluidicly coupled to the first valve so that, when the first valve is in its open position, the pump passes fluid from the fluid reservoir and to the vessel; an impactor reservoir connected to the vessel; a third valve connected between the impactor reservoir and the vessel and movable from an open position in which charging of the vessel with the plurality of impactors to form the suspension is permitted, and to a closed position in which the charging of the vessel with the plurality of impactors is prevented; wherein the vessel comprises a first configuration in which the first valve is in its closed position, the second valve is in its closed position, and the third valve is in its open position so that the charging of the vessel with the plurality of impactors to form the suspension is permitted; wherein the vessel further comprises a second configuration in which the first, second and third valves are in their respective closed positions so that the pressurizing means is able to increase the pressure in the vessel; wherein the vessel further comprises a third configuration in which the first valve is in its open position to permit the pump to pass fluid from the fluid reservoir and to the vessel; and the second valve is in its open position to permit the vessel to inject the suspension into the flow region at the third pressure; wherein the pressurizing means comprises a cylinder; wherein the third pressure is substantially equal to, less than, or greater than the second pressure; wherein a flow of the suspension in the flow region is produced in response to the injection of the suspension into the flow region; and wherein the system further comprises means for accelerating the velocity of and discharging the flow of the suspension; wherein a portion of a subterranean formation is removed in response to the discharge of the flow of the suspension.

A method has been described that includes charging at least a first vessel with a plurality of impactors during at least a portion of a first time period; pressurizing at least a second vessel during at least a portion of the first time period; permitting at least a third vessel to inject a suspension of liquid and a plurality of impactors into a flow region during at least a portion of the first time period; pressurizing the at least a first vessel during at least a portion of a second time period; permitting the at least a second vessel to inject a suspension of liquid and a plurality of impactors into the flow region during at least a portion of the second time period; charging the at least a third vessel with a plurality of impactors during at least a portion of the second time period; permitting the at least a first vessel to inject a suspension of liquid and a plurality of impactors into the flow region during at least a portion of a third time period; charging the at least a second vessel with a plurality of impactors during at least a portion of the third time period; pressurizing the at least a third vessel during at least a portion of the third time period; wherein a constant flow of a suspension of liquid and a plurality of impactors is produced in the flow region in response to permitting the at least a third vessel to inject a suspension of liquid and a plurality of impactors into the flow region during at least a portion of the first time period, permitting the at least a second vessel to inject a suspension of liquid and a plurality of impactors into the flow region during at least a portion of the second time period, and permitting the at least a first vessel to inject a suspension of liquid and a plurality of impactors during at least a portion of the third time period; wherein the method further comprises accelerating the velocity of the constant flow of a suspension of liquid and a plurality of impactors; discharging the constant flow of a suspension of liquid and a plurality of impactors to remove a portion of a subterranean formation; permitting liquid to flow through the flow region at a first pressure, wherein pressurizing the at least a second vessel during at least a portion of the first time period comprises pressurizing the at least a second vessel during at least a portion of the first time period to a second pressure that is greater than the first pressure; wherein permitting the at least a third vessel to inject a suspension of liquid and a plurality of impactors into the flow region during at least a portion of the first time period comprises permitting the at least a third vessel to inject a suspension of liquid and a plurality of impactors into the flow region during at least a portion of the first time period so that the suspension of liquid and a plurality of impactors is injected into the flow region at a third pressure that is greater than the first pressure; and wherein the third pressure is substantially equal to, less than, or greater than the second pressure.

A system has been described that includes means for charging at least a first vessel with a plurality of impactors during at least a portion of a first time period; means for pressurizing at least a second vessel during at least a portion of the first time period; means for permitting at least a third vessel to inject a suspension of liquid and a plurality of impactors into a flow region during at least a portion of the first time period; means for pressurizing the at least a first vessel during at least a portion of a second time period; means for permitting the at least a second vessel to inject a suspension of liquid and a plurality of impactors into the flow region during at least a portion of the second time period; means for charging the at least a third vessel with a plurality of impactors during at least a portion of the second time period; means for permitting the at least a first vessel to inject a suspension of liquid and a plurality of impactors during at least a portion of a third time period; means for charging the at least a second vessel with a plurality of impactors during at least a portion of the third time period; and means for pressurizing the at least a third vessel during at least a portion of the third time period; wherein a constant flow of a suspension of liquid and a plurality of impactors is produced in the flow region in response to permitting the at least a third vessel to inject a suspension of liquid and a plurality of impactors into the flow region during at least a portion of the first time period, permitting the at least a second vessel to inject a suspension of liquid and a plurality of impactors into the flow region during at least a portion of the second time period, and permitting the at least a first vessel to inject a suspension of liquid and a plurality of impactors during at least a portion of the third time period; wherein the system further comprises means for accelerating the velocity of and discharging the constant flow of a suspension of liquid and a plurality of impactors, wherein a subterranean formation is removed in response to the discharge of the constant flow of a suspension of liquid and a plurality of impactors; and means for permitting liquid to flow through the flow region at a first pressure, wherein the means for pressurizing the at least a second vessel during at least a portion of the first time period comprises means for pressurizing the at least a second vessel during at least a portion of the first time period to a second pressure that is greater than the first pressure; wherein the means for permitting the at least a third vessel to inject a suspension of liquid and a plurality of impactors into the flow region during at least a portion of the first time period comprises means for permitting the at least a third vessel to inject a suspension of liquid and a plurality of impactors into the flow region during at least a portion of the first time period so that the suspension of liquid and a plurality of impactors is injected into the flow region at a third pressure that is greater than the first pressure; and wherein the third pressure is substantially equal to, less than or greater than the second pressure.

A method of injecting a suspension of liquid and a plurality of impactors into a flow region having a first pressure has been described that includes charging a vessel with the plurality of impactors to form the suspension of liquid and the plurality impactors in the vessel; pressurizing the vessel to a second pressure that is greater than the first pressure; and permitting the vessel to inject the suspension of liquid and the plurality of impactors into the flow region at a third pressure that is greater than the first pressure; wherein a flow of the suspension of liquid and the plurality of impactors in the flow region is produced in response to permitting the vessel to inject the suspension of liquid and the plurality of impactors into the flow region at a third pressure that is greater than the first pressure; wherein the method further comprises accelerating the velocity of the flow of the suspension of liquid and the plurality of impactors; discharging the flow of the suspension of liquid and the plurality of impactors to remove a portion of a subterranean formation; wherein the third pressure is substantially equal to, less than or greater than the second pressure; wherein the method further comprises permitting a second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel; pressurizing a third vessel to the second pressure during at least a portion of charging the first-mentioned vessel with a plurality of impactors to form a suspension of liquid and the plurality impactors in the first-mentioned vessel; charging the second vessel with a plurality of impactors during at least a portion of pressurizing the first-mentioned vessel to a second pressure that is greater than the first pressure; permitting the third vessel to inject a suspension of liquid and a plurality of impactors into the flow region at the third pressure during at least a portion of pressurizing the first-mentioned vessel to a second pressure that is greater than the first pressure; pressurizing the second vessel to the second pressure during at least a portion of permitting the first-mentioned vessel to inject the suspension of liquid and the plurality of impactors into the flow region at a third pressure that is greater than the first pressure; and charging the third vessel with a plurality of impactors during at least a portion of permitting the first-mentioned vessel to inject the suspension of liquid and the plurality of impactors into the flow region at a third pressure that is greater than the first pressure; wherein a constant flow of a suspension of liquid and a plurality of impactors is produced in the flow region in response to permitting the first-mentioned vessel to inject the suspension of liquid and the plurality of impactors into the flow region at a third pressure that is greater than the first pressure, permitting the second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel, and permitting the third vessel to inject a suspension of liquid and a plurality of impactors into the flow region at the third pressure during at least a portion of pressurizing the first-mentioned vessel to a second pressure that is greater than the first pressure.

A system for injecting a suspension of liquid and a plurality of impactors into a flow region having a first pressure has been described that includes means for charging a vessel with the plurality of impactors to form the suspension of liquid and the plurality impactors in the vessel; means for pressurizing the vessel to a second pressure that is greater than the first pressure; and means for permitting the vessel to inject the suspension of liquid and the plurality of impactors into the flow region at a third pressure that is greater than the first pressure; wherein a flow of the suspension of liquid and the plurality of impactors in the flow region is produced in response to permitting the vessel to inject the suspension of liquid and the plurality of impactors into the flow region at a third pressure that is greater than the first pressure; wherein the system further comprises means for accelerating the velocity of the flow of the suspension of liquid and the plurality of impactors; and means for discharging the flow of the suspension of liquid and the plurality of impactors to remove a portion of a subterranean formation; wherein the third pressure is substantially equal to, less than or greater than the second pressure; wherein the system further comprises means for permitting a second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel; means for pressurizing a third vessel to the second pressure during at least a portion of charging the first-mentioned vessel with a plurality of impactors to form a suspension of liquid and the plurality impactors in the first-mentioned vessel; means for charging the second vessel with a plurality of impactors during at least a portion of pressurizing the first-mentioned vessel to a second pressure that is greater than the first pressure; means for permitting the third vessel to inject a suspension of liquid and a plurality of impactors into the flow region at the third pressure during at least a portion of pressurizing the first-mentioned vessel to a second pressure that is greater than the first pressure; means for pressurizing the second vessel to the second pressure during at least a portion of permitting the first-mentioned vessel to inject the suspension of liquid and the plurality of impactors into the flow region at a third pressure that is greater than the first pressure; and means for charging the third vessel with a plurality of impactors during at least a portion of permitting the first-mentioned vessel to inject the suspension of liquid and the plurality of impactors into the flow region at a third pressure that is greater than the first pressure; and wherein a constant flow of a suspension of liquid and a plurality of impactors is produced in the flow region in response to permitting the first-mentioned vessel to inject the suspension of liquid and the plurality of impactors into the flow region at a third pressure that is greater than the first pressure, permitting the second vessel to inject a suspension of liquid and a plurality of impactors into the flow region at the third pressure during at least a portion of charging the first-mentioned vessel with a plurality of impactors to form a suspension of liquid and the plurality impactors in the first-mentioned vessel, and permitting the third vessel to inject a suspension of liquid and a plurality of impactors into the flow region at the third pressure during at least a portion of pressurizing the first-mentioned vessel to a second pressure that is greater than the first pressure.

A system for injecting a suspension of liquid and a plurality of impactors into a flow region having a first pressure has been described that includes a pump; first, second and third vessels, wherein a first valve is fluidicly coupled between the pump and each of the first, second and third vessels; a pressurizing means is fluidicly coupled to each of the first, second and third vessels for pressurizing the respective vessel to a second pressure that is greater than the first pressure; and a second valve is coupled to each of the first, second and third vessels; wherein each of the first valves is movable from a closed position to an open position in which the pump is permitted to pass fluid to the respective vessel; and wherein each of the second valves is movable from a closed position to an open position in which the respective vessel is permitted to inject at least a portion of the suspension into the flow region at a third pressure that is greater than the first pressure; wherein the system further comprises a fluid reservoir to which the pump is fluidicly coupled, wherein the pump is adapted to pass fluid from the fluid reservoir and through the flow region, and wherein the fluid flows through the flow region at the first pressure; means fluidicly coupled between the pump and the flow region for reducing the pressure of the fluid flow in the flow region to the first pressure; and an impactor reservoir; wherein a third valve is connected between the impactor reservoir and each of the first, second and third vessels, each of the third valves being movable from an open position in which charging of the respective vessel with at least a portion of the plurality of impactors to form at least a portion of the suspension is permitted, and to a closed position in which the charging of the respective vessel is prevented; wherein each of the first, second and third vessels comprises a first configuration in which the respective first valve is in its closed position, the respective second valve is in its closed position, and the respective third valve is in its open position so that the charging of the vessel with at least a portion of the plurality of impactors to form at least a portion of the suspension is permitted; wherein each of the first, second and third vessels further comprises a second configuration in which the respective first, second and third valves are in their respective closed positions so that the pressurizing means is able to increase the pressure in the respective vessel; wherein each of the first, second and third vessels further comprises a third configuration in which the respective first valve is in its open position to permit the pump to pass fluid from the fluid reservoir and to the respective vessel; and the respective second valve is in its open position to permit the respective vessel to inject the at least a portion of the suspension into the flow region at the third pressure; wherein the pressurizing means comprises a cylinder; wherein the third pressure is substantially equal to, less than or greater than the second pressure; wherein a flow of the suspension in the flow region is produced in response to the respective injections; and wherein the system further comprises means for accelerating the velocity of and discharging the flow of the suspension, wherein a portion of a subterranean formation is removed in response to the discharge of the flow of the suspension.

A system for excavating a subterranean formation has been described that includes a source of impactors; a source of drilling fluid; a first vessel connected to the source of impactors; a first nozzle connected to the source of drilling fluid for discharging fluid into the first vessel to draw the impactors into the first vessel to form a suspension that is discharged from the first vessel; a second vessel connected to the first eductor for receiving the discharged suspension from the first eductor; a second nozzle connected to the source of drilling fluid for discharging fluid into the second vessel to draw the suspension into the second vessel to create another suspension that is discharged from the second vessel; and a body member for receiving the second suspension and discharging same to remove at least a portion of the formation. In an exemplary embodiment, the system comprises the impactors are drawn into the first vessel at a first pressure, and wherein the suspension is discharged from the first vessel at a second pressure that is greater than the first pressure. In an exemplary embodiment, the system comprises the first pressure is approximately atmospheric pressure. In an exemplary embodiment, the system comprises the body member has at least one cavity formed therein for receiving the second suspension and discharging same. In an exemplary embodiment, the system comprises a nozzle disposed in the cavity for discharging the second suspension at a relatively high velocity from the cavity and towards the formation to cut the formation.

A method for excavating a subterranean formation has been described that includes connecting a source of impactors to a first vessel; introducing fluid into the first vessel to draw the impactors into the first vessel to form a first suspension; discharging the first suspension from the first vessel and into a second vessel; introducing fluid into the second vessel to draw the impactors into the second vessel to form a second suspension; and discharging the second suspension from the second vessel and to the formation for removing a portion of the formation. In an exemplary embodiment, the method comprises the impactors are drawn into the first vessel at a first pressure and wherein the suspension is discharged from the first vessel at a second pressure that is greater than the first pressure. In an exemplary embodiment, the method comprises the first pressure is approximately atmospheric pressure. In an exemplary embodiment, the method comprises mechanically drilling the formation to remove another portion of the formation. In an exemplary embodiment, the step of discharging comprises passing the discharged second suspension into a cavity formed in a body member and adapted to direct the second suspension towards the formation to remove the portion of the formation. In an exemplary embodiment, the method comprises increasing the velocity of the second suspension as it discharges from the cavity towards the formation to cut the formation. In an exemplary embodiment, the method comprises the suspension is received in the second vessel at a pressure that is higher than it would be if it were not formed in the first vessel.

A system for excavating a subterranean formation has been described that includes a source of impactors; a source of drilling fluid; first means connected to the source of the impactors for receiving the impactors at a first pressure, the first means being connected to the source of the fluid for forming a first suspension of the impactors and the fluid at a second pressure that is greater than the first pressure; second means connected to the first means and to the fluid source for receiving the first suspension at the second pressure and for forming a second suspension of the impactors and the fluid at a third pressure that is greater than the second pressure; and a body member for receiving the second suspension discharging same to remove at least a portion of the formation. In an exemplary embodiment, the system comprises the impactors are received by the first means at a first pressure and wherein the suspension is received by the second means at a second pressure that is greater than the first pressure. In an exemplary embodiment, the system comprises the first pressure is approximately atmospheric pressure. In an exemplary embodiment, the system comprises the body member has at least one cavity formed therein for receiving the second suspension and discharging same. In an exemplary embodiment, the system comprises a nozzle disposed in the cavity for discharging the second suspension at a relatively high velocity from the cavity and towards the formation to cut the formation.

A system for excavating a subterranean formation has been described that includes a source of impactors; a source of drilling fluid; a first vessel connected to the source of impactors; a first nozzle connected to the source of drilling fluid for discharging fluid into the first vessel to draw the impactors into the first vessel to form a suspension that is discharged from the first vessel; a second vessel connected to the first eductor for receiving the discharged suspension from the first eductor; a second nozzle connected to the source of drilling fluid for discharging fluid into the second vessel to draw the suspension into the second vessel to create another suspension that is discharged from the second vessel; and a body member for receiving the second suspension and discharging same to remove at least a portion of the formation; wherein the impactors are drawn into the first vessel at a first pressure, and wherein the suspension is discharged from the first vessel at a second pressure that is greater than the first pressure; wherein the first pressure is approximately atmospheric pressure; wherein the body member has at least one cavity formed therein for receiving the second suspension and discharging same; and wherein the system further comprises a nozzle disposed in the cavity for discharging the second suspension at a relatively high velocity from the cavity and towards the formation to cut the formation.

A method for excavating a subterranean formation has been described that includes connecting a source of impactors to a first vessel; introducing fluid into the first vessel to draw the impactors into the first vessel to form a first suspension; discharging the first suspension from the first vessel and into a second vessel; introducing fluid into the second vessel to draw the impactors into the second vessel to form a second suspension; and discharging the second suspension from the second vessel and to the formation for removing a portion of the formation; wherein the impactors are drawn into the first vessel at a first pressure and wherein the suspension is discharged from the first vessel at a second pressure that is greater than the first pressure; wherein the first pressure is approximately atmospheric pressure; wherein the method further comprises mechanically drilling the formation to remove another portion of the formation; wherein the step of discharging comprises passing the discharged second suspension into a cavity formed in a body member and adapted to direct the second suspension towards the formation to remove the portion of the formation; wherein the method further comprises increasing the velocity of the second suspension as it discharges from the cavity towards the formation to cut the formation; and wherein the suspension is received in the second vessel at a pressure that is higher than it would be if it were not formed in the first vessel.

A system for excavating a subterranean formation has been described that includes a source of impactors; a source of drilling fluid; first means connected to the source of the impactors for receiving the impactors at a first pressure, the first means being connected to the source of the fluid for forming a first suspension of the impactors and the fluid at a second pressure that is greater than the first pressure; second means connected to the first means and to the fluid source for receiving the first suspension at the second pressure and for forming a second suspension of the impactors and the fluid at a third pressure that is greater than the second pressure; and a body member for receiving the second suspension discharging same to remove at least a portion of the formation; wherein the impactors are received by the first means at a first pressure and wherein the suspension is received by the second means at a second pressure that is greater than the first pressure; wherein the first pressure is approximately atmospheric pressure; wherein the body member has at least one cavity formed therein for receiving the second suspension and discharging same; and wherein the system further comprises a nozzle disposed in the cavity for discharging the second suspension at a relatively high velocity from the cavity and towards the formation to cut the formation.

A system for injecting particles into a flow region comprising a first pressure has been described that includes an injection system adapted to receive the particles at a second pressure that is less than the first pressure, the injection system at least partially defining a control volume within which a permeable media is adapted to be at least partially formed by at least a portion of the particles, the permeable media being adapted to create a pressure differential thereacross that is approximately equal to the difference between the first and second pressures during at least a portion of the injection of the particles into the flow region. In an exemplary embodiment, the injection system comprises one or more augers. In an exemplary embodiment, the injection system comprises one or more screw feeders. In an exemplary embodiment, the injection system comprises one or more pistons. In an exemplary embodiment, the injection system comprises one or more pumps. In an exemplary embodiment, the injection system comprises one or more concrete pumps. In an exemplary embodiment, the injection system comprises one or more extruders. In an exemplary embodiment, the particles comprise a plurality of solid material impactors. In an exemplary embodiment, the particles comprise proppant materials. In an exemplary embodiment, the second pressure is at or substantially near atmospheric pressure during the at least a portion of the injection of the particles into the flow region. In an exemplary embodiment, the particles comprise a first plurality of particles and a second plurality of particles, wherein the particles in the second plurality of particles are smaller in size than the particles in the first plurality of particles. In an exemplary embodiment, the first pressure ranges from about 1,000 psi to about 8,000 psi during the at least a portion of the injection of the particles into the flow region. In an exemplary embodiment, the pressure differential ranges from about 1,000 psi to about 8,000 psi during the at least a portion of the injection of the particles into the flow region. In an exemplary embodiment, the first pressure ranges from about 1,000 psi to about 8,000 psi during the at least a portion of the injection of the particles into the flow region; and wherein the second pressure is at or substantially near atmospheric pressure during the at least a portion of the injection of the particles into the flow region. In an exemplary embodiment, the pressure differential facilitates the operation of the injection system. In an exemplary embodiment, the method comprises a reservoir fluidicly coupled to the injection system for holding the particles. In an exemplary embodiment, the system comprises a drill string defining a fluid passage fluidicly coupled to the flow region. In an exemplary embodiment, the system comprises at least one nozzle fluidicly coupled to the flow region, and a drill bit in which the at least one nozzle is at least partially located. In an exemplary embodiment, the injection system comprises an inlet via which the particles enter the injection system; and an outlet fluidicly coupled between the inlet and the flow region; wherein the permeable media extends from about the inlet to about the outlet. In an exemplary embodiment, a fluid is adapted to flow through the flow region during the at least a portion of the injection of the particles into the flow region; wherein the permeable media is configured so that, if at least a portion of the fluid bleeds from the flow region, through the permeable media, and to the inlet during the at least a portion of the injection of the particles into the flow region, the bleed rate of the at least a portion of the fluid is less than or equal to about 6 gpm. In an exemplary embodiment, the permeable media is configured so that the bleed rate of any fluid flow from the flow region, through the permeable media, and to the inlet during the at least a portion of the injection of the particles into the flow region is less than or equal to about 6 gpm. In an exemplary embodiment, the permeability of the permeable media is less than or equal to about 32,000 md. In an exemplary embodiment, the permeability of the permeable media ranges from about 20,000±1,000 md to about 32,000±1,000 md. In an exemplary embodiment, the permeability of the permeable media is less than or equal to about 20,000 md. In an exemplary embodiment, the permeability of the permeable media is about 31,800 md. In an exemplary embodiment, the permeability of the permeable media is about 31,300 md. In an exemplary embodiment, the permeability of the permeable media is about 19,600 md.

A method has been described that includes providing an injection system comprising an inlet; receiving particles into the injection system via the inlet; injecting the particles into a flow region using the injection system, wherein the pressure in the flow region is greater than the pressure at the inlet; and forming a permeable media within the injection system using the particles, wherein the permeable media creates a pressure differential thereacross, the pressure differential being approximately equal to the difference between the pressure in the flow region and the pressure at the inlet during at least a portion of injecting the particles into the flow region using the injection system. In an exemplary embodiment, the method comprises filtering the particles before receiving the particles into the injection system via the inlet. In an exemplary embodiment, the injection system further comprises an outlet fluidicly coupled between the flow region and the inlet; and wherein the method further comprises cleaning at least an end of the outlet during injecting the particles into the flow region using the injection system. In an exemplary embodiment, the method comprises pumping a fluid through the flow region, wherein a suspension of the fluid and the particles is formed in response to injecting the particles into the flow region using the injection system; introducing the suspension into a drill bit; and discharging the suspension from the drill bit. In an exemplary embodiment, the method comprises adjusting the permeability of the permeable media. In an exemplary embodiment, adjusting the permeability of the permeable media comprises mixing a second plurality of particles with the first-mentioned particles, wherein the particles in the second plurality of particles are smaller in size than the first-mentioned particles. In an exemplary embodiment, the method comprises limiting the bleed rate of any fluid flow from the flow region, through the permeable media, and to the inlet to less than or equal to about 6 gpm. In an exemplary embodiment, the pressure in the flow region ranges from about 1,000 psi to about 8,000 psi during injecting the particles into the flow region using the injection system. In an exemplary embodiment, the pressure differential ranges from about 1,000 psi to about 8,000 psi during injecting the particles into the flow region using the injection system. In an exemplary embodiment, the pressure in the flow region ranges from about 1,000 psi to about 8,000 psi during injecting the particles into the flow region using the injection system; and wherein the pressure at the inlet is at or substantially near atmospheric pressure during injecting the particles into the flow region using the injection system. In an exemplary embodiment, the pressure differential facilitates injecting the particles into the flow region using the injection system. In an exemplary embodiment, the permeability of the permeable media is less than or equal to about 32,000 md. In an exemplary embodiment, the permeability of the permeable media ranges from about 20,000±1,000 md to about 32,000±1,000 md. In an exemplary embodiment, the permeability of the permeable media is less than or equal to about 20,000 md. In an exemplary embodiment, the permeability of the permeable media is about 31,800 md. In an exemplary embodiment, the permeability of the permeable media is about 31,300 md. In an exemplary embodiment, the permeability of the permeable media is about 19,600 md.

A system has been described that includes means for providing an injection system comprising an inlet; means for receiving particles into the injection system via the inlet; means for injecting the particles into a flow region using the injection system, wherein the pressure in the flow region is greater than the pressure at the inlet; and means for forming a permeable media within the injection system using the particles, wherein the permeable media creates a pressure differential thereacross, the pressure differential being approximately equal to the difference between the pressure in the flow region and the pressure at the inlet during at least a portion of injecting the particles into the flow region using the injection system. In an exemplary embodiment, the system comprises means for filtering the particles before receiving the particles into the injection system via the inlet. In an exemplary embodiment, the injection system comprises an outlet fluidicly coupled between the flow region and the inlet; and wherein the system further comprises means for cleaning at least an end of the outlet during injecting the particles into the flow region using the injection system. In an exemplary embodiment, the system comprises means for pumping a fluid through the flow region, wherein a suspension of the fluid and the particles is formed in response to injecting the particles into the flow region using the injection system; means for introducing the suspension into a drill bit; and means for discharging the suspension from the drill bit. In an exemplary embodiment, the system comprises means for adjusting the permeability of the permeable media. In an exemplary embodiment, means for adjusting the permeability of the permeable media comprises means for mixing a second plurality of particles with the first-mentioned particles, wherein the particles in the second plurality of particles are smaller in size than the first-mentioned particles. In an exemplary embodiment, the system comprises means for limiting the bleed rate of any fluid flow from the flow region, through the permeable media, and to the inlet to less than or equal to about 6 gpm. In an exemplary embodiment, the pressure in the flow region ranges from about 1,000 psi to about 8,000 psi during injecting the particles into the flow region using the injection system. In an exemplary embodiment, the pressure differential ranges from about 1,000 psi to about 8,000 psi during injecting the particles into the flow region using the injection system. In an exemplary embodiment, the pressure in the flow region ranges from about 1,000 psi to about 8,000 psi during injecting the particles into the flow region using the injection system; and wherein the pressure at the inlet is at or substantially near atmospheric pressure during injecting the particles into the flow region using the injection system. In an exemplary embodiment, the pressure differential facilitates injecting the particles into the flow region using the injection system. In an exemplary embodiment, the permeability of the permeable media is less than or equal to about 32,000 md. In an exemplary embodiment, the permeability of the permeable media ranges from about 20,000±1,000 md to about 32,000±1,000 md. In an exemplary embodiment, the permeability of the permeable media is less than or equal to about 20,000 md. In an exemplary embodiment, the permeability of the permeable media is about 31,800 md. In an exemplary embodiment, the permeability of the permeable media is about 31,300 md. In an exemplary embodiment, the permeability of the permeable media is about 19,600 md.

A system for injecting particles into a flow region comprising a first pressure has been described that includes an injection system adapted to receive the particles at a second pressure that is less than the first pressure, the injection system at least partially defining a control volume within which a permeable media is adapted to be at least partially formed by at least a portion of the particles, the permeable media being adapted to create a pressure differential thereacross that is approximately equal to the difference between the first and second pressures during at least a portion of the injection of the particles into the flow region; wherein the injection system comprises at least one of: one or more augers; one or more screw feeders; one or more pistons; one or more pumps; one or more concrete pumps; and one or more extruders; wherein the particles comprise at least one of: a plurality of solid material impactors; and proppant materials; wherein the second pressure is at or substantially near atmospheric pressure during the at least a portion of the injection of the particles into the flow region; wherein the first pressure ranges from about 1,000 psi to about 8,000 psi during the at least a portion of the injection of the particles into the flow region; wherein the pressure differential ranges from about 1,000 psi to about 8,000 psi during the at least a portion of the injection of the particles into the flow region; wherein the system further comprises a reservoir fluidicly coupled to the injection system for holding the particles; a drill string defining a fluid passage fluidicly coupled to the flow region; at least one nozzle fluidicly coupled to the fluid passage; and a drill bit in which the at least one nozzle is at least partially located; and wherein the injection system comprises an inlet via which the particles enter the injection system; and an outlet fluidicly coupled between the inlet and the flow region; wherein the permeable media is disposed between the inlet and the outlet.

A method has been described that includes providing an injection system comprising an inlet; receiving particles into the injection system via the inlet; injecting the particles into a flow region using the injection system, wherein the pressure in the flow region is greater than the pressure at the inlet; forming a permeable media within the injection system using the particles, wherein the permeable media creates a pressure differential thereacross, the pressure differential being approximately equal to the difference between the pressure in the flow region and the pressure at the inlet during at least a portion of injecting the particles into the flow region using the injection system; filtering the particles before receiving the particles into the injection system via the inlet; wherein the injection system further comprises an outlet fluidicly coupled between the flow region and the inlet; wherein the method further comprises pumping a fluid through the flow region, wherein a suspension of the fluid and the particles is formed in response to injecting the particles into the flow region using the injection system; introducing the suspension into a drill bit; and discharging the suspension from the drill bit; wherein the pressure differential ranges from about 1,000 psi to about 8,000 psi during injecting the particles into the flow region using the injection system; wherein the pressure in the flow region ranges from about 1,000 psi to about 8,000 psi during injecting the particles into the flow region using the injection system; and wherein the pressure at the inlet is at or substantially near atmospheric pressure during injecting the particles into the flow region using the injection system.

A system has been described that includes means for providing an injection system comprising an inlet; means for receiving particles into the injection system via the inlet; means for injecting the particles into a flow region using the injection system, wherein the pressure in the flow region is greater than the pressure at the inlet; means for forming a permeable media within the injection system using the particles, wherein the permeable media creates a pressure differential thereacross, the pressure differential being approximately equal to the difference between the pressure in the flow region and the pressure at the inlet during at least a portion of injecting the particles into the flow region using the injection system; and means for filtering the particles before receiving the particles into the injection system via the inlet; wherein the injection system further comprises an outlet fluidicly coupled between the flow region and the inlet; wherein the system further comprises means for pumping a fluid through the flow region, wherein a suspension of the fluid and the particles is formed in response to injecting the particles into the flow region using the injection system; means for introducing the suspension into a drill bit; and means for discharging the suspension from the drill bit; wherein the pressure differential ranges from about 1,000 psi to about 8,000 psi during injecting the particles into the flow region using the injection system; wherein the pressure in the flow region ranges from about 1,000 psi to about 8,000 psi during injecting the particles into the flow region using the injection system; and wherein the pressure at the inlet is at or substantially near atmospheric pressure during injecting the particles into the flow region using the injection system.

An apparatus for injecting particles into a flow region has been described that includes an injection system comprising an inlet via which the injection system is adapted to receive the particles; and a control volume at least partially defined by the injection system and within which a permeable media is at least partially formed by at least a portion of the particles; wherein a pressure differential is created by the permeable media during at least a portion of the injection of the particles into the flow region, the pressure differential being approximately equal to the difference between the pressure in the flow region and the pressure at the inlet. In an exemplary embodiment, the injection system comprises an extruder comprising a barrel comprising a bore fluidicly coupled to the inlet and adapted to be fluidicly coupled to the flow region; a screw feeder extending within the barrel; and a housing coupled to the barrel and comprising the inlet. In an exemplary embodiment, the control volume is at least partially defined by the inside surface of the barrel defined by the bore. In an exemplary embodiment, the screw feeder comprises a shaft and a thread extending thereabout, the control volume being at least partially defined between the inside surface of the barrel defined by the bore and the outside surface of the shaft. In an exemplary embodiment, the apparatus comprises a gearbox operably coupled to the shaft; and a motor operably coupled to the gearbox. In an exemplary embodiment, the barrel comprises a flange for coupling the extruder to a standpipe that defines the flow region. In an exemplary embodiment, the injection system comprises one or more augers. In an exemplary embodiment, the injection system comprises one or more screw feeders. In an exemplary embodiment, the injection system comprises one or more pistons. In an exemplary embodiment, the injection system comprises one or more pumps. In an exemplary embodiment, the injection system comprises one or more concrete pumps. In an exemplary embodiment, the particles comprise a plurality of solid material impactors. In an exemplary embodiment, the particles comprise proppant materials. In an exemplary embodiment, the pressure at the inlet is at or substantially near atmospheric pressure during the at least a portion of the injection of the particles into the flow region. In an exemplary embodiment, the particles comprise a first plurality of particles and a second plurality of particles, wherein the particles in the second plurality of particles are smaller in size than the particles in the first plurality of particles. In an exemplary embodiment, the pressure in the flow region ranges from about 1,000 psi to about 8,000 psi during the at least a portion of the injection of the particles into the flow region. In an exemplary embodiment, the pressure differential ranges from about 1,000 psi to about 8,000 psi during the at least a portion of the injection of the particles into the flow region. In an exemplary embodiment, the pressure in the flow region ranges from about 1,000 psi to about 8,000 psi during the at least a portion of the injection of the particles into the flow region; and wherein the pressure at the inlet is at or substantially near atmospheric pressure during the at least a portion of the injection of the particles into the flow region. In an exemplary embodiment, the pressure differential facilitates the operation of the injection system. In an exemplary embodiment, a fluid is adapted to flow through the flow region during the at least a portion of the injection of the particles into the flow region; wherein the permeable media is configured so that, if at least a portion of the fluid bleeds from the flow region, through the permeable media, and to the inlet during the at least a portion of the injection of the particles into the flow region, the bleed rate of the at least a portion of the fluid is less than or equal to about 6 gpm. In an exemplary embodiment, the permeable media is configured so that the bleed rate of any fluid flow from the flow region, through the permeable media, and to the inlet during the at least a portion of the injection of the particles into the flow region is less than or equal to about 6 gpm. In an exemplary embodiment, the permeability of the permeable media is less than or equal to about 32,000 md. In an exemplary embodiment, the permeability of the permeable media ranges from about 20,000±1,000 md to about 32,000±1,000 md. In an exemplary embodiment, the permeability of the permeable media is less than or equal to about 20,000 md. In an exemplary embodiment, the permeability of the permeable media is about 31,800 md. In an exemplary embodiment, the permeability of the permeable media is about 31,300 md. In an exemplary embodiment, the permeability of the permeable media is about 19,600 md.

An apparatus for injecting particles into a flow region has been described that includes an injection system comprising an inlet via which the injection system is adapted to receive the particles; and a control volume at least partially defined by the injection system and within which a permeable media is at least partially formed by at least a portion of the particles; wherein a pressure differential is created by the permeable media during at least a portion of the injection of the particles into the flow region, the pressure differential being approximately equal to the difference between the pressure in the flow region and the pressure at the inlet; wherein the injection system comprises an extruder comprising a barrel comprising a bore fluidicly coupled to the inlet and adapted to be fluidicly coupled to the flow region; and a screw feeder extending within the barrel; wherein the screw feeder comprises a shaft and a thread extending thereabout, the control volume being at least partially defined between the inside surface of the barrel defined by the bore and the outside surface of the shaft; and wherein the apparatus further comprises a gearbox operably coupled to the shaft; and a motor operably coupled to the gearbox.

A method has been described that includes providing an injection system; fluidicly coupling a flow region to the injection system; substantially directly injecting particles into the flow region using the injection system; pumping a fluid through the flow region, wherein a suspension of the fluid and the particles is formed in response to injecting the particles into the flow region using the injection system; and introducing the suspension into a wellbore.

A system has been described that includes means for providing an injection system; means for fluidicly coupling a flow region to the injection system; means for substantially directly injecting particles into the flow region using the injection system; means for pumping a fluid through the flow region, wherein a suspension of the fluid and the particles is formed in response to injecting the particles into the flow region using the injection system; and means for introducing the suspension into a wellbore.

A method of excavating a subterranean formation comprising an average unconfined compressive strength of at least about 28,000 psi has been described that includes penetrating the subterranean formation with a drill bit, comprising rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 11,675 lb, an average torque of less than or equal to about 728 ft-lb, and an average rate-of-penetration of greater than or equal to about 29.9 ft/hr; a set of operating parameters comprising an average weight-on-bit of less than or equal to about 17,809 lb, an average torque of less than or equal to about 1,235 ft-lb, and an average rate-of-penetration of greater than or equal to about 34.2 ft/hr; a set of operating parameters comprising an average weight-on-bit of less than or equal to about 25,537 lb, an average torque of less than or equal to about 1,691 ft-lb, and an average rate-of-penetration of greater than or equal to about 40.9 ft/hr; a set of operating parameters comprising an average weight-on-bit of less than or equal to about 29,300 lb, an average torque of less than or equal to about 1,852 ft-lb, and an average rate-of-penetration of greater than or equal to about 45.2 ft/hr; a set of operating parameters comprising an average weight-on-bit of less than or equal to about 11,961 lb, an average torque of less than or equal to about 737 ft-lb, and an average rate-of-penetration of greater than or equal to about 31.9 ft/hr; a set of operating parameters comprising an average weight-on-bit of less than or equal to about 29,741 lb, an average torque of less than or equal to about 1,973 ft-lb, and an average rate-of-penetration of greater than or equal to about 43.2 ft/hr; a set of operating parameters comprising an average weight-on-bit of less than or equal to about 34,806 lb, an average torque of less than or equal to about 2,272 ft-lb, and an average rate-of-penetration of greater than or equal to about 45.7 ft/hr; a set of operating parameters comprising an average weight-on-bit of less than or equal to about 38,487 lb, an average torque of less than or equal to about 2,540 ft-lb, and an average rate-of-penetration of greater than or equal to about 51.7 ft/hr; a set of operating parameters comprising an average weight-on-bit of less than or equal to about 41,714 lb, an average torque of less than or equal to about 2,836 ft-lb, and an average rate-of-penetration of greater than or equal to about 53.4 ft/hr; a set of operating parameters comprising an average weight-on-bit of less than or equal to about 47,132 lb, an average torque of less than or equal to about 3,315 ft-lb, and an average rate-of-penetration of greater than or equal to about 57.9 ft/hr; a set of operating parameters comprising an average weight-on-bit of less than or equal to about 55,980 lb, an average torque of less than or equal to about 3,596 ft-lb, and an average rate-of-penetration of greater than or equal to about 52.0 ft/hr; and a set of operating parameters comprising an average weight-on-bit of less than or equal to about 68,880 lb, an average torque of less than or equal to about 4,135 ft-lb, and an average rate-of-penetration of greater than or equal to about 29.1 ft/hr.

A method of excavating a subterranean formation comprising an average unconfined compressive strength of at least about 9,800 psi has been described that includes penetrating the subterranean formation with a drill bit, comprising rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 25,720 lb, an average torque of less than or equal to about 3,374 ft-lb, and an average rate-of-penetration of greater than or equal to about 64.5 ft/hr; a set of operating parameters comprising an average weight-on-bit of less than or equal to about 39,141 lb, an average torque of less than or equal to about 4,290 ft-lb, and an average rate-of-penetration of greater than or equal to about 49.6 ft/hr; a set of operating parameters comprising an average weight-on-bit of less than or equal to about 10,710 lb, an average torque of less than or equal to about 1,694 ft-lb, and an average rate-of-penetration of greater than or equal to about 29.6 ft/hr; a set of operating parameters comprising an average weight-on-bit of less than or equal to about 19,993 lb, an average torque of less than or equal to about 2,841 ft-lb, and an average rate-of-penetration of greater than or equal to about 40.2 ft/hr; a set of operating parameters comprising an average weight-on-bit of less than or equal to about 25,889 lb, an average torque of less than or equal to about 2,851 ft-lb, and an average rate-of-penetration of greater than or equal to about 32.5 ft/hr; a set of operating parameters comprising an average weight-on-bit of less than or equal to about 29,985 lb, an average torque of less than or equal to about 3,182 ft-lb, and an average rate-of-penetration of greater than or equal to about 36.9 ft/hr; and a set of operating parameters comprising an average weight-on-bit of less than or equal to about 25,218 lb, an average torque of less than or equal to about 2,408 ft-lb, and an average rate-of-penetration of greater than or equal to about 14.6 ft/hr.

A method of excavating a subterranean formation comprising an average unconfined compressive strength of at least about 16,000 psi has been described that includes penetrating the subterranean formation with a drill bit, comprising rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 16,494 lb, an average torque of less than or equal to about 1,253 ft-lb, and an average rate-of-penetration of greater than or equal to about 28.7 ft/hr; a set of operating parameters comprising an average weight-on-bit of less than or equal to about 31,277 lb, an average torque of less than or equal to about 2,406 ft-lb, and an average rate-of-penetration of greater than or equal to about 35.9 ft/hr; a set of operating parameters comprising an average weight-on-bit of less than or equal to about 42,678 lb, an average torque of less than or equal to about 3,326 ft-lb, and an average rate-of-penetration of greater than or equal to about 42.6 ft/hr; a set of operating parameters comprising an average weight-on-bit of less than or equal to about 49,035 lb, an average torque of less than or equal to about 3,669 ft-lb, and an average rate-of-penetration of greater than or equal to about 39.6 ft/hr; a set of operating parameters comprising an average weight-on-bit of less than or equal to about 61,298 lb, an average torque of less than or equal to about 4,785 ft-lb, and an average rate-of-penetration of greater than or equal to about 46.0 ft/hr; a set of operating parameters comprising an average weight-on-bit of less than or equal to about 64,073 lb, an average torque of less than or equal to about 5,111 ft-lb, and an average rate-of-penetration of greater than or equal to about 48.5 ft/hr; a set of operating parameters comprising an average weight-on-bit of less than or equal to about 2,219 lb, an average torque of less than or equal to about 452 ft-lb, and an average rate-of-penetration of greater than or equal to about 35.5 ft/hr; a set of operating parameters comprising an average weight-on-bit of less than or equal to about 29,390 lb, an average torque of less than or equal to about 2,216 ft-lb, and an average rate-of-penetration of greater than or equal to about 32.3 ft/hr; and a set of operating parameters comprising an average weight-on-bit of less than or equal to about 12,546 lb, an average torque of less than or equal to about 938 ft-lb, and an average rate-of-penetration of greater than or equal to about 31.5 ft/hr.

A method of excavating a subterranean formation comprising an average unconfined compressive strength of at least about 27,000 psi has been described that includes penetrating the subterranean formation with a drill bit, comprising rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 22,964 lb, an average torque of less than or equal to about 1,585 ft-lb, and an average rate-of-penetration of greater than or equal to about 31.0 ft/hr; a set of operating parameters comprising an average weight-on-bit of less than or equal to about 26,208 lb, an average torque of less than or equal to about 1,835 ft-lb, and an average rate-of-penetration of greater than or equal to about 34.1 ft/hr; a set of operating parameters comprising an average weight-on-bit of less than or equal to about 46,523 lb, an average torque of less than or equal to about 2,788 ft-lb, and an average rate-of-penetration of greater than or equal to about 42.4 ft/hr; a set of operating parameters comprising an average weight-on-bit of less than or equal to about 47,100 lb, an average torque of less than or equal to about 3,156 ft-lb, and an average rate-of-penetration of greater than or equal to about 46.7 ft/hr; and a set of operating parameters comprising an average weight-on-bit of less than or equal to about 48,330 lb, an average torque of less than or equal to about 3,490 ft-lb, and an average rate-of-penetration of greater than or equal to about 52.7 ft/hr.

A method of excavating a subterranean formation comprising an average unconfined compressive strength of at least about 28,000 psi has been described that includes penetrating the subterranean formation with a drill bit, comprising rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 9,762 lb, an average torque of less than or equal to about 1,505 ft-lb, and an average rate-of-penetration of greater than or equal to about 38.7 ft/hr; a set of operating parameters comprising an average weight-on-bit of less than or equal to about 15,266 lb, an average torque of less than or equal to about 2,014 ft-lb, and an average rate-of-penetration of greater than or equal to about 44.0 ft/hr; a set of operating parameters comprising an average weight-on-bit of less than or equal to about 8,747 lb, an average torque of less than or equal to about 939 ft-lb, and an average rate-of-penetration of greater than or equal to about 34.7 ft/hr; a set of operating parameters comprising an average weight-on-bit of less than or equal to about 9,532 lb, an average torque of less than or equal to about 754 ft-lb, and an average rate-of-penetration of greater than or equal to about 28.3 ft/hr; a set of operating parameters comprising an average weight-on-bit of less than or equal to about 15,244 lb, an average torque of less than or equal to about 1,529 ft-lb, and an average rate-of-penetration of greater than or equal to about 31.2 ft/hr; a set of operating parameters comprising an average weight-on-bit of less than or equal to about 9,984 lb, an average torque of less than or equal to about 989 ft-lb, and an average rate-of-penetration of greater than or equal to about 29.8 ft/hr; a set of operating parameters comprising an average weight-on-bit of less than or equal to about 15,081 lb, an average torque of less than or equal to about 1271 ft-lb, and an average rate-of-penetration of greater than or equal to about 33.3 ft/hr; a set of operating parameters comprising an average weight-on-bit of less than or equal to about 10,358 lb, an average torque of less than or equal to about 929 ft-lb, and an average rate-of-penetration of greater than or equal to about 25.7 ft/hr; a set of operating parameters comprising an average weight-on-bit of less than or equal to about 9,895 lb, an average torque of less than or equal to about 864 ft-lb, and an average rate-of-penetration of greater than or equal to about 26.2 ft/hr; a set of operating parameters comprising an average weight-on-bit of less than or equal to about 10,032 lb, an average torque of less than or equal to about 967 ft-lb, and an average rate-of-penetration of greater than or equal to about 26.6 ft/hr; a set of operating parameters comprising an average weight-on-bit of less than or equal to about 15,313 lb, an average torque of less than or equal to about 1,259 ft-lb, and an average rate-of-penetration of greater than or equal to about 32.8 ft/hr; a set of operating parameters comprising an average weight-on-bit of less than or equal to about 15,343 lb, an average torque of less than or equal to about 1,322 ft-lb, and an average rate-of-penetration of greater than or equal to about 31.4 ft/hr; a set of operating parameters comprising an average weight-on-bit of less than or equal to about 15,078 lb, an average torque of less than or equal to about 1,406 ft-lb, and an average rate-of-penetration of greater than or equal to about 26.7 ft/hr; a set of operating parameters comprising an average weight-on-bit of less than or equal to about 10,217 lb, an average torque of less than or equal to about 894 ft-lb, and an average rate-of-penetration of greater than or equal to about 29.1 ft/hr; a set of operating parameters comprising an average weight-on-bit of less than or equal to about 9,950 lb, an average torque of less than or equal to about 896 ft-lb, and an average rate-of-penetration of greater than or equal to about 30.3 ft/hr; a set of operating parameters comprising an average weight-on-bit of less than or equal to about 13,641 lb, an average torque of less than or equal to about 1022 ft-lb, and an average rate-of-penetration of greater than or equal to about 27.8 ft/hr; a set of operating parameters comprising an average weight-on-bit of less than or equal to about 10,227 lb, an average torque of less than or equal to about 851 ft-lb, and an average rate-of-penetration of greater than or equal to about 28.9 ft/hr; a set of operating parameters comprising an average weight-on-bit of less than or equal to about 10,024 lb, an average torque of less than or equal to about 820 ft-lb, and an average rate-of-penetration of greater than or equal to about 30.6 ft/hr; a set of operating parameters comprising an average weight-on-bit of less than or equal to about 9,959 lb, an average torque of less than or equal to about 829 ft-lb, and an average rate-of-penetration of greater than or equal to about 30.2 ft/hr; a set of operating parameters comprising an average weight-on-bit of less than or equal to about 13,845 lb, an average torque of less than or equal to about 1121 ft-lb, and an average rate-of-penetration of greater than or equal to about 42.2 ft/hr; a set of operating parameters comprising an average weight-on-bit of less than or equal to about 15,156 lb, an average torque of less than or equal to about 1,199 ft-lb, and an average rate-of-penetration of greater than or equal to about 38.7 ft/hr; a set of operating parameters comprising an average weight-on-bit of less than or equal to about 14,955 lb, an average torque of less than or equal to about 1,197 ft-lb, and an average rate-of-penetration of greater than or equal to about 35.1 ft/hr; a set of operating parameters comprising an average weight-on-bit of less than or equal to about 15,371 lb, an average torque of less than or equal to about 1,217 ft-lb, and an average rate-of-penetration of greater than or equal to about 32.7 ft/hr; a set of operating parameters comprising an average weight-on-bit of less than or equal to about 10,492 lb, an average torque of less than or equal to about 868 ft-lb, and an average rate-of-penetration of greater than or equal to about 31.5 ft/hr; a set of operating parameters comprising an average weight-on-bit of less than or equal to about 10,614 lb, an average torque of less than or equal to about 865 ft-lb, and an average rate-of-penetration of greater than or equal to about 30.4 ft/hr; a set of operating parameters comprising an average weight-on-bit of less than or equal to about 10,471 lb, an average torque of less than or equal to about 870 ft-lb, and an average rate-of-penetration of greater than or equal to about 30.2 ft/hr; a set of operating parameters comprising an average weight-on-bit of less than or equal to about 10,342 lb, an average torque of less than or equal to about 810 ft-lb, and an average rate-of-penetration of greater than or equal to about 31.8 ft/hr; a set of operating parameters comprising an average weight-on-bit of less than or equal to about 10,264 lb, an average torque of less than or equal to about 788 ft-lb, and an average rate-of-penetration of greater than or equal to about 30.8 ft/hr; a set of operating parameters comprising an average weight-on-bit of less than or equal to about 10,353 lb, an average torque of less than or equal to about 827 ft-lb, and an average rate-of-penetration of greater than or equal to about 31.6 ft/hr; a set of operating parameters comprising an average weight-on-bit of less than or equal to about 5,232 lb, an average torque of less than or equal to about 776 ft-lb, and an average rate-of-penetration of greater than or equal to about 28.7 ft/hr; a set of operating parameters comprising an average weight-on-bit of less than or equal to about 10,094 lb, an average torque of less than or equal to about 1,408 ft-lb, and an average rate-of-penetration of greater than or equal to about 34.7 ft/hr; a set of operating parameters comprising an average weight-on-bit of less than or equal to about 12,425 lb, an average torque of less than or equal to about 1,700 ft-lb, and an average rate-of-penetration of greater than or equal to about 37.3 ft/hr; a set of operating parameters comprising an average weight-on-bit of less than or equal to about 14,924 lb, an average torque of less than or equal to about 2,146 ft-lb, and an average rate-of-penetration of greater than or equal to about 44.0 ft/hr; a set of operating parameters comprising an average weight-on-bit of less than or equal to about 5,101 lb, an average torque of less than or equal to about 779 ft-lb, and an average rate-of-penetration of greater than or equal to about 30.3 ft/hr; a set of operating parameters comprising an average weight-on-bit of less than or equal to about 9,940 lb, an average torque of less than or equal to about 1,319 ft-lb, and an average rate-of-penetration of greater than or equal to about 35.8 ft/hr; a set of operating parameters comprising an average weight-on-bit of less than or equal to about 12,553 lb, an average torque of less than or equal to about 1,589 ft-lb, and an average rate-of-penetration of greater than or equal to about 36.0 ft/hr; and a set of operating parameters comprising an average weight-on-bit of less than or equal to about 14,969 lb, an average torque of less than or equal to about 1,903 ft-lb, and an average rate-of-penetration of greater than or equal to about 40.6 ft/hr.

A method of excavating a subterranean formation comprising an average unconfined compressive strength of at least about 28,000 psi has been described that includes penetrating the subterranean formation with a drill bit, comprising rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 5623 lb, an average torque of less than or equal to about 760 ft-lb, and an average rate-of-penetration of greater than or equal to about 34.8 ft/hr; a set of operating parameters comprising an average weight-on-bit of less than or equal to about 8036 lb, an average torque of less than or equal to about 1006 ft-lb, and an average rate-of-penetration of greater than or equal to about 33.1 ft/hr; a set of operating parameters comprising an average weight-on-bit of less than or equal to about 10682 lb, an average torque of less than or equal to about 1281 ft-lb, and an average rate-of-penetration of greater than or equal to about 36.6 ft/hr; a set of operating parameters comprising an average weight-on-bit of less than or equal to about 6986 lb, an average torque of less than or equal to about 562 ft-lb, and an average rate-of-penetration of greater than or equal to about 33.3 ft/hr; a set of operating parameters comprising an average weight-on-bit of less than or equal to about 5462 lb, an average torque of less than or equal to about 693 ft-lb, and an average rate-of-penetration of greater than or equal to about 32.2 ft/hr; a set of operating parameters comprising an average weight-on-bit of less than or equal to about 5905 lb, an average torque of less than or equal to about 533 ft-lb, and an average rate-of-penetration of greater than or equal to about 19.7 ft/hr; a set of operating parameters comprising an average weight-on-bit of less than or equal to about 5597 lb, an average torque of less than or equal to about 418 ft-lb, and an average rate-of-penetration of greater than or equal to about 20.8 ft/hr; a set of operating parameters comprising an average weight-on-bit of less than or equal to about 7420 lb, an average torque of less than or equal to about 750 ft-lb, and an average rate-of-penetration of greater than or equal to about 32.6 ft/hr; a set of operating parameters comprising an average weight-on-bit of less than or equal to about 10138 lb, an average torque of less than or equal to about 943 ft-lb, and an average rate-of-penetration of greater than or equal to about 29.6 ft/hr; a set of operating parameters comprising an average weight-on-bit of less than or equal to about 3197 lb, an average torque of less than or equal to about 440 ft-lb, and an average rate-of-penetration of greater than or equal to about 46.4 ft/hr; a set of operating parameters comprising an average weight-on-bit of less than or equal to about 7348 lb, an average torque of less than or equal to about 562 ft-lb, and an average rate-of-penetration of greater than or equal to about 33.3 ft/hr; a set of operating parameters comprising an average weight-on-bit of less than or equal to about 8423 lb, an average torque of less than or equal to about 659 ft-lb, and an average rate-of-penetration of greater than or equal to about 37.9 ft/hr; a set of operating parameters comprising an average weight-on-bit of less than or equal to about 9621 lb, an average torque of less than or equal to about 667 ft-lb, and an average rate-of-penetration of greater than or equal to about 24.3 ft/hr; a set of operating parameters comprising an average weight-on-bit of less than or equal to about 9616 lb, an average torque of less than or equal to about 831 ft-lb, and an average rate-of-penetration of greater than or equal to about 28.8 ft/hr; a set of operating parameters comprising an average weight-on-bit of less than or equal to about 3685 lb, an average torque of less than or equal to about 441 ft-lb, and an average rate-of-penetration of greater than or equal to about 26.4 ft/hr; a set of operating parameters comprising an average weight-on-bit of less than or equal to about 10817 lb, an average torque of less than or equal to about 1360 ft-lb, and an average rate-of-penetration of greater than or equal to about 41.7 ft/hr; a set of operating parameters comprising an average weight-on-bit of less than or equal to about 11050 lb, an average torque of less than or equal to about 1229 ft-lb, and an average rate-of-penetration of greater than or equal to about 33.8 ft/hr; a set of operating parameters comprising an average weight-on-bit of less than or equal to about 10972 lb, an average torque of less than or equal to about 1217 ft-lb, and an average rate-of-penetration of greater than or equal to about 34.1 ft/hr; a set of operating parameters comprising an average weight-on-bit of less than or equal to about 11101 lb, an average torque of less than or equal to about 1190 ft-lb, and an average rate-of-penetration of greater than or equal to about 34.0 ft/hr; a set of operating parameters comprising an average weight-on-bit of less than or equal to about 11269 lb, an average torque of less than or equal to about 731 ft-lb, and an average rate-of-penetration of greater than or equal to about 36.8 ft/hr; a set of operating parameters comprising an average weight-on-bit of less than or equal to about 11847 lb, an average torque of less than or equal to about 595 ft-lb, and an average rate-of-penetration of greater than or equal to about 33.7 ft/hr; a set of operating parameters comprising an average weight-on-bit of less than or equal to about 11514 lb, an average torque of less than or equal to about 705 ft-lb, and an average rate-of-penetration of greater than or equal to about 34.0 ft/hr; a set of operating parameters comprising an average weight-on-bit of less than or equal to about 11489 lb, an average torque of less than or equal to about 507 ft-lb, and an average rate-of-penetration of greater than or equal to about 28.4 ft/hr; a set of operating parameters comprising an average weight-on-bit of less than or equal to about 11395 lb, an average torque of less than or equal to about 569 ft-lb, and an average rate-of-penetration of greater than or equal to about 30.7 ft/hr; a set of operating parameters comprising an average weight-on-bit of less than or equal to about 9074 lb, an average torque of less than or equal to about 938 ft-lb, and an average rate-of-penetration of greater than or equal to about 40.1 ft/hr; a set of operating parameters comprising an average weight-on-bit of less than or equal to about 9125 lb, an average torque of less than or equal to about 916 ft-lb, and an average rate-of-penetration of greater than or equal to about 34.0 ft/hr; a set of operating parameters comprising an average weight-on-bit of less than or equal to about 14398 lb, an average torque of less than or equal to about 1378 ft-lb, and an average rate-of-penetration of greater than or equal to about 41.1 ft/hr; and a set of operating parameters comprising an average weight-on-bit of less than or equal to about 14006 lb, an average torque of less than or equal to about 1381 ft-lb, and an average rate-of-penetration of greater than or equal to about 40.0 ft/hr.

A system for excavating a subterranean formation comprising an average unconfined compressive strength of at least about 28,000 psi has been described that includes means for penetrating the subterranean formation with a drill bit, comprising means for rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 11,675 lb, an average torque of less than or equal to about 728 ft-lb, and an average rate-of-penetration of greater than or equal to about 29.9 ft/hr; a set of operating parameters comprising an average weight-on-bit of less than or equal to about 17,809 lb, an average torque of less than or equal to about 1,235 ft-lb, and an average rate-of-penetration of greater than or equal to about 34.2 ft/hr; a set of operating parameters comprising an average weight-on-bit of less than or equal to about 25,537 lb, an average torque of less than or equal to about 1,691 ft-lb, and an average rate-of-penetration of greater than or equal to about 40.9 ft/hr; a set of operating parameters comprising an average weight-on-bit of less than or equal to about 29,300 lb, an average torque of less than or equal to about 1,852 ft-lb, and an average rate-of-penetration of greater than or equal to about 45.2 ft/hr; a set of operating parameters comprising an average weight-on-bit of less than or equal to about 11,961 lb, an average torque of less than or equal to about 737 ft-lb, and an average rate-of-penetration of greater than or equal to about 31.9 ft/hr; a set of operating parameters comprising an average weight-on-bit of less than or equal to about 29,741 lb, an average torque of less than or equal to about 1,973 ft-lb, and an average rate-of-penetration of greater than or equal to about 43.2 ft/hr; a set of operating parameters comprising an average weight-on-bit of less than or equal to about 34,806 lb, an average torque of less than or equal to about 2,272 ft-lb, and an average rate-of-penetration of greater than or equal to about 45.7 ft/hr; a set of operating parameters comprising an average weight-on-bit of less than or equal to about 38,487 lb, an average torque of less than or equal to about 2,540 ft-lb, and an average rate-of-penetration of greater than or equal to about 51.7 ft/hr; a set of operating parameters comprising an average weight-on-bit of less than or equal to about 41,714 lb, an average torque of less than or equal to about 2,836 ft-lb, and an average rate-of-penetration of greater than or equal to about 53.4 ft/hr; a set of operating parameters comprising an average weight-on-bit of less than or equal to about 47,132 lb, an average torque of less than or equal to about 3,315 ft-lb, and an average rate-of-penetration of greater than or equal to about 57.9 ft/hr; a set of operating parameters comprising an average weight-on-bit of less than or equal to about 55,980 lb, an average torque of less than or equal to about 3,596 ft-lb, and an average rate-of-penetration of greater than or equal to about 52.0 ft/hr; and a set of operating parameters comprising an average weight-on-bit of less than or equal to about 68,880 lb, an average torque of less than or equal to about 4,135 ft-lb, and an average rate-of-penetration of greater than or equal to about 29.1 ft/hr.

A system for excavating a subterranean formation comprising an average unconfined compressive strength of at least about 9,800 psi has been described that includes means for penetrating the subterranean formation with a drill bit, comprising means for rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 25,720 lb, an average torque of less than or equal to about 3,374 ft-lb, and an average rate-of-penetration of greater than or equal to about 64.5 ft/hr; a set of operating parameters comprising an average weight-on-bit of less than or equal to about 39,141 lb, an average torque of less than or equal to about 4,290 ft-lb, and an average rate-of-penetration of greater than or equal to about 49.6 ft/hr; a set of operating parameters comprising an average weight-on-bit of less than or equal to about 10,710 lb, an average torque of less than or equal to about 1,694 ft-lb, and an average rate-of-penetration of greater than or equal to about 29.6 ft/hr; a set of operating parameters comprising an average weight-on-bit of less than or equal to about 19,993 lb, an average torque of less than or equal to about 2,841 ft-lb, and an average rate-of-penetration of greater than or equal to about 40.2 ft/hr; a set of operating parameters comprising an average weight-on-bit of less than or equal to about 25,889 lb, an average torque of less than or equal to about 2,851 ft-lb, and an average rate-of-penetration of greater than or equal to about 32.5 ft/hr; a set of operating parameters comprising an average weight-on-bit of less than or equal to about 29,985 lb, an average torque of less than or equal to about 3,182 ft-lb, and an average rate-of-penetration of greater than or equal to about 36.9 ft/hr; and a set of operating parameters comprising an average weight-on-bit of less than or equal to about 25,218 lb, an average torque of less than or equal to about 2,408 ft-lb, and an average rate-of-penetration of greater than or equal to about 14.6 ft/hr.

A system for excavating a subterranean formation comprising an average unconfined compressive strength of at least about 16,000 psi has been described that includes means for penetrating the subterranean formation with a drill bit, comprising means for rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 16,494 lb, an average torque of less than or equal to about 1,253 ft-lb, and an average rate-of-penetration of greater than or equal to about 28.7 ft/hr; a set of operating parameters comprising an average weight-on-bit of less than or equal to about 31,277 lb, an average torque of less than or equal to about 2,406 ft-lb, and an average rate-of-penetration of greater than or equal to about 35.9 ft/hr; a set of operating parameters comprising an average weight-on-bit of less than or equal to about 42,678 lb, an average torque of less than or equal to about 3,326 ft-lb, and an average rate-of-penetration of greater than or equal to about 42.6 ft/hr; a set of operating parameters comprising an average weight-on-bit of less than or equal to about 49,035 lb, an average torque of less than or equal to about 3,669 ft-lb, and an average rate-of-penetration of greater than or equal to about 39.6 ft/hr; a set of operating parameters comprising an average weight-on-bit of less than or equal to about 61,298 lb, an average torque of less than or equal to about 4,785 ft-lb, and an average rate-of-penetration of greater than or equal to about 46.0 ft/hr; a set of operating parameters comprising an average weight-on-bit of less than or equal to about 64,073 lb, an average torque of less than or equal to about 5,111 ft-lb, and an average rate-of-penetration of greater than or equal to about 48.5 ft/hr; a set of operating parameters comprising an average weight-on-bit of less than or equal to about 2,219 lb, an average torque of less than or equal to about 452 ft-lb, and an average rate-of-penetration of greater than or equal to about 35.5 ft/hr; a set of operating parameters comprising an average weight-on-bit of less than or equal to about 29,390 lb, an average torque of less than or equal to about 2,216 ft-lb, and an average rate-of-penetration of greater than or equal to about 32.3 ft/hr; and a set of operating parameters comprising an average weight-on-bit of less than or equal to about 12,546 lb, an average torque of less than or equal to about 938 ft-lb, and an average rate-of-penetration of greater than or equal to about 31.5 ft/hr.

A system for excavating a subterranean formation comprising an average unconfined compressive strength of at least about 27,000 psi has been described that includes means for penetrating the subterranean formation with a drill bit, comprising means for rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 22,964 lb, an average torque of less than or equal to about 1,585 ft-lb, and an average rate-of-penetration of greater than or equal to about 31.0 ft/hr; a set of operating parameters comprising an average weight-on-bit of less than or equal to about 26,208 lb, an average torque of less than or equal to about 1,835 ft-lb, and an average rate-of-penetration of greater than or equal to about 34.1 ft/hr; a set of operating parameters comprising an average weight-on-bit of less than or equal to about 46,523 lb, an average torque of less than or equal to about 2,788 ft-lb, and an average rate-of-penetration of greater than or equal to about 42.4 ft/hr; a set of operating parameters comprising an average weight-on-bit of less than or equal to about 47,100 lb, an average torque of less than or equal to about 3,156 ft-lb, and an average rate-of-penetration of greater than or equal to about 46.7 ft/hr; and a set of operating parameters comprising an average weight-on-bit of less than or equal to about 48,330 lb, an average torque of less than or equal to about 3,490 ft-lb, and an average rate-of-penetration of greater than or equal to about 52.7 ft/hr.

A system for excavating a subterranean formation comprising an average unconfined compressive strength of at least about 28,000 psi has been described that includes means for penetrating the subterranean formation with a drill bit, comprising means for rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 9,762 lb, an average torque of less than or equal to about 1,505 ft-lb, and an average rate-of-penetration of greater than or equal to about 38.7 ft/hr; a set of operating parameters comprising an average weight-on-bit of less than or equal to about 15,266 lb, an average torque of less than or equal to about 2,014 ft-lb, and an average rate-of-penetration of greater than or equal to about 44.0 ft/hr; a set of operating parameters comprising an average weight-on-bit of less than or equal to about 8,747 lb, an average torque of less than or equal to about 939 ft-lb, and an average rate-of-penetration of greater than or equal to about 34.7 ft/hr; a set of operating parameters comprising an average weight-on-bit of less than or equal to about 9,532 lb, an average torque of less than or equal to about 754 ft-lb, and an average rate-of-penetration of greater than or equal to about 28.3 ft/hr; a set of operating parameters comprising an average weight-on-bit of less than or equal to about 15,244 lb, an average torque of less than or equal to about 1,529 ft-lb, and an average rate-of-penetration of greater than or equal to about 31.2 ft/hr; a set of operating parameters comprising an average weight-on-bit of less than or equal to about 9,984 lb, an average torque of less than or equal to about 989 ft-lb, and an average rate-of-penetration of greater than or equal to about 29.8 ft/hr; a set of operating parameters comprising an average weight-on-bit of less than or equal to about 15,081 lb, an average torque of less than or equal to about 1271 ft-lb, and an average rate-of-penetration of greater than or equal to about 33.3 ft/hr; a set of operating parameters comprising an average weight-on-bit of less than or equal to about 10,358 lb, an average torque of less than or equal to about 929 ft-lb, and an average rate-of-penetration of greater than or equal to about 25.7 ft/hr; a set of operating parameters comprising an average weight-on-bit of less than or equal to about 9,895 lb, an average torque of less than or equal to about 864 ft-lb, and an average rate-of-penetration of greater than or equal to about 26.2 ft/hr; a set of operating parameters comprising an average weight-on-bit of less than or equal to about 10,032 lb, an average torque of less than or equal to about 967 ft-lb, and an average rate-of-penetration of greater than or equal to about 26.6 ft/hr; a set of operating parameters comprising an average weight-on-bit of less than or equal to about 15,313 lb, an average torque of less than or equal to about 1,259 ft-lb, and an average rate-of-penetration of greater than or equal to about 32.8 ft/hr; a set of operating parameters comprising an average weight-on-bit of less than or equal to about 15,343 lb, an average torque of less than or equal to about 1,322 ft-lb, and an average rate-of-penetration of greater than or equal to about 31.4 ft/hr; a set of operating parameters comprising an average weight-on-bit of less than or equal to about 15,078 lb, an average torque of less than or equal to about 1,406 ft-lb, and an average rate-of-penetration of greater than or equal to about 26.7 ft/hr; a set of operating parameters comprising an average weight-on-bit of less than or equal to about 10,217 lb, an average torque of less than or equal to about 894 ft-lb, and an average rate-of-penetration of greater than or equal to about 29.1 ft/hr; a set of operating parameters comprising an average weight-on-bit of less than or equal to about 9,959 lb, an average torque of less than or equal to about 896 ft-lb, and an average rate-of-penetration of greater than or equal to about 30.3 ft/hr; a set of operating parameters comprising an average weight-on-bit of less than or equal to about 13,641 lb, an average torque of less than or equal to about 1022 ft-lb, and an average rate-of-penetration of greater than or equal to about 27.8 ft/hr; a set of operating parameters comprising an average weight-on-bit of less than or equal to about 10,227 lb, an average torque of less than or equal to about 851 ft-lb, and an average rate-of-penetration of greater than or equal to about 28.9 ft/hr; a set of operating parameters comprising an average weight-on-bit of less than or equal to about 10,024 lb, an average torque of less than or equal to about 820 ft-lb, and an average rate-of-penetration of greater than or equal to about 30.6 ft/hr; a set of operating parameters comprising an average weight-on-bit of less than or equal to about 9,950 lb, an average torque of less than or equal to about 829 ft-lb, and an average rate-of-penetration of greater than or equal to about 30.2 ft/hr; a set of operating parameters comprising an average weight-on-bit of less than or equal to about 13,845 lb, an average torque of less than or equal to about 1121 ft-lb, and an average rate-of-penetration of greater than or equal to about 42.2 ft/hr; a set of operating parameters comprising an average weight-on-bit of less than or equal to about 15,156 lb, an average torque of less than or equal to about 1,199 ft-lb, and an average rate-of-penetration of greater than or equal to about 38.7 ft/hr; a set of operating parameters comprising an average weight-on-bit of less than or equal to about 14,955 lb, an average torque of less than or equal to about 1,197 ft-lb, and an average rate-of-penetration of greater than or equal to about 35.1 ft/hr; a set of operating parameters comprising an average weight-on-bit of less than or equal to about 15,371 lb, an average torque of less than or equal to about 1,217 ft-lb, and an average rate-of-penetration of greater than or equal to about 32.7 ft/hr; a set of operating parameters comprising an average weight-on-bit of less than or equal to about 10,492 lb, an average torque of less than or equal to about 868 ft-lb, and an average rate-of-penetration of greater than or equal to about 31.5 ft/hr; a set of operating parameters comprising an average weight-on-bit of less than or equal to about 10,614 lb, an average torque of less than or equal to about 865 ft-lb, and an average rate-of-penetration of greater than or equal to about 30.4 ft/hr; a set of operating parameters comprising an average weight-on-bit of less than or equal to about 10,471 lb, an average torque of less than or equal to about 870 ft-lb, and an average rate-of-penetration of greater than or equal to about 30.2 ft/hr; a set of operating parameters comprising an average weight-on-bit of less than or equal to about 10,342 lb, an average torque of less than or equal to about 810 ft-lb, and an average rate-of-penetration of greater than or equal to about 31.8 ft/hr; a set of operating parameters comprising an average weight-on-bit of less than or equal to about 10,264 lb, an average torque of less than or equal to about 788 ft-lb, and an average rate-of-penetration of greater than or equal to about 30.8 ft/hr; a set of operating parameters comprising an average weight-on-bit of less than or equal to about 10,353 lb, an average torque of less than or equal to about 827 ft-lb, and an average rate-of-penetration of greater than or equal to about 31.6 ft/hr; a set of operating parameters comprising an average weight-on-bit of less than or equal to about 5,232 lb, an average torque of less than or equal to about 776 ft-lb, and an average rate-of-penetration of greater than or equal to about 28.7 ft/hr; a set of operating parameters comprising an average weight-on-bit of less than or equal to about 10,094 lb, an average torque of less than or equal to about 1,408 ft-lb, and an average rate-of-penetration of greater than or equal to about 34.7 ft/hr; a set of operating parameters comprising an average weight-on-bit of less than or equal to about 12,425 lb, an average torque of less than or equal to about 1,700 ft-lb, and an average rate-of-penetration of greater than or equal to about 37.3 ft/hr; a set of operating parameters comprising an average weight-on-bit of less than or equal to about 14,924 lb, an average torque of less than or equal to about 2,146 ft-lb, and an average rate-of-penetration of greater than or equal to about 44.0 ft/hr; a set of operating parameters comprising an average weight-on-bit of less than or equal to about 5,101 lb, an average torque of less than or equal to about 779 ft-lb, and an average rate-of-penetration of greater than or equal to about 30.3 ft/hr; a set of operating parameters comprising an average weight-on-bit of less than or equal to about 9,940 lb, an average torque of less than or equal to about 1,319 ft-lb, and an average rate-of-penetration of greater than or equal to about 35.8 ft/hr; a set of operating parameters comprising an average weight-on-bit of less than or equal to about 12,553 lb, an average torque of less than or equal to about 1,589 ft-lb, and an average rate-of-penetration of greater than or equal to about 36.0 ft/hr; and a set of operating parameters comprising an average weight-on-bit of less than or equal to about 14,969 lb, an average torque of less than or equal to about 1,903 ft-lb, and an average rate-of-penetration of greater than or equal to about 40.6 ft/hr.

A system for excavating a subterranean formation comprising an average unconfined compressive strength of at least about 28,000 psi has been described that includes means for penetrating the subterranean formation with a drill bit, comprising means for rotating the drill bit, the drill bit comprising operating parameters during at least a portion of rotating the drill bit, the operating parameters of the drill bit comprising at least one of the following sets of operating parameters: a set of operating parameters comprising an average weight-on-bit of less than or equal to about 5623 lb, an average torque of less than or equal to about 760 ft-lb, and an average rate-of-penetration of greater than or equal to about 34.8 ft/hr; a set of operating parameters comprising an average weight-on-bit of less than or equal to about 8036 lb, an average torque of less than or equal to about 1006 ft-lb, and an average rate-of-penetration of greater than or equal to about 33.1 ft/hr; a set of operating parameters comprising an average weight-on-bit of less than or equal to about 10682 lb, an average torque of less than or equal to about 1281 ft-lb, and an average rate-of-penetration of greater than or equal to about 36.6 ft/hr; a set of operating parameters comprising an average weight-on-bit of less than or equal to about 6986 lb, an average torque of less than or equal to about 951 ft-lb, and an average rate-of-penetration of greater than or equal to about 38.3 ft/hr; a set of operating parameters comprising an average weight-on-bit of less than or equal to about 5462 lb, an average torque of less than or equal to about 693 ft-lb, and an average rate-of-penetration of greater than or equal to about 32.2 ft/hr; a set of operating parameters comprising an average weight-on-bit of less than or equal to about 5905 lb, an average torque of less than or equal to about 533 ft-lb, and an average rate-of-penetration of greater than or equal to about 19.7 ft/hr; a set of operating parameters comprising an average weight-on-bit of less than or equal to about 5597 lb, an average torque of less than or equal to about 418 ft-lb, and an average rate-of-penetration of greater than or equal to about 20.8 ft/hr; a set of operating parameters comprising an average weight-on-bit of less than or equal to about 7420 lb, an average torque of less than or equal to about 750 ft-lb, and an average rate-of-penetration of greater than or equal to about 32.6 ft/hr; a set of operating parameters comprising an average weight-on-bit of less than or equal to about 10138 lb, an average torque of less than or equal to about 943 ft-lb, and an average rate-of-penetration of greater than or equal to about 29.6 ft/hr; a set of operating parameters comprising an average weight-on-bit of less than or equal to about 3197 lb, an average torque of less than or equal to about 440 ft-lb, and an average rate-of-penetration of greater than or equal to about 46.4 ft/hr; a set of operating parameters comprising an average weight-on-bit of less than or equal to about 7348 lb, an average torque of less than or equal to about 951 ft-lb, and an average rate-of-penetration of greater than or equal to about 38.3 ft/hr; a set of operating parameters comprising an average weight-on-bit of less than or equal to about 8423 lb, an average torque of less than or equal to about 659 ft-lb, and an average rate-of-penetration of greater than or equal to about 37.9 ft/hr; a set of operating parameters comprising an average weight-on-bit of less than or equal to about 9621 lb, an average torque of less than or equal to about 667 ft-lb, and an average rate-of-penetration of greater than or equal to about 24.3 ft/hr; a set of operating parameters comprising an average weight-on-bit of less than or equal to about 9616 lb, an average torque of less than or equal to about 831 ft-lb, and an average rate-of-penetration of greater than or equal to about 28.8 ft/hr; a set of operating parameters comprising an average weight-on-bit of less than or equal to about 3685 lb, an average torque of less than or equal to about 441 ft-lb, and an average rate-of-penetration of greater than or equal to about 26.4 ft/hr; a set of operating parameters comprising an average weight-on-bit of less than or equal to about 10817 lb, an average torque of less than or equal to about 1360 ft-lb, and an average rate-of-penetration of greater than or equal to about 41.7 ft/hr; a set of operating parameters comprising an average weight-on-bit of less than or equal to about 11050 lb, an average torque of less than or equal to about 1229 ft-lb, and an average rate-of-penetration of greater than or equal to about 33.8 ft/hr; a set of operating parameters comprising an average weight-on-bit of less than or equal to about 10972 lb, an average torque of less than or equal to about 1217 ft-lb, and an average rate-of-penetration of greater than or equal to about 34.1 ft/hr; a set of operating parameters comprising an average weight-on-bit of less than or equal to about 11101 lb, an average torque of less than or equal to about 1190 ft-lb, and an average rate-of-penetration of greater than or equal to about 34.0 ft/hr; a set of operating parameters comprising an average weight-on-bit of less than or equal to about 11269 lb, an average torque of less than or equal to about 731 ft-lb, and an average rate-of-penetration of greater than or equal to about 36.8 ft/hr; a set of operating parameters comprising an average weight-on-bit of less than or equal to about 11847 lb, an average torque of less than or equal to about 595 ft-lb, and an average rate-of-penetration of greater than or equal to about 33.7 ft/hr; a set of operating parameters comprising an average weight-on-bit of less than or equal to about 11514 lb, an average torque of less than or equal to about 705 ft-lb, and an average rate-of-penetration of greater than or equal to about 34.0 ft/hr; a set of operating parameters comprising an average weight-on-bit of less than or equal to about 11489 lb, an average torque of less than or equal to about 507 ft-lb, and an average rate-of-penetration of greater than or equal to about 28.4 ft/hr; a set of operating parameters comprising an average weight-on-bit of less than or equal to about 11395 lb, an average torque of less than or equal to about 569 ft-lb, and an average rate-of-penetration of greater than or equal to about 30.7 ft/hr; a set of operating parameters comprising an average weight-on-bit of less than or equal to about 9074 lb, an average torque of less than or equal to about 938 ft-lb, and an average rate-of-penetration of greater than or equal to about 40.1 ft/hr; a set of operating parameters comprising an average weight-on-bit of less than or equal to about 9125 lb, an average torque of less than or equal to about 916 ft-lb, and an average rate-of-penetration of greater than or equal to about 34.0 ft/hr; a set of operating parameters comprising an average weight-on-bit of less than or equal to about 14398 lb, an average torque of less than or equal to about 1378 ft-lb, and an average rate-of-penetration of greater than or equal to about 41.1 ft/hr; and a set of operating parameters comprising an average weight-on-bit of less than or equal to about 14006 lb, an average torque of less than or equal to about 1381 ft-lb, and an average rate-of-penetration of greater than or equal to about 40.0 ft/hr.

An apparatus for excavating a subterranean formation has been described that includes a source of impactors, a source of drilling fluid, and a flow line connected to the source of drilling fluid. An injection system is coupled to the source of impactors and adapted to receive the impactors, wherein the injection system is a concrete pump fluidicly coupled to the drilling fluid line for injecting the impactors into the flow line to form a suspension. A nozzle is connected to the flow line for discharging the suspension to remove at least a portion of the formation. In one embodiment, the impactors are received at the injection system at a first pressure, are injected into the flow line at a second pressure, and the flow line is maintained at a third pressure. In another embodiment, the third pressure is greater than the second pressure, and the second pressure is greater than the first. In another embodiment, the second and third pressures are approximately equal.

A method for excavating a subterranean formation is described that includes the steps of: connecting a drilling fluid source to a flow line, connecting a source of impactors to an injection system, said injection system comprising a concrete pump, introducing drilling fluid to the flow line, injecting impactors from the injection system into the flow line to produce a slurry comprising the impactors, and discharging the slurry from the flow line into the formation for removing a part of the formation. In one embodiment, the impactors are received at the injection system at a first pressure, the impactors are injected into the flow line at a second pressure, and the flow line is maintained at a third pressure. In another embodiment, the third pressure is greater than the second pressure, and the second pressure is greater than the first. In another embodiment, the second and third pressures are approximately equal.

A method for introducing a plurality of particles into a wellbore is described that includes the steps of: providing a source of particles, wherein said source is fluidicly coupled to an injection system, pressurizing a flow line comprising a drilling fluid, injecting the particles into the flow line to produce a slurry comprising drilling fluid and particles, and introducing said slurry into a wellbore. In one embodiment, the source of particles is maintained at approximately atmospheric pressure. In another embodiment, the flow line is maintained at a pressure greater than atmospheric pressure. In another embodiment, the injector injects the particles at an elevated pressure into the flow line. In another embodiment, the flow line is maintained at a pressure greater than the pressure at which the particles are injected into the flow line. In another embodiment, the injection system includes a concrete pump. In another embodiment, the injection system further includes a sequencing valve. In another embodiment, the injection system is an extruder. In another embodiment, the pressure of the flow line is maintained at greater than 3000 psi. In another embodiment, the particles are injected into the flow line at a pressure greater than 3000 psi.

A system for producing a pressurized impactor slurry is described that includes means for charging a first vessel with a plurality of impactors, means for pressurizing a second vessel with a liquid, and means for introducing a pressurized flow of impactors into the second vessel to produce a pressurized impactor slurry. In one embodiment, the first vessel is a concrete pump. In another embodiment the first vessel is an extruder.

An apparatus for injecting magnetic particles into a fluid stream at an increased pressure is described that includes a source of magnetic particles, wherein the magnetic particles are maintained at substantially near atmospheric pressure. The apparatus also includes an injector fluidicly coupled to the source of particles and the fluid stream, wherein the injector comprising a screw extruder, the extruder including a base, a housing, a barrel, and a screw positioned within said barrel, wherein the barrel further comprises at least one magnetic circuit positioned about the exterior of the barrel; and wherein the injector is positioned to discharge a plurality of impactors into the fluid stream, wherein the impactors are discharged into the fluid stream at a pressure greater than atmospheric pressure. In one embodiment, the injection device is coupled to the fluid stream by a stand pipe. In another embodiment, the apparatus further includes a second injection device, said second injection device comprising a screw extruder, said screw extruder including a second separate base, a second housing, a second barrel and a second screw positioned within the barrel, wherein the first and second extruder are connected by a stand pipe. In another embodiment, the first and second extruders are connected by a standpipe, and the standpipe connected to a discharge end of the first extruder and to the inlet end of the second extruder. In another embodiment, the apparatus further includes a vibrational source positioned on the standpipe connecting the first and second extruders. In another embodiment, the screw of the injection device has a tapered core, wherein the diameter of the core is greater at the discharge end.

A method for preparing a slurry comprising impactors and drilling fluid is described including the steps of providing a first vessel, said first vessel comprising a plurality of impactors, providing a second vessel, said second vessel comprising a source of drilling fluid, said second vessel coupled to a stand pipe, wherein said second vessel is fluidicly coupled to a pump, and supplying said plurality of impactors to an injection device.

A system for excavating a subterranean formation is described that includes a impactor source, a fluid source, a first vessel connected to the fluid source, the first vessel connected to a pump for producing a fluid stream, a second vessel connected to impactor source for discharging impactors into the fluid stream, thereby producing a suspension; and a body member for receiving the suspension and discharging same to remove at least a portion of the formation. In one embodiment, the second vessel is a concrete pump. In another embodiment, the concrete pump includes a sequencing valve. In another embodiment, the impactors are introduced to the concrete pump at atmospheric pressure. In another embodiment, the impactors are introduced to the fluid stream at an increased pressure. In another embodiment, the second vessel comprises an extruder. In another embodiment, the impactors are magnetic and extruder includes at least one magnetic circuit. In another embodiment, the system is designed for use with highly abrasive suspension.

A system for injecting particles into a flow region having a first pressure is described, the system includes an injection system selected from a concrete pump and an extruder, wherein the system is adapted to receive the particles at a second pressure that is less than the first pressure, the injection system at least partially defining a control volume within which a permeable media is adapted to be at least partially formed by at least a portion of the particles, the permeable media being adapted to create a pressure differential approximately equal to the difference between the first and second pressures during at least a portion of the injection of the particles into the flow region.

A method is described that includes the steps of providing an injection system comprising an inlet, receiving particles into the injection system via the inlet, wherein the injection system is selected from a concrete pump and an extruder, injecting the particles into a flow region using the injection system, wherein the pressure in the flow region is greater than the pressure at the inlet, and forming a permeable media within the injection system using the particles, wherein the permeable media creates a pressure differential, the pressure differential being approximately equal to the difference between the pressure in the flow region and the pressure at the inlet during at least a portion of injecting the particles into the flow region using the injection system.

An apparatus for injecting particles into a flow region is described that includes an injection system comprising an inlet via which the injection system is adapted to receive the particles and a control volume at least partially defined by the injection system and within which a permeable media is at least partially formed by at least a portion of the particles. A pressure differential is created by the permeable media during at least a portion of the injection of the particles into the flow region, the pressure differential being approximately equal to the difference between the pressure in the flow region and the pressure at the inlet. The injection system comprises an extruder includes a barrel comprising a bore fluidicly coupled to the inlet and adapted to be fluidicly coupled to the flow region, a screw feeder extending within the barrel, and at least one magnetic circuit positioned about the barrel of the injection system. The screw feeder comprises a shaft and a thread extending thereabout, the control volume being at least partially defined between the inside surface of the barrel defined by the bore and the outside surface of the shaft; and the apparatus includes a gearbox operably coupled to the shaft and a motor operably coupled to the gearbox. In one embodiment, the inlet can include a vibrator.

It is understood that variations may be made in the foregoing without departing from the scope of the disclosure.

Any spatial references such as, for example, "upper," "lower," "above," "below," "radial," "axial," "between," "vertical," "horizontal, "angular," upward," "downward," "side-to-side," "left-to-right," "right-to-left," "top-to-bottom," "bottom-to-top," etc., are for the purpose of illustration only and do not limit the specific orientation or location of the structure described above.

As used herein, the terms "about" and "approximately" are understood to refer to values which are within 5% of the number being modified by the terms.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus for injecting particles into a fluid stream at an increased pressure, comprising:

a source of impactors comprising at least some ferritic material capable of influence by magnetic fields, wherein said impactors are maintained at substantially near atmospheric pressure;

a screw extruder fluidicly coupled to the source of impactors and the fluid stream, said extruder including a barrel, and a screw positioned within said barrel, wherein said barrel further comprises at least one magnetic circuit positioned about the exterior of the barrel and substantially no pressure drop across the extruder;

wherein said extruder is positioned to discharge a plurality of impactors into the fluid stream, wherein the impactors are discharged at a pressure greater than atmospheric pressure into the fluid stream, wherein said fluid stream is also at a pressure greater than atmospheric pressure and wherein the impactor pressure and the fluid stream pressure are substantially similar.

* * * * *